US009694942B2

(12) United States Patent
Stanley et al.

(10) Patent No.: US 9,694,942 B2
(45) Date of Patent: Jul. 4, 2017

(54) FLEXIBLE CONTAINERS WITH EASILY VARIABLE SIZING

(71) Applicant: The Procter & Gamble Company, Cincinnati, OH (US)

(72) Inventors: Scott Kendyl Stanley, Mason, OH (US); Kenneth Stephen McGuire, Montgomery, OH (US); Tadayoshi Ishihara, West Chester, OH (US); Lee Mathew Arent, Fairfield, OH (US); Jun You, West Chester, OH (US); Joseph Craig Lester, Liberty Township, OH (US); Benjamin Jacob Clare, Cincinnati, OH (US); Marc Richard Bourgeois, Liberty Township, OH (US); Charles John Berg, Jr., Wyoming, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/973,822

(22) Filed: Dec. 18, 2015

(65) Prior Publication Data

US 2016/0176578 A1 Jun. 23, 2016

Related U.S. Application Data

(60) Provisional application No. 62/094,550, filed on Dec. 19, 2014, provisional application No. 62/094,567, filed on Dec. 19, 2014.

(51) Int. Cl.

| | |
|---|---|
| ***B65D 85/00*** | (2006.01) |
| ***B65D 25/56*** | (2006.01) |
| ***B65D 65/38*** | (2006.01) |
| ***B65D 35/02*** | (2006.01) |

(52) U.S. Cl.

CPC ..... *B65D 25/56* (2013.01); *B65D 35/02* (2013.01); *B65D 65/38* (2013.01)

(58) Field of Classification Search

USPC ..... 206/459.5, 459.1, 524.1

See application file for complete search history.

(56) References Cited

U.S. PATENT DOCUMENTS

| | | | |
|---|---|---|---|
| 5,990,216 | A | 11/1999 | Cai et al. |
| 6,076,968 | A | 6/2000 | Smith et al. |
| 9,327,867 | B2 | 5/2016 | Stanley et al. |

(Continued)

FOREIGN PATENT DOCUMENTS

| | | |
|---|---|---|
| DE | 102005002301 | 7/2006 |
| EP | 1714892 A1 | 10/2006 |

(Continued)

OTHER PUBLICATIONS

All Office Actions for U.S. Appl. No. 14/973,827, filed Dec. 18, 2015.

(Continued)

*Primary Examiner* — Jacob K Ackun

(74) *Attorney, Agent, or Firm* — Charles R Ware; Jeffrey V Bamber

(57) ABSTRACT

Non-durable self-supporting flexible containers with easily variable sizing. Line ups of flexible containers have similar sizes, shapes, and constructions, but hold differing amounts of fluent product at unexpected fill heights.

20 Claims, 53 Drawing Sheets

(56) References Cited

U.S. PATENT DOCUMENTS

| | | | | |
|---|---|---|---|---|
| 9,469,088 | B2 | 10/2016 | Stanley et al. | |
| 2008/0110782 | A1* | 5/2008 | Burgdorf | A61F 13/551 206/438 |
| 2009/0056281 | A1 | 3/2009 | Murray | |
| 2009/0101646 | A1* | 4/2009 | Paul | A47F 1/12 220/254.4 |
| 2010/0047403 | A1 | 2/2010 | Johnson | |
| 2010/0147726 | A1* | 6/2010 | Timmann | B65D 23/0871 206/459.5 |
| 2010/0218462 | A1 | 9/2010 | Murray | |
| 2011/0062051 | A1 | 3/2011 | Miller | |
| 2013/0055517 | A1 | 3/2013 | McKiernan et al. | |
| 2013/0059766 | A1 | 3/2013 | McKiernan et al. | |
| 2013/0059997 | A1 | 3/2013 | Smith et al. | |
| 2013/0292287 | A1 | 11/2013 | Stanley et al. | |
| 2013/0292353 | A1 | 11/2013 | Stanley et al. | |
| 2013/0292395 | A1 | 11/2013 | Stanley et al. | |
| 2013/0292413 | A1 | 11/2013 | Stanley et al. | |
| 2013/0292415 | A1 | 11/2013 | Stanley et al. | |
| 2013/0294711 | A1 | 11/2013 | Stanley et al. | |
| 2013/0337244 | A1 | 12/2013 | Stanley et al. | |
| 2014/0033654 | A1 | 2/2014 | Stanley et al. | |
| 2014/0033655 | A1 | 2/2014 | Stanley et al. | |
| 2014/0090850 | A1 | 4/2014 | Benicewicz et al. | |
| 2014/0202912 | A1* | 7/2014 | Matthews | B65D 27/14 206/459.5 |
| 2015/0012557 | A1 | 1/2015 | El-Moslimany | |
| 2015/0028057 | A1 | 1/2015 | Arent et al. | |
| 2015/0033671 | A1 | 2/2015 | Stanley et al. | |
| 2015/0034662 | A1 | 2/2015 | Stanley et al. | |
| 2015/0034670 | A1 | 2/2015 | Stanley et al. | |
| 2015/0036950 | A1 | 2/2015 | Stanley et al. | |
| 2015/0121810 | A1* | 5/2015 | Bourgeois | B65D 75/008 53/434 |
| 2015/0122373 | A1* | 5/2015 | Bourgeois | B65B 31/04 141/12 |
| 2015/0122840 | A1 | 5/2015 | Cox et al. | |
| 2015/0122841 | A1 | 5/2015 | McGuire et al. | |
| 2015/0122842 | A1 | 5/2015 | Berg et al. | |
| 2015/0122846 | A1 | 5/2015 | Stanley et al. | |
| 2015/0125099 | A1 | 5/2015 | Ishihara et al. | |
| 2015/0125574 | A1 | 5/2015 | Arent et al. | |
| 2015/0126349 | A1 | 5/2015 | Ishihara et al. | |
| 2016/0176582 | A1 | 6/2016 | McGuire et al. | |
| 2016/0176583 | A1 | 6/2016 | Ishihara et al. | |
| 2016/0176584 | A1 | 6/2016 | Ishihara et al. | |
| 2016/0176597 | A1 | 6/2016 | Ishihara et al. | |
| 2016/0221727 | A1 | 8/2016 | Stanley et al. | |
| 2016/0297569 | A1 | 10/2016 | Berg et al. | |
| 2016/0297589 | A1 | 10/2016 | You et al. | |
| 2016/0297590 | A1 | 10/2016 | You et al. | |
| 2016/0297591 | A1 | 10/2016 | You et al. | |
| 2016/0325518 | A1 | 11/2016 | Ishihara et al. | |

FOREIGN PATENT DOCUMENTS

| | | |
|---|---|---|
| EP | 1517845 | 4/2011 |
| JP | A-H107159 | 1/1998 |
| JP | 2005343492 | 12/2005 |
| JP | 2006027697 | 2/2006 |
| JP | 2006240651 | 9/2006 |
| JP | 2009184690 | 8/2009 |
| JP | 4639677 | 2/2011 |
| JP | 2012025394 | 2/2012 |
| RU | 2038815 | 7/1995 |
| WO | WO9601775 | 1/1996 |
| WO | WO2005063589 | 7/2005 |
| WO | WO2005082741 | 9/2005 |
| WO | WO2008064508 | 6/2008 |
| WO | WO2012073004 | 6/2012 |
| WO | WO2013124201 | 8/2013 |
| WO | WO-2013/169688 A1 | 11/2013 |
| WO | WO2013169688 | 11/2013 |
| WO | WO2013169688 A1 | 11/2013 |

OTHER PUBLICATIONS

All Office Actions for U.S. Appl. No. 14/973,835, filed Dec. 18, 2015.
All Office Actions for U.S. Appl. No. 14/973,838, filed Dec. 18, 2015.
All Office Actions for U.S. Appl. no. 14/973,852, filed Dec. 18, 2015.
All Office Actions for U.S. Appl. No. 13/888,679, filed May 7, 2013.
All Office Actions for U.S. Appl. No. 13/888,721, filed May 7, 2013.
All Office Actions for U.S. Appl. No. 13/888,963, filed May 7, 2013.
All Office Actions for U.S. Appl. No. 13/888,756, filed May 7, 2013.
All Office Actions for U.S. Appl. No. 13/957,158, filed Aug. 1, 2013.
All Office Actions for U.S. Appl. No. 13/957,187, filed Aug. 1, 2013.
All Office Actions for U.S. Appl. No. 13/889,000, filed May 7, 2013.
All Office Actions for U.S. Appl. No. 13/889,090, filed May 7, 2013.
All Office Actions for U.S. Appl. No. 14/448,396, filed Jul. 31, 2014.
All Office Actions for U.S. Appl. No. 14/448,440, filed Jul. 31, 2014.
All Office Actions for U.S. Appl. No. 14/448,491, filed Jul. 31, 2014.
All Office Actions for U.S. Appl. No. 14/448,599, filed Jul. 31, 2014.
All Office Actions for U.S. Appl. No. 15/094,096, filed Apr. 8, 2016.
All Office Actions for U.S. Appl. No. 15/094,118, filed Apr. 8, 2016.
All Office Actions for U.S. Appl. No. 14/534,197, filed Nov. 6, 2014.
All Office Actions for U.S. Appl. No. 14/534,198, filed Nov. 6, 2014.
All Office Actions for U.S. Appl. No. 14/534,201, filed Nov. 6, 2014.
All Office Actions for U.S. Appl. No. 14/534,203, filed Nov. 6, 2014.
All Office Actions for U.S. Appl. No. 14/534,206, filed Nov. 6, 2014.
All Office Actions for U.S. Appl. No. 14/534,209, filed Nov. 6, 2014.
All Office Actions for U.S. Appl. No. 14/534,210, filed Nov. 6, 2014.
All Office Actions for U.S. Appl. No. 14/534,213, filed Nov. 6, 2014.
All Office Actions for U.S. Appl. No. 14,534,214, filed Nov. 6, 2014.
International Search Report and Written Opinion for PCT/US2015/066538, filed Apr. 20, 2016.
"The Rigidified Standing Pouch—A Concept For Flexible Packaging", Philip John Campbell, A Thesis Written In Partial Fulfillment Of The Requirements For The Degree Of Master Of Industrial Design, North Carolina State University School Of Design Raleigh, 1993, pp. 1-35.
All Office Actions, U.S. Appl. No. 14/973,827, filed Dec. 18, 2015.
All Office Actions, U.S. Appl. No. 14/973,835, filed Dec. 18, 2015.
All Office Actions, U.S. Appl. No. 14/973,838, filed Dec. 18, 2015.
All Office Actions, U.S. Appl. No. 14/973,852, filed Dec. 18, 2015.
International Search Report and Written Opinion, PCT/US2015/066538, date of mailing Apr. 20, 2016.

* cited by examiner

FLEXIBLE CONTAINERS WITH EASILY VARIABLE SIZING

FIELD

The present disclosure relates in general to flexible containers, and in particular, to flexible containers having with easily variable sizing, line-ups of such containers, and methods of making such line-ups.

BACKGROUND

"[I]f you cannot make pure goods and full weight, go to something else that is honest, even if it is breaking stone." James Gamble, co-founder of The Procter and Gamble Company, from the mid-1800s. A 'good' that is 'full weight' is a product with an actual size that is true to its label; it delivers the product according to the listed size. While the quotation provided above is from some time ago, its principle continues to endure as a standard to which product manufacturers should aspire. And, this principle can be applied in many different contexts, including the embodiments of flexible containers described herein.

Fluent products include liquid products and/or pourable solid products. In various embodiments, a container can be used to receive, contain, and dispense one or more fluent products. And, in various embodiments, a container can be used to receive, contain, and/or dispense individual articles or separately packaged portions of a product. A container can include one or more product spaces. A product space can be configured to be filled with one or more fluent products. A container receives a fluent product when its product space is filled. Once filled to a desired volume, a container can be configured to contain the fluent product in its product space, until the fluent product is dispensed. A container contains a fluent product by providing a barrier around the fluent product. The barrier prevents the fluent product from escaping the product space. The barrier can also protect the fluent product from the environment outside of the container. A filled product space is typically closed off by a cap or a seal. A container can be configured to dispense one or more fluent products contained in its product space(s). Once dispensed, an end user can consume, apply, or otherwise use the fluent product(s), as appropriate. In various embodiments, a container may be configured to be refilled and reused or a container may be configured to be disposed of after a single fill or even after a single use. A container should be configured with sufficient structural integrity, such that it can receive, contain, and dispense its fluent product(s), as intended, without failure.

A container for fluent product(s) can be handled, displayed for sale, and put into use. A container can be handled in many different ways as it is made, filled, decorated, packaged, shipped, and unpacked. A container can experience a wide range of external forces and environmental conditions as it is handled by machines and people, moved by equipment and vehicles, and contacted by other containers and various packaging materials. A container for fluent product(s) should be configured with sufficient structural integrity, such that it can be handled in any of these ways, or in any other way known in the art, as intended, without failure.

A container can also be displayed for sale in many different ways as it is offered for purchase. A container can be offered for sale as an individual article of commerce or packaged with one or more other containers or products, which together form an article of commerce. A container can be offered for sale as a primary package with or without a secondary package. A container can be decorated to display characters, graphics, branding, and/or other visual elements when the container is displayed for sale. A container can be configured to be displayed for sale while laying down or standing up on a store shelf, while presented in a merchandising display, while hanging on a display hanger, or while loaded into a display rack or a vending machine. A container for fluent product(s) should be configured with a structure that allows it to be displayed in any of these ways, or in any other way known in the art, as intended, without failure.

A container can also be put into use in many different ways, by its end user. A container can be configured to be held and/or gripped by an end user, so a container should be appropriately sized and shaped for human hands; and for this purpose, a container can include useful structural features such as a handle and/or a gripping surface. A container can be stored while laying down or standing up on a support surface, while hanging on or from a projection such as a hook or a clip, or while supported by a product holder, or (for refillable or rechargeable containers) positioned in a refilling or recharging station. A container can be configured to dispense fluent product(s) while in any of these storage positions or while being held by the user. A container can be configured to dispense fluent product(s) through the use of gravity, and/or pressure, and/or a dispensing mechanism, such as a pump, or a straw, or through the use of other kinds of dispensers known in the art. Some containers can be configured to be filled and/or refilled by a seller (e.g. a merchant or retailer) or by an end user. A container for fluent product(s) should be configured with a structure that allows it to be put to use in any of these ways, or in any other way known in the art, as intended, without failure. A container can also be configured to be disposed of by the end user, as waste and/or recyclable material, in various ways.

One conventional type of container for fluent products is a rigid container made from solid material(s). Examples of conventional rigid containers include molded plastic bottles, glass jars, metal cans, cardboard boxes, etc. These conventional rigid containers are well-known and generally useful; however their designs do present several notable difficulties.

First, some conventional rigid containers for fluent products can be expensive to make. Some rigid containers are made by a process shaping one or more solid materials. Other rigid containers are made with a phase change process, where container materials are heated (to soften/melt), then shaped, then cooled (to harden/solidify). Both kinds of making are energy intensive processes, which can require complex equipment.

Second, some conventional rigid containers for fluent products can require significant amounts of material. Rigid containers that are designed to stand up on a support surface require solid walls that are thick enough to support the containers when they are filled. This can require significant amounts of material, which adds to the cost of the containers and can contribute to difficulties with their disposal.

Third, some conventional rigid containers for fluent products can be difficult to decorate. The sizes, shapes, (e.g. curved surfaces) and/or materials of some rigid containers, make it difficult to print directly on their outside surfaces. Labeling requires additional materials and processing, and limits the size and shape of the decoration. Overwrapping provides larger decoration areas, but also requires additional materials and processing, often at significant expense.

Fourth, some conventional rigid containers for fluent products can be prone to certain kinds of damage. If a rigid container is pushed against a rough surface, then the container can become scuffed, which may obscure printing on the container. If a rigid container is pressed against a hard object, then the container can become dented, which may look unsightly. And if a rigid container is dropped, then the container can rupture, which may cause its fluent product to be lost.

Fifth, some fluent products in conventional rigid containers can be difficult to dispense. When an end user squeezes a rigid container to dispense its fluent product, the end user must overcome the resistance of the rigid sides, to deform the container. Some users may lack the hand strength to easily overcome that resistance; these users may dispense less than their desired amount of fluent product. Other users may need to apply so much of their hand strength, that they cannot easily control how much they deform the container; these users may dispense more than their desired amount of fluent product.

Sixth, when using conventional rigid containers, it can be difficult for a manufacturer to change such containers from one product size to another product size.

Product manufacturers regularly need to change the sizes of their products, by changing the amounts of fluent products in their containers. As a first example, a manufacturer may wish to run a promotion, offering a container with more fluent product, at a particular price point. As a second example, a manufacturer may wish to offer a container with less fluent product at a lower price, to provide a particular value proposition to consumers. These are two common examples, but there are many more. Manufacturers may wish to offer containers with new and/or different amounts of fluent products for many other reasons, such as supply issues, manufacturing limitations, changeover needs, packaging considerations, distribution logistics, regulatory requirements, retailer requests, consumer preferences, competitive responses, market conditions, etc. These product sizing issues become even more complex for manufacturers that have products with many variations in many different markets.

When a product manufacturer offers a fluent product in a conventional rigid container, and the manufacturer needs to change the size of the product, the change usually requires the manufacturer to make and use a new size of container for the new amount. If a manufacturer wishes to offer a product size with more fluent product, then the manufacturer usually cannot significantly increase the amount of fluent product in the original container, because most rigid containers are designed with limited headspaces, which do not allow for overfilling. If a manufacturer wishes to offer a product size with less fluent product, then the manufacturer usually cannot significantly decrease the amount of fluent product in the original container, because there are often limits to underfilling product containers. In some geographies, there are regulations that prohibit manufacturers from underfilling rigid product containers, by a significant amount. Even apart from such regulations, a manufacturer may not wish to significantly underfill a product container, to avoid negative perceptions by end users of the product. For example, even if a manufacturer clearly labels its container with the correct amount of fluent product, if consumers see that the container is significantly underfilled, then the consumers may perceive that the container is not a good value. The consumer may then form a negative association with the brand for that product; this is something the manufacturer wishes to avoid.

Unfortunately, when a product manufacturer offers a fluent product in a conventional rigid container, making a new size of that container can be costly, time-consuming, and challenging to coordinate. Changing the size of a conventional rigid container can be expensive because it typically requires buying a new mold, which, depending on many factors, can cost anywhere from thousands of dollars to millions of dollars. When several new molds are needed, these costs can multiply. Changing the size of a conventional rigid container can be time-consuming because a new mold may take weeks or even months to specify, design, fabricate, ship, and qualify for production.

Changing the size of a product container can be challenging to coordinate because the new size must fit with everything it touches—either directly or indirectly. In manufacturing a container, the container may touch various equipment for making, handling, decorating, labeling, and filling the container. In packaging a container, the container may touch various packaging equipment as well as secondary packaging materials, cartons, cases, and pallets. In supplying a container, the container may touch a wide variety of things, depending on how the container is supplied. When a container is supplied in a retail store, the container touches a store shelf or a merchandising display. When a container is supplied through an on-line retail environment, the container may touch pick bins, handling equipment, and/or shipping containers. In its use, a container may touch a container holder, container dispenser, or container refilling apparatus, among other things. At some point in its use, a container is also likely to be touched and/or held by human hands. For all of these touches, the size of the container must be coordinated to fit. And, of course, the changed product must have an actual size that is true to its label; it must continue to deliver the product in the listed size.

So, although product manufacturers regularly need to change the amounts of fluent products in their containers, doing so can be costly, time-consuming, and challenging to coordinate; as a result, when using conventional rigid containers, it can be difficult for a manufacturer to change such containers from one product size to another product size.

SUMMARY

The present disclosure describes various embodiments of containers made from flexible material. Because these containers are made from flexible material, these containers offer a number of advantages, when compared with conventional rigid containers.

First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to print and/or decorate, because they are made from flexible materials, and flexible materials can be printed and/or decorated as conformable webs, before they are formed into containers. Fourth, these flexible containers can be less prone to scuffing, denting, and rupture, because flexible materials allow their outer surfaces to deform when contacting surfaces and objects, and then to bounce back. Fifth, fluent products in these flexible containers can be more readily and carefully dispensed, because the sides of flexible containers can be more easily and controllably squeezed by human hands. Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed and put into use, as intended, without failure. Sixth, these flexible containers can be configured with easily variable sizing, allowing a product manufacturer to change a product's size with less expense, in less time, and with less coordination, when compared with conventional rigid containers.

In a first set of embodiments of the present disclosure, a line-up of flexible containers having similar constructions can hold different amounts of fluent product at similar fill heights. This line-up of flexible containers can comprise a first disposable self-supporting flexible container and a second disposable self-supporting flexible container. Any or all of the containers in the line-up may or may not be configured for retail sale. The first container can have: a first product space construction that is based, at least in part, on a first folding pattern; a first external amount indicium that indicates a first listed amount of a first fluent product that is being offered for sale with the first container; a first actual amount of the first fluent product, disposed in the first product space, wherein the first actual amount is nearly equal to the first listed amount; and a first closed fill height for the first fluent product in the first product space. The second container can have: a second product space having a second product space construction that is based, at least in part, on a second folding pattern that is substantially the same as the first folding pattern; a second external amount indicium that indicates a second listed amount of a second fluent product that is being offered for sale with the second container (the second fluent product may be similar to, or the same as, or different from the first fluent product), wherein the second listed amount is a particular percentage less than the first listed amount, and the particular percentage is greater than or equal to 0.1% and less than or equal to 70%; a second actual amount of the second fluent product, disposed in the second product space, wherein the second actual amount is nearly equal to the second listed amount; and a second closed fill height for the second fluent product in the second product space, wherein the second closed fill height is greater than or equal to the first closed fill height.

In a second set of embodiments of the present disclosure, in a line-up of flexible containers having similar constructions, one of the containers can hold relatively less fluent product at an unexpectedly high fill height. This line-up of flexible containers can comprise a first disposable self-supporting flexible container and a second disposable self-supporting flexible container. Any or all of the containers in the line-up may or may not be configured for retail sale. The first container can have: a first product space construction that is based, at least in part, on a first folding pattern; a first external amount indicium that indicates a first listed amount of a first fluent product that is being offered for sale with the first container; a first actual amount of the first fluent product, disposed in the first product space, wherein the first actual amount is nearly equal to the first listed amount; and a first closed fill height for the first fluent product in the first product space. The second container can have: a second product space having a second product space construction that is based, at least in part, on a second folding pattern that is substantially the same as the first folding pattern; a second external amount indicium that indicates a second listed amount of a second fluent product that is being offered for sale with the second container (the second fluent product may be similar to, or the same as, or different from the first fluent product), wherein the second listed amount is a particular percentage less than the first listed amount, and the particular percentage is greater than or equal to 0.1% and less than or equal to 70%; a second actual amount of the second fluent product, disposed in the second product space, wherein the second actual amount is nearly equal to the second listed amount; and a second closed fill height for the second fluent product in the second product space, wherein the second closed fill height is a particular calculated value that falls within certain mathematical expressions (explained herein) that represent an unexpectedly high fill height.

In a third set of embodiments of the present disclosure, in a line-up of flexible containers having similar external shapes, one of the containers can hold relatively less fluent product. This line-up of flexible containers can comprise a first disposable self-supporting flexible container and a second disposable self-supporting flexible container. Any or all of the containers in the line-up may or may not be configured for retail sale. The first container can have a first overall front profile and a first product space with a first total capacity. The second container can have a second disposable self-supporting flexible container, having a second overall front profile that has substantially the same size and shape as the first overall front profile, and a second product space with a second total capacity that is a particular percentage less than the first total capacity; wherein the particular percentage is greater than or equal to 5% and less than or equal to 70%.

In a fourth set of embodiments of the present disclosure, in a line-up of flexible containers having similar external sizes, one of the containers can hold relatively less fluent product. This line-up of flexible containers can comprise a first disposable self-supporting flexible container and a second disposable self-supporting flexible container. Any or all of the containers in the line-up may or may not be configured for retail sale. The first container can have a first overall external displacement and a first product space with a first total capacity. The second container can have a second disposable self-supporting flexible container, having a second overall external displacement, and a second product space with a second total capacity that is a particular percentage less than the first total capacity; wherein the particular percentage is greater than or equal to 5% and less than or equal to 70%; and wherein the second overall external displacement is greater than or equal to the first overall external displacement.

Each of these line-ups of flexible containers offers a number of advantages. A product size can be changed with less expense, because processing equipment for a flexible container can be designed to change from one size to another, without the need to purchase new equipment. A product size can be changed in less time, because processing equipment for a flexible container can be changed over in hours or minutes (or even on the fly) rather than waiting for new equipment. A product size can be changed with less coordination, because flexible containers can be designed to have internal capacities that are different, but external dimensions that are similar (or the same). So, when using flexible containers of the present disclosure, a manufacturer can easily change such containers from one product size to another product size.

BRIEF DESCRIPTION OF THE DRAWINGS

FIG. 28A illustrates a front view of a flexible container, having a relatively smaller treated area for increasing the extensibility of a squeeze panel.

FIG. 28B illustrates a front view of a flexible container, having a relatively larger treated area for increasing the extensibility of a squeeze panel.

FIG. 28C illustrates a front view of a flexible container, having no treated area for increasing the extensibility of a squeeze panel.

FIG. 29A illustrates a front view of a flexible container, having relatively smaller folds for decreasing the size of an overall side profile.

FIG. 29B illustrates a front view of a flexible container, having no folds for decreasing the size of an overall side profile.

FIG. 29C illustrates a front view of a flexible container, having relatively larger folds for decreasing the size of an overall side profile.

FIG. 30A illustrates a front view of a flexible container, having relatively few joining locations for decreasing the size of an overall side profile.

FIG. 30B illustrates a front view of a flexible container, having no joining locations for decreasing the size of an overall side profile.

FIG. 30C illustrates a front view of a flexible container, having relatively many joining locations for decreasing the size of an overall side profile.

FIG. 31A illustrates a partial internal cross-sectional side view of a flexible container, having relatively few internal tie members for decreasing the size of an overall side profile.

FIG. 31B illustrates a partial internal cross-sectional side view of a flexible container, having no internal tie members for decreasing the size of an overall side profile.

FIG. 31C illustrates a partial internal cross-sectional side view of a flexible container, having relatively many internal tie members for decreasing the size of an overall side profile.

Figure 32A:
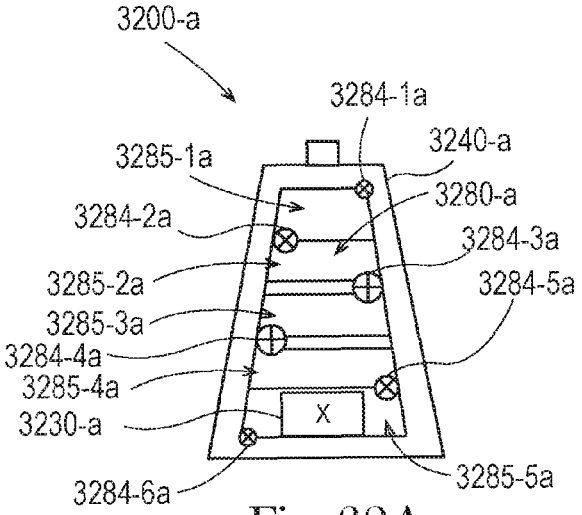

FIG. 32A illustrates a front view of a flexible container, having relatively few expanded surface stiffening members for decreasing the size of an overall side profile.

Figure 32B:
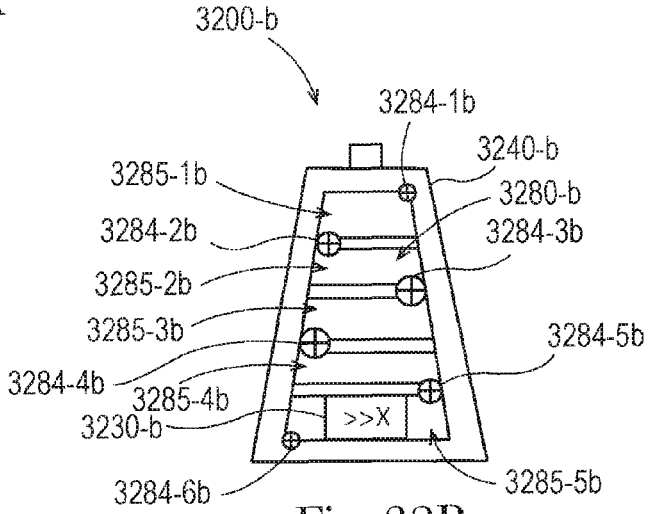

FIG. 32B illustrates a front view of a flexible container, having no expanded surface stiffening members for decreasing the size of an overall side profile.

FIG. 32C illustrates a front view of a flexible container, having relatively many expanded surface stiffening members for decreasing the size of an overall side profile.

Figure 33C:
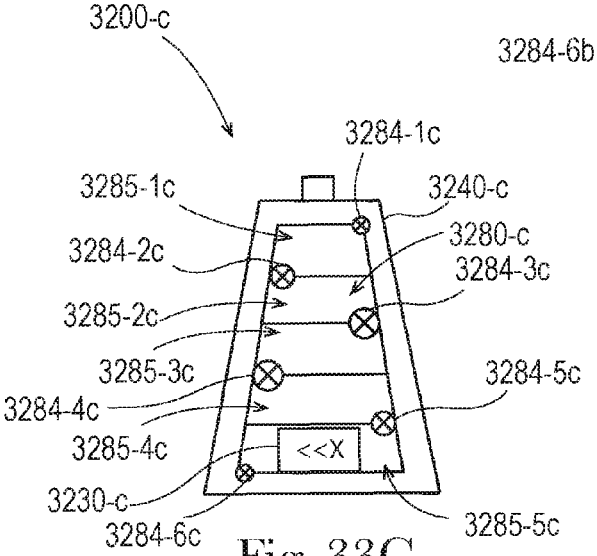
Figures 33A, 33B, 33C:
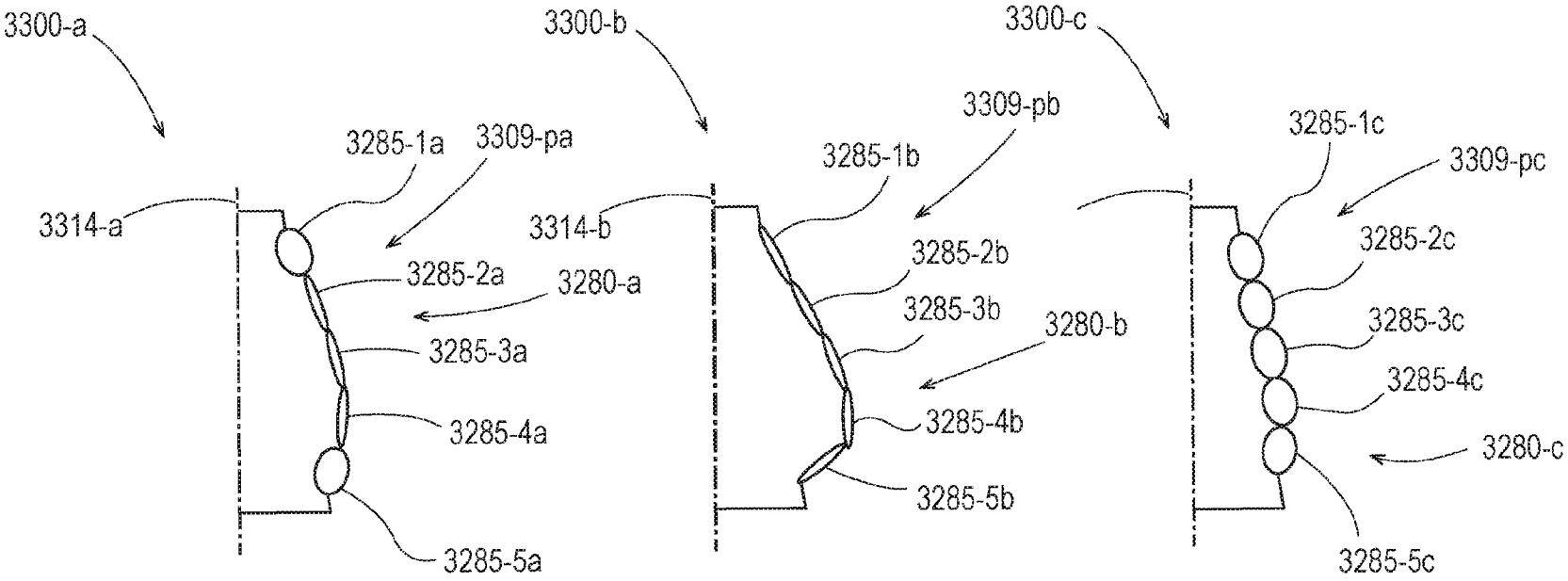

FIG. 33A illustrates a partial internal cross-sectional side view of the flexible container of FIG. 32A.

FIG. 33B illustrates a partial internal cross-sectional side view of the flexible container of FIG. 32B.

FIG. 33C illustrates a partial internal cross-sectional side view of the flexible container of FIG. 32C.

Figure 34C:
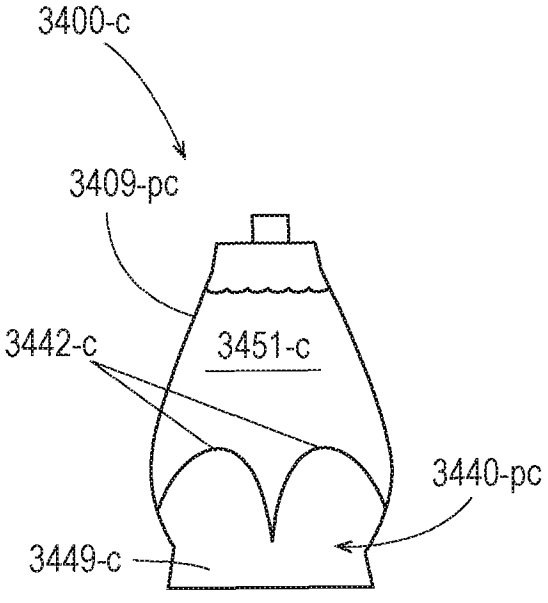
Figure 34B:
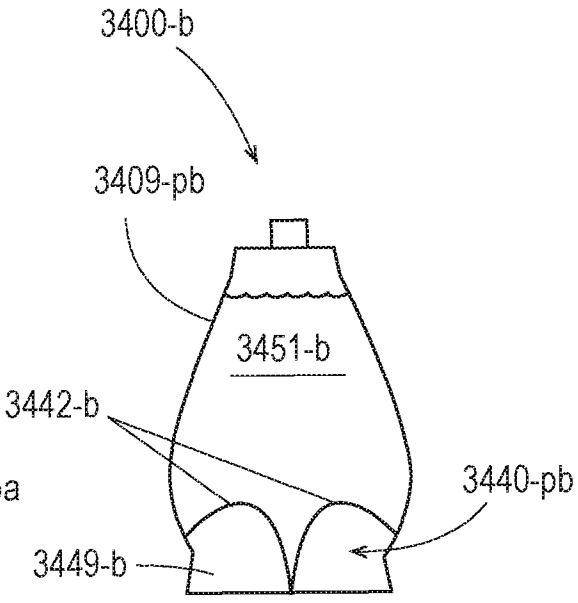
Figure 34A:
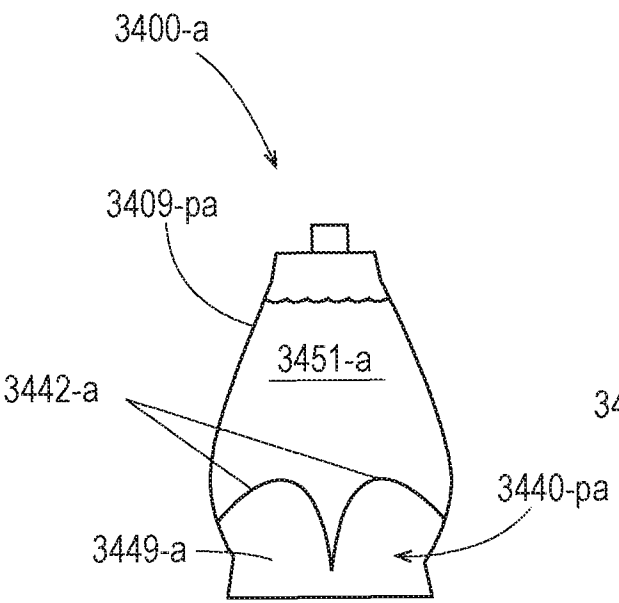

FIG. 34A illustrates a partial internal cross-sectional front view of a flexible container, having an intermediate amount of expansion material in a structural support volume.

FIG. 34B illustrates a partial internal cross-sectional front view of a flexible container, having a relatively smaller amount of expansion material in a structural support volume.

FIG. 34C illustrates a partial internal cross-sectional front view of a flexible container, having a relatively larger amount of expansion material in a structural support volume.

Figure 35C:
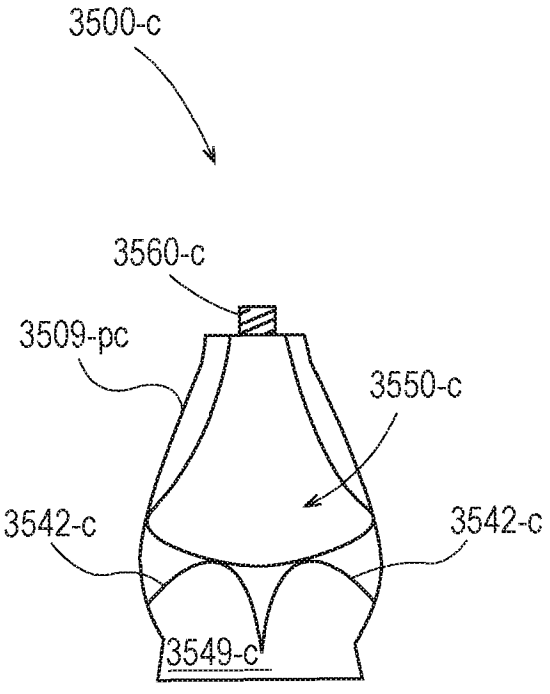
Figure 35B:
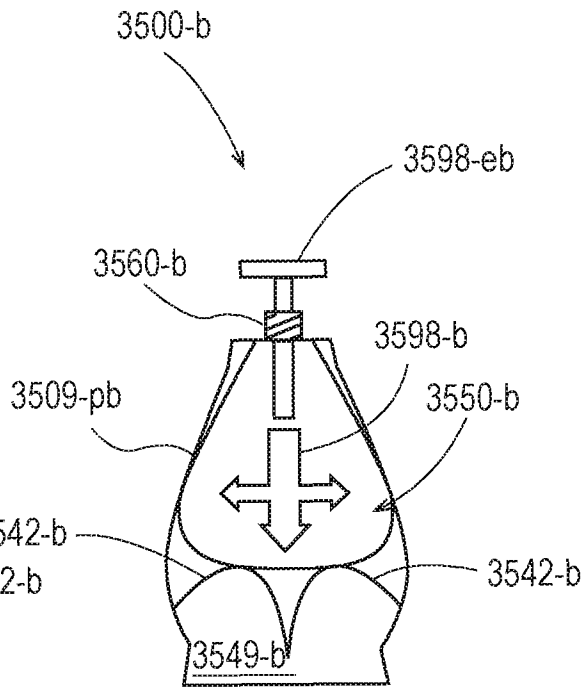
Figure 35A:
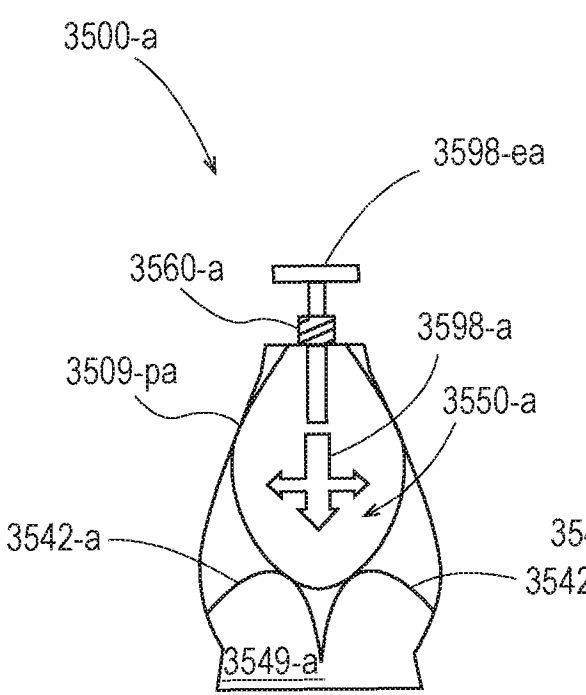

FIG. 35A illustrates a partial internal cross-sectional front view of a flexible container having its product space increased a relatively smaller amount by an internal pressure.

FIG. 35B illustrates a partial internal cross-sectional front view of a flexible container having its product space increased a relatively larger amount by an internal pressure.

FIG. 35C illustrates a partial internal cross-sectional front view of a flexible container having its product space not increased by an internal pressure.

Figures 36A, 36B, 36C:
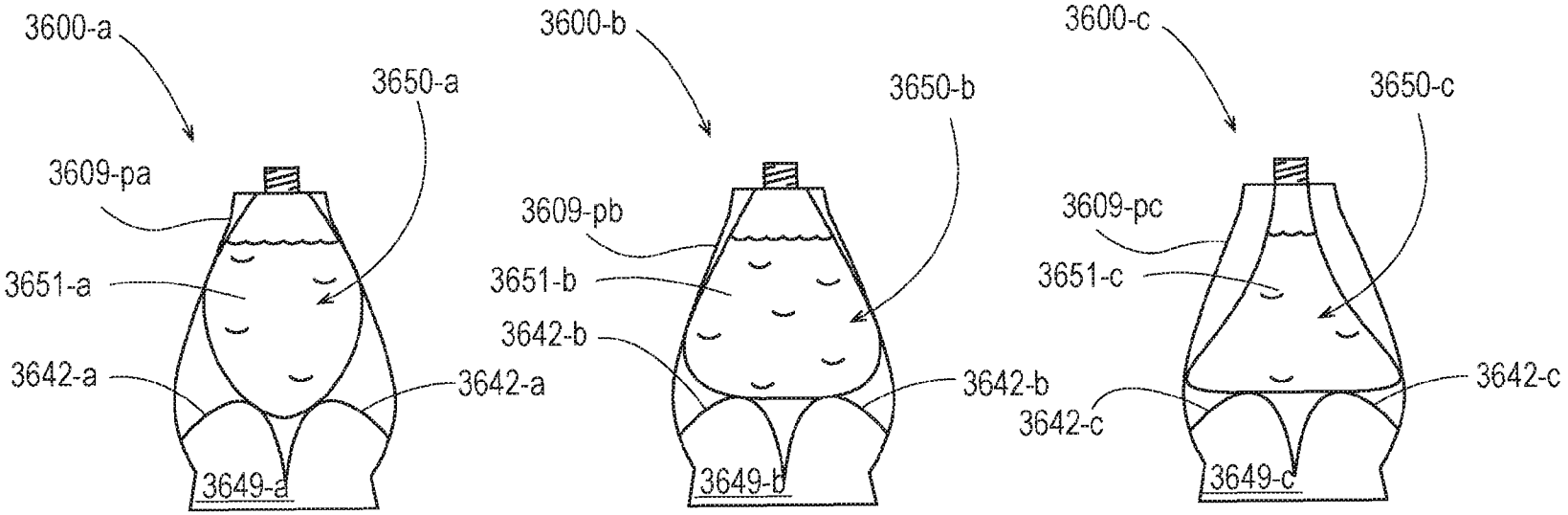

FIG. 36A illustrates a partial internal cross-sectional front view of the flexible container of FIG. 35A, when filled.

FIG. 36B illustrates a partial internal cross-sectional front view of the flexible container of FIG. 35B, when filled.

FIG. 36C illustrates a partial internal cross-sectional front view of the flexible container of FIG. 35C, when filled.

Figures 37A, 37B, 37C:
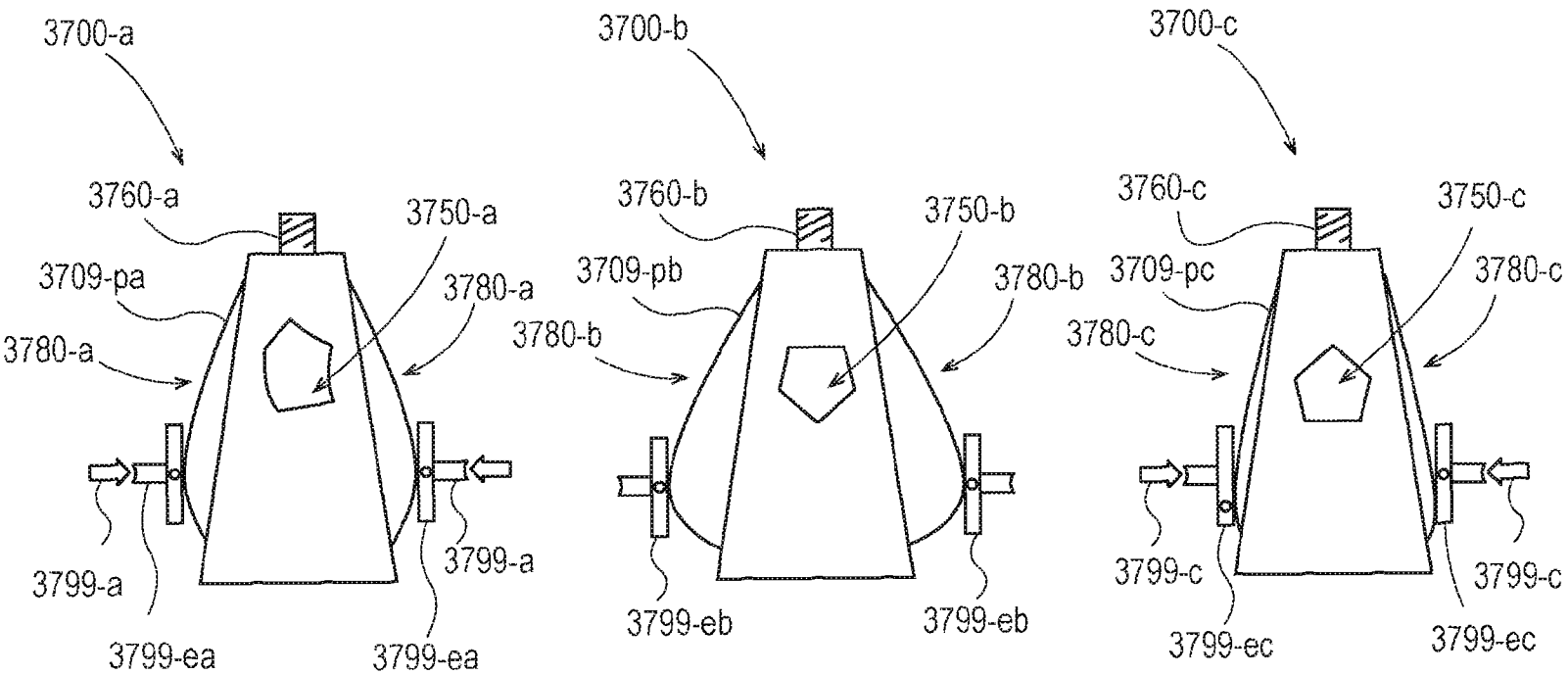

FIG. 37A illustrates a side view of a flexible container having its product space decreased a relatively smaller amount by external pushing forces.

FIG. 37B illustrates a side view of a flexible container having its product space not decreased by external pushing forces.

FIG. 37C illustrates a side view of a flexible container having its product space decreased a relatively larger amount by external pushing forces.

DETAILED DESCRIPTION

The present disclosure describes various embodiments of containers made from flexible material. Because these containers are made from flexible material, these containers offer a number of advantages, when compared with conventional rigid containers. In particular, these flexible containers can be configured with easily variable sizing, allowing a product manufacturer to change a product's size with less expense, in less time, and with less coordination, when compared with conventional rigid containers. A product size can be changed with less expense, because processing equipment for a flexible container can be designed to change from one size to another, without the need to purchase new equipment. A product size can be changed in less time, because processing equipment for a flexible container can be changed over in hours or minutes (or even on the fly) rather than waiting for new equipment. A product size can be changed with less coordination, because flexible containers can be designed to have internal capacities that are different, but external dimensions that are similar (or the same). So, when using flexible containers of the present disclosure, a manufacturer can easily change such containers from one product size to another product size.

Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed for sale and put into use, as intended, without failure.

As used herein, the term "about" modifies a particular value, by referring to a range equal to the particular value, plus or minus twenty percent (+/−20%). For any of the embodiments of flexible containers, disclosed herein, any disclosure of a particular value, can, in various alternate embodiments, also be understood as a disclosure of a range equal to about that particular value (i.e. +/−20%).

As used herein, the term "actual amount" refers to a measured amount of the fluent product(s) present in a product space of a container when the container is configured for retail sale.

As used herein, the term "ambient conditions" refers to a temperature of 19-21 degrees Celsius and a relative humidity of 45-55%.

As used herein, the term "approximately" modifies a particular value, by referring to a range equal to the particular value, plus or minus fifteen percent (+/−15%). For any of the embodiments of flexible containers, disclosed herein, any disclosure of a particular value, can, in various alternate embodiments, also be understood as a disclosure of a range equal to approximately that particular value (i.e. +/−15%).

As used herein, the term "atmospheric pressure" refers to an absolute pressure of 1 atmosphere.

As used herein, when referring to a sheet of material, the term "basis weight" refers to a measure of mass per area, in units of grams per square meter (gsm). For any of the embodiments of flexible containers, disclosed herein, in various embodiments, any of the flexible materials can be configured to have a basis weight of 10-1000 gsm, or any integer value for gsm from 10-1000, or within any range formed by any of these values, such as 20-800 gsm, 30-600 gsm, 40-400 gsm, or 50-200, etc.

As used herein, when referring to a flexible container, the term "bottom" refers to the portion of the container that is located in the lowermost 30% of the overall height of the container, that is, from 0-30% of the overall height of the container. As used herein, the term bottom can be further limited by modifying the term bottom with a particular percentage value, which is less than 30%. For any of the embodiments of flexible containers, disclosed herein, a reference to the bottom of the container can, in various alternate embodiments, refer to the bottom 25% (i.e. from 0-25% of the overall height), the bottom 20% (i.e. from 0-20% of the overall height), the bottom 15% (i.e. from 0-15% of the overall height), the bottom 10% (i.e. from 0-10% of the overall height), or the bottom 5% (i.e. from 0-5% of the overall height), or any integer value for percentage between 0% and 30%.

As used herein, the term "branding" refers to a visual element intended to distinguish a product from other products. Examples of branding include one of more of any of the following: trademarks, trade dress, logos, icons, and the like. For any of the embodiments of flexible containers, disclosed herein, in various embodiments, any surface of the flexible container can include one or more brandings of any size, shape, or configuration, disclosed herein or known in the art, in any combination.

As used herein, the term "character" refers to a visual element intended to convey information. Examples of characters include one or more of any of the following: letters, numbers, symbols, and the like. For any of the embodiments of flexible containers, disclosed herein, in various embodiments, any surface of the flexible container can include one or more characters of any size, shape, or configuration, disclosed herein or known in the art, in any combination.

As used herein, the term "closed" refers to a state of a product space, wherein fluent products within the product space are prevented from escaping the product space (e.g. by one or more materials that form a barrier), but the product space is not necessarily hermetically sealed. For example, a closed container can include a vent, which allows a head space in the container to be in fluid communication with air in the environment outside of the container.

As used herein, the term "closed fill height" refers to a distance that is measured when the container is configured for retail sale and while the container is standing upright on a horizontal support surface, the distance measured vertically from the upper side of the support surface to a fill line in a product space of the container. If a container does not have a standing upright orientation but does have a hanging orientation, then the term closed fill height refers to a distance that is measured when the container is configured for retail sale and while the container is hanging down from a support, the distance measured vertically from the lowest point on the container to a fill line in a product space of the container. If a container does not have a standing upright orientation or a hanging orientation, then the term closed fill height does not apply to the container.

As used herein, the term "deflation feature" refers to one or more structural features provided with a flexible container for use in deflating some or all of the expanded structural support volume(s) of the flexible container, by allowing expansion material(s) inside of the structural support volume to escape into the environment, so that the structural support volume is no longer expanded. A deflation feature can be used when the flexible container is ready to be disposed of (i.e. as waste, compost, and/or recyclable material). Any of the flexible containers disclosed herein can be configured with any number of any kind of deflation feature, configured in any way disclosed herein or known in the art.

One kind of deflation feature is a cutting device, which is a rigid element that includes a point or edge configured to cut and/or pierce through flexible material(s) that form at least part of a structural support volume. As an example, a cutting device can be included with a flexible container by attaching the device to any portion of the outside (e.g. top, middle, side, bottom, etc.) of the container with adhesive, or under a label, or any other way known in the art, for externally attaching rigid elements to a container. As another example, a cutting device can be included with a flexible container by including the device with other packaging material, such as attached to an outer carton, inside of an overwrap layer, in between containers provided together, etc. As still another example, a cutting device can be included with a flexible container by including the device inside of any portion of the container, such as in a product space, in a structural support volume, in a mixing chamber, in a dedicated space for the device, in a base structure, or any other way known in the art, for internally including rigid elements within a container. As yet another example, a cutting device can be included with a flexible container, by making the cutting device integral with or detachable from another rigid element that is part of the container, such as a rigid base structure, cap, dispenser, fitment, connecting element, reinforcing element, or any other rigid element for containers disclosed herein or known in the art. A cutting device can be configured to be any convenient size and any workable shape and can be used manually or through use of a tool. In addition to rigid elements, flexible materials that can be turned into a rigid cutting device through rolling up or folding flexible materials are also envisioned.

Another kind of deflation feature is an exit channel, which can be configured to be opened in material(s) that border or define at least a portion of the fillable space of a structural support volume. An exit channel can be an existing connection (e.g. seam, seal, or joint) in the container, which is configured to fail (e.g. separate and at least partially open) when exposed to opening forces. An exit channel can also be formed with one or more points, lines, and/or areas of weakness (e.g. thinned, scored, perforated, frangible seal, etc.), which are configured to fail or to otherwise be breached, when exposed to opening forces. An exit channel can be protected by another material, such as an adhesive label, to ensure the exit channel remains closed until the user wishes to deflate. An exit channel can further be formed by configuring the container with one or more tear initiation sites (such as a notch in an edge, a pull-tab, etc.) such that a tear propagating from the site(s) can open the flexible material. An exit channel can be configured to be any convenient size and any workable shape and can be opened manually (by grasping and pulling, by poking with a finger or fingernail, or any other way) or through use of a tool or by overpressurizing a structural support volume (through application of compressive force or controlled environmental conditions) such that the structural support volume fails when its expansion material(s) burst out.

Still another kind of deflation feature is a valve, connected to the fillable space of a structural support volume, wherein the valve can be opened to the container's environment. Embodiments of the present disclosure can use as a deflation feature, any and all embodiments of valves (including materials, structures, and/or features for valves, as well as any and all methods of making and/or using such valves), as disclosed in the following patent documents: U.S. nonprovisional patent application Ser. No. 13/379,655 filed Jun. 21, 2010, entitled "Collapsible Bottle, Method Of Manufacturing a Blank For Such Bottle and Beverage-Filled Bottle Dispensing System" in the name of Reidl, published as US2012/0097634; U.S. nonprovisional patent application Ser. No. 10/246,893 filed Sep. 19, 2002, entitled "Bubble-Seal Apparatus for Easily Opening a Sealed Package" in the name of Perell, et al., published as 20040057638; and U.S. Pat. No. 7,585,528 filed Dec. 16, 2002, entitled "Package having an inflated frame" in the name of Ferri, et al., granted on Sep. 8, 2009; each of which is hereby incorporated by reference.

As used herein, the term "directly connected" refers to a configuration wherein elements are attached to each other without any intermediate elements therebetween, except for any means of attachment (e.g. adhesive).

As used herein, when referring to a flexible container, the term "dispenser" refers to a structure configured to dispense fluent product(s) from a product space and/or from a mixing volume to the environment outside of the container. For any of the flexible containers disclosed herein, any dispenser can be configured in any way disclosed herein or known in the art, including any suitable size, shape, and flow rate. For example, a dispenser can be a push-pull type dispenser, a dispenser with a flip-top cap, a dispenser with a screw-on cap, a rotatable type dispenser, dispenser with a cap, a pump type dispenser, a pump spray type dispenser, a trigger spray type dispenser, a straw dispenser, a flip up straw dispenser, a straw dispenser with bite valve, a dosing dispenser, etc. A dispenser can be a parallel dispenser, providing multiple flow channels in fluid communication with multiple product spaces, wherein those flow channels remain separate until the point of dispensing, thus allowing fluent products from multiple product spaces to be dispensed as separate fluent products, dispensed together at the same time. A dispenser can be a mixing dispenser, providing one or more flow channels in fluid communication with multiple product spaces, with multiple flow channels combined before the point of dispensing, thus allowing fluent products from multiple product spaces to be dispensed as the fluent products mixed together. As another example, a dispenser can be formed by a frangible opening. As further examples, a dispenser can utilize one or more valves and/or dispensing mechanisms disclosed in the art, such as those disclosed in: published US patent application 2003/0096068, entitled "One-way valve for inflatable package"; U.S. Pat. No. 4,988,016 entitled "Self-sealing container"; and U.S. Pat. No. 7,207,717, entitled "Package having a fluid actuated closure"; each of which is hereby incorporated by reference. Still further, any of the dispensers disclosed herein, may be incorporated into a flexible container either directly, or in combination with one or more other materials or structures (such as a fitment), or in any way known in the art. In some alternate embodiments, dispensers disclosed herein can be configured for both dispensing and filling, to allow filling of product space(s) through one or more dispensers. In other alternate embodiments, a product space can include one or more filling structure(s) (e.g. for adding water to a mixing volume) in addition to or instead of one or more dispenser(s). Any location for a dispenser, disclosed herein can alternatively be used as a location for a filling structure. In some embodiments, a product space can include one or more filling structures in addition to any dispenser(s). And, any location for a dispenser, disclosed herein can alternatively be used as a location for an opening, through which product can be filled and/or dispensed, wherein the opening may be reclosable or non-reclosable, and can be configured in any way known in the art of packaging. For example, an opening can be: a line of weakness, which can be torn open; a zipper seal, which can be pulled open and pressed closed (e.g. a press seal), or opened and closed with a slider; openings with adhesive-based closures; openings with cohesive-based closures; openings with closures having fasteners (e.g. snaps, tin tie, etc.), openings with closures having micro-sized fasteners (e.g. with opposing arrays of interlocking fastening elements, such as hook, loops, and/or other mating elements, etc.), and any other kind of opening for packages or containers, with or without a closure, known in the art.

As used herein, when referring to a flexible container, the term "disposable" refers to a container which, after dispensing a product to an end user, is not configured to be refilled with an additional amount of the product, but is configured to be disposed of (i.e. as waste, compost, and/or recyclable material). Part, parts, or all of any of the embodiments of flexible containers, disclosed herein, can be configured to be disposable.

As used herein, when referring to a flexible container, the term "durable" refers to a container that is reusable more than non-durable containers.

As used herein, when referring to a flexible container, the term "effective base contact area" refers to a particular area defined by a portion of the bottom of the container, when the container is configured for retail sale and is standing upright and its bottom is resting on a horizontal support surface, determined as described below. The effective base contact area lies in a plane defined by the horizontal support surface. The effective base contact area is a continuous area bounded on all sides by an outer periphery.

The outer periphery is formed from an actual contact area and from a series of projected areas from defined cross-sections taken at the bottom of the container. The actual contact area is the one or more portions of the bottom of the container that contact the horizontal support surface, when the effective base contact area is defined. The effective base contact area includes all of the actual contact area. However, in some embodiments, the effective base contact area may extend beyond the actual contact area.

The series of projected area are formed from five horizontal cross-sections, taken at the bottom of the flexible container. These cross-sections are taken at 1%, 2%, 3%, 4%, and 5% of the overall height. The outer extent of each of these cross-sections is projected vertically downward onto the horizontal support surface to form five (overlapping) projected areas, which, together with the actual contact area, form a single combined area. This is not a summing up of the values for these areas, but is the formation of a single combined area that includes all of these (projected and actual) areas, overlapping each other, wherein any overlapping portion makes only one contribution to the single combined area.

The outer periphery of the effective base contact area is formed as described below. In the following description, the terms convex, protruding, concave, and recessed are understood from the perspective of points outside of and around the combined area. The outer periphery is formed by a combination of the outer extent of the combined area and any chords, which are straight line segments constructed as described below.

For each continuous portion of the combined area that has an outer perimeter with a shape that is concave or recessed, a chord is constructed across that portion. This chord is the shortest straight line segment that can be drawn tangent to the combined area on both sides of the concave/recessed portion.

For a combined area that is discontinuous (formed by two or more separate portions), one or more chords are constructed around the outer perimeter of the combined area, across the one or more discontinuities (open spaces disposed between the portions). These chords are straight line segments drawn tangent to the outermost separate portions of the combined area. These chords are drawn to create the largest possible effective base contact area.

Thus, the outer periphery is formed by a combination of the outer extent of the combined area and any chords, constructed as described above, which all together enclose the effective base area. Any chords that are bounded by the combined area and/or one or more other chords, are not part of the outer periphery and should be ignored.

Any of the embodiments of flexible containers, disclosed herein, can be configured to have an effective base contact area from 1 to 50,000 square centimeters ($cm^2$), or any integer value for $cm^2$ between 1 and 50,000 $cm^2$, or within any range formed by any of the preceding values, such as: from 2 to 25,000 $cm^2$, 3 to 10,000 $cm^2$, 4 to 5,000 $cm^2$, 5 to 2,500 $cm^2$, from 10 to 1,000 $cm^2$, from 20 to 500 $cm^2$, from 30 to 300 $cm^2$, from 40 to 200 $cm^2$, or from 50 to 100 $cm^2$, etc.

In a line-up of flexible containers, according to any of the embodiments disclosed herein, both or all of the flexible containers in the line-up can have an effective base contact area that is about, approximately, substantially, or nearly the same in size and/or shape.

As used herein, when referring to a flexible container, the term "expanded" refers to the state of one or more flexible materials that are configured to be formed into a structural support volume, after the structural support volume is made rigid by one or more expansion materials. An expanded structural support volume has an overall width that is significantly greater than the combined thickness of its one or more flexible materials, before the structural support volume is filled with the one or more expansion materials. Examples of expansion materials include liquids (e.g. water), gases (e.g. compressed air), fluent products, foams (that can expand after being added into a structural support volume), co-reactive materials (that produce gas), or phase change materials (that can be added in solid or liquid form, but which turn into a gas; for example, liquid nitrogen or dry ice), or other suitable materials known in the art, or combinations of any of these (e.g. fluent product and liquid nitrogen). In various embodiments, expansion materials can be added at atmospheric pressure, or added under pressure greater than atmospheric pressure, or added to provide a material change that will increase pressure to something above atmospheric pressure. For any of the embodiments of flexible containers, disclosed herein, its one or more flexible materials can be expanded at various points in time, with respect to its manufacture, sale, and use, including, for example: before or after its product space(s) are filled with fluent product(s), before or after the flexible container is shipped to a seller, and before or after the flexible container is purchased by an end user.

As used herein, when referring to a container for retail sale of one or more fluent products, the term "external amount indicium" refers to an indicium that is joined to the container, that is visible from outside of the container, and that indicates a listed amount of fluent product that is being offered for sale with the container. The indicium can be any kind of indicium described herein or known in the art. In various embodiments, the indicium can be a particular value in various units of measurement (e g milliliters and/or fluid ounces for a fluent product that is a liquid; grams and/or ounces of weight for a fluent product that is a pourable solid). In various embodiments, the indicium can be for a particular product size that is associated with a particular amount of fluent product being offered for sale. The indicium can be provided on a label or as printing or in any other form described herein or known in the art. The indicium can be joined to an outside of the container or joined to an inside of the container (and visible through a transparent portion of the container), or on secondary packaging connected to the container. Alternatively, instead of being joined to the container, the indicium can be presented as part of a merchandising display for the container or can be communicated via advertising materials. An external amount indicium is typically applied to a container by the manufacturer of the product or by a retailer of the product.

Although a manufacturer may earnestly endeavor to make products that are properly filled and accurately labeled, there may be some limited instances, in which a container may contain an actual amount of fluent product that is not exactly equal to the listed amount of fluent product indicated by its external amount indicium. As a first example, a manufacturer may intentionally overfill containers, in an attempt to make up for projected losses of fluent product (from evaporation) during their shelf life. As a second example, a manufacturer may experience variability in the filling of containers, resulting in a few containers having actual amounts of fluent product that vary somewhat from a targeted amount of fill. As a third example, a retailer may unintentionally sell a product that has passed its expected shelf life, and has experienced a larger than projected loss of fluent product (from evaporation). Despite these limited instances, a container offered for retail sale typically contains an actual amount of fluent product that is nearly equal to the listed amount of fluent product indicated by its external amount indicium.

As used herein, when referring to a product space of a flexible container, the term "filled" refers to the state of the product space in the container (which is fully manufactured) after the filling of its product space(s) with fluent product(s) is complete and the container is fully closed and/or sealed, wherein the container has not been opened or unsealed, and wherein the fluent product(s) in the container have not been put into its/their intended end use.

A filled product space may or may not include an allowance for headspace, depending on the kind of fluent product(s) being contained, and the requirements for containing the fluent product(s). As an example, a manufacturer can label a flexible container with an external amount indicium that indicates a listed amount of a fluent product that is being offered for sale with the container, can add to the product space of the container an actual amount of the fluent product that is nearly equal to the listed amount (but still includes a headspace that is designed for that fluent product in that product space), and can close the container so the container is configured for retail sale; that container is considered filled. As used herein, the term filled can be modified by using the term filled with a particular percentage value.

As used herein, the term "flat" refers to a surface that is without significant projections or depressions.

As used herein, the term "flexible container" refers to a container with a product space, wherein one or more flexible materials form 50-100% of the overall surface area of the one or more materials that define the three-dimensional space of the product space. For any of the embodiments of flexible containers, disclosed herein, in various embodiments, the flexible container can be configured to have a product space, wherein one or more flexible materials form a particular percentage of the overall area of the one or more materials that define the three-dimensional space, and the particular percentage is any integer value for percentage between 50% and 100%, or within any range formed by any of these values, such as: 60-100%, or 70-100%, or 80-100%, or 90-100%, etc. One kind of flexible container is a film-based container, which is a flexible container made from one or more flexible materials, which include a film.

For any of the embodiments of flexible containers, disclosed herein, in various embodiments, the middle of the flexible container (apart from any fluent product) can be configured to have an overall middle mass, wherein one or more flexible materials form a particular percentage of the overall middle mass, and the particular percentage is any integer value for percentage between 50% and 100%, or within any range formed by any of the preceding values, such as: 60-100%, or 70-100%, or 80-100%, or 90-100%, etc.

For any of the embodiments of flexible containers, disclosed herein, in various embodiments, the entire flexible container (apart from any fluent product) can be configured to have an overall mass, wherein one or more flexible materials form a particular percentage of the overall mass, and the particular percentage is any integer value for percentage between 50% and 100%, or within any range formed by any of the preceding values, such as: 60-100%, or 70-100%, or 80-100%, or 90-100%, etc.

As used herein, when referring to a flexible container, the term "flexible material" refers to a thin, easily deformable, sheet-like material, having a flexibility factor within the range of 1,000-2,500,000 N/m. For any of the embodiments of flexible containers, disclosed herein, in various embodiments, any of the flexible materials can be configured to have a flexibility factor of 1,000-2,500,000 N/m, or any integer value for flexibility factor from 1,000-2,500,000 N/m, or within any range formed by any of these values, such as 1,000-1,500,000 N/m, 1,500-1,000,000 N/m, 2,500-800,000 N/m, 5,000-700,000 N/m, 10,000-600,000 N/m, 15,000-500,000 N/m, 20,000-400,000 N/m, 25,000-300,000 N/m, 30,000-200,000 N/m, 35,000-100,000 N/m, 40,000-90,000 N/m, or 45,000-85,000 N/m, etc. Throughout the present disclosure the terms "flexible material", "flexible sheet", "sheet", and "sheet-like material" are used interchangeably and are intended to have the same meaning. Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, and in any combination, as described herein or as known in the art.

As examples, flexible materials such as films and nonwovens can be made from one or more thermoplastic polymers, as described herein and/or as known in the art. Thermoplastic polymers can include polyolefins such as polyethylene and/or copolymers thereof, including low density, high density, linear low density, or ultra low density polyethylenes. Polypropylene and/or polypropylene copolymers, including atactic polypropylene; isotactic polypropylene, syndiotactic polypropylene, and/or combinations thereof can also be used. Polybutylene is also a useful polyolefin.

Other suitable polymers include polyamides or copolymers thereof, such as Nylon 6, Nylon 11, Nylon 12, Nylon 46, Nylon 66; polyesters and/or copolymers thereof, such as maleic anhydride polypropylene copolymer, polyethylene terephthalate; olefin carboxylic acid copolymers such as ethylene/acrylic acid copolymer, ethylene/maleic acid copolymer, ethylene/methacrylic acid copolymer, ethylene/vinyl acetate copolymers or combinations thereof; polyacrylates, polymethacrylates, and/or their copolymers such as poly (methyl methacrylates).

Other nonlimiting examples of polymers include polyesters, polycarbonates, polyvinyl acetates, poly(oxymethylene), styrene copolymers, polyacrylates, polymethacrylates, poly(methyl methacrylates), polystyrene/methyl methacrylate copolymers, polyetherimides, polysulfones, and/or combinations thereof. In some embodiments, thermoplastic polymers can include polypropylene, polyethylene, polyamides, polyvinyl alcohol, ethylene acrylic acid, polyolefin carboxylic acid copolymers, polyesters, and/or combinations thereof.

Biodegradable thermoplastic polymers also are contemplated for use herein.

A thermoplastic polymer component of a flexible material can be a single polymer species as described above or a blend of two or more thermoplastic polymers as described above.

Also as examples, flexible materials can further include one or more additives, as described herein and/or as known in the art. Non-limiting examples of classes of such additives include perfumes, dyes, pigments, nanoparticles, antistatic agents, fillers, photoactives, and other classes of additives known in the art, and combinations. The films disclosed herein can contain a single additive or a mixture of any number of additives.

Thermoplastic polymers, and their variations, as disclosed herein can be formed into a film and can comprise many different configurations, depending on the film properties desired. The properties of the film can be manipulated by varying, for example, the thickness, or in the case of multilayered films, the number of layers, the chemistry of the layers, i.e., hydrophobic or hydrophilic, and the types of polymers used to form the polymeric layers. The films disclosed herein can be multi-layer films. For multi-layer films, each respective layer can be made from any material disclosed herein or known in the art, in any manner disclosed herein or known in the art.

Furthermore, the films can comprise other additives, such as other polymers materials (e.g., a polypropylene, a polyethylene, a ethylene vinyl acetate, a polymethylpentene any combination thereof, or the like), a filler (e.g., glass, talc, calcium carbonate, or the like), a mold release agent, a flame retardant, an electrically conductive agent, an anti-static agent, a pigment, an antioxidant, an impact modifier, a stabilizer (e.g., a UV absorber), wetting agents, dyes, a film anti-static agent or any combination thereof. Film antistatic agents include cationic, anionic, and/or, nonionic agents. Cationic agents include ammonium, phosphonium and sulphonium cations, with alkyl group substitutions and an associated anion such as chloride, methosulphate, or nitrate. Anionic agents contemplated include alkylsulphonates. Nonionic agents include polyethylene glycols, organic stearates, organic amides, glycerol monostearate (GMS), alkyl di-ethanolamides, and ethoxylated amines. Other filler materials can comprise fibers, structural reinforcing agents, and all types of biosourced materials such as oils (hydrogenated soy bean oil), fats, starch, etc.

For any of the flexible materials, materials that are safe/approved for food contact may be selected. Additionally, materials that are approved for medical usage, or materials that can be sterilized through retort, autoclave, or radiation treatment, or other sterilization processes known in the art, may be used.

In various embodiments, part, parts, or all of a flexible material can be coated or uncoated, treated or untreated, processed or unprocessed, in any manner known in the art. In various embodiments, parts, parts, or about all, or approximately all, or substantially all, or nearly all, or all of a flexible material can made of sustainable, bio-sourced, recycled, recyclable, and/or biodegradable material. Part, parts, or about all, or approximately all, or substantially all, or nearly all, or all of any of the flexible materials described herein can be partially or completely translucent, partially or completely transparent, or partially or completely opaque.

With regard to films and elastomers for use as flexible materials, these can be formed in any manner known in the art, such as casting, extruding (blown or flat; singly or with coextrusion), calendering, depositing solution(s), skiving, etc. then slitting, cutting, and/or converting the films and/or elastomers into the desired sizes or shapes, as sheets or webs, as will be understood by one skilled in the art. With regard to blown films, multiple processes can be used including: collapsed bubble to create a blocked film, and double and or triple bubble processes. Flexible materials may further be subjected to any number or orienting, tenter frame, tenter hook, stretching, or activation processes. With regard to foamed sheets for use as flexible materials, these can be formed in any manner known in the art, by mixing base ingredients, adding the foaming mixture to a mold or shaping apparatus, then curing, cutting, and/or converting the foam into the desired sizes or shapes, as sheets or webs. With regard to nonwoven fabrics, these can be formed in any manner known in the art using spunbonded fibers and/or meltblown fibers, staple-length and/or continuous fibers, with any layering, mixing, or other combination known in the art. Other materials listed herein for use as flexible materials can be made in any manner known in the art.

The flexible materials used to make the containers disclosed herein can be formed in any manner known in the art, and can be joined together using any kind of joining or sealing method known in the art, including, for example, heat sealing (e.g. conductive sealing, impulse sealing, ultrasonic sealing, etc.), welding, crimping, bonding, adhering, and the like, and combinations of any of these.

In a line-up of flexible containers, according to any of the embodiments disclosed herein, both or all of the flexible containers in the line-up can be made from one or more flexible materials that are similar or the same, including any of the materials described herein or known in the art, in any suitable form.

As used herein, when referring to a flexible container, the term "flexibility factor" refers to a material parameter for a thin, easily deformable, sheet-like material, wherein the parameter is measured in Newtons per meter, and the flexibility factor is equal to the product of the value for the Young's modulus of the material (measured in Pascals) and the value for the overall thickness of the material (measured in meters).

As used herein, when referring to a flexible container, the term "fluent product" refers to one or more liquids and/or pourable solids, and combinations thereof. Examples of fluent products include one or more of any of the following: bites, bits, creams, chips, chunks, crumbs, crystals, emulsions, flakes, gels, grains, granules, jellies, kibbles, liquid solutions, liquid suspensions, lotions, nuggets, ointments, particles, particulates, pastes, pieces, pills, powders, salves, shreds, sprinkles, and the like, either individually or in any combination. Throughout the present disclosure the terms "fluent product" and "flowable product" are used interchangeably and are intended to have the same meaning. Any of the product spaces disclosed herein can be configured to include one or more of any fluent product disclosed herein, or known in the art, in any combination.

As used herein, when referring to a flexible container the term "folding pattern" refers to all of the folds that are applied to the one or more flexible materials used to make the flexible container, during the making of that flexible container; when applied to the one or more flexible materials, the folding pattern results in a folded configuration for that flexible container.

As used herein, when referring to a flexible container, the term "formed" refers to the state of one or more materials that are configured to be formed into a product space, after the product space is provided with its defined three-dimensional space.

As used herein, the term "graphic" refers to a visual element intended to provide a decoration or to communicate information. Examples of graphics include one or more of any of the following: colors, patterns, designs, images, and the like. For any of the embodiments of flexible containers, disclosed herein, in various embodiments, any surface of the flexible container can include one or more graphics of any size, shape, or configuration, disclosed herein or known in the art, in any combination.

As used herein, when referring to a flexible container, the terms "hang," "hangs," "hanging," "hang down," "hangs down," and "hanging down" refer to a particular orientation of a self-supporting flexible container that does not have a standing upright orientation, when the container is suspended from a support by a hanging feature that is provided with and/or attached to the flexible container. This hanging down orientation can be determined from the structural features of the container and/or indicia on the container. As an example, if a flexible container has a clearly defined structure that is configured to be used as a hanging feature for the container (e.g. a through-hole, a hook shape, or a hanging structure such as a chain or clip), then the container is hanging down when the container is suspended by this hanging feature while it is engaged with a rigid, cylindrical (having a diameter of 1 centimeter or less), horizontally oriented support, and not contacting anything else. If a hanging orientation cannot be determined from the structural features of the container and/or indicia on the container, then, the container is considered to not have a hanging orientation.

As used herein, the term "headspace" refers to the portion of a filled product space that is not occupied by a fluent product. For example, a headspace can exist above a fill line in a product space.

As used herein, when referring to a flexible container, the term "height area ratio" refers to a ratio for the container, with units of per centimeter ($cm^{-1}$), which is equal to the value for the overall height of the container divided by the value for the effective base contact area of the container.

For any of the embodiments of flexible containers, disclosed herein, in various embodiments, any of the flexible containers, can be configured to have a height area ratio from 0.3 to 3.0 per centimeter, or any value in increments of 0.05 $cm^{-1}$ between 0.3 and 3.0 per centimeter, or within any range formed by any of the preceding values, such as: from 0.35 to 2.0 $cm^{-1}$, from 0.4 to 1.5 $cm^{-1}$, from 0.4 to 1.2 $cm^{-1}$, or from 0.45 to 0.9 $cm^{-1}$, etc.

As used herein, the terms "indicium" and "indicia" refer to one or more of characters, graphics, branding, or other visual elements, in any combination. For any of the embodiments of flexible containers, disclosed herein, in various embodiments, any surface of the flexible container can include one or more indicia of any size, shape, or configuration, disclosed herein or known in the art, in any combination.

As used herein, the term "indirectly connected" refers to a configuration wherein elements are attached to each other with one or more intermediate elements therebetween.

As used herein, when referring to a flexible container with a structural support frame the term "internal expansion pressure" refers to the pressure within an expanded structural support volume, measured under ambient conditions and at atmospheric pressure.

As used herein, the term "joined" refers to a configuration wherein elements are either directly connected or indirectly connected.

As used herein, the term "lateral" refers to a direction, orientation, or measurement that is parallel to a lateral centerline of a container, when the container is standing upright or hanging down from a support, as described herein. A lateral orientation may also be referred to a "horizontal" orientation, and a lateral measurement may also be referred to as a "width."

As used herein, the term "like-numbered" refers to similar alphanumeric labels for corresponding elements, as described below. Like-numbered elements have labels with the same last two digits; for example, one element with a label ending in the digits 20 and another element with a label ending in the digits 20 are like-numbered Like-numbered elements can have labels with a differing first digit, wherein that first digit matches the number for its figure; as an example, an element of FIG. 3 labeled 320 and an element of FIG. 4 labeled 420 are like-numbered Like-numbered elements can have labels with a suffix (i.e. the portion of the label following the dash symbol) that is the same or possibly different (e.g. corresponding with a particular embodiment); for example, a first embodiment of an element in FIG. 3A labeled 320-*a* and a second embodiment of an element in FIG. 3B labeled 320-*b*, are like numbered.

As used herein, when referring to a line-up of flexible containers the term "line-up" refers to a group of two or more flexible containers, each having a particular configuration that is unique within the group, and each made by and/or offered by a single person, organization, or business entity. The line-up can include any number of flexible containers such as two, three, four, five, six, seven, eight, nine, or ten flexible containers. The uniqueness of the particular configurations may result from differences between the flexible containers and/or differences between the fluent products in the flexible containers. In various embodiments, the flexible containers in the line-up may or may not be filled with fluent product. If the flexible containers in the line-up are filled with fluent product, then the fluent product in one or more of the flexible containers may be the same as, similar to, or different from the fluent product in one, or some, or all of the other flexible containers in the line-up. As an example, in a line-up of flexible containers, two or more flexible containers may be filled with the same fluent product. As another example, in a line-up of flexible containers, two or more flexible containers may be filled with similar fluent products that have formulas with the same base composition, but differ in one or more of any of the following ways: having ingredients combined in different apportionments, having one or more different active ingredients, having one or more different additives, and/or having one or more distinguishing additives (e.g. colors, fragrances, flavors, etc.). As a further example, in a line-up of flexible containers, two or more flexible containers may be filled with fluent products of the same product type (e.g. two or more soaps, two or more shampoos, two or more beverages, etc.) wherein the fluent products may have different formulations. As yet another example, in a line-up of flexible containers, two or more flexible containers may be filled with different fluent products from the same product category (e.g. in the category of hair care, a shampoo and a conditioner; in the category of dish care, a detergent and a rinse aid; in the category of condiments, ketchup and mustard, etc.). In various embodiments of a line-up of flexible containers, one or more of the flexible containers may have graphics, branding, and/or indicia that are the same as, similar to, or different from the graphics, branding, and/or indicia on one, or some, or all of the other flexible containers in the line-up.

As used herein, the term "listed amount" refers to a particular amount of a fluent product that is being offered for sale with a container, as indicated on an external amount indicium for that container, when the container is configured for retail sale.

As used herein, the term "longitudinal" refers to a direction, orientation, or measurement that is parallel to a longitudinal centerline of a container, when the container is standing upright on a horizontal support surface or hanging down from a support, as described herein. A longitudinal orientation may also be referred to a "vertical" orientation. When expressed in relation to a horizontal support surface for a container, a longitudinal measurement may also be referred to as a "height", measured above the horizontal support surface.

As used herein, when referring to a flexible container, the term "middle" refers to the portion of the container that is located in between the top of the container and the bottom of the container. As used herein, the term middle can be modified by describing the term middle with reference to a particular percentage value for the top and/or a particular percentage value for the bottom. For any of the embodiments of flexible containers, disclosed herein, a reference to the middle of the container can, in various alternate embodiments, refer to the portion of the container that is located between any particular percentage value for the top, disclosed herein, and/or any particular percentage value for the bottom, disclosed herein, in any combination.

As used herein, the term "mixing volume" refers to a type chamber that is configured to receive one or more fluent product(s) from one or more product spaces and/or from the environment outside of the container.

As used herein, when referring to a product space, the term "multiple dose" refers to a chamber that is sized to contain a particular amount of product that is about equal to two or more units of typical consumption, application, or use by an end user. Any of the embodiments of flexible containers, disclosed herein, can be configured to have one or more multiple dose product spaces. A container with only one product space, which is a multiple dose product space, is referred to herein as a "multiple dose container."

As used herein, the term "nearly" modifies a particular value, by referring to a range equal to the particular value, plus or minus five percent (+/−5%). For any of the embodiments of flexible containers, disclosed herein, any disclosure of a particular value, can, in various alternate embodiments, also be understood as a disclosure of a range equal to approximately that particular value (i.e. +/−5%).

As used herein, when referring to a flexible container, the term "non-durable" refers to a container that is temporarily reusable, or disposable, or single use.

As used herein, when referring to a flexible container, the term "non-fluent product" refers to materials, products, and/or articles that are not liquids, pourable solids, or combinations or liquids and pourable solids. Any of the flexible containers disclosed herein can be configured for packaging one or more of any non-fluent product disclosed herein, or known in the art, in any combination. When used for non-fluent products, flexible containers, as disclosed herein, can provide benefits associated with partly or fully supporting and/or enclosing the non-fluent product with primary and/or secondary packaging that includes one or more structural support volumes, one or more structural support members, and/or one or more structural support frames; for example, so the non-fluent product can be supported and/or enclosed by packaging that is self-supporting and/or standing upright, as will be understood by one skilled in the art.

As used herein, when referring to a flexible container, the term "nonstructural panel" refers to a layer of one or more adjacent sheets of flexible material, the layer having an outermost major surface that faces outward, toward the environment outside of the flexible container, and an innermost major surface that faces inward, toward one or more product spaces disposed within the flexible container; a nonstructural panel is configured such that, the layer, does not independently provide substantial support in making the container self-supporting and/or standing upright.

As used herein, the term "overall external displacement" refers to a total volume of a flexible container that is configured for retail sale, when measured according to the following test method for displacement. The test method for displacement is used on one flexible container at a time. Before the testing begins, all secondary packaging is removed from the flexible container; however, the flexible container is neither opened nor unsealed before the testing. The test method for displacement is performed under ambient conditions and at atmospheric pressure. The flexible container is fully submerged in a rigid open container of distilled water that has a temperature of 19-21 degrees Celsius. While the flexible container is submerged, the size and shape of the flexible container must not be artificially distorted by any part of the testing equipment. Before the displacement is measured, any air pockets trapped beneath the flexible container must be removed; also any large bubbles (having diameter greater than 1 centimeter) in the water must be removed. When the displacement is measured, the flexible container is fully submerged, in a standing orientation on a bottom of the rigid open container, and submerged to a depth such that an uppermost portion of the flexible container is 1-5 centimeters beneath the surface of the water. The overall external displacement of the flexible container is measured by determining how much water is displaced by the flexible container when the flexible container is fully submerged, as described above.

As used herein, the term "open fill height" refers to a distance that is measured (as described below) for a container that was configured for retail sale, immediately after the product space is opened and (if applicable) unsealed for the first time, but before any of the fluent product in the product space has been mixed, dispensed, and/or used, and before anything has been added into any part of the container. The open fill height is measured while the container is standing upright on a horizontal support surface, and is measured vertically from the upper side of the support surface to a fill line in a product space of the container. If a container does not have a standing upright orientation but does have a hanging orientation, then the open fill height is measured while the container is hanging down from a support, and is measured vertically from the lowest point on the container to a fill line in a product space of the container.

Figure 22C:
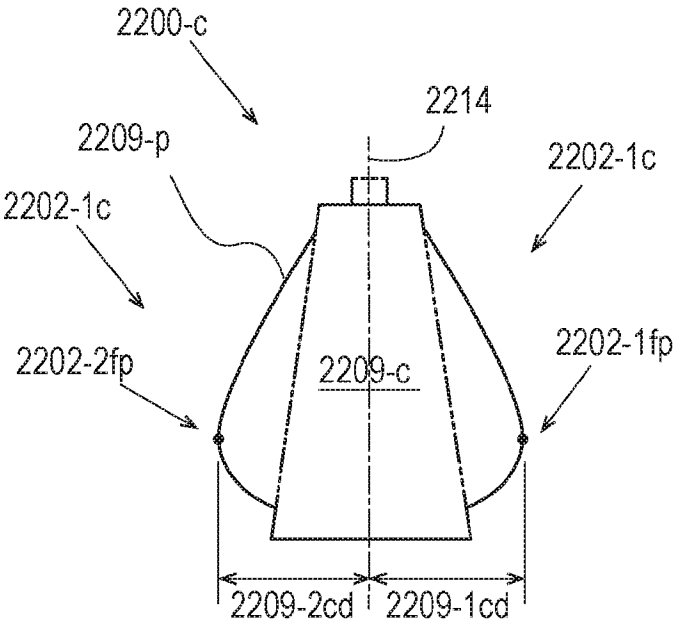
FIG. 22C illustrates an exemplary overall side profile and exemplary side profile central depth measurements.
Figure 22B:
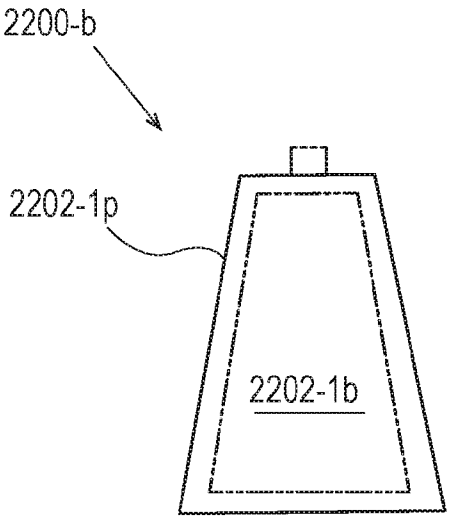
FIG. 22B illustrates an exemplary overall front profile.

As used herein, the term "overall front profile" refers to a full-scale size and shape of an outline of a flexible container (excluding any secondary packaging and any removable portions, such as a cap, which are removed from the container before the overall front profile is determined), when the container is configured for retail sale, wherein the overall front profile is determined when a front of the container is directly viewed straight-on toward the container's center, determined as described below. If the flexible container is a stand up container, then the overall front profile is determined while the container is standing up. If an overall front profile of a first container (that is not a stand up container) is being compared with an overall front profile of a second container (that is not a stand up container), then each overall front profile is determined with its container oriented in the same way. An exemplary overall side profile is illustrated in FIG. 22B.

As used herein, when referring to a flexible container, the term "overall height" refers to a distance that is measured (as described below) when the container is configured for retail sale; the overall height excludes any secondary packaging and any removable portions, such as a cap, which are removed from the container before the overall height is determined, as described below. If the flexible container is a stand up container, then the overall height is measured while the container is standing upright on a horizontal support surface, the distance measured vertically from the upper side of the support surface to a point on the top of the container, which is farthest away from the upper side of the support surface. If a container does not have a standing upright orientation but does have a hanging orientation, then the overall height is measured while the container is hanging down from a support, the distance measured vertically from the lowest point on the container to the highest point on the container. Any of the embodiments of flexible containers, disclosed herein, can be configured to have an overall height from 2.0 cm to 100.0 cm, or any value in increments of 0.1 cm between 2.0 and 100.0 cm, or within any range formed by any of the preceding values, such as: from 4.0 to 90.0 cm, from 5.0 to 80.0 cm, from 6.0 to 70.0 cm, from 7.0 to 60.0 cm, from 8.0 to 50.0 cm, from 9.0 to 40.0 cm, or from 10.0 to 30.0, etc.

As used herein, the term "overall set of printed external indicia" refers to all of the indicia on the one or more flexible materials of a flexible container that is configured for retail sale, wherein these indicia are visible from outside of the flexible container (with any secondary packaging and any removable portions, such as a cap, removed from the container), except that the overall set of printed external indicia excludes the following: any listed amount of any product(s) in the container, and any uniquely identifying indicia for manufacturer and/or retail use (such as a bar code, scan code, universal product code, stock-keeping-unit, etc.).

As used herein, the term "overall side profile" refers to a full-scale size and shape of an outline of a flexible container (excluding any secondary packaging and any removable portions, such as a cap, which are removed from the container before the overall side profile is determined), when the container is configured for retail sale, wherein the overall side profile is determined when a side of the container is directly viewed straight-on toward the container's center, determined as described below. If the flexible container is a stand up container, then the overall side profile is determined while the container is standing up. If an overall side profile of a first particular container (that is not a stand up container) is being compared with an overall side profile of a second particular container (that is not a stand up container), then each overall side profile is determined from the same side (left or right) with its container oriented in the same way. An exemplary overall side profile is illustrated in FIG. 22C.

As used herein, when referring to a sheet of flexible material, the term "overall thickness" refers to a linear dimension measured perpendicular to the outer major surfaces of the sheet, when the sheet is lying flat. For any of the embodiments of flexible containers, disclosed herein, in various embodiments, any of the flexible materials can be configured to have an overall thickness 5-500 micrometers (μm), or any integer value for micrometers from 5-500, or within any range formed by any of these values, such as 10-500 μm, 20-400 μm, 30-300 μm, 40-200 μm, 50-100 μm, or 50-150 μm, etc.

As used herein, the term "product space" refers to an enclosable three-dimensional space that is configured to receive and directly contain one or more fluent product(s), wherein that space is defined by one or more materials that form a barrier that prevents the fluent product(s) from escaping the product space. By directly containing the one or more fluent products, the fluent products come into contact with the materials that form the enclosable three-dimensional space; there is no intermediate material or container, which prevents such contact. Throughout the present disclosure the terms "product space," "product volume," and "product receiving volume" are used interchangeably and are intended to have the same meaning. Any of the embodiments of flexible containers, disclosed herein, can be configured to have any number of product spaces including one product space, two product spaces, three product spaces, four product spaces, five product spaces, six product spaces, or even more product spaces. In some embodiments, one or more product spaces can be enclosed within another product space. Any of the product spaces disclosed herein can have a product space of any size, including from 0.001 liters to 100.0 liters, or any value in increments of 0.001 liters between 0.001 liters and 3.0 liters, or any value in increments of 0.01 liters between 3.0 liters and 10.0 liters, or any value in increments of 1.0 liters between 10.0 liters and 100.0 liters, or within any range formed by any of the preceding values, such as: from 0.001 to 2.2 liters, 0.01 to 2.0 liters, 0.05 to 1.8 liters, 0.1 to 1.6 liters, 0.15 to 1.4 liters, 0.2 to 1.2 liters, 0.25 to 1.0 liters, etc. A product space can have any shape in any orientation. A product space can be included in a container that has a structural support frame, and a product space can be included in a container that does not have a structural support frame.

As used herein, the term "product viewing portion" refers to a portion of a flexible container, which is partially and/or fully transparent and/or translucent, such that, when a product space of the container contains distilled water, at least a portion of a fill line for the water can be seen through the product viewing portion, from outside of the flexible container, by an unaided human with normal vision.

As used herein, when referring to a flexible container, the term "resting on a horizontal support surface" refers to the container resting directly on the horizontal support surface, without other support.

As used herein, when referring to a flexible container for retail sale, the term "configured for retail sale" refers to a flexible container that is fully manufactured and its product space(s) is/are filled with fluent product(s) and the container is fully closed and/or sealed and the container is in condition to be purchased by an end user (e.g. a consumer), wherein the container has not been opened or unsealed, and wherein the fluent product(s) in the container have not been put into its/their intended end use.

As used herein, the term "sealed," when referring to a product space, refers to a state of the product space wherein fluent products within the product space are prevented from escaping the product space (e.g. by one or more materials that form a barrier, and by a seal), and the product space is hermetically sealed.

As used herein, the term "sealed closed," when referring to a product space, refers to a state of the product space that is both closed and sealed.

As used herein, the term "sealed closed fill height" refers to a closed fill height that is measured while the product space is sealed closed.

As used herein, the term "sealed closed headspace pressure" refers to a measured pressure of headspace in a product space that is sealed closed, As used herein, when referring to a flexible container the term "sealing pattern" refers to all of the seals that are applied to the one or more flexible materials used to make a flexible container, during the making of that flexible container; when applied to the one or more flexible materials, the sealing pattern results in a sealed configuration for that flexible container.

As used herein, when referring to a flexible container, the term "self-supporting" refers to a container that includes a product space and a structural support frame, wherein, when the container is resting on a horizontal support surface, in at least one orientation, the structural support frame is configured to prevent the container from collapsing and to give the container an overall height that is significantly greater than the combined thickness of the materials that form the container, even when the product space is unfilled. Any of the embodiments of flexible containers, disclosed herein, can be configured to be self-supporting. As examples, self-supporting flexible containers of the present disclosure can be used to form pillow packs, pouches, doy packs, sachets, tubes, boxes, tubs, cartons, flow wraps, gusseted packs, jugs, bottles, jars, bags in boxes, trays, hanging packs, blister packs, or any other forms known in the art.

As used herein, when referring to a flexible container, the term "single use" refers to a closed container which, after being opened by an end user, is not configured to be reclosed. Any of the embodiments of flexible containers, disclosed herein, can be configured to be single use.

As used herein, when referring to a product space, the term "single dose" refers to a product space that is sized to contain a particular amount of product that is about equal to one unit of typical consumption, application, or use by an end user. Any of the embodiments of flexible containers, disclosed herein, can be configured to have one or more single dose product spaces. A container with only one product space, which is a single dose product space, is referred to herein as a "single dose container."

As used herein, the term "squeeze panel" refers to a nonstructural panel that is under tension generated and maintained across the nonstructural panel by one or more structural support volumes, when expanded.

Figure 22A:
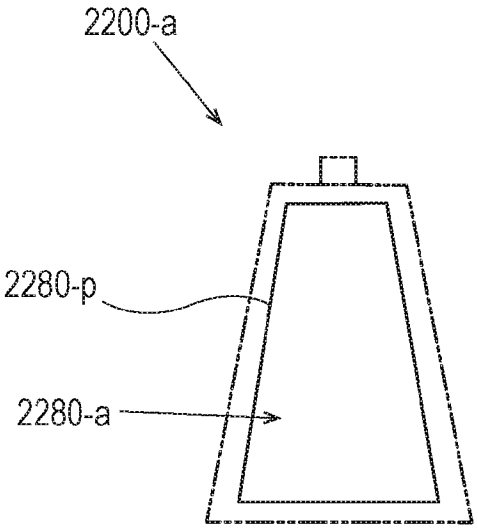
FIG. 22A illustrates an exemplary squeeze panel profile.

As used herein, the term "squeeze panel profile" refers to a full-scale size and shape of an outer extent of a squeeze panel of a flexible container, when the container is configured for retail sale, wherein the squeeze panel profile is determined when a front or a back of the container is directly viewed straight-on toward the container's center, determined as described below. If the flexible container is a stand up container, then the squeeze panel profile is determined while the container is standing up. If a squeeze panel profile of a first particular container (that is not a stand up container) is being compared with a squeeze panel profile of a second particular container (that is not a stand up container), then each squeeze panel profile is determined with its container oriented in the same way. An exemplary squeeze panel profile is illustrated in FIG. 22A.

As used herein, the term "side profile central depth measurement" refers to a dimension of a stand up flexible container, when the container is configured for retail sale, wherein the dimension is measured while the flexible container is standing up, and is measured linearly from a longitudinal centerline of the container, parallel to a third centerline of the container, to a farthest point on the squeeze panel profile of the container, in a front or a back of the container. A front side profile central depth measurement refers to a side profile central depth measurement measured to a portion of a squeeze panel profile in a front of the container. A back side profile central depth measurement refers to a side profile central depth measurement measured to a portion of a squeeze panel profile in a back of the container.

As used herein, when referring to a flexible container, the terms "stand up," "stands up," "standing up", "stand upright", "stands upright", and "standing upright" refer to a particular orientation of a self-supporting flexible container, when the container is resting on a horizontal support surface. This standing upright orientation can be determined from the structural features of the container and/or indicia on the container. In a first determining test, if the flexible container has a clearly defined base structure that is configured to be used on the bottom of the container, then the container is determined to be standing upright when this base structure is resting on the horizontal support surface. If the first test cannot determine the standing upright orientation, then, in a second determining test, the container is determined to be standing upright when the container is oriented to rest on the horizontal support surface such that the indicia on the flexible container are best positioned in an upright orientation. If the second test cannot determine the standing upright orientation, then, in a third determining test, the container is determined to be standing upright when the container is oriented to rest on the horizontal support surface such that the container has the largest overall height. If the third test cannot determine the standing upright orientation, then, in a fourth determining test, the container is determined to be standing upright when the container is oriented to rest on the horizontal support surface such that the container has the largest height area ratio. If the fourth test cannot determine the standing upright orientation, then, the container is considered to not have a standing upright orientation.

As used herein, when referring to a flexible container, the term "stand up container" refers to a self-supporting container, wherein, when the container (with all of its product space(s) filled with distilled water to 100% total capacity) is standing up, the container has a height area ratio from 0.4 to 1.5 $cm^{-1}$. Any of the embodiments of flexible containers, disclosed herein, can be configured to be stand up containers.

As used herein, when referring to a flexible container, the term "structural support frame" refers to a rigid structure formed of one or more structural support members, joined together, around one or more sizable empty spaces and/or one or more nonstructural panels, and generally used as a major support for the product space(s) in the flexible container and in making the container self-supporting and/or standing upright. In each of the embodiments disclosed herein, when a flexible container includes a structural support frame and one or more product spaces, the structural support frame is considered to be supporting the product spaces of the container, unless otherwise indicated.

As used herein, when referring to a flexible container, the term "structural support member" refers to a rigid, physical structure, which includes one or more expanded structural support volumes, and which is configured to be used in a structural support frame, to carry one or more loads (from the flexible container) across a span. A structure that does not include at least one expanded structural support volume, is not considered to be a structural support member, as used herein.

A structural support member has two defined ends, a middle between the two ends, and an overall length from its one end to its other end. A structural support member can have one or more cross-sectional areas, each of which has an overall width that is less than its overall length.

A structural support member can be configured in various forms. A structural support member can include one, two, three, four, five, six or more structural support volumes, arranged in various ways. For example, a structural support member can be formed by a single structural support volume. As another example, a structural support member can be formed by a plurality of structural support volumes, disposed end to end, in series, wherein, in various embodiments, part, parts, or about all, or approximately all, or substantially all, or nearly all, or all of some or all of the structural support volumes can be partly or fully in contact with each other, partly or fully directly connected to each other, and/or partly or fully joined to each other. As a further example, a structural support member can be formed by a plurality of support volumes disposed side by side, in parallel, wherein, in various embodiments, part, parts, or about all, or approximately all, or substantially all, or nearly all, or all of some or all of the structural support volumes can be partly or fully in contact with each other, partly or fully directly connected to each other, and/or partly or fully joined to each other.

In some embodiments, a structural support member can include a number of different kinds of elements. For example, a structural support member can include one or more structural support volumes along with one or more mechanical reinforcing elements (e.g. braces, collars, connectors, joints, ribs, etc.), which can be made from one or more rigid (e.g. solid) materials.

Structural support members can have various shapes and sizes. Part, parts, or about all, or approximately all, or substantially all, or nearly all, or all of a structural support member can be straight, curved, angled, segmented, or other shapes, or combinations of any of these shapes. Part, parts, or about all, or approximately all, or substantially all, or nearly all, or all of a structural support member can have any suitable cross-sectional shape, such as circular, oval, square, triangular, star-shaped, or modified versions of these shapes, or other shapes, or combinations of any of these shapes. A structural support member can have an overall shape that is tubular, or convex, or concave, along part, parts, or about all, or approximately all, or substantially all, or nearly all, or all of a length. A structural support member can have any suitable cross-sectional area, any suitable overall width, and any suitable overall length. A structural support member can be substantially uniform along part, parts, or about all, or approximately all, or substantially all, or nearly all, or all of its length, or can vary, in any way described herein, along part, parts, or about all, or approximately all, or substantially all, or nearly all, or all of its length. For example, a cross-sectional area of a structural support member can increase or decrease along part, parts, or all of its length. Part, parts, or all of any of the embodiments of structural support members of the present disclosure, can be configured according to any embodiment disclosed herein, including any workable combination of structures, features, materials, and/or connections from any number of any of the embodiments disclosed herein.

As used herein, when referring to a flexible container, the term "structural support volume" refers to a fillable space made from one or more flexible materials, wherein the space is configured to be at least partially filled with one or more expansion materials, which create tension in the one or more flexible materials, and form an expanded structural support volume. One or more expanded structural support volumes can be configured to be included in a structural support member. A structural support volume is distinct from structures configured in other ways, such as: structures without a fillable space (e.g. an open space), structures made from inflexible (e.g. solid) materials, structures with spaces that are not configured to be filled with an expansion material (e.g. an unattached area between adjacent layers in a multilayer panel), and structures with flexible materials that are not configured to be expanded by an expansion material (e.g. a space in a structure that is configured to be a non-structural panel). Notably, in various embodiments, any spaces defined by the unattached area between adjacent layers in a multilayer panel may contain any gas or vapor composition of single or multiple chemistries including air, nitrogen or a gas composition comprising, as examples, greater than 80% nitrogen, greater than 20% carbon dioxide, greater than 10% of a noble gas, less than 15% oxygen; the gas or vapor contained in such spaces may include water vapor at a relative humidity of 0-100%, or any integer percentage value in this range. Throughout the present disclosure the terms "structural support volume" and "expandable chamber" are used interchangeably and are intended to have the same meaning.

In some embodiments, a structural support frame can include a plurality of structural support volumes, wherein some of or all of the structural support volumes are in fluid communication with each other. In other embodiments, a structural support frame can include a plurality of structural support volumes, wherein some of or none of the structural support volumes are in fluid communication with each other. Any of the structural support frames of the present disclosure can be configured to have any kind of fluid communication disclosed herein.

As used herein, the term "substantially" modifies a particular value, by referring to a range equal to the particular value, plus or minus ten percent (+/−10%). For any of the embodiments of flexible containers, disclosed herein, any disclosure of a particular value, can, in various alternate embodiments, also be understood as a disclosure of a range equal to approximately that particular value (i.e. +/−10%).

As used herein, when referring to a flexible container, the term "temporarily reusable" refers to a container which, after dispensing a product to an end user, is configured to be refilled with an additional amount of a product, up to ten times, before the container experiences a failure that renders it unsuitable for receiving, containing, or dispensing the product. As used herein, the term temporarily reusable can be further limited by modifying the number of times that the container can be refilled before the container experiences such a failure. For any of the embodiments of flexible containers, disclosed herein, a reference to temporarily reusable can, in various alternate embodiments, refer to temporarily reusable by refilling up to eight times before failure, by refilling up to six times before failure, by refilling up to four times before failure, or by refilling up to two times before failure, or any integer value for refills between one and ten times before failure. Any of the embodiments of flexible containers, disclosed herein, can be configured to be temporarily reusable, for the number of refills disclosed herein.

As used herein, the term "thickness" refers to a measurement that is parallel to a third centerline of a container, when the container is standing upright or hanging down from a support, as described herein. A thickness may also be referred to as a "depth."

As used herein, when referring to a flexible container, the term "top" refers to the portion of the container that is located in the uppermost 20% of the overall height of the container, that is, from 80-100% of the overall height of the container. As used herein, the term top can be further limited by modifying the term top with a particular percentage value, which is less than 20%. For any of the embodiments of flexible containers, disclosed herein, a reference to the top of the container can, in various alternate embodiments, refer to the top 15% (i.e. from 85-100% of the overall height), the top 10% (i.e. from 90-100% of the overall height), or the top 5% (i.e. from 95-100% of the overall height), or any integer value for percentage between 0% and 20%.

As used herein, when referring to a product space of a flexible container, the term "total capacity" refers to a maximum amount of distilled water that the product space can hold (without overflowing) under ambient conditions and at atmospheric pressure (and without pressurized filling), when the container is standing upright. If a container does not have a standing upright orientation but does have a hanging orientation, then the term total capacity refers to a maximum amount of distilled water that the product space can hold (without overflowing) under ambient conditions and at atmospheric pressure (and without pressurized filling), while the container is hanging down from a support. The total capacity of a particular flexible container can be empirically determined using this definition. As used herein, the term total capacity can be modified by using the term filled with a particular percentage value.

As used herein, when referring to a flexible container, the term "unexpanded" refers to the state of one or more materials that are configured to be formed into a structural support volume, before the structural support volume is made rigid by an expansion material.

As used herein, when referring to a product space of a flexible container, the term "unfilled" refers to the state of the product space when it does not contain a fluent product.

As used herein, when referring to a flexible container, the term "unformed" refers to the state of one or more materials that are configured to be formed into a product space, before the product space is provided with its defined three-dimensional space. For example, an article of manufacture could be a container blank with an unformed product space, wherein sheets of flexible material, with portions joined together, are laying flat against each other.

As used herein, when referring to a product space of a flexible container, the term "vented" refers to a product space that is in fluid communication with the environment outside of the container such that the product space (e.g. a headspace within the product space) can equalize with the pressure of the environment.

Flexible containers, as described herein, may be used across a variety of industries for a variety of products. For example, any embodiment of flexible containers, as described herein, may be used across the consumer products industry, including any of the following products, any of which can take any workable fluent product form described herein or known in the art: baby care products (e.g. soaps, shampoos, and lotions); beauty care products for cleaning, treating, beautifying, and/or decorating human or animal hair (e.g. hair shampoos, hair conditioners, hair dyes, hair colorants, hair repair products, hair growth products, hair removal products, hair minimization products, etc.); beauty care products for cleaning, treating, beautifying, and/or decorating human or animal skin (e.g. soaps, body washes, body scrubs, facial cleansers, astringents, sunscreens, sun block lotions, lip balms, cosmetics, skin conditioners, cold creams, skin moisturizers, antiperspirants, deodorants, etc.); beauty care products for cleaning, treating, beautifying, and/or decorating human or animal nails (e.g. nail polishes, nail polish removers, etc.); grooming products for cleaning, treating, beautifying, and/or decorating human facial hair (e.g. shaving products, pre-shaving products, after shaving products, etc.); health care products for cleaning, treating, beautifying, and/or decorating human or animal oral cavities (e.g. toothpaste, mouthwash, breath freshening products, anti-plaque products, tooth whitening products, etc.); health care products for treating human and/or animal health conditions (e.g. medicines, medicaments, pharmaceuticals, vitamins, nutraceuticals, nutrient supplements (for calcium, fiber, etc.), cough treatment products, cold remedies, lozenges, treatments for respiratory and/or allergy conditions, pain relievers, sleep aids, gastrointestinal treatment products (for heartburn, upset stomach, diarrhea, irritable bowel syndrome, etc.), purified water, treated water, etc.); pet care products for feeding and/or caring for animals (e.g. pet food, pet vitamins, pet medicines, pet chews, pet treats, etc.); fabric care products for cleaning, conditioning, refreshing and/or treating fabrics, clothes and/or laundry (e.g. laundry detergents, fabric conditioners, fabric dyes, fabric bleaches, etc.); dish care products for home, commercial, and/or industrial use (e.g. dish soaps and rinse aids for hand-washing and/or machine washing); cleaning and/or deodorizing products for home, commercial, and/or industrial use (e.g. soft surface cleaners, hard surface cleaners, glass cleaners, ceramic tile cleaners, carpet cleaner, wood cleaners, multi-surface cleaners, surface disinfectants, kitchen cleaners, bath cleaners (e.g. sink, toilet, tub, and/or shower cleaners), appliance cleaning products, appliance treatment products, car cleaning products, car deodorizing products, air cleaners, air deodorizers, air disinfectants, etc.), and the like.

As further examples, any embodiment of flexible containers, as described herein, may be used across additional areas of home, commercial, and/or industrial, building and/or grounds, construction and/or maintenance, including any of the following products, any of which can take any workable fluent product form (e.g. liquid, granular, powdered, etc.) described herein or known in the art: products for establishing, maintaining, modifying, treating, and/or improving lawns, gardens, and/or grounds (e.g. grass seeds, vegetable seeds, plant seeds, birdseed, other kinds of seeds, plant food, fertilizer, soil nutrients and/or soil conditions (e.g. nitrogen, phosphate, potash, lime, etc.), soil sterilants, herbicides, weed preventers, pesticides, pest repellents, insecticides, insect repellents, etc.); products for landscaping use (e.g. topsoils, potting soils, general use soils, mulches, wood chips, tree bark nuggets, sands, natural stones and/or rocks (e.g. decorative stones, pea gravel, gravel, etc.) of all kinds, man-made compositions based on stones and rocks (e.g. paver bases, etc.)); products for starting and/or fueling fires in grills, fire pits, fireplaces, etc. (e.g. fire logs, fire starting nuggets, charcoal, lighter fluid, matches, etc.); lighting products (e.g. light bulbs and light tubes or all kinds including: incandescents, compact fluorescents, fluorescents, halogens, light emitting diodes, of all sizes, shapes, and uses); chemical products for construction, maintenance, remodeling, and/or decorating (e.g. concretes, cements, mortars, mix colorants, concrete curers/sealants, concrete protectants, grouts, blacktop sealants, crack filler/repair products, spackles, joint compounds, primers, paints, stains, topcoats, sealants, caulks, adhesives, epoxies, drain cleaning/declogging products, septic treatment products, etc.); chemical products (e.g. thinners, solvents, and strippers/removers including alcohols, mineral spirits, turpentines, linseed oils, etc.); water treatment products (e.g. water softening products such as salts, bacteriostats, fungicides, etc.); fasteners of all kinds (e.g. screws, bolts, nuts, washers, nails, staples, tacks, hangers, pins, pegs, rivets, clips, rings, and the like, for use with/in/on wood, metal, plastic, concrete, concrete, etc.); and the like.

As further examples, any embodiment of flexible containers, as described herein, may be used across the food and beverage industry, including any of the following products, any of which can take any workable fluent product form described herein or known in the art: foods such as basic ingredients (e.g. grains such as rice, wheat, corn, beans, and derivative ingredients made from any of these, as well as nuts, seeds, and legumes, etc.), cooking ingredients (e.g. sugar, spices such as salt and pepper, cooking oils, vinegars, tomato pastes, natural and artificial sweeteners, flavorings, seasonings, etc.), baking ingredients (e.g. baking powders, starches, shortenings, syrups, food colorings, fillings, gelatins, chocolate chips and other kinds of chips, frostings, sprinkles, toppings, etc.), dairy foods (e.g. creams, yogurts, sour creams, wheys, caseins, etc.), spreads (e.g. jams, jellies, etc.), sauces (e.g. barbecue sauces, salad dressings, tomato sauces, etc.), condiments (e.g. ketchups, mustards, relishes, mayonnaises, etc.), processed foods (noodles and pastas, dry cereals, cereal mixes, premade mixes, snack chips and snacks and snack mixes of all kinds, pretzels, crackers, cookies, candies, chocolates of all kinds, marshmallows, puddings, etc.); beverages such as water, milks, juices, flavored and/or carbonated beverages (e.g. soda), sports drinks, coffees, teas, spirits, alcoholic beverages (e.g. beer, wine, etc.), etc.; and ingredients for making or mixing into beverages (e.g. coffee beans, ground coffees, cocoas, tea leaves, dehydrated beverages, powders for making beverages, natural and artificial sweeteners, flavorings, etc.). Further, prepared foods, fruits, vegetables, soups, meats, pastas, microwavable and or frozen foods as well as produce, eggs, milk, and other fresh foods. Any of the embodiments of flexible containers disclosed herein can also be sterilized (e.g. by treatment with ultraviolet light or peroxide-based compositions), to make the containers safe for use in storing food and/or beverage. In any embodiment, the containers can be configured to be suitable for retort processes.

As still further examples, any embodiment of flexible containers, as described herein, may be used across the medical industry, in the areas of medicines, medical devices, and medical treatment, including uses for receiving, containing, storing and/or dispensing, any of the following fluent products, in any form known in the art: bodily fluids from humans and/or animals (e.g. amniotic fluid, aqueous humour, vitreous humour, bile, blood, blood plasma, blood serum, breast milk, cerebrospinal fluid, cerumen (earwax), chyle, chime, endolymph (and perilymph), ejaculate, runny feces, gastric acid, gastric juice, lymph, mucus (including nasal drainage and phlegm), pericardial fluid, peritoneal fluid, pleural fluid, pus, rheum, saliva, sebum (skin oil), semen, sputum, synovial fluid, tears, sweat, vaginal secretion, vomit, urine, etc.); fluids for intravenous therapy to human or animal bodies (e.g. volume expanders (e.g. crystalloids and colloids), blood-based products including blood substitutes, buffer solutions, liquid-based medications (which can include pharmaceuticals), parenteral nutritional formulas (e.g. for intravenous feeding, wherein such formulas can include salts, glucose, amino acids, lipids, supplements, nutrients, and/or vitamins); other medicinal fluids for administering to human or animal bodies (e.g. medicines, medicaments, nutrients, nutraceuticals, pharmaceuticals, etc.) by any suitable method of administration (e.g. orally (in solid, liquid, or pill form), topically, intranasally, by inhalation, or rectally. Any of the embodiments of flexible containers disclosed herein can also be sterilized (e.g. by treatment with ultraviolet light or peroxide-based compositions or through an autoclave or retort process), to make the containers safe for use in sterile medical environments.

As even further examples, any embodiment of flexible containers, as described herein, may be used across any and all industries that use internal combustion engines (such as the transportation industry, the power equipment industry, the power generation industry, etc.), including products for vehicles such as cars, trucks, automobiles, boats, aircraft, etc., with such containers useful for receiving, containing, storing, and/or dispensing, any of the following fluent products, in any form known in the art: engine oil, engine oil additives, fuel additives, brake fluids, transmission fluids, engine coolants, power steering fluids, windshield wiper fluids, products for vehicle care (e.g. for body, tires, wheels, windows, trims, upholsteries, etc.), as well as other fluids configured to clean, penetrate, degrease, lubricate, and/or protect one or more parts of any and all kinds of engines, power equipment, and/or transportation vehicles.

Any embodiment of flexible containers, as described herein, can also be used for receiving, containing, storing, and/or dispensing, non-fluent products, in any of the following categories: Baby Care products, including disposable wearable absorbent articles, diapers, training pants, infant and toddler care wipes, etc. and the like; Beauty Care products including applicators for applying compositions to human or animal hair, skin, and/or nails, etc. and the like; Home Care products including wipes and scrubbers for all kinds of cleaning applications and the like; Family Care products including wet or dry bath tissue, facial tissue, disposable handkerchiefs, disposable towels, wipes, etc. and the like; Feminine Care products including catamenial pads, incontinence pads, interlabial pads, panty liners, pessaries, sanitary napkins, tampons, tampon applicators, wipes, etc. and the like; Health Care products including oral care products such as oral cleaning devices, dental floss, flossing devices, toothbrushes, etc. and the like; Pet Care products including grooming aids, pet training aids, pet devices, pet toys, etc. and the like; Portable Power products including electrochemical cells, batteries, battery current interrupters, battery testers, battery chargers, battery charge monitoring equipment, battery charge/discharge rate controlling equipment, "smart" battery electronics, flashlights, etc. and the like; Small Appliance Products including hair removal appliances (including, e.g. electric foil shavers for men and women, charging and/or cleaning stations, electric hair trimmers, electric beard trimmers, electric epilator devices, cleaning fluid cartridges, shaving conditioner cartridges, shaving foils, and cutter blocks); oral care appliances (including, e.g., electric toothbrushes with accumulator or battery, refill brushheads, interdental cleaners, tongue cleaners, charging stations, electric oral irrigators, and irrigator clip on jets); small electric household appliances (including, e.g., coffee makers, water kettles, handblenders, handmixers, food processors, steam cookers, juicers, citrus presses, toasters, coffee or meat grinders, vacuum pumps, irons, steam pressure stations for irons and in general non electric attachments therefore, hair care appliances (including, e.g., electric hair driers, hairstylers, hair curlers, hair straighteners, cordless gas heated styler/irons and gas cartridges therefore, and air filter attachments); personal diagnostic appliances (including, e.g., blood pressure monitors, ear thermometers, and lensfilters therefore); clock appliances and watch appliances (including, e.g., alarm clocks, travel alarm clocks combined with radios, wall clocks, wristwatches, and pocket calculators), etc. and the like.

Figure 1A:
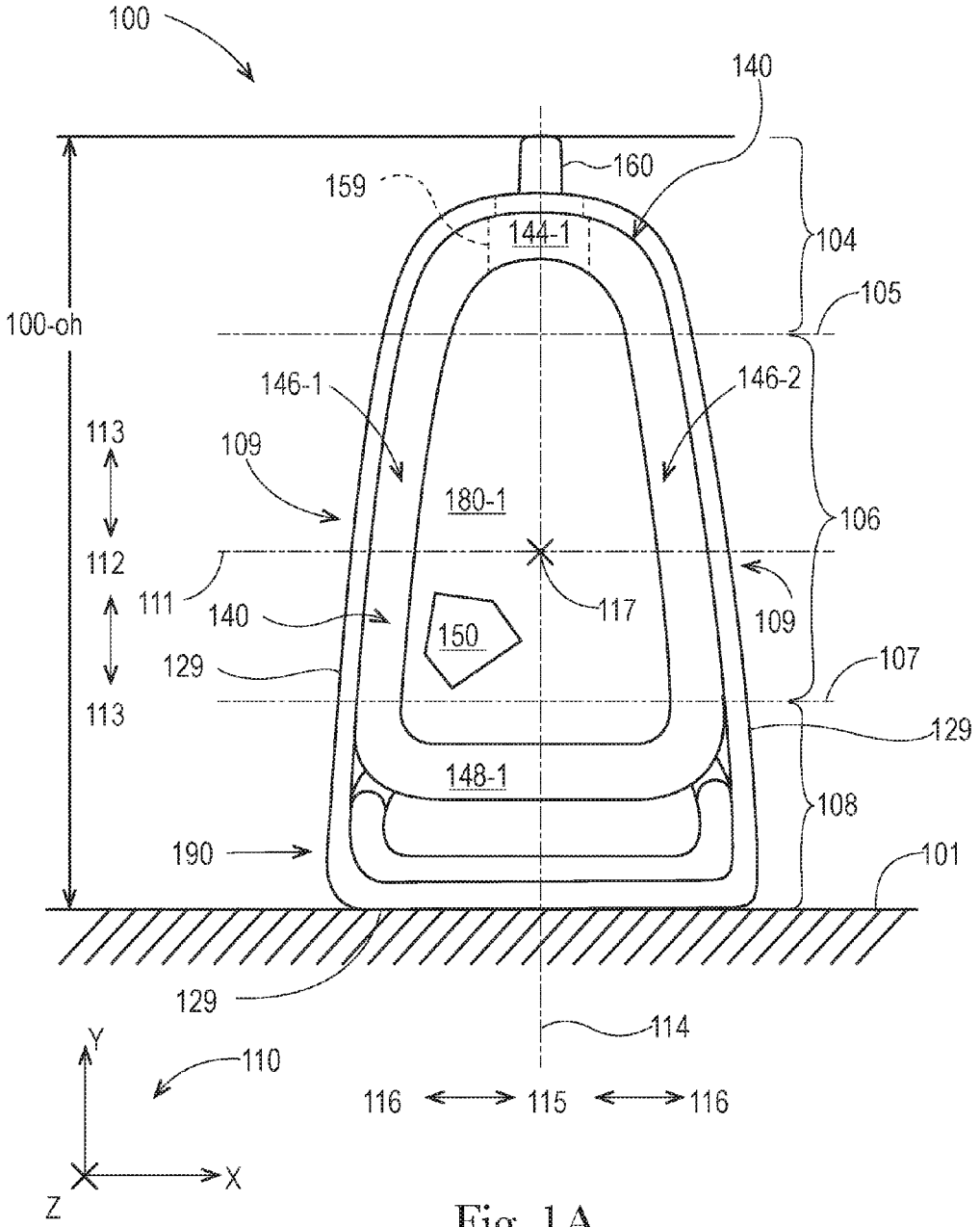
FIG. 1A illustrates a front view of an embodiment of a stand up flexible container.

FIGS. 1A-1D illustrates various views of an embodiment of a stand up flexible container 100. FIG. 1A illustrates a front view of the container 100. The container 100 is standing upright on a horizontal support surface 101.

In FIG. 1A, a coordinate system 110, provides lines of reference for referring to directions in the figure. The coordinate system 110 is a three-dimensional Cartesian coordinate system with an X-axis, a Y-axis, and a Z-axis, wherein each axis is perpendicular to the other axes, and any two of the axes define a plane. The X-axis and the Z-axis are parallel with the horizontal support surface 101 and the Y-axis is perpendicular to the horizontal support surface 101.

FIG. 1A also includes other lines of reference, for referring to directions and locations with respect to the container 100. A lateral centerline 111 runs parallel to the X-axis. An XY plane at the lateral centerline 111 separates the container 100 into a front half and a back half. An XZ plane at the lateral centerline 111 separates the container 100 into an upper half and a lower half. A longitudinal centerline 114 runs parallel to the Y-axis. A YZ plane at the longitudinal centerline 114 separates the container 100 into a left half and a right half. A third centerline 117 runs parallel to the Z-axis. The lateral centerline 111, the longitudinal centerline 114, and the third centerline 117 all intersect at a center of the container 100.

A disposition with respect to the lateral centerline 111 defines what is longitudinally inboard 112 and longitudinally outboard 113. When a first location is nearer to the lateral centerline 111 than a second location, the first location is considered to be disposed longitudinally inboard 112 to the second location. And, the second location is considered to be disposed longitudinally outboard 113 from the first location. The term lateral refers to a direction, orientation, or measurement that is parallel to the lateral centerline 111. A lateral orientation may also be referred to a horizontal orientation, and a lateral measurement may also be referred to as a width.

A disposition with respect to the longitudinal centerline 114 defines what is laterally inboard 115 and laterally outboard 116. When a first location is nearer to the longitudinal centerline 114 than a second location, the first location is considered to be disposed laterally inboard 115 to the second location. And, the second location is considered to be disposed laterally outboard 116 from the first location. The term longitudinal refers to a direction, orientation, or measurement that is parallel to the longitudinal centerline 114. A longitudinal orientation may also be referred to a vertical orientation.

A longitudinal direction, orientation, or measurement may also be expressed in relation to a horizontal support surface for the container 100. When a first location is nearer to the support surface than a second location, the first location can be considered to be disposed lower than, below, beneath, or under the second location. And, the second location can be considered to be disposed higher than, above, or upward from the first location. A longitudinal measurement may also be referred to as a height, measured above the horizontal support surface 101.

A measurement that is made parallel to the third centerline 117 is referred to a thickness or depth. A disposition in the direction of the third centerline 117 and toward a front 102-1 of the container is referred to as forward 118 or in front of. A disposition in the direction of the third centerline 117 and toward a back 102-2 of the container is referred to as backward 119 or behind.

These terms for direction, orientation, measurement, and disposition, as described above, are used for all of the embodiments of the present disclosure, whether or not a support surface, reference line, or coordinate system is illustrated in a figure.

The container 100 includes a top 104, a middle 106, and a bottom 108, the front 102-1, the back 102-2, and left and right sides 109. The top 104 is separated from the middle 106 by a reference plane 105, which is parallel to the XZ plane. The middle 106 is separated from the bottom 108 by a reference plane 107, which is also parallel to the XZ plane. The container 100 has an overall height of 100-oh. In the embodiment of FIG. 1A, the front 102-1 and the back 102-2 of the container are joined together at a seal 129, which extends around the outer periphery of the container 100, across the top 104, down the side 109, and then, at the bottom of each side 109, splits outward to follow the front and back portions of the base 190, around their outer extents.

The container 100 includes a structural support frame 140, a product space 150, a dispenser 160, panels 180-1 and 180-2, and a base structure 190. A portion of panel 180-1 is illustrated as broken away, in order to illustrate the product space 150. The product space 150 is configured to contain one or more fluent products. The dispenser 160 allows the container 100 to dispense these fluent product(s) from the product space 150 through a flow channel 158 then through the dispenser 160, to the environment outside of the container 100. In the embodiment of FIGS. 1A-1D, the dispenser 160 is disposed in the center of the uppermost part of the top 104, however, in various alternate embodiments, the dispenser 160 can be disposed anywhere else on the top 140, middle 106, or bottom 108, including anywhere on either of the sides 109, on either of the panels 180-1 and 180-2, and on any part of the base 190 of the container 100. The structural support frame 140 supports the mass of fluent product(s) in the product space 150, and makes the container 100 stand upright. The panels 180-1 and 180-2 are relatively flat surfaces, overlaying the product space 150, and are suitable for displaying any kind of indicia. However, in various embodiments, part, parts, or about all, or approximately all, or substantially all, or nearly all, or all of either or both of the panels 180-1 and 180-2 can include one or more curved surfaces. The base structure 190 supports the structural support frame 140 and provides stability to the container 100 as it stands upright.

The structural support frame 140 is formed by a plurality of structural support members. The structural support frame 140 includes top structural support members 144-1 and 144-2, middle structural support members 146-1, 146-2, 146-3, and 146-4, as well as bottom structural support members 148-1 and 148-2.

The top structural support members 144-1 and 144-2 are disposed on the upper part of the top 104 of the container 100, with the top structural support member 144-1 disposed in the front 102-1 and the top structural support member 144-2 disposed in the back 102-2, behind the top structural support member 144-1. The top structural support members

144-1 and 144-2 are adjacent to each other and can be in contact with each other along the laterally outboard portions of their lengths. In various embodiments, the top structural support members 144-1 and 144-2 can be in contact with each other at one or more relatively smaller locations and/or at one or more relatively larger locations, along part, or parts, or about all, or approximately all, or substantially all, or nearly all, or all of their overall lengths, so long as there is a flow channel 158 between the top structural support members 144-1 and 144-2, which allows the container 100 to dispense fluent product(s) from the product space 150 through the flow channel 158 then through the dispenser 160. The top structural support members 144-1 and 144-2 are not directly connected to each other. However, in various alternate embodiments, the top structural support members 144-1 and 144-2 can be directly connected and/or joined together along part, or parts, or about all, or approximately all, or substantially all, or nearly all, or all of their overall lengths.

The top structural support members 144-1 and 144-2 are disposed substantially above the product space 150. Overall, each of the top structural support members 144-1 and 144-2 is oriented about horizontally, but with its ends curved slightly downward. And, overall each of the top structural support members 144-1 and 144-2 has a cross-sectional area that is substantially uniform along its length; however the cross-sectional area at their ends are slightly larger than the cross-sectional area in their middles.

The middle structural support members 146-1, 146-2, 146-3, and 146-4 are disposed on the left and right sides 109, from the top 104, through the middle 106, to the bottom 108. The middle structural support member 146-1 is disposed in the front 102-1, on the left side 109; the middle structural support member 146-4 is disposed in the back 102-2, on the left side 109, behind the middle structural support member 146-1. The middle structural support members 146-1 and 146-4 are adjacent to each other and can be in contact with each other along substantially all of their lengths. In various embodiments, the middle structural support members 146-1 and 146-4 can be in contact with each other at one or more relatively smaller locations and/or at one or more relatively larger locations, along part, or parts, or about all, or approximately all, or substantially all, or nearly all, or all of their overall lengths. The middle structural support members 146-1 and 146-4 are not directly connected to each other. However, in various alternate embodiments, the middle structural support members 146-1 and 146-4 can be directly connected and/or joined together along part, or parts, or about all, or approximately all, or substantially all, or nearly all, or all of their overall lengths.

The middle structural support member 146-2 is disposed in the front 102-1, on the right side 109; the middle structural support member 146-3 is disposed in the back 102-2, on the right side 109, behind the middle structural support member 146-2. The middle structural support members 146-2 and 146-3 are adjacent to each other and can be in contact with each other along substantially all of their lengths. In various embodiments, the middle structural support members 146-2 and 146-3 can be in contact with each other at one or more relatively smaller locations and/or at one or more relatively larger locations, along part, or parts, or about all, or approximately all, or substantially all, or nearly all, or all of their overall lengths. The middle structural support members 146-2 and 146-3 are not directly connected to each other. However, in various alternate embodiments, the middle structural support members 146-2 and 146-3 can be directly connected and/or joined together along part, or parts, or about all, or approximately all, or substantially all, or nearly all, or all of their overall lengths.

The middle structural support members 146-1, 146-2, 146-3, and 146-4 are disposed substantially laterally outboard from the product space 150. Overall, each of the middle structural support members 146-1, 146-2, 146-3, and 146-4 is oriented about vertically, but angled slightly, with its upper end laterally inboard to its lower end. And, overall each of the middle structural support members 146-1, 146-2, 146-3, and 146-4 has a cross-sectional area that changes along its length, increasing in size from its upper end to its lower end.

The bottom structural support members 148-1 and 148-2 are disposed on the bottom 108 of the container 100, with the bottom structural support member 148-1 disposed in the front 102-1 and the bottom structural support member 148-2 disposed in the back 102-2, behind the top structural support member 148-1. The bottom structural support members 148-1 and 148-2 are adjacent to each other and can be in contact with each other along substantially all of their lengths. In various embodiments, the bottom structural support members 148-1 and 148-2 can be in contact with each other at one or more relatively smaller locations and/or at one or more relatively larger locations, along part, or parts, or about all, or approximately all, or substantially all, or nearly all, or all of their overall lengths. The bottom structural support members 148-1 and 148-2 are not directly connected to each other. However, in various alternate embodiments, the bottom structural support members 148-1 and 148-2 can be directly connected and/or joined together along part, or parts, or about all, or approximately all, or substantially all, or nearly all, or all of their overall lengths.

The bottom structural support members 148-1 and 148-2 are disposed substantially below the product space 150, but substantially above the base structure 190. Overall, each of the bottom structural support members 148-1 and 148-2 is oriented about horizontally, but with its ends curved slightly upward. And, overall each of the bottom structural support members 148-1 and 148-2 has a cross-sectional area that is substantially uniform along its length.

In the front portion of the structural support frame 140, the left end of the top structural support member 144-1 is joined to the upper end of the middle structural support member 146-1; the lower end of the middle structural support member 146-1 is joined to the left end of the bottom structural support member 148-1; the right end of the bottom structural support member 148-1 is joined to the lower end of the middle structural support member 146-2; and the upper end of the middle structural support member 146-2 is joined to the right end of the top structural support member 144-1. Similarly, in the back portion of the structural support frame 140, the left end of the top structural support member 144-2 is joined to the upper end of the middle structural support member 146-4; the lower end of the middle structural support member 146-4 is joined to the left end of the bottom structural support member 148-2; the right end of the bottom structural support member 148-2 is joined to the lower end of the middle structural support member 146-3; and the upper end of the middle structural support member 146-3 is joined to the right end of the top structural support member 144-2. In the structural support frame 140, the ends of the structural support members, which are joined together, are directly connected, all around the periphery of their walls. However, in various alternative embodiments, any of the structural support members 144-1, 144-2, 146-1, 146-2, 146-3, 146-4, 148-1, and 148-2 can be joined together in any way described herein or known in the art.

In alternative embodiments of the structural support frame 140, adjacent structural support members can be combined into a single structural support member, wherein the combined structural support member can effectively substitute for the adjacent structural support members, as their functions and connections are described herein. In other alternative embodiments of the structural support frame 140, one or more additional structural support members can be added to the structural support members in the structural support frame 140, wherein the expanded structural support frame can effectively substitute for the structural support frame 140, as its functions and connections are described herein. Also, in some alternative embodiments, a flexible container may not include a base structure.

Figure 1B:
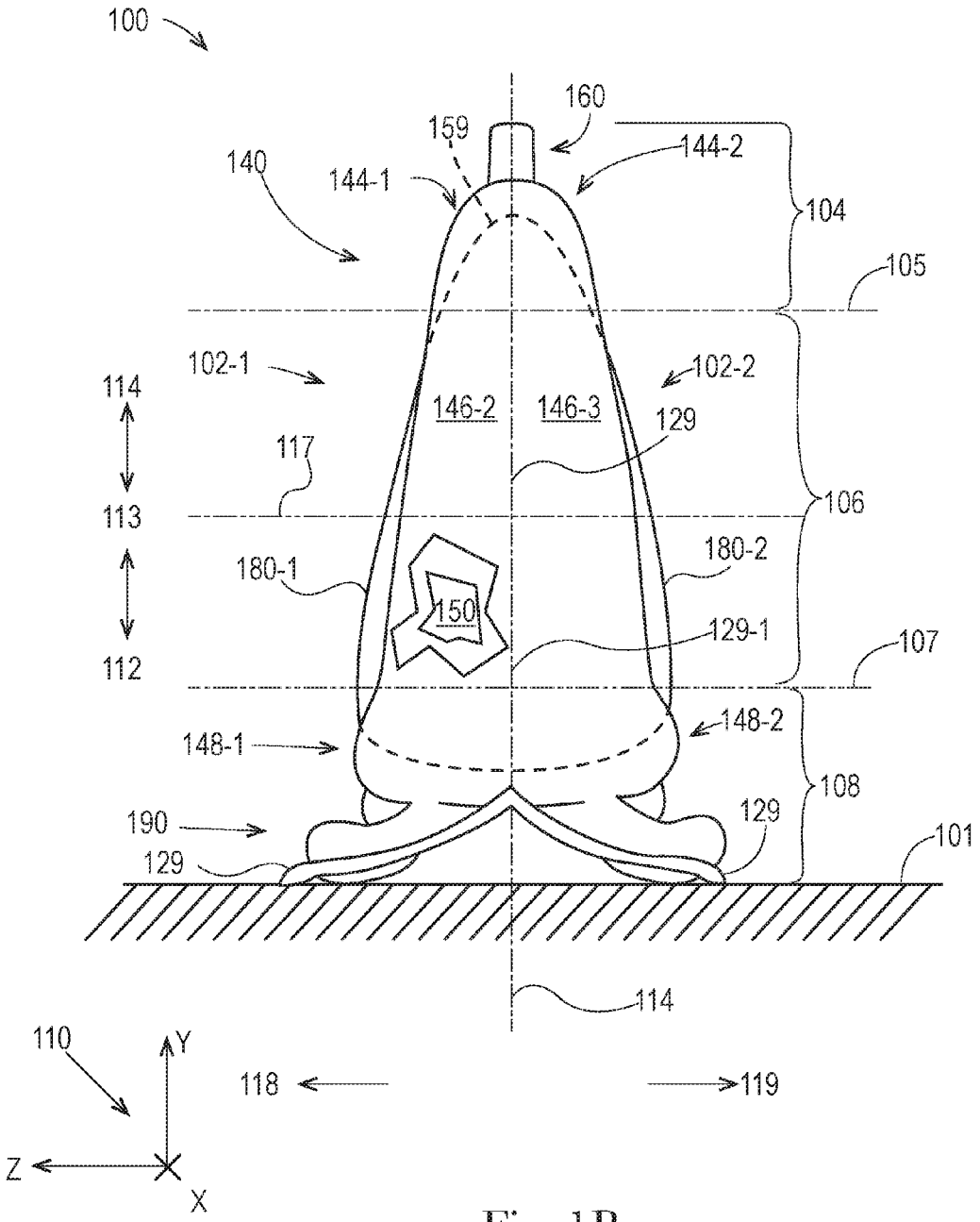
FIG. 1B illustrates a side view of the stand up flexible container of FIG. 1A.

FIG. 1B illustrates a side view of the stand up flexible container 100 of FIG. 1A.

Figure 1C:
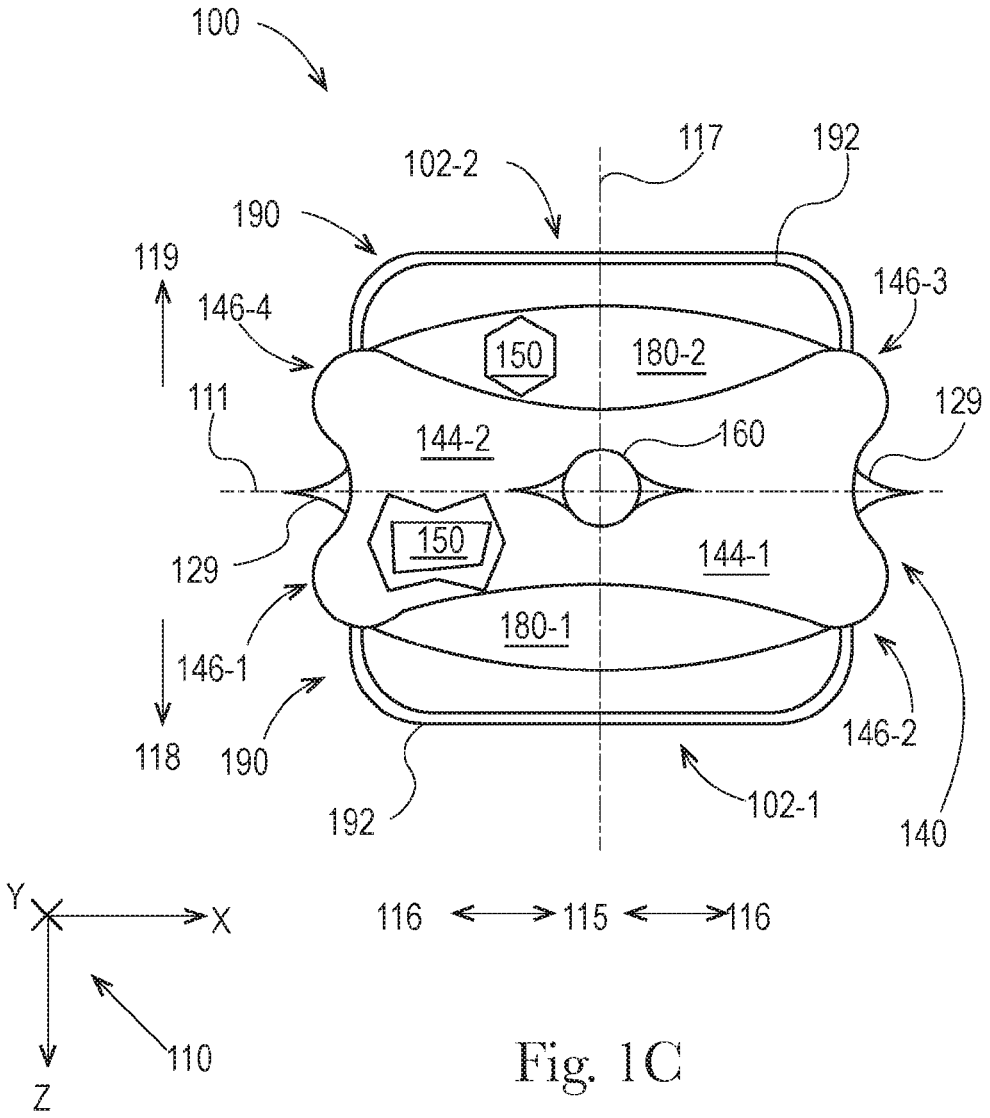
FIG. 1C illustrates a top view of the stand up flexible container of FIG. 1A.

FIG. 1C illustrates a top view of the stand up flexible container 100 of FIG. 1A.

Figure 1D:
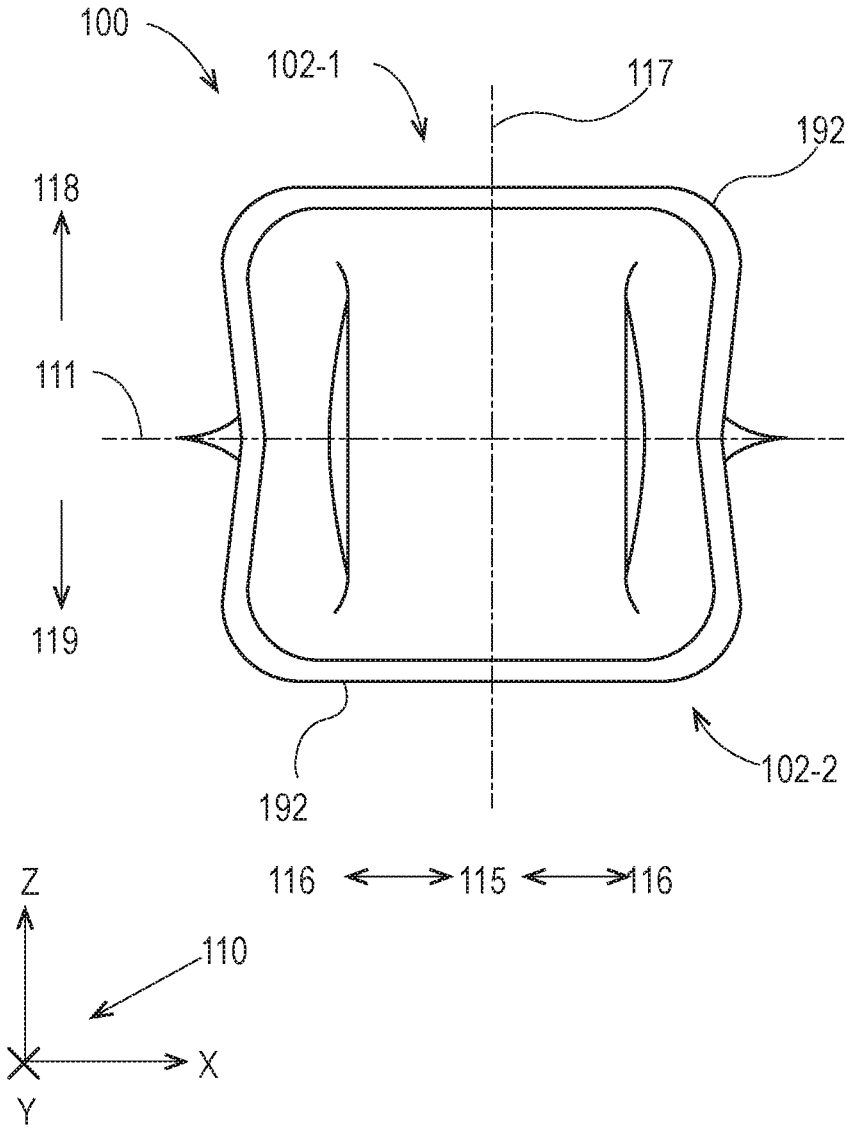
FIG. 1D illustrates a bottom view of the stand up flexible container of FIG. 1A.

FIG. 1D illustrates a bottom view of the stand up flexible container 100 of FIG. 1A.

Figure 1G:
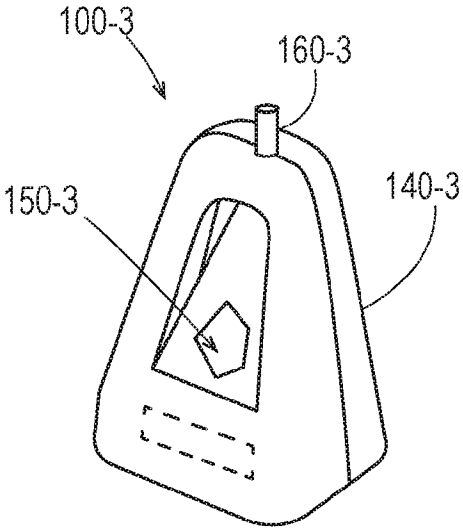
FIG. 1G illustrates a perspective view of an alternative embodiment of the stand up flexible container of FIG. 1A, including an external structural support frame.
Figure 1F:
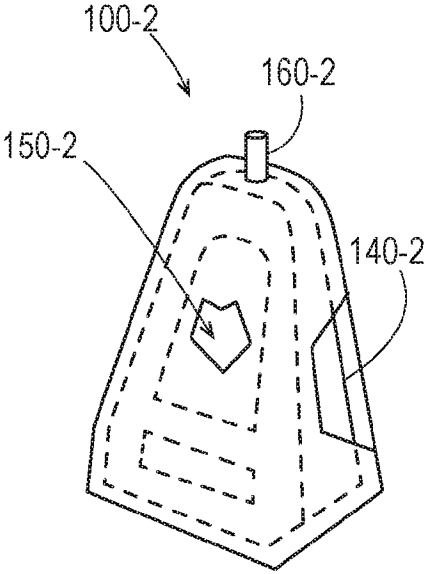
FIG. 1F illustrates a perspective view of an alternative embodiment of the stand up flexible container of FIG. 1A, including an internal structural support frame.
Figure 1E:
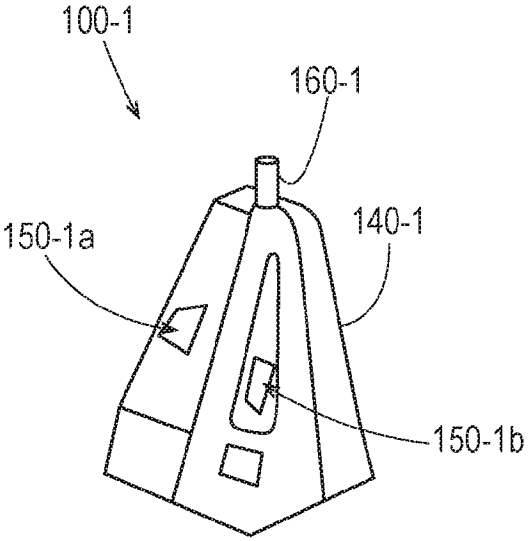
FIG. 1E illustrates a perspective view of an alternative embodiment of the stand up flexible container of FIG. 1A, including an asymmetric structural support frame.

FIG. 1E illustrates a perspective view of a container 100-1, which is an alternative embodiment of the stand up flexible container 100 of FIG. 1A, including an asymmetric structural support frame 140-1, a first portion of the product space 150-1*b*, a second portion of the product space 150-1*a*, and a dispenser 160-1. The embodiment of FIG. 1E is similar to the embodiment of FIG. 1A with like-numbered terms configured in the same way, except that the frame 140-1 extends around about half of the container 100-1, directly supporting a first portion of the product space 150-1*b*, which is disposed inside of the frame 140-1, and indirectly supporting a second portion of the product space 150-1*a*, which is disposed outside of the frame 140-1. In various embodiments, any stand-up flexible container of the present disclosure can be modified in a similar way, such that: the frame extends around only part or parts of the container, and/or the frame is asymmetric with respect to one or more centerlines of the container, and/or part or parts of one or more product spaces of the container are disposed outside of the frame, and/or part or parts of one or more product spaces of the container are indirectly supported by the frame.

FIG. 1F illustrates a perspective view of a container 100-2, which is an alternative embodiment of the stand up flexible container 100 of FIG. 1A, including an internal structural support frame 140-2, a product space 150-2, and a dispenser 160-2. The embodiment of FIG. 1F is similar to the embodiment of FIG. 1A with like-numbered terms configured in the same way, except that the frame 140-2 is internal to the product space 150-2. In various embodiments, any stand-up flexible container of the present disclosure can be modified in a similar way, such that: part, parts, or all of the frame (including part, parts, or all of one or more of any structural support members that form the frame) are about, approximately, substantially, nearly, or completely enclosed by one or more product spaces.

FIG. 1G illustrates a perspective view of a container 100-3, which is an alternative embodiment of the stand up flexible container 100 of FIG. 1A, including an external structural support frame 140-3, a product space 150-3, and a dispenser 160-3. The embodiment of FIG. 1G is similar to the embodiment of FIG. 1A with like-numbered terms configured in the same way, except that the product space 150-3 is not integrally connected to the frame 140-3 (that is, not simultaneously made from the same web of flexible materials), but rather the product space 150-3 is separately made and then joined to the frame 140-3. The product space 150-3 can be joined to the frame in any convenient manner disclosed herein or known in the art. In the embodiment of FIG. 1G, the product space 150-3 is disposed within the frame 140-3, but the product space 150-3 has a reduced size and a somewhat different shape, when compared with the product space 150 of FIG. 1A; however, these differences are made to illustrate the relationship between the product space 150-3 and the frame 140-3, and are not required. In various embodiments, any stand-up flexible container of the present disclosure can be modified in a similar way, such that one or more the product spaces are not integrally connected to the frame.

FIGS. 2A-8G illustrate embodiments of stand up flexible containers having various overall shapes. Any of the embodiments of FIGS. 2A-8G can be configured according to any of the embodiments disclosed herein, including the embodiments of FIGS. 1A-1G. Any of the elements (e.g. structural support frames, structural support members, panels, dispensers, etc.) of the embodiments of FIGS. 2A-8G, can be configured according to any of the embodiments disclosed herein. While each of the embodiments of FIGS. 2A-8G illustrates a container with one dispenser, in various embodiments, each container can include multiple dispensers, according to any embodiment described herein. FIGS. 2A-8G illustrate exemplary additional/alternate locations for dispenser with phantom line outlines. Part, parts, or about all, or approximately all, or substantially all, or nearly all, or all of each of the panels in the embodiments of FIGS. 2A-8G is suitable to display any kind of indicia. Each of the side panels in the embodiments of FIGS. 2A-8G is configured to be a nonstructural panel, overlaying product space(s) disposed within the flexible container, however, in various embodiments, one or more of any kind of decorative or structural element (such as a rib, protruding from an outer surface) can be joined to part, parts, or about all, or approximately all, or substantially all, or nearly all, or all of any of these side panels. For clarity, not all structural details of these flexible containers are illustrated in FIGS. 2A-8G, however any of the embodiments of FIGS. 2A-8G can be configured to include any structure or feature for flexible containers, disclosed herein. For example, any of the embodiments of FIGS. 2A-8G can be configured to include any kind of base structure disclosed herein.

Figure 2A:
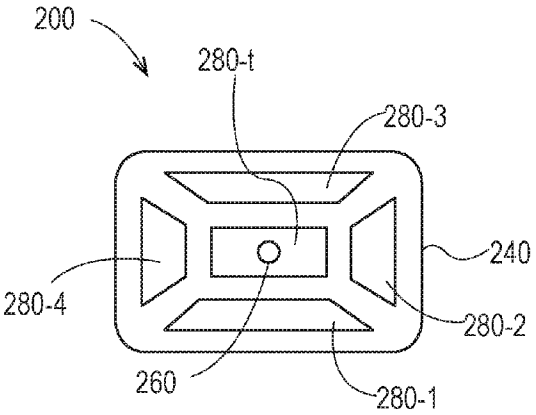
FIG. 2A illustrates a top view of a stand up flexible container having a structural support frame that has an overall shape like a frustum.
Figure 2B:
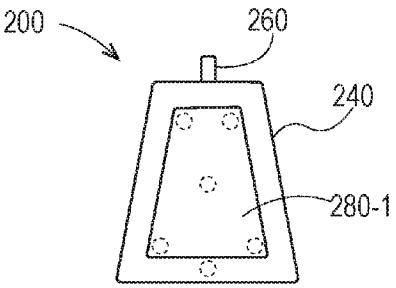
FIG. 2B illustrates a front view of the container of FIG. 2A.
Figure 2C:
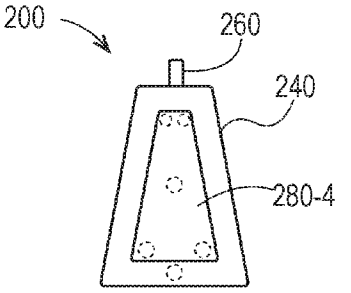
FIG. 2C illustrates a side view of the container of FIG. 2A.
Figure 2D:
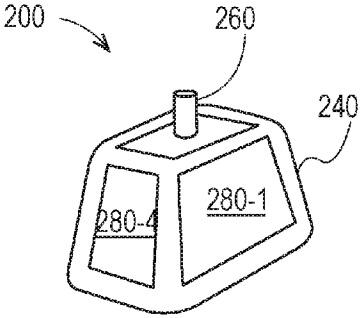
FIG. 2D illustrates an isometric view of the container of FIG. 2A.

FIG. 2A illustrates a top view of a stand up flexible container 200 having a structural support frame 240 that has an overall shape like a frustum. In the embodiment of FIG. 2A, the frustum shape is based on a four-sided pyramid, however, in various embodiments, the frustum shape can be based on a pyramid with a different number of sides, or the frustum shape can be based on a cone. The support frame 240 is formed by structural support members disposed along the edges of the frustum shape and joined together at their ends. The structural support members define a rectangular shaped top panel 280-*t*, trapezoidal shaped side panels 280-1, 280-2, 280-3, and 280-4, and a rectangular shaped bottom panel (not shown). Each of the side panels 280-1, 280-2, 280-3, and 280-4 is about flat, however in various embodiments, part, parts, or about all, or approximately all, or substantially all, or nearly all, or all of any of the side panels can be approximately flat, substantially flat, nearly flat, or completely flat. The container 200 includes a dispenser 260, which is configured to dispense one or more fluent products from one or more product spaces disposed within the container 200. In the embodiment of FIG. 2A, the dispenser 260 is disposed in the center of the top panel 280-*t*, however, in various alternate embodiments, the dispenser 260 can be disposed anywhere else on the top, sides, or bottom, of the container 200, according to any embodiment described or illustrated herein. FIG. 2B illustrates a front view of the container 200 of FIG. 2A, including exemplary additional/alternate locations for a dispenser, any of which can also apply to the back of the container. FIG. 2C illustrates a side view of the container 200 of FIG. 2A, including exemplary additional/alternate locations for a dispenser (illustrated as phantom lines), any of which can apply to either side of the container. FIG. 2D illustrates an isometric view of the container 200 of FIG. 2A.

Figure 2G:
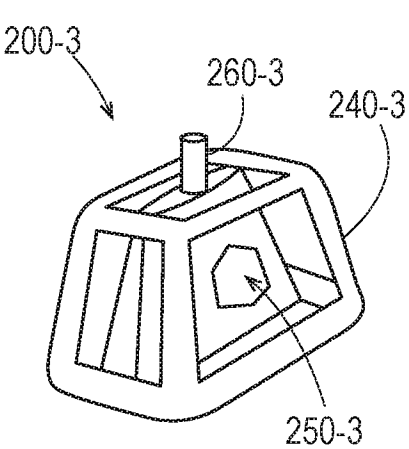
FIG. 2G illustrates a perspective view of an alternative embodiment of the stand up flexible container of FIG. 2A, including an external structural support frame.
Figure 2F:
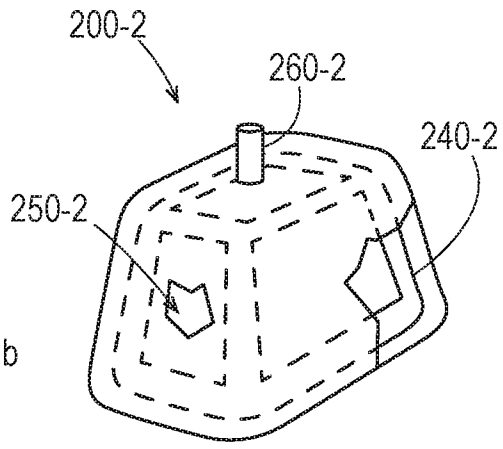
FIG. 2F illustrates a perspective view of an alternative embodiment of the stand up flexible container of FIG. 1A, including an internal structural support frame.
Figure 2E:
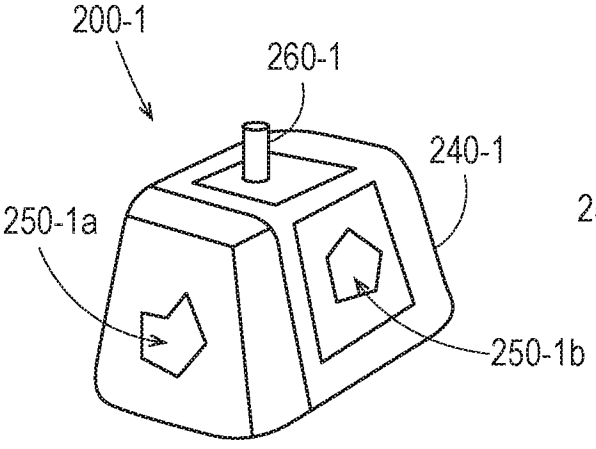
FIG. 2E illustrates a perspective view of an alternative embodiment of the stand up flexible container of FIG. 2A, including an asymmetric structural support frame.

FIG. 2E illustrates a perspective view of a container 200-1, which is an alternative embodiment of the stand up flexible container 200 of FIG. 2A, including an asymmetric structural support frame 240-1, a first portion of the product space 250-1*b*, a second portion of the product space 250-1*a*, and a dispenser 260-1, configured in the same manner as the embodiment of FIG. 1E, except based on the container 200. FIG. 2F illustrates a perspective view of a container 200-2, which is an alternative embodiment of the stand up flexible container 200 of FIG. 2A, including an internal structural support frame 240-2, a product space 250-2, and a dispenser 260-2, configured in the same manner as the embodiment of FIG. 1F, except based on the container 200. FIG. 2G illustrates a perspective view of a container 200-3, which is an alternative embodiment of the stand up flexible container 200 of FIG. 2A, including an external structural support frame 240-3, a non-integral product space 250-3 joined to and disposed within the frame 240-3, and a dispenser 260-3, configured in the same manner as the embodiment of FIG. 1G, except based on the container 200.

Figure 3B:
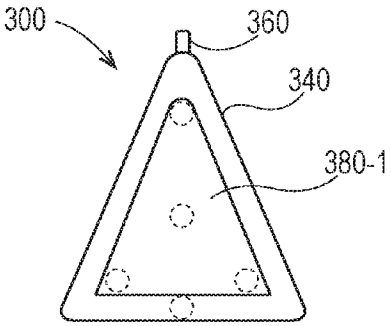
FIG. 3B illustrates a front view of the container of FIG. 3A.
Figure 3D:
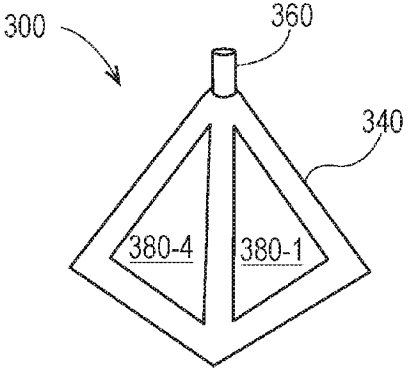
FIG. 3D illustrates an isometric view of the container of FIG. 3A.
Figure 3A:
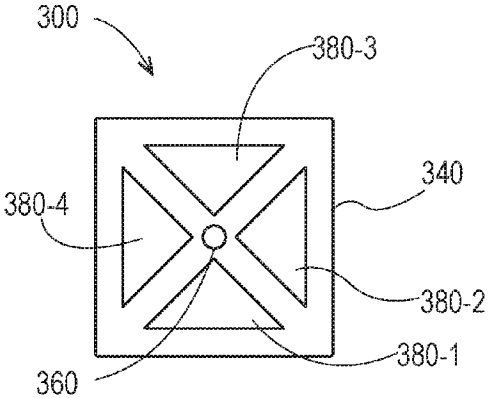
FIG. 3A illustrates a top view of a stand up flexible container having a structural support frame that has an overall shape like a pyramid.
Figure 3C:
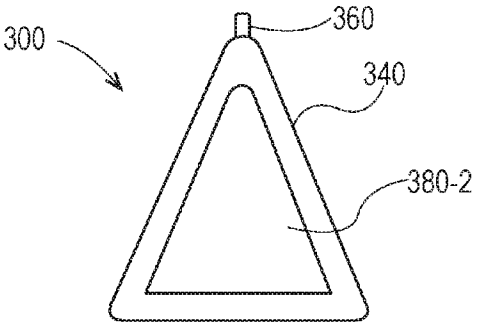
FIG. 3C illustrates a side view of the container of FIG. 3A.

FIG. 3A illustrates a top view of a stand up flexible container 300 having a structural support frame 340 that has an overall shape like a pyramid. In the embodiment of FIG. 3A, the pyramid shape is based on a four-sided pyramid, however, in various embodiments, the pyramid shape can be based on a pyramid with a different number of sides. The support frame 340 is formed by structural support members disposed along the edges of the pyramid shape and joined together at their ends. The structural support members define triangular shaped side panels 380-1, 380-2, 380-3, and 380-4, and a square shaped bottom panel (not shown). Each of the side panels 380-1, 380-2, 380-3, and 380-4 is about flat, however in various embodiments, part, parts, or about all, or approximately all, or substantially all, or nearly all, or all of any of the side panels can be approximately flat, substantially flat, nearly flat, or completely flat. The container 300 includes a dispenser 360, which is configured to dispense one or more fluent products from one or more product spaces disposed within the container 300. In the embodiment of FIG. 3A, the dispenser 360 is disposed at the apex of the pyramid shape, however, in various alternate embodiments, the dispenser 360 can be disposed anywhere else on the top, sides, or bottom, of the container 300. FIG. 3B illustrates a front view of the container 300 of FIG. 3A, including exemplary additional/alternate locations for a dispenser (illustrated as phantom lines), any of which can also apply to any side of the container. FIG. 3C illustrates a side view of the container 300 of FIG. 3A. FIG. 3D illustrates an isometric view of the container 300 of FIG. 3A.

Figure 3F:
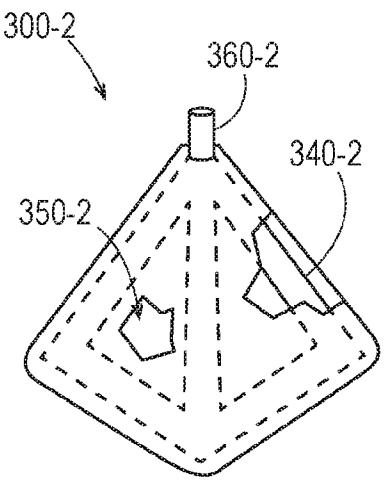
FIG. 3F illustrates a perspective view of an alternative embodiment of the stand up flexible container of FIG. 3A, including an internal structural support frame.
Figure 3E:
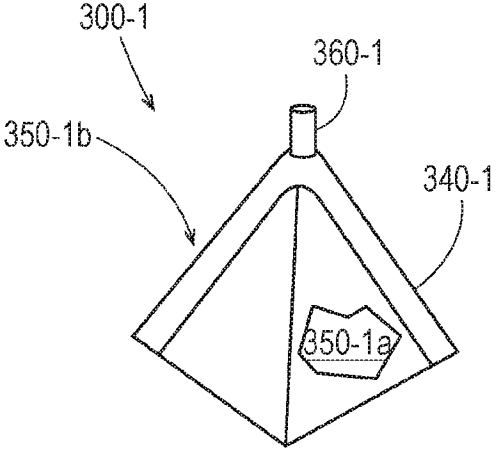
FIG. 3E illustrates a perspective view of an alternative embodiment of the stand up flexible container of FIG. 3A, including an asymmetric structural support frame.
Figure 3G:
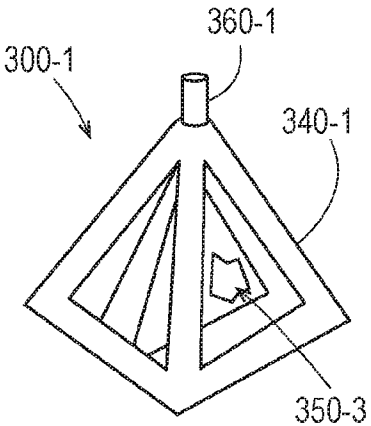
FIG. 3G illustrates a perspective view of an alternative embodiment of the stand up flexible container of FIG. 3A, including an external structural support frame.

FIG. 3E illustrates a perspective view of a container 300-1, which is an alternative embodiment of the stand up flexible container 300 of FIG. 3A, including an asymmetric structural support frame 340-1, a first portion of the product space 350-1*b*, a second portion of the product space 350-1*a*, and a dispenser 360-1, configured in the same manner as the embodiment of FIG. 1E, except based on the container 300. FIG. 3F illustrates a perspective view of a container 300-2, which is an alternative embodiment of the stand up flexible container 300 of FIG. 3A, including an internal structural support frame 340-2, a product space 350-2, and a dispenser 360-2, configured in the same manner as the embodiment of FIG. 1F, except based on the container 300. FIG. 3G illustrates a perspective view of a container 300-3, which is an alternative embodiment of the stand up flexible container 300 of FIG. 3A, including an external structural support frame 340-3, a non-integral product space 350-3 joined to and disposed within the frame 340-3, and a dispenser 360-3, configured in the same manner as the embodiment of FIG. 1G, except based on the container 300.

Figure 4B:
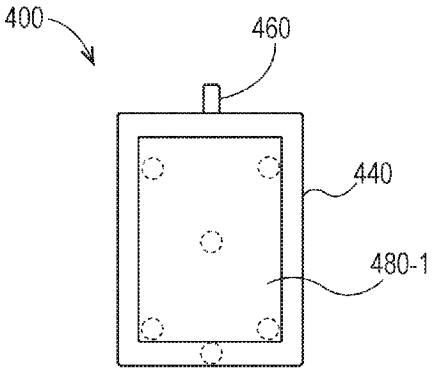
FIG. 4B illustrates a front view of the container of FIG. 4A.
Figure 4A:
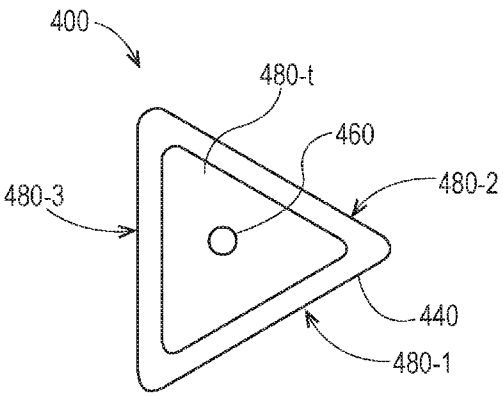
FIG. 4A illustrates a top view of a stand up flexible container having a structural support frame that has an overall shape like a trigonal prism.
Figure 4D:
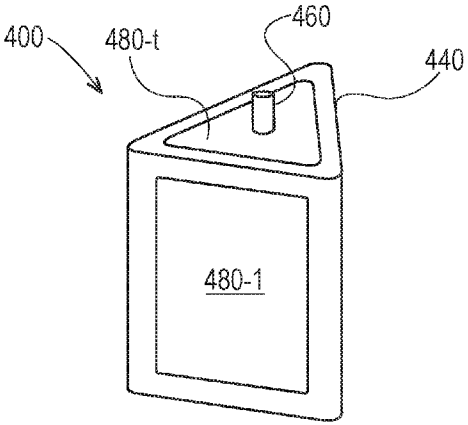
FIG. 4D illustrates an isometric view of the container of FIG. 4A.
Figure 4C:
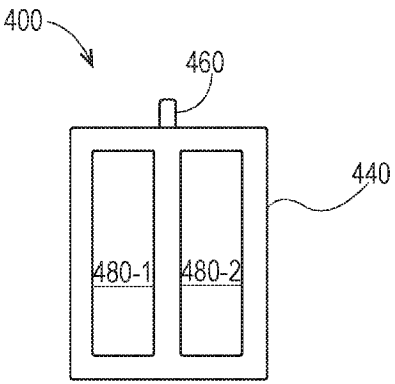
FIG. 4C illustrates a side view of the container of FIG. 4A.

FIG. 4A illustrates a top view of a stand up flexible container 400 having a structural support frame 440 that has an overall shape like a trigonal prism. In the embodiment of FIG. 4A, the prism shape is based on a triangle. The support frame 440 is formed by structural support members disposed along the edges of the prism shape and joined together at their ends. The structural support members define a triangular shaped top panel 480-*t*, rectangular shaped side panels 480-1, 480-2, and 480-3, and a triangular shaped bottom panel (not shown). Each of the side panels 480-1, 480-2, and 480-3 is about flat, however in various embodiments, part, parts, or about all, or approximately all, or substantially all, or nearly all, or all of the side panels can be approximately flat, substantially flat, nearly flat, or completely flat. The container 400 includes a dispenser 460, which is configured to dispense one or more fluent products from one or more product spaces disposed within the container 400. In the embodiment of FIG. 4A, the dispenser 460 is disposed in the center of the top panel 480-*t*, however, in various alternate embodiments, the dispenser 460 can be disposed anywhere else on the top, sides, or bottom, of the container 400. FIG. 4B illustrates a front view of the container 400 of FIG. 4A, including exemplary additional/alternate locations for a dispenser (illustrated as phantom lines), any of which can also apply to any side of the container 400. FIG. 4C illustrates a side view of the container 400 of FIG. 4A. FIG. 4D illustrates an isometric view of the container 400 of FIG. 4A.

Figure 4G:
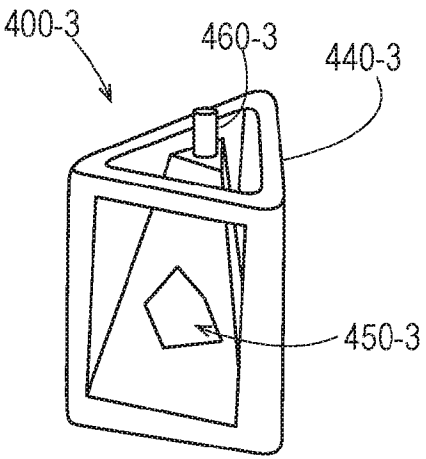
FIG. 4G illustrates a perspective view of an alternative embodiment of the stand up flexible container of FIG. 4A, including an external structural support frame.
Figure 4F:
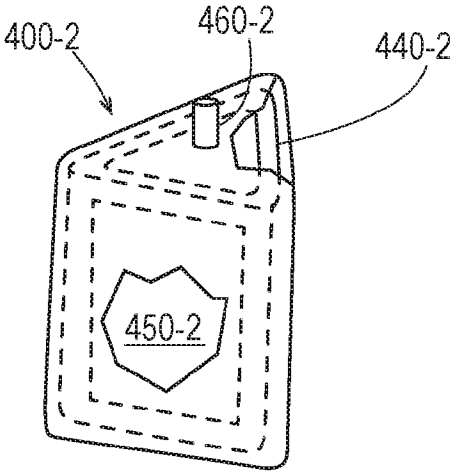
FIG. 4F illustrates a perspective view of an alternative embodiment of the stand up flexible container of FIG. 4A, including an internal structural support frame.
Figure 4E:
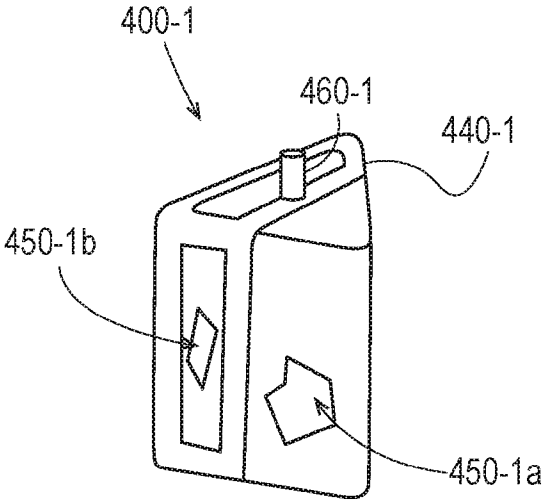
FIG. 4E illustrates a perspective view of an alternative embodiment of the stand up flexible container of FIG. 4A, including an asymmetric structural support frame.

FIG. 4E illustrates a perspective view of a container 400-1, which is an alternative embodiment of the stand up flexible container 400 of FIG. 4A, including an asymmetric structural support frame 440-1, a first portion of the product space 450-1*b*, a second portion of the product space 450-1*a*, and a dispenser 460-1, configured in the same manner as the embodiment of FIG. 1E, except based on the container 400. FIG. 4F illustrates a perspective view of a container 400-2, which is an alternative embodiment of the stand up flexible container 400 of FIG. 4A, including an internal structural support frame 440-2, a product space 450-2, and a dispenser 460-2, configured in the same manner as the embodiment of FIG. 1F, except based on the container 400. FIG. 4G illustrates a perspective view of a container 400-3, which is an alternative embodiment of the stand up flexible container 400 of FIG. 4A, including an external structural support frame 440-3, a non-integral product space 450-3 joined to and disposed within the frame 440-3, and a dispenser 460-3, configured in the same manner as the embodiment of FIG. 1G, except based on the container 400.

Figure 5B:
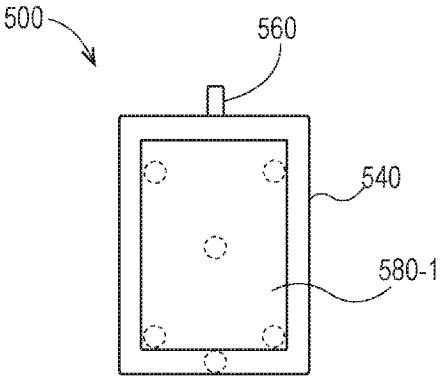
FIG. 5B illustrates a front view of the container of FIG. 5A.
Figure 5D:
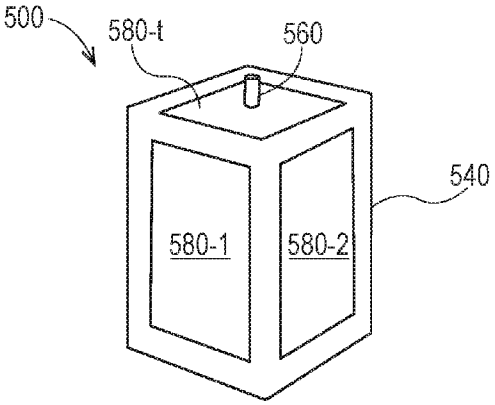
FIG. 5D illustrates an isometric view of the container of FIG. 5A.
Figure 5A:
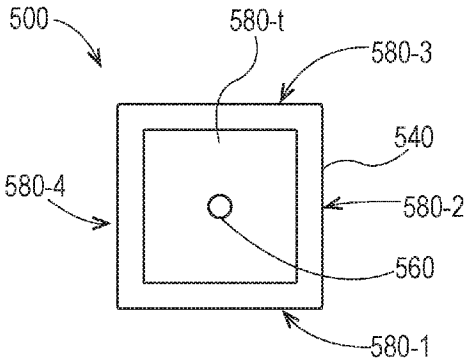
FIG. 5A illustrates a top view of a stand up flexible container having a structural support frame that has an overall shape like a tetragonal prism.
Figure 5C:
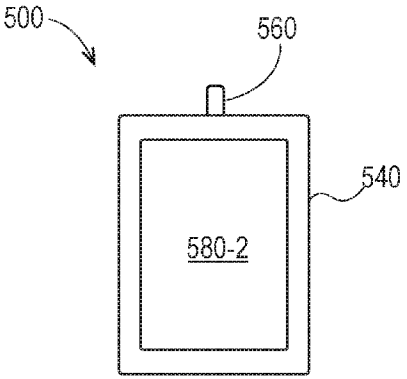
FIG. 5C illustrates a side view of the container of FIG. 5A.

FIG. 5A illustrates a top view of a stand up flexible container 500 having a structural support frame 540 that has an overall shape like a tetragonal prism. In the embodiment of FIG. 5A, the prism shape is based on a square. The support frame 540 is formed by structural support members disposed along the edges of the prism shape and joined together at their ends. The structural support members define a square shaped top panel 580-*t*, rectangular shaped side panels 580-1, 580-2, 580-3, and 580-4, and a square shaped bottom panel (not shown). Each of the side panels 580-1, 580-2, 580-3, and 580-4 is about flat, however in various embodiments, part, parts, or about all, or approximately all, or substantially all, or nearly all, or all of any of the side panels can be approximately flat, substantially flat, nearly flat, or completely flat. The container 500 includes a dispenser 560, which is configured to dispense one or more fluent products from one or more product spaces disposed within the container 500. In the embodiment of FIG. 5A, the dispenser 560 is disposed in the center of the top panel 580-*t*, however, in various alternate embodiments, the dispenser 560 can be disposed anywhere else on the top, sides, or bottom, of the container 500. FIG. 5B illustrates a front view of the container 500 of FIG. 5A, including exemplary additional/alternate locations for a dispenser (illustrated as phantom lines), any of which can also apply to any side of the container 500. FIG. 5C illustrates a side view of the container 500 of FIG. 5A. FIG. 5D illustrates an isometric view of the container 500 of FIG. 5A.

Figure 5G:
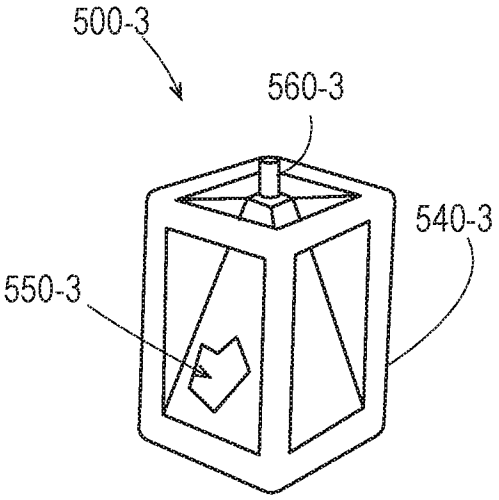
FIG. 5G illustrates a perspective view of an alternative embodiment of the stand up flexible container of FIG. 5A, including an external structural support frame.
Figure 5F:
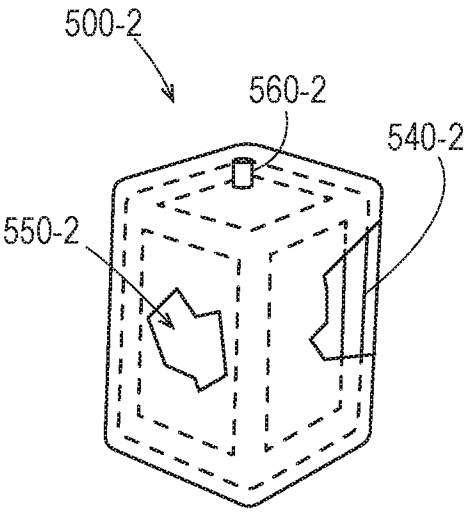
FIG. 5F illustrates a perspective view of an alternative embodiment of the stand up flexible container of FIG. 5A, including an internal structural support frame.
Figure 5E:
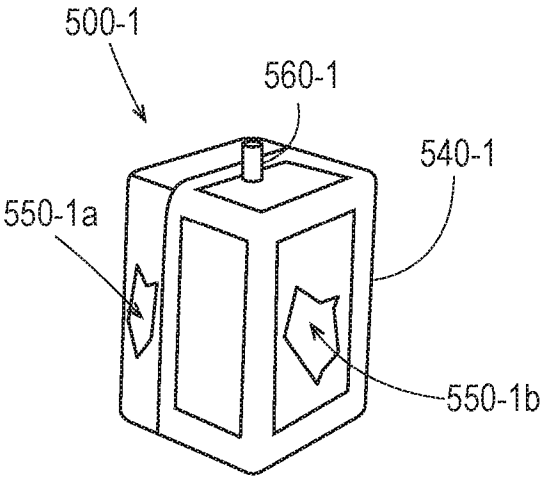
FIG. 5E illustrates a perspective view of an alternative embodiment of the stand up flexible container of FIG. 5A, including an asymmetric structural support frame.

FIG. 5E illustrates a perspective view of a container 500-1, which is an alternative embodiment of the stand up flexible container 500 of FIG. 5A, including an asymmetric structural support frame 540-1, a first portion of the product space 550-1*b*, a second portion of the product space 550-1*a*, and a dispenser 560-1, configured in the same manner as the embodiment of FIG. 1E, except based on the container 500. FIG. 5F illustrates a perspective view of a container 500-2, which is an alternative embodiment of the stand up flexible container 500 of FIG. 5A, including an internal structural support frame 540-2, a product space 550-2, and a dispenser 560-2, configured in the same manner as the embodiment of FIG. 1F, except based on the container 500. FIG. 5G illustrates a perspective view of a container 500-3, which is an alternative embodiment of the stand up flexible container 500 of FIG. 5A, including an external structural support frame 540-3, a non-integral product space 550-3 joined to and disposed within the frame 540-3, and a dispenser 560-3, configured in the same manner as the embodiment of FIG. 1G, except based on the container 500.

Figure 6B:
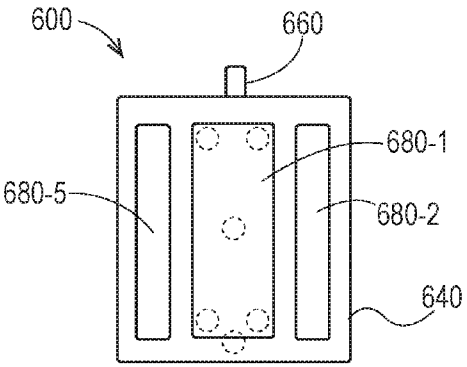
FIG. 6B illustrates a front view of the container of FIG. 6A.
Figure 6D:
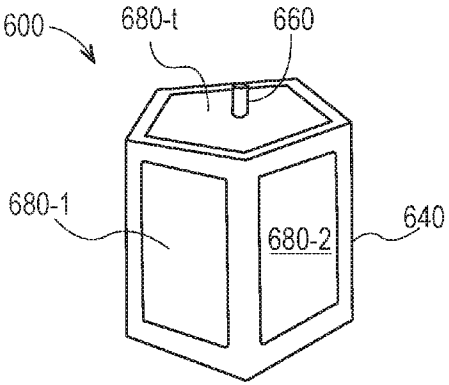
FIG. 6D illustrates an isometric view of the container of FIG. 6A.
Figure 6A:
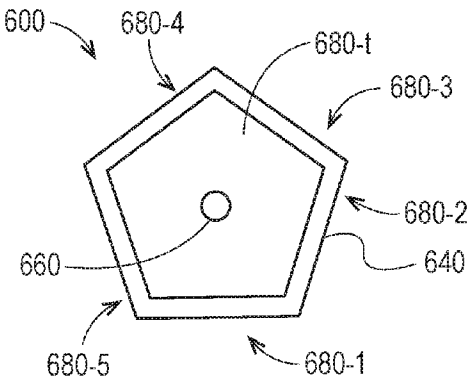
FIG. 6A illustrates a top view of a stand up flexible container having a structural support frame that has an overall shape like a pentagonal prism.
Figure 6C:
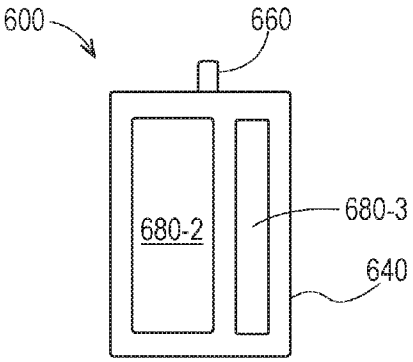
FIG. 6C illustrates a side view of the container of FIG. 6A.

FIG. 6A illustrates a top view of a stand up flexible container 600 having a structural support frame 640 that has an overall shape like a pentagonal prism. In the embodiment of FIG. 6A, the prism shape is based on a pentagon. The support frame 640 is formed by structural support members disposed along the edges of the prism shape and joined together at their ends. The structural support members define a pentagon shaped top panel 680-*t*, rectangular shaped side panels 680-1, 680-2, 680-3, 680-4, and 680-5, and a pentagon shaped bottom panel (not shown). Each of the side panels 680-1, 680-2, 680-3, 680-4, and 680-5 is about flat, however in various embodiments, part, parts, or about all, or approximately all, or substantially all, or nearly all, or all of any of the side panels can be approximately flat, substantially flat, nearly flat, or completely flat. The container 600 includes a dispenser 660, which is configured to dispense one or more fluent products from one or more product spaces disposed within the container 600. In the embodiment of FIG. 6A, the dispenser 660 is disposed in the center of the top panel 680-*t*, however, in various alternate embodiments, the dispenser 660 can be disposed anywhere else on the top, sides, or bottom, of the container 600. FIG. 6B illustrates a front view of the container 600 of FIG. 6A, including exemplary additional/alternate locations for a dispenser (illustrated as phantom lines), any of which can also apply to any side of the container 600. FIG. 6C illustrates a side view of the container 600 of FIG. 6A. FIG. 6D illustrates an isometric view of the container 600 of FIG. 6A.

Figure 6G:
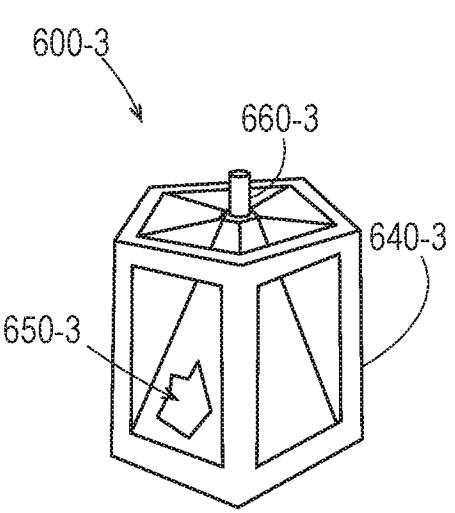
FIG. 6G illustrates a perspective view of an alternative embodiment of the stand up flexible container of FIG. 6A, including an external structural support frame.
Figure 6F:
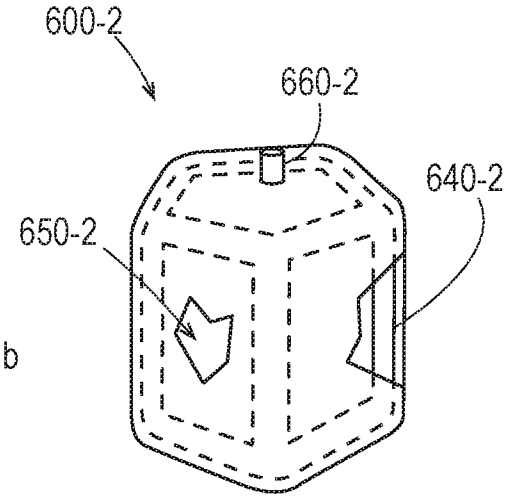
FIG. 6F illustrates a perspective view of an alternative embodiment of the stand up flexible container of FIG. 6A, including an internal structural support frame.
Figure 6E:
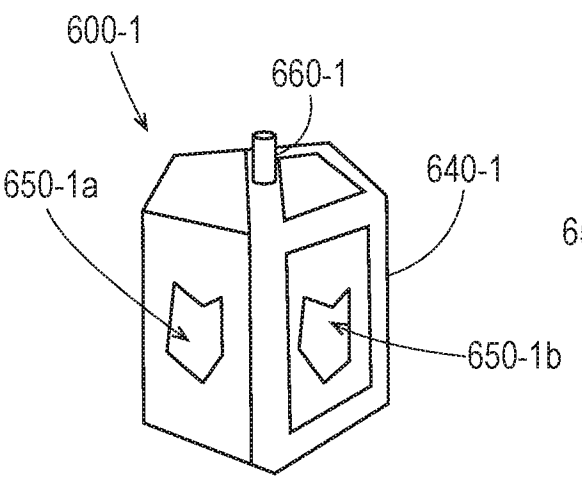
FIG. 6E illustrates a perspective view of an alternative embodiment of the stand up flexible container of FIG. 6A, including an asymmetric structural support frame.

FIG. 6E illustrates a perspective view of a container 600-1, which is an alternative embodiment of the stand up flexible container 600 of FIG. 6A, including an asymmetric structural support frame 640-1, a first portion of the product space 650-1*b*, a second portion of the product space 650-1*a*, and a dispenser 660-1, configured in the same manner as the embodiment of FIG. 1E, except based on the container 600. FIG. 6F illustrates a perspective view of a container 600-2, which is an alternative embodiment of the stand up flexible container 600 of FIG. 6A, including an internal structural support frame 640-2, a product space 650-2, and a dispenser 660-2, configured in the same manner as the embodiment of FIG. 1F, except based on the container 600. FIG. 6G illustrates a perspective view of a container 600-3, which is an alternative embodiment of the stand up flexible container 600 of FIG. 6A, including an external structural support frame 640-3, a non-integral product space 650-3 joined to and disposed within the frame 640-3, and a dispenser 660-3, configured in the same manner as the embodiment of FIG. 1G, except based on the container 600.

Figure 7A:
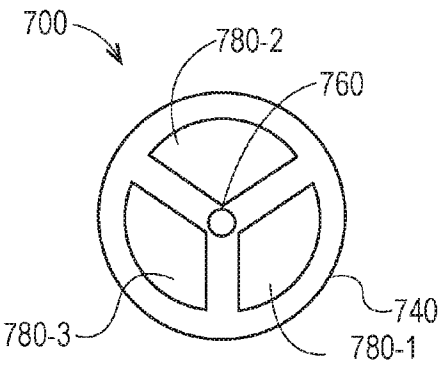
FIG. 7A illustrates a top view of a stand up flexible container having a structural support frame that has an overall shape like a cone.
Figure 7B:
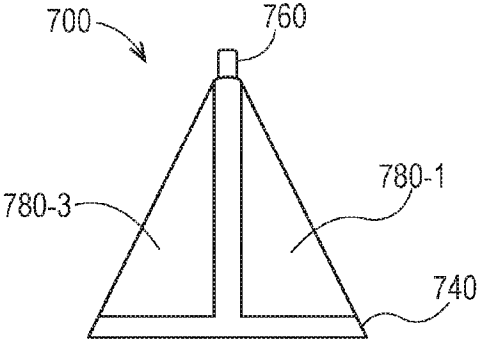
FIG. 7B illustrates a front view of the container of FIG. 7A.
Figure 7C:
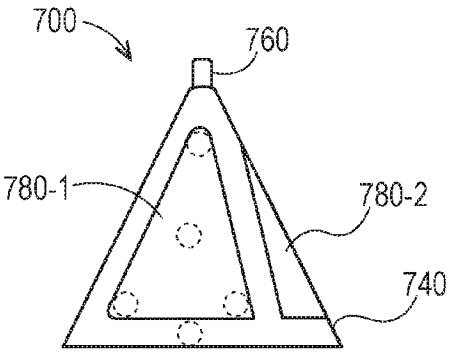
FIG. 7C illustrates a side view of the container of FIG. 7A.
Figure 7D:
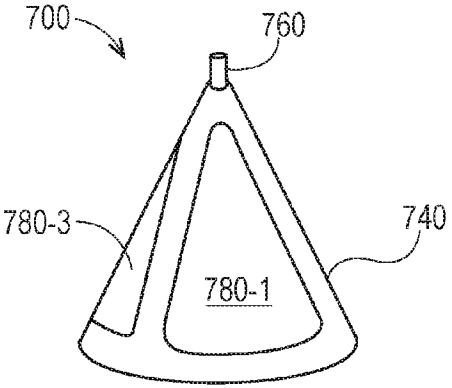
FIG. 7D illustrates an isometric view of the container of FIG. 7A.

FIG. 7A illustrates a top view of a stand up flexible container 700 having a structural support frame 740 that has an overall shape like a cone. The support frame 740 is formed by curved structural support members disposed around the base of the cone and by straight structural support members extending linearly from the base to the apex, wherein the structural support members are joined together at their ends. The structural support members define curved somewhat triangular shaped side panels 780-1, 780-2, and 780-3, and a circular shaped bottom panel (not shown). Each of the side panels 780-1, 780-2, and 780-3, is curved, however in various embodiments, part, parts, or about all, or approximately all, or substantially all, or nearly all, or all of any of the side panels can be approximately flat, substantially flat, nearly flat, or completely flat. The container 700 includes a dispenser 760, which is configured to dispense one or more fluent products from one or more product spaces disposed within the container 700. In the embodiment of FIG. 7A, the dispenser 760 is disposed at the apex of the conical shape, however, in various alternate embodiments, the dispenser 760 can be disposed anywhere else on the top, sides, or bottom, of the container 700. FIG. 7B illustrates a front view of the container 700 of FIG. 7A. FIG. 7C illustrates a side view of the container 700 of FIG. 7A, including exemplary additional/alternate locations for a dispenser (illustrated as phantom lines), any of which can also apply to any side panel of the container 700. FIG. 7D illustrates an isometric view of the container 700 of FIG. 7A.

Figure 7G:
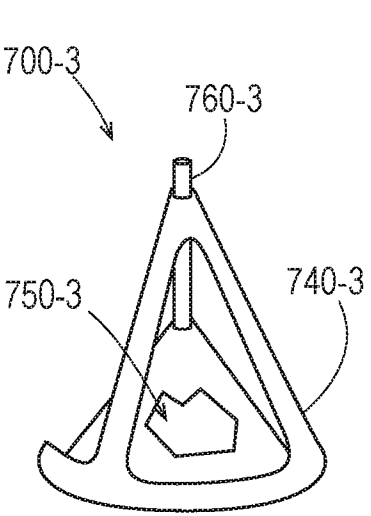
FIG. 7G illustrates a perspective view of an alternative embodiment of the stand up flexible container of FIG. 7A, including an external structural support frame.
Figure 7F:
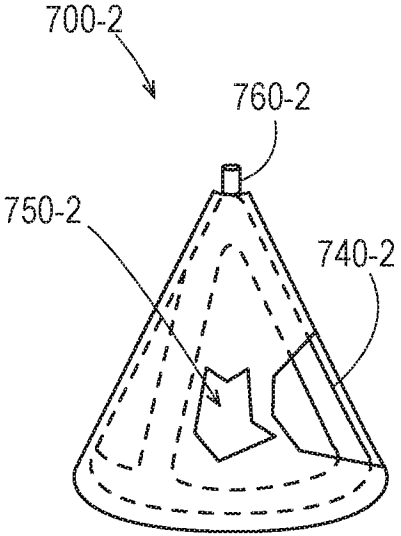
FIG. 7F illustrates a perspective view of an alternative embodiment of the stand up flexible container of FIG. 7A, including an internal structural support frame.
Figure 7E:
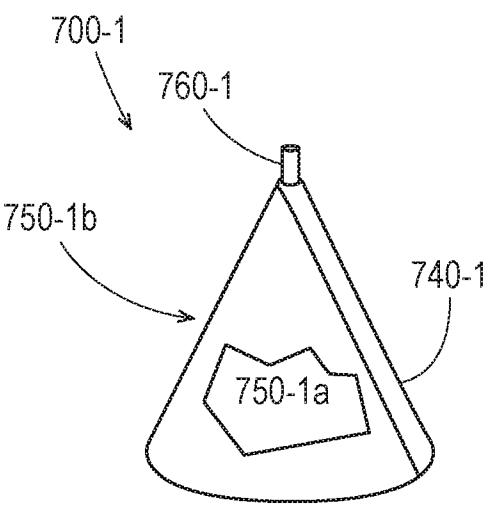
FIG. 7E illustrates a perspective view of an alternative embodiment of the stand up flexible container of FIG. 7A, including an asymmetric structural support frame.

FIG. 7E illustrates a perspective view of a container 700-1, which is an alternative embodiment of the stand up flexible container 700 of FIG. 7A, including an asymmetric structural support frame 740-1, a first portion of the product space 750-1*b*, a second portion of the product space 750-1*a*, and a dispenser 760-1, configured in the same manner as the embodiment of FIG. 1E, except based on the container 700. FIG. 7F illustrates a perspective view of a container 700-2, which is an alternative embodiment of the stand up flexible container 700 of FIG. 7A, including an internal structural support frame 740-2, a product space 750-2, and a dispenser 760-2, configured in the same manner as the embodiment of FIG. 1F, except based on the container 700. FIG. 7G illustrates a perspective view of a container 700-3, which is an alternative embodiment of the stand up flexible container 700 of FIG. 7A, including an external structural support frame 740-3, a non-integral product space 750-3 joined to and disposed within the frame 740-3, and a dispenser 760-3, configured in the same manner as the embodiment of FIG. 1G, except based on the container 700.

Figure 8B:
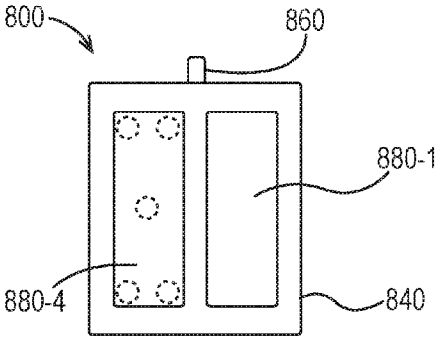
FIG. 8B illustrates a front view of the container of FIG. 8A.
Figure 8D:
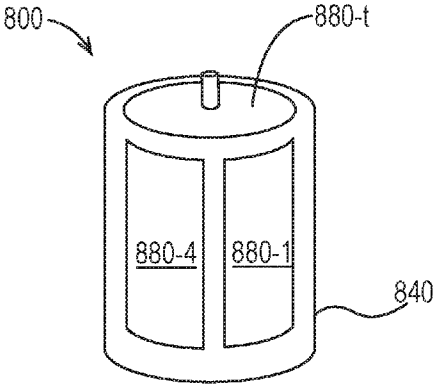
FIG. 8D illustrates an isometric view of the container of FIG. 8A.
Figure 8A:
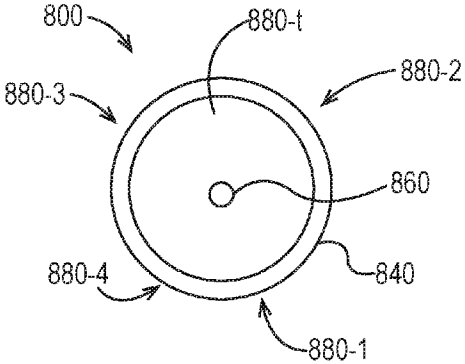
FIG. 8A illustrates a top view of a stand up flexible container having a structural support frame that has an overall shape like a cylinder.
Figure 8C:
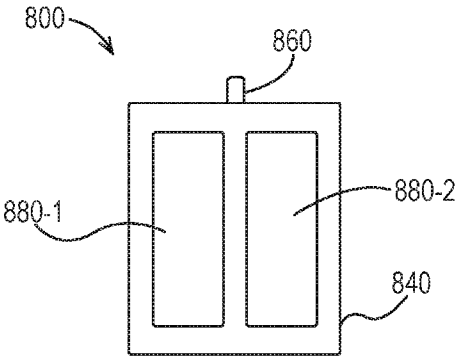
FIG. 8C illustrates a side view of the container of FIG. 8A.

FIG. 8A illustrates a top view of a stand up flexible container 800 having a structural support frame 840 that has an overall shape like a cylinder. The support frame 840 is formed by curved structural support members disposed around the top and bottom of the cylinder and by straight structural support members extending linearly from the top to the bottom, wherein the structural support members are joined together at their ends. The structural support members define a circular shaped top panel 880-*t*, curved somewhat rectangular shaped side panels 880-1, 880-2, 880-3, and 880-4, and a circular shaped bottom panel (not shown). Each of the side panels 880-1, 880-2, 880-3, and 880-4, is curved, however in various embodiments, part, parts, or about all, or approximately all, or substantially all, or nearly all, or all of any of the side panels can be approximately flat, substantially flat, nearly flat, or completely flat. The container 800 includes a dispenser 860, which is configured to dispense one or more fluent products from one or more product spaces disposed within the container 800. In the embodiment of FIG. 8A, the dispenser 860 is disposed in the center of the top panel 880-*t*, however, in various alternate embodiments, the dispenser 860 can be disposed anywhere else on the top, sides, or bottom, of the container 800. FIG. 8B illustrates a front view of the container 800 of FIG. 8A, including exemplary additional/alternate locations for a dispenser (illustrated as phantom lines), any of which can also apply to any side panel of the container 800. FIG. 8C illustrates a side view of the container 800 of FIG. 8A. FIG. 8D illustrates an isometric view of the container 800 of FIG. 8A.

Figure 8G:
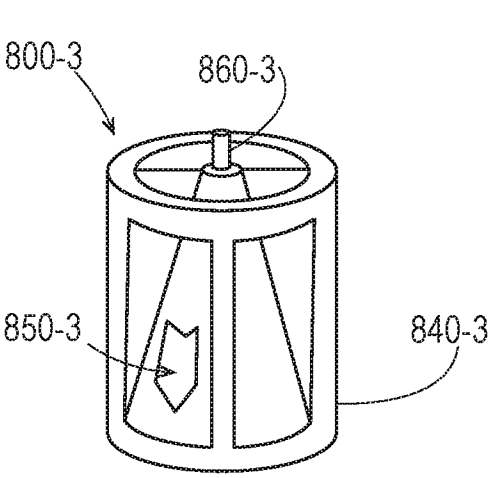
FIG. 8G illustrates a perspective view of an alternative embodiment of the stand up flexible container of FIG. 8A, including an external structural support frame.
Figure 8F:
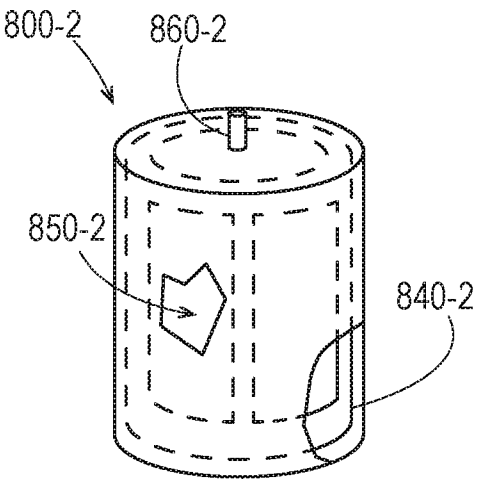
FIG. 8F illustrates a perspective view of an alternative embodiment of the stand up flexible container of FIG. 8A, including an internal structural support frame.
Figure 8E:
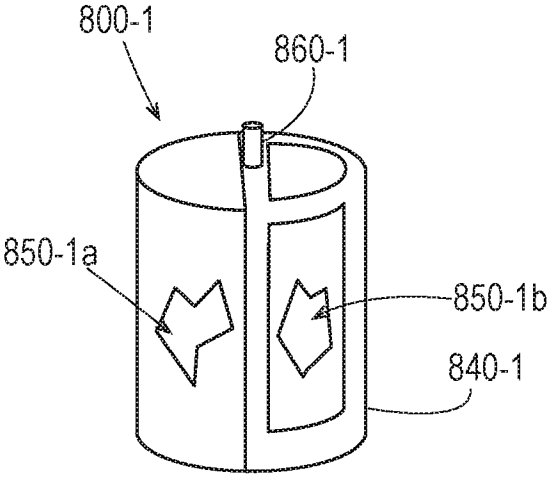
FIG. 8E illustrates a perspective view of an alternative embodiment of the stand up flexible container of FIG. 8A, including an asymmetric structural support frame.

FIG. 8E illustrates a perspective view of a container 800-1, which is an alternative embodiment of the stand up flexible container 800 of FIG. 8A, including an asymmetric structural support frame 840-1, a first portion of the product space 850-1*b*, a second portion of the product space 850-1*a*, and a dispenser 860-1, configured in the same manner as the embodiment of FIG. 1E, except based on the container 800. FIG. 8F illustrates a perspective view of a container 800-2, which is an alternative embodiment of the stand up flexible container 800 of FIG. 8A, including an internal structural support frame 840-2, a product space 850-2, and a dispenser 860-2, configured in the same manner as the embodiment of FIG. 1F, except based on the container 800. FIG. 8G illustrates a perspective view of a container 800-3, which is an alternative embodiment of the stand up flexible container 800 of FIG. 8A, including an external structural support frame 840-3, a non-integral product space 850-3 joined to and disposed within the frame 840-3, and a dispenser 860-3, configured in the same manner as the embodiment of FIG. 1G, except based on the container 800.

In additional embodiments, any stand up flexible container with a structural support frame, as disclosed herein, can be configured to have an overall shape that corresponds with any other known three-dimensional shape, including any kind of polyhedron, any kind of prismatoid, and any kind of prism (including right prisms and uniform prisms).

Figure 9B:
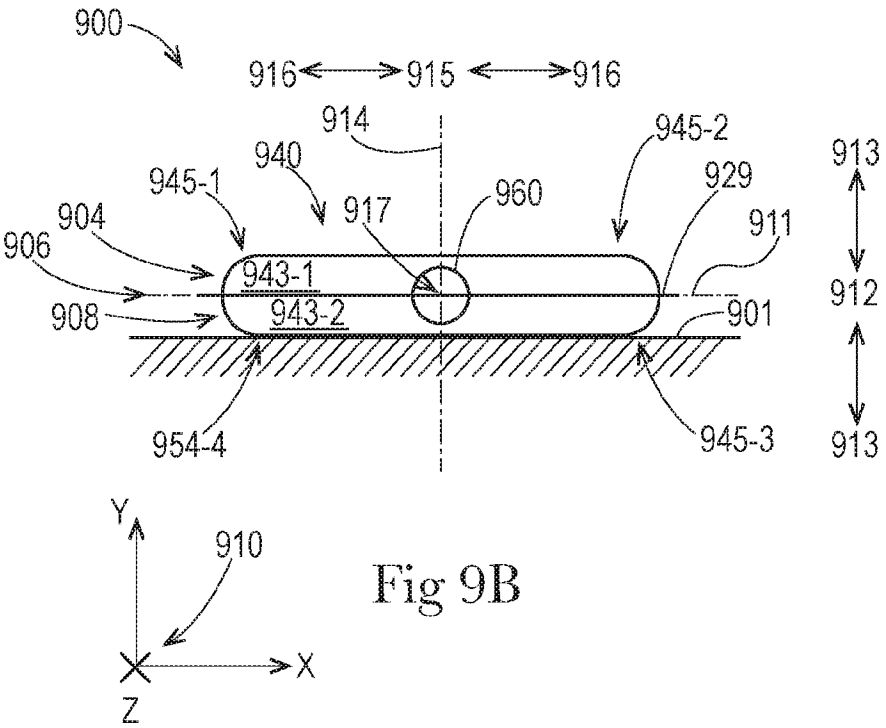
FIG. 9B illustrates an end view of the flexible container of FIG. 9A.
Figure 9A:
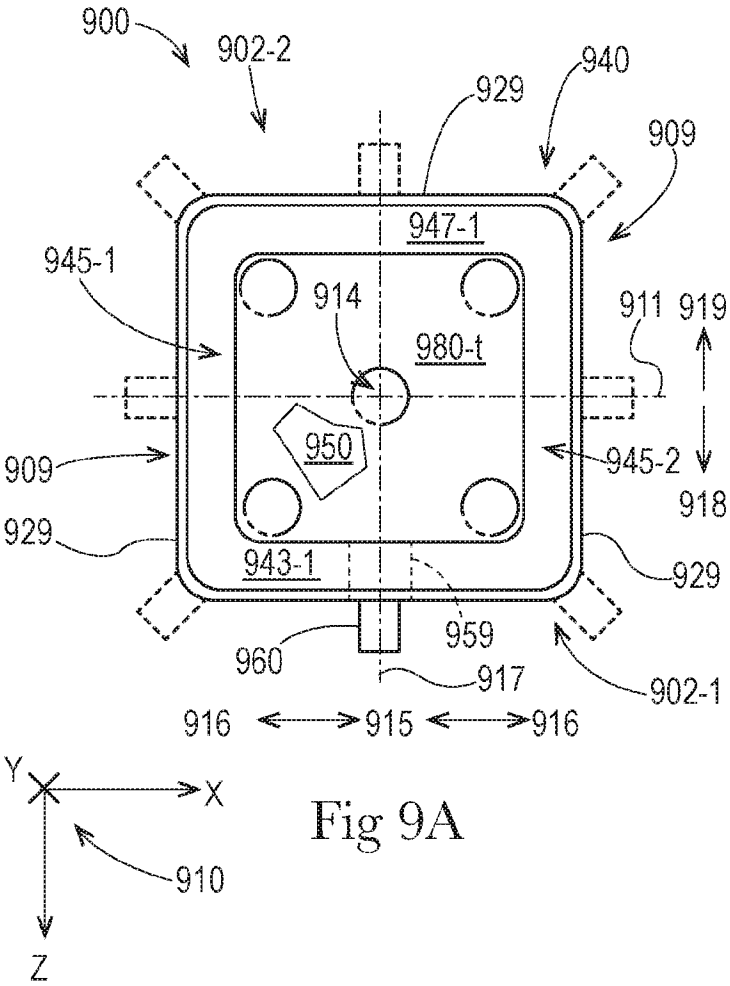
FIG. 9A illustrates a top view of an embodiment of a self-supporting flexible container, having an overall shape like a square.

FIG. 9A illustrates a top view of an embodiment of a self-supporting flexible container 900, having an overall shape like a square. FIG. 9B illustrates an end view of the flexible container 900 of FIG. 9A. The container 900 is resting on a horizontal support surface 901.

In FIG. 9B, a coordinate system 910, provides lines of reference for referring to directions in the figure. The coordinate system 910 is a three-dimensional Cartesian coordinate system, with an X-axis, a Y-axis, and a Z-axis. The X-axis and the Z-axis are parallel with the horizontal support surface 901 and the Y-axis is perpendicular to the horizontal support surface 901.

FIG. 9A also includes other lines of reference, for referring to directions and locations with respect to the container 100. A lateral centerline 911 runs parallel to the X-axis. An XY plane at the lateral centerline 911 separates the container 100 into a front half and a back half. An XZ plane at the lateral centerline 911 separates the container 100 into an upper half and a lower half. A longitudinal centerline 914 runs parallel to the Y-axis. A YZ plane at the longitudinal centerline 914 separates the container 900 into a left half and a right half. A third centerline 917 runs parallel to the Z-axis. The lateral centerline 911, the longitudinal centerline 914, and the third centerline 917 all intersect at a center of the container 900. These terms for direction, orientation, measurement, and disposition, in the embodiment of FIGS. 9A-9B are the same as the like-numbered terms in the embodiment of FIGS. 1A-1D.

The container 900 includes a top 904, a middle 906, and a bottom 908, the front 902-1, the back 902-2, and left and right sides 909. In the embodiment of FIGS. 9A-9B, the upper half and the lower half of the container are joined together at a seal 929, which extends around the outer periphery of the container 900. The bottom of the container 900 is configured in the same way as the top of the container 900.

The container 900 includes a structural support frame 940, a product space 950, a dispenser 960, a top panel 980-*t* and a bottom panel (not shown). A portion of the top panel 980-*t* is illustrated as broken away, in order to show the product space 950. The product space 950 is configured to contain one or more fluent products. The dispenser 960 allows the container 900 to dispense these fluent product(s) from the product space 950 through a flow channel 958 then through the dispenser 960, to the environment outside of the container 900. The structural support frame 940 supports the mass of fluent product(s) in the product space 950. The top panel 980-*t* and the bottom panel are relatively flat surfaces, overlaying the product space 950, and are suitable for displaying any kind of indicia.

The structural support frame 940 is formed by a plurality of structural support members. The structural support frame 940 includes front structural support members 943-1 and 943-2, intermediate structural support members 945-1, 945-2, 945-3, and 945-4, as well as back structural support members 947-1 and 947-2. Overall, each of the structural support members in the container 900 is oriented horizontally. And, each of the structural support members in the container 900 has a cross-sectional area that is substantially uniform along its length, although in various embodiments, this cross-sectional area can vary.

Upper structural support members 943-1, 945-1, 945-2, and 947-1 are disposed in an upper part of the middle 906 and in the top 904, while lower structural support members 943-2, 945-4, 945-3, and 947-2 are disposed in a lower part of the middle 906 and in the bottom 908. The upper structural support members 943-1, 945-1, 945-2, and 947-1 are disposed above and adjacent to the lower structural support members 943-2, 945-4, 945-3, and 947-2, respectively.

In various embodiments, adjacent upper and lower structural support members can be in contact with each other at one or more relatively smaller locations and/or at one or more relatively larger locations, along part, or parts, or about all, or approximately all, or substantially all, or nearly all, or all of their overall lengths, so long as there is a gap in the contact for the flow channel 958, between the structural support members 943-1 and 943-2. In the embodiment of FIGS. 9A-9B, the upper and lower structural support members are not directly connected to each other. However, in various alternate embodiments, adjacent upper and lower structural support members can be directly connected and/or joined together along part, or parts, or about all, or approximately all, or substantially all, or nearly all, or all of their overall lengths.

The ends of structural support members 943-1, 945-2, 947-1, and 945-1 are joined together to form a top square that is outward from and surrounding the product space 950, and the ends of structural support members 943-2, 945-3, 947-2, and 945-4 are also joined together to form a bottom square that is outward from and surrounding the product space 950. In the structural support frame 940, the ends of the structural support members, which are joined together, are directly connected, all around the periphery of their walls. However, in various alternative embodiments, any of the structural support members of the embodiment of FIGS. 9A-9B can be joined together in any way described herein or known in the art.

In alternative embodiments of the structural support frame 940, adjacent structural support members can be combined into a single structural support member, wherein the combined structural support member can effectively substitute for the adjacent structural support members, as their functions and connections are described herein. In other alternative embodiments of the structural support frame 940, one or more additional structural support members can be added to the structural support members in the structural support frame 940, wherein the expanded structural support frame can effectively substitute for the structural support frame 940, as its functions and connections are described herein.

Figure 9E:
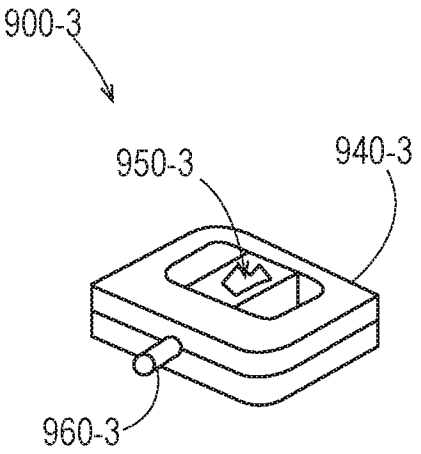
FIG. 9E illustrates a perspective view of an alternative embodiment of the self-supporting flexible container of FIG. 9A, including an external structural support frame.
Figure 9D:
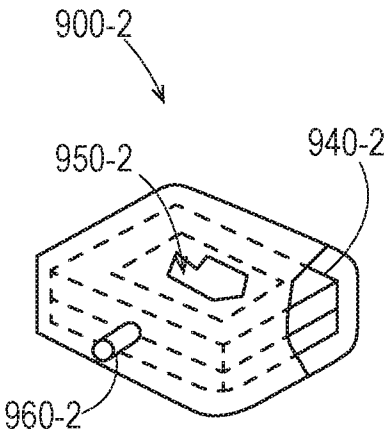
FIG. 9D illustrates a perspective view of an alternative embodiment of the self-supporting flexible container of FIG. 9A, including an internal structural support frame.
Figure 9C:
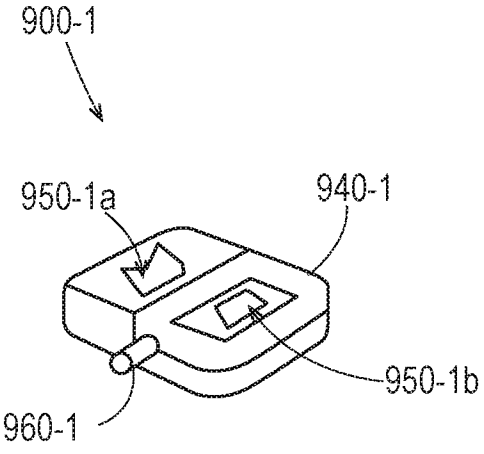
FIG. 9C illustrates a perspective view of an alternative embodiment of the self-supporting flexible container of FIG. 9A, including an asymmetric structural support frame.

FIG. 9C illustrates a perspective view of a container 900-1, which is an alternative embodiment of the self-supporting flexible container 900 of FIG. 1A, including an asymmetric structural support frame 940-1, a first portion of the product space 950-1*b*, a second portion of the product space 950-1*a*, and a dispenser 960-1. The embodiment of FIG. 9C is similar to the embodiment of FIG. 9A with like-numbered terms configured in the same way, except that the frame 940-1 extends around about half of the container 900-1, directly supporting a first portion of the product space 950-1*b*, which is disposed inside of the frame 940-1, and indirectly supporting a second portion of the product space 950-1*a*, which is disposed outside of the frame 940-1. In various embodiments, any self-supporting flexible container of the present disclosure can be modified in a similar way, such that: the frame extends around only part or parts of the container, and/or the frame is asymmetric with respect to one or more centerlines of the container, and/or part or parts of one or more product spaces of the container are disposed outside of the frame, and/or part or parts of one or more product spaces of the container are indirectly supported by the frame.

FIG. 9D illustrates a perspective view of a container 900-2, which is an alternative embodiment of the self-supporting flexible container 900 of FIG. 9A, including an internal structural support frame 940-2, a product space 950-2, and a dispenser 960-2. The embodiment of FIG. 9D is similar to the embodiment of FIG. 9A with like-numbered terms configured in the same way, except that the frame 940-2 is internal to the product space 950-2. In various embodiments, any self-supporting flexible container of the present disclosure can be modified in a similar way, such that: part, parts, or all of the frame (including part, parts, or all of one or more of any structural support members that form the frame) are about, approximately, substantially, nearly, or completely enclosed by one or more product spaces.

FIG. 9E illustrates a perspective view of a container 900-3, which is an alternative embodiment of the stand up flexible container 900 of FIG. 9A, including an external structural support frame 940-3, a product space 950-3, and a dispenser 960-3. The embodiment of FIG. 9E is similar to the embodiment of FIG. 9A with like-numbered terms configured in the same way, except that the product space 950-3 is not integrally connected to the frame 940-3 (that is, not simultaneously made from the same web of flexible materials), but rather the product space 950-3 is separately made and then joined to the frame 940-3. The product space 950-3 can be joined to the frame in any convenient manner disclosed herein or known in the art. In the embodiment of FIG. 9E, the product space 950-3 is disposed within the frame 940-3, but the product space 950-3 has a reduced size and a somewhat different shape, when compared with the product space 950 of FIG. 9A; however, these differences are made to illustrate the relationship between the product space 950-3 and the frame 940-3, and are not required. In various embodiments, any self-supporting flexible container of the present disclosure can be modified in a similar way, such that one or more the product spaces are not integrally connected to the frame.

FIGS. 10A-11E illustrate embodiments of self-supporting flexible containers (that are not stand up containers) having various overall shapes. Any of the embodiments of FIGS. 10A-11E can be configured according to any of the embodiments disclosed herein, including the embodiments of FIGS. 9A-9E. Any of the elements (e.g. structural support frames, structural support members, panels, dispensers, etc.) of the embodiments of FIGS. 10A-11E, can be configured according to any of the embodiments disclosed herein. While each of the embodiments of FIGS. 10A-11E illustrates a container with one dispenser, in various embodiments, each container can include multiple dispensers, according to any embodiment described herein. Part, parts, or about all, or approximately all, or substantially all, or nearly all, or all of each of the panels in the embodiments of FIGS. 10A-11E is suitable to display any kind of indicia. Each of the top and bottom panels in the embodiments of FIGS. 10A-11E is configured to be a nonstructural panel, overlaying product space(s) disposed within the flexible container, however, in various embodiments, one or more of any kind of decorative or structural element (such as a rib, protruding from an outer surface) can be joined to part, parts, or about all, or approximately all, or substantially all, or nearly all, or all of any of these panels. For clarity, not all structural details of these flexible containers are illustrated in FIGS. 10A-11E, however any of the embodiments of FIGS. 10A-11E can be configured to include any structure or feature for flexible containers, disclosed herein.

Figure 10B:
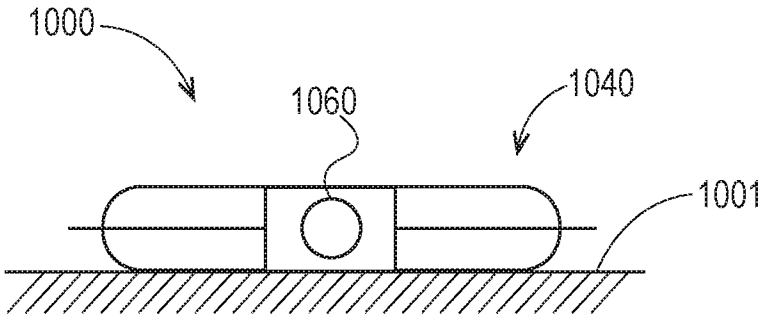
FIG. 10B illustrates an end view of the flexible container of FIG. 10A.
Figure 10A:
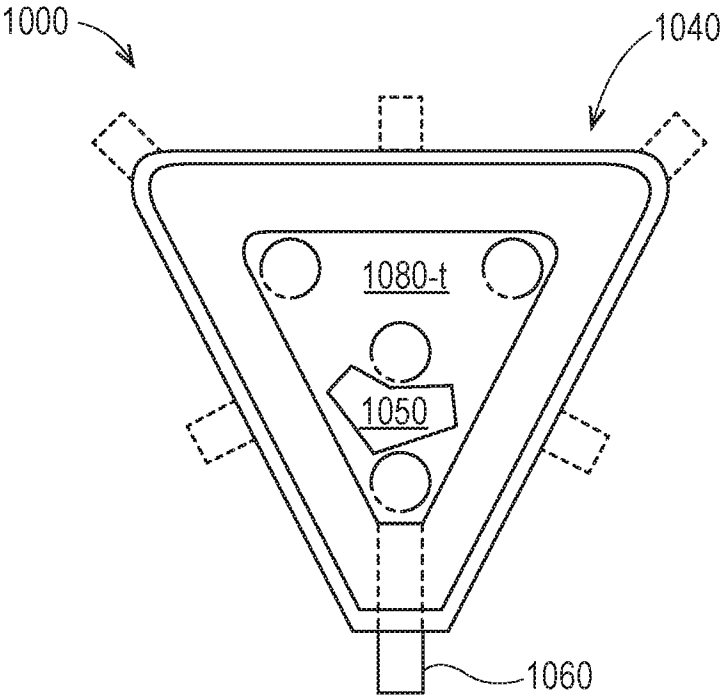
FIG. 10A illustrates a top view of an embodiment of a self-supporting flexible container, having an overall shape like a triangle.

FIG. 10A illustrates a top view of an embodiment of a self-supporting flexible container 1000 (that is not a stand up flexible container) having a product space 1050 and an overall shape like a triangle. However, in various embodiments, a self-supporting flexible container can have an overall shape like a polygon having any number of sides. The support frame 1040 is formed by structural support members disposed along the edges of the triangular shape and joined together at their ends. The structural support members define a triangular shaped top panel 1080-*t*, and a triangular shaped bottom panel (not shown). The top panel 1080-*t* and the bottom panel are about flat, however in various embodiments, part, parts, or about all, or approximately all, or substantially all, or nearly all, or all of any of the side panels can be approximately flat, substantially flat, nearly flat, or completely flat. The container 1000 includes a dispenser 1060, which is configured to dispense one or more fluent products from one or more product spaces disposed within the container 1000. In the embodiment of FIG. 10A, the dispenser 1060 is disposed in the center of the front, however, in various alternate embodiments, the dispenser 1060 can be disposed anywhere else on the top, sides, or bottom, of the container 1000. FIG. 10A includes exemplary additional/alternate locations for a dispenser (illustrated as phantom lines). FIG. 10B illustrates an end view of the flexible container 1000 of FIG. 10B, resting on a horizontal support surface 1001.

Figure 10E:
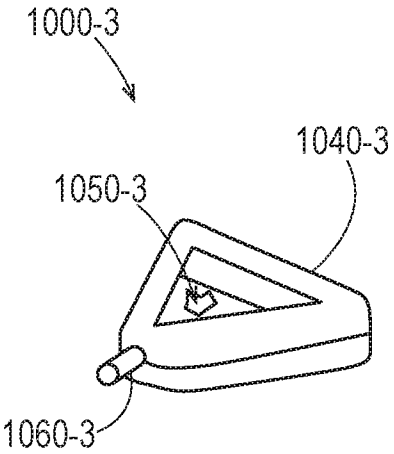
FIG. 10E illustrates a perspective view of an alternative embodiment of the self-supporting flexible container of FIG. 10A, including an external structural support frame.
Figure 10D:
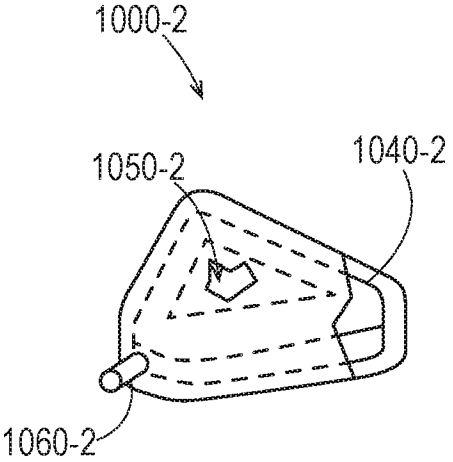
FIG. 10D illustrates a perspective view of an alternative embodiment of the self-supporting flexible container of FIG. 10A, including an internal structural support frame.
Figure 10C:
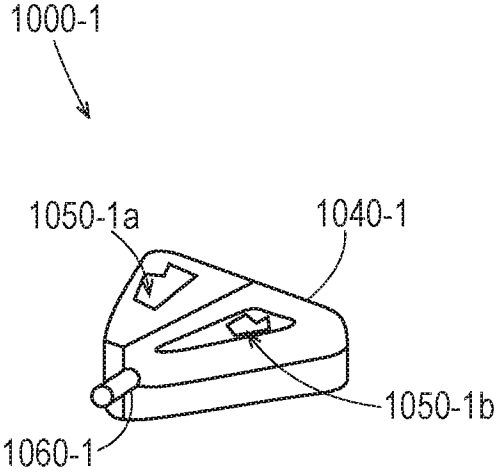
FIG. 10C illustrates a perspective view of an alternative embodiment of the self-supporting flexible container of FIG. 10A, including an asymmetric structural support frame.

FIG. 10C illustrates a perspective view of a container 1000-1, which is an alternative embodiment of the self-supporting flexible container 1000 of FIG. 10A, including an asymmetric structural support frame 1040-1, a first portion of the product space 1050-1*b*, a second portion of the product space 1050-1*a*, and a dispenser 1060-1, configured in the same manner as the embodiment of FIG. 9C, except based on the container 1000. FIG. 10D illustrates a perspective view of a container 1000-2, which is an alternative embodiment of the self-supporting flexible container 1000 of FIG. 10A, including an internal structural support frame 1040-2, a product space 1050-2, and a dispenser 1060-2, configured in the same manner as the embodiment of FIG. 9D, except based on the container 1000. FIG. 10E illustrates a perspective view of a container 1000-3, which is an alternative embodiment of the self-supporting flexible container 1000 of FIG. 10A, including an external structural support frame 1040-3, a non-integral product space 1050-3 joined to and disposed within the frame 1040-3, and a dispenser 1060-3, configured in the same manner as the embodiment of FIG. 9E, except based on the container 1000.

Figure 11B:
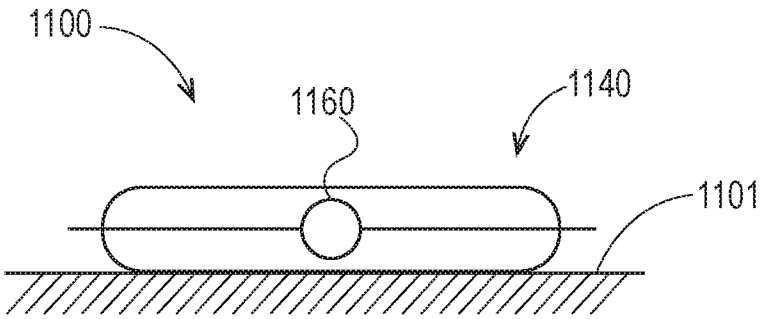
FIG. 11B illustrates an end view of the flexible container of FIG. 11A.
Figure 11A:
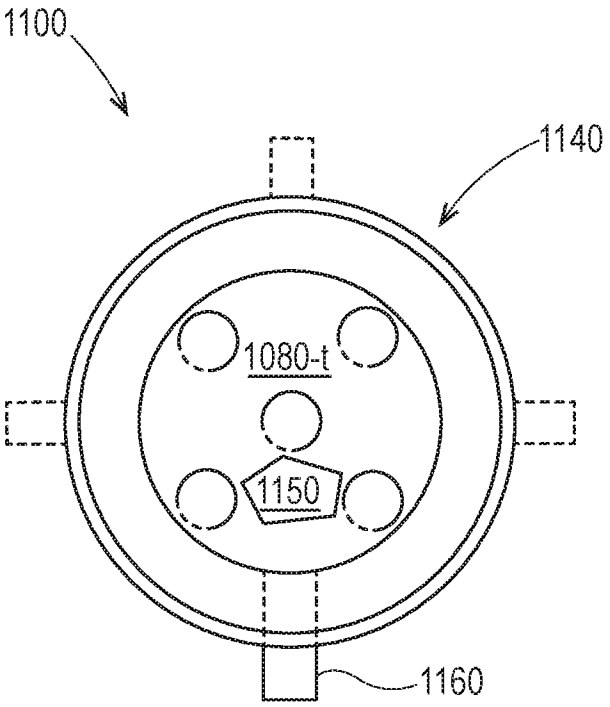
FIG. 11A illustrates a top view of an embodiment of a self-supporting flexible container, having an overall shape like a circle.

FIG. 11A illustrates a top view of an embodiment of a self-supporting flexible container 1100 (that is not a stand up flexible container) having a product space 1150 and an overall shape like a circle. The support frame 1140 is formed by structural support members disposed around the circumference of the circular shape and joined together at their ends. The structural support members define a circular shaped top panel 1180-*t*, and a circular shaped bottom panel (not shown). The top panel 1180-*t* and the bottom panel are about flat, however in various embodiments, part, parts, or about all, or approximately all, or substantially all, or nearly all, or all of any of the side panels can be approximately flat, substantially flat, nearly flat, or completely flat. The container 1100 includes a dispenser 1160, which is configured to dispense one or more fluent products from one or more product spaces disposed within the container 1100. In the embodiment of FIG. 11A, the dispenser 1160 is disposed in the center of the front, however, in various alternate embodiments, the dispenser 1160 can be disposed anywhere else on the top, sides, or bottom, of the container 1100. FIG. 11A includes exemplary additional/alternate locations for a dispenser (illustrated as phantom lines). FIG. 11B illustrates an end view of the flexible container 1100 of FIG. 10B, resting on a horizontal support surface 1101.

Figure 11E:
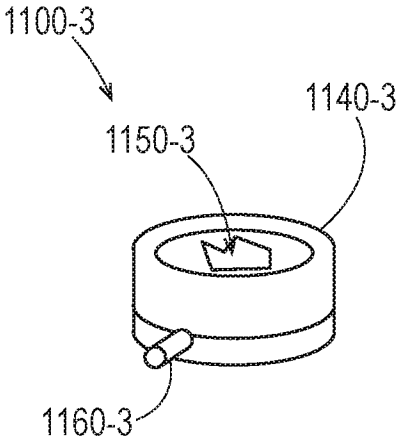
FIG. 11E illustrates a perspective view of an alternative embodiment of the self-supporting flexible container of FIG. 11A, including an external structural support frame.
Figure 11D:
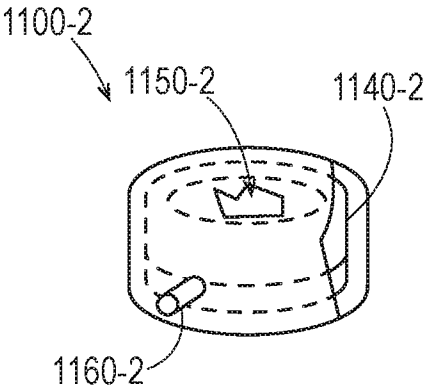
FIG. 11D illustrates a perspective view of an alternative embodiment of the self-supporting flexible container of FIG. 11A, including an internal structural support frame.
Figure 11C:
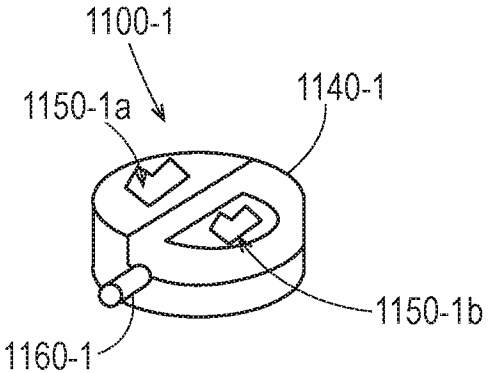
FIG. 11C illustrates a perspective view of an alternative embodiment of the self-supporting flexible container of FIG. 11A, including an asymmetric structural support frame.

FIG. 11C illustrates a perspective view of a container 1100-1, which is an alternative embodiment of the self-supporting flexible container 1100 of FIG. 11A, including an asymmetric structural support frame 1140-1, a first portion of the product space 1150-1*b*, a second portion of the product space 1150-1*a*, and a dispenser 1160-1, configured in the same manner as the embodiment of FIG. 9C, except based on the container 1100. FIG. 11D illustrates a perspective view of a container 1100-2, which is an alternative embodiment of the self-supporting flexible container 1100 of FIG. 11A, including an internal structural support frame 1140-2, a product space 1150-2, and a dispenser 1160-2, configured in the same manner as the embodiment of FIG. 9D, except based on the container 1100. FIG. 11E illustrates a perspective view of a container 1100-3, which is an alternative embodiment of the self-supporting flexible container 1100 of FIG. 11A, including an external structural support frame 1140-3, a non-integral product space 1150-3 joined to and disposed within the frame 1140-3, and a dispenser 1160-3, configured in the same manner as the embodiment of FIG. 9E, except based on the container 1100.

In additional embodiments, any self-supporting container with a structural support frame, as disclosed herein, can be configured to have an overall shape that corresponds with any other known three-dimensional shape. For example, any self-supporting container with a structural support frame, as disclosed herein, can be configured to have an overall shape (when observed from a top view) that corresponds with a rectangle, a polygon (having any number of sides), an oval, an ellipse, a star, or any other shape, or combinations of any of these.

Figure 12A:
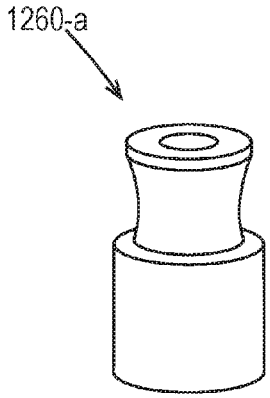
FIG. 12A illustrates an isometric view of push-pull type dispenser.
Figure 12B:
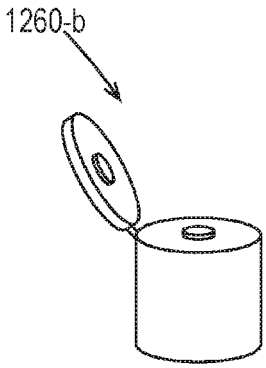
FIG. 12B illustrates an isometric view of dispenser with a flip-top cap.
Figure 12C:
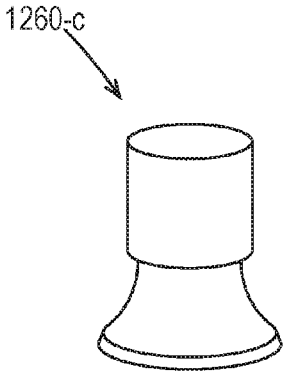
FIG. 12C illustrates an isometric view of dispenser with a screw-on cap.
Figure 12D:
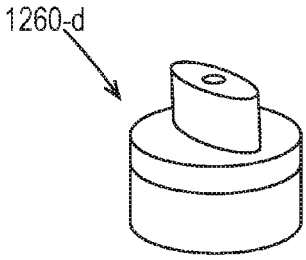
FIG. 12D illustrates an isometric view of rotatable type dispenser.
Figure 12E:
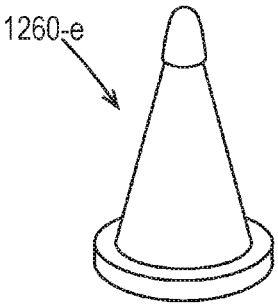
FIG. 12E illustrates an isometric view of nozzle type dispenser with a cap.
Figures 13A, 13B, 13C, 13D:
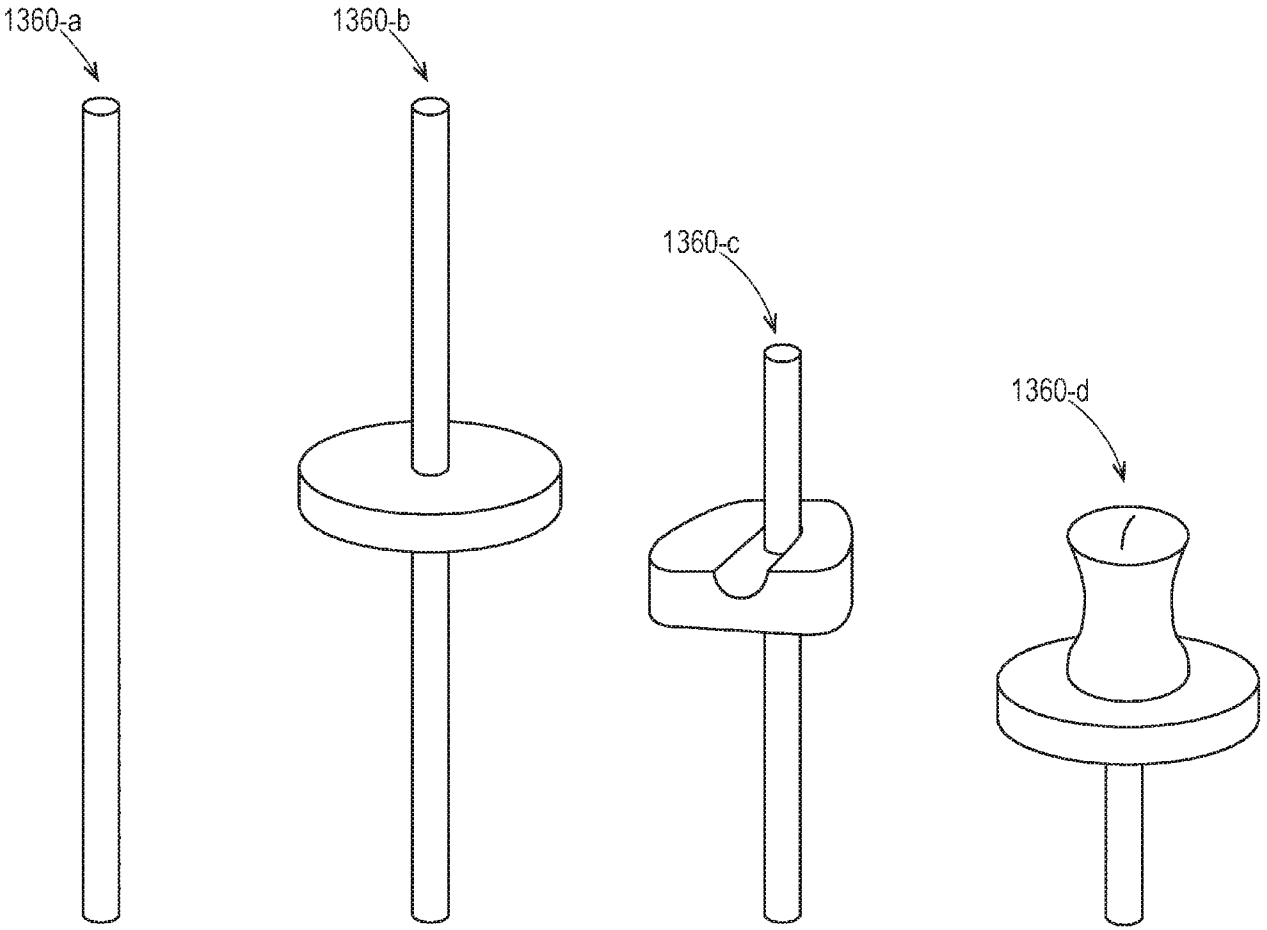
FIG. 13A illustrates an isometric view of straw dispenser.
FIG. 13B illustrates an isometric view of straw dispenser with a lid.
FIG. 13C illustrates an isometric view of flip up straw dispenser.
FIG. 13D illustrates an isometric view of straw dispenser with bite valve.
Figure 14A:
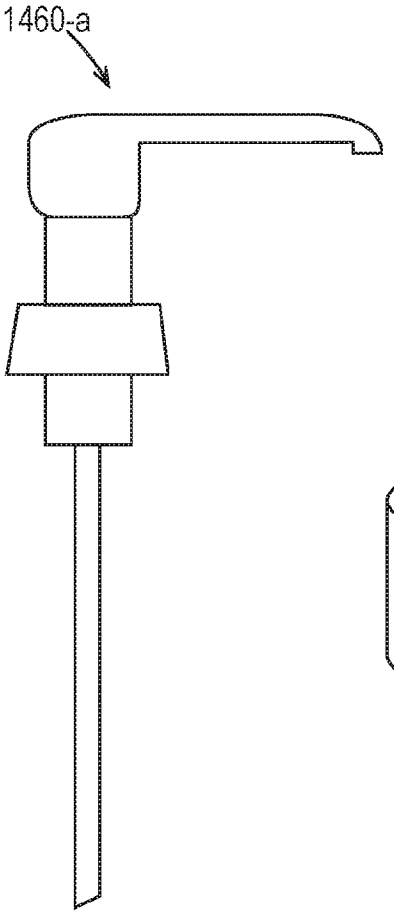
FIG. 14A illustrates an isometric view of pump type dispenser.
Figure 14B:
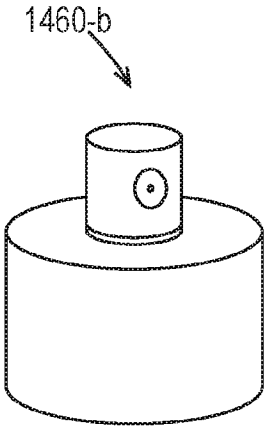
FIG. 14B illustrates an isometric view of pump spray type dispenser.
Figure 14C:
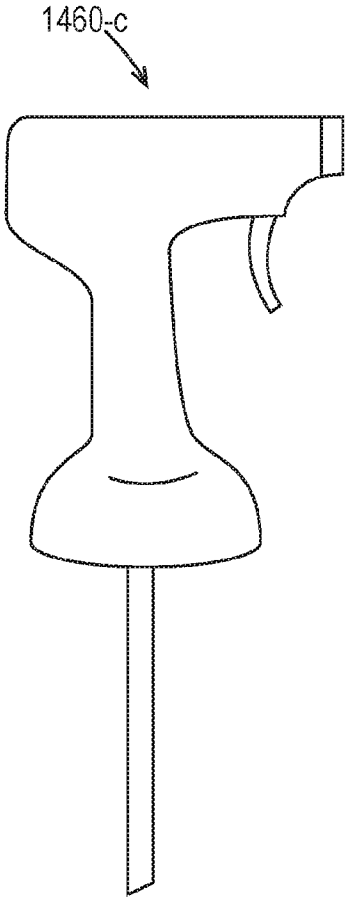
FIG. 14C illustrates an isometric view of trigger spray type dispenser.

FIGS. 12A-14C illustrate various exemplary dispensers, which can be used with the flexible containers disclosed herein. FIG. 12A illustrates an isometric view of push-pull type dispenser 1260-*a*. FIG. 12B illustrates an isometric view of dispenser with a flip-top cap 1260-*b*. FIG. 12C illustrates an isometric view of dispenser with a screw-on cap 1260-*c*. FIG. 12D illustrates an isometric view of rotatable type dispenser 1260-*d*. FIG. 12E illustrates an isometric view of nozzle type dispenser with a cap 1260-*d*. FIG. 13A illustrates an isometric view of straw dispenser 1360-*a*. FIG. 13B illustrates an isometric view of straw dispenser with a lid 1360-*b*. FIG. 13C illustrates an isometric view of flip up straw dispenser 1360-*c*. FIG. 13D illustrates an isometric view of straw dispenser with bite valve 1360-*d*. FIG. 14A illustrates an isometric view of pump type dispenser 1460-*a*, which can, in various embodiments be a foaming pump type dispenser. FIG. 14B illustrates an isometric view of pump spray type dispenser 1460-*b*. FIG. 14C illustrates an isometric view of trigger spray type dispenser 1460-*c*.

Figure 15C:
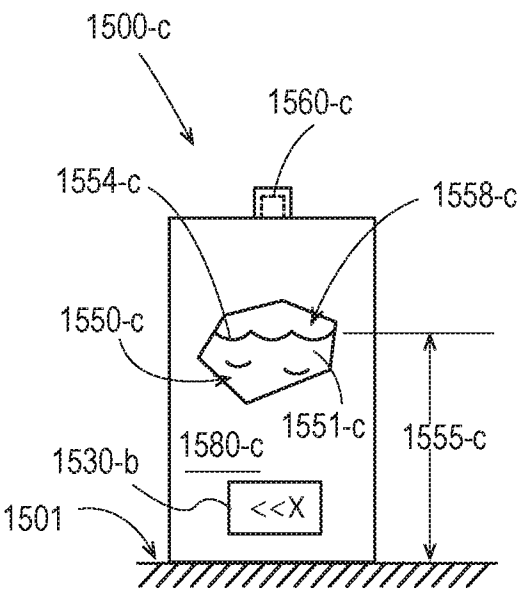
Fig. 15C PRIOR ART
FIG. 15C illustrates a front view of the rigid container of FIG. 15A, having a third amount of a fluent product, which is less than the first amount, according to the prior art.
Figure 15B:
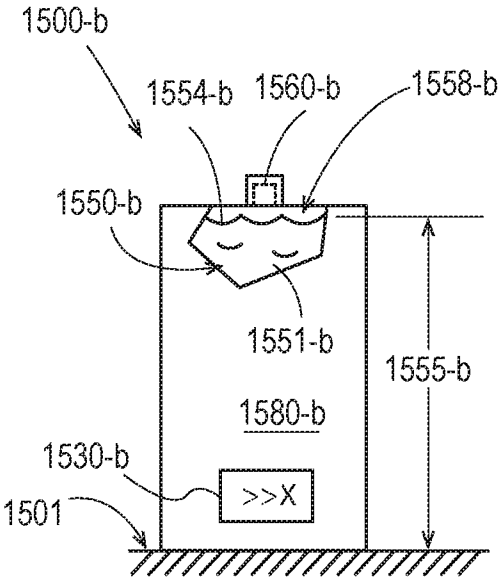
Fig. 15B PRIOR ART
FIG. 15B illustrates a front view of the rigid container of FIG. 15A, having a second amount of a fluent product, which is greater than the first amount, according to the prior art.
Figure 15A:
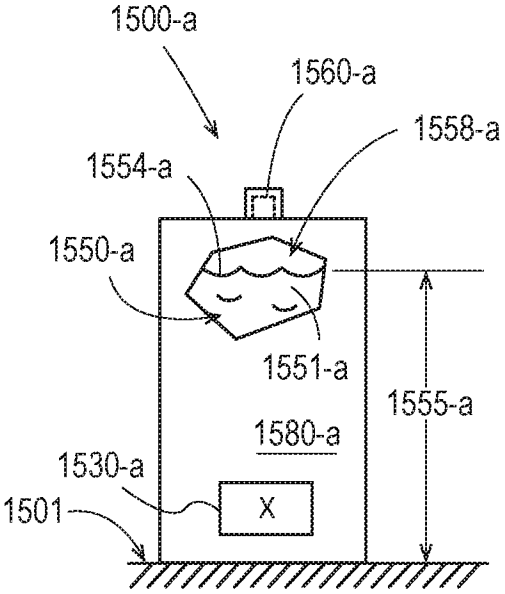
Fig. 15A PRIOR ART
FIG. 15A illustrates a front view of a rigid container, having a first amount of a fluent product, according to the prior art.

Together, FIGS. 15A-15C illustrate an embodiment of a conventional rigid container wherein fill height varies in proportion to the amount of fluent product in the container's product spaces.

FIG. 15A illustrates a front view of a rigid container 1500-*a*, having a first actual amount of a liquid fluent product 1551-*a*, according to the prior art. The rigid container 1500-*a* is a conventional molded bottle, with a top, bottom, and an outer wall 1580-*a*, together forming an overall shape that is cylindrical. The rigid container 1500-*a* is standing upright with its bottom resting on a horizontal support surface 1501. The rigid container 1500-*a* includes a product space 1550-*a* that is visible in FIG. 15A through a portion of the outer wall 1580-*a* that is illustrated as broken away. The product space 1550-*a* has a particular size and is also cylindrical. The fluent product 1551-*a* is disposed in the product space 1550-*a*. The top of the rigid container 1500-*a* includes a dispenser 1560-*a* that is closed by a cap. An external amount indicium 1530-*a* is disposed on the outside of the outer wall 1580-*a*. The external amount indicium 1530-*a* indicates a particular listed amount (designated "X") of the fluent product 1551-*a* that is being offered for sale with the container 1500-*a*. In the embodiment of FIG. 15A, the rigid container 1500-*a* contains a first actual amount of the fluent product 1551-*a*, wherein the first actual amount is equal to the particular listed amount indicated by the external amount indicium 1530-*a*. Inside the product space 1550-*a*, the fluent product 1551-*a* forms a fill line 1554-*a* at a closed fill height 1555-*a*; the fluent product 1551-*a* sits below the fill line 1554-*a* and a headspace 1558-*a* exists above the fill line 1554-*a*. Since the product space 1550-*a* is cylindrical, the first actual amount of the fluent product 1551-*a* in the container 1500-*a* is equal to a horizontal cross-sectional area of the product space 1550-*a* multiplied by a vertical height of the fluent product 1551-*a* within the product space 1550-*a*. As a result, for the container 1500-*a*, a fill height will vary in proportion to an amount of fluent product in the product space 1550-*a*.

FIG. 15B illustrates a front view of a rigid container 1500-*b*, having a second amount of a liquid fluent product 1551-*b*, according to the prior art. The rigid container 1500-*b* is the same as the rigid container 1500-*a* of FIG. 15A, with like-numbered elements configured in the same way, except as described below. The external amount indicium 1530-*b* indicates a particular listed amount (designated ">>X") of the fluent product 1551-*b* that is being offered for sale with the container 1500-*b*. In the embodiment of FIG. 15B, the rigid container 1500-*b* contains a second actual amount of the fluent product 1551-*b*, wherein the second actual amount is equal to the particular listed amount indicated by the external amount indicium 1530-*b*. In FIG. 15B, the second listed amount of the fluent product 1551-*b* is greater than the first listed amount of the fluent product 1551-*a* of FIG. 15A, and the second actual amount of the fluent product 1551-*b* in the container 1500-*b* is greater than the first actual amount of the fluent product 1551-*a* in the container 1500-*a* of FIG. 15A. The fluent product 1551-*b* forms a fill line 1554-*b* at a closed fill height 1555-*b*. Since the product space 1550-*b* is the same size and shape as the product space 1550-*a*, the closed fill height 1555-*b* is higher than the closed fill height 1555-*a* of FIG. 15A. The closed fill height 1555-*b* is greater than the closed fill height 1555-*a* in the same proportion that the second actual amount of the fluent product 1551-*b* is greater than the first actual amount of the fluent product 1551-*a*.

FIG. 15C illustrates a front view of a rigid container 1500-*c*, having a third amount of a liquid fluent product 1551-*c*, according to the prior art. The rigid container 1500-*c* is the same as the rigid container 1500-*a* of FIG. 15A, with like-numbered elements configured in the same way, except as described below. The external amount indicium 1530-*c* indicates a particular listed amount (designated "<<X") of the fluent product 1551-*c* that is being offered for sale with the container 1500-*c*. In the embodiment of FIG. 15C, the rigid container 1500-*c* contains a third actual amount of the fluent product 1551-*c*, wherein the third actual amount is equal to the particular listed amount indicated by the external amount indicium 1530-*c*. In FIG. 15C, the third actual amount of the fluent product 1551-*c* in the container 1500-*c* is less than the first actual amount of the fluent product 1551-*a* in the container 1500-*a* of FIG. 15A. The fluent product 1551-*c* forms a fill line 1554-*c* at a closed fill height 1555-*c* above the horizontal support surface 1501. Since the product space 1550-*c* is the same size and shape as the product space 1550-*a*, the closed fill height 1555-*c* is lower than the closed fill height 1555-*a* of FIG. 15A. The closed fill height 1555-*c* is less than the closed fill height 1555-*a* in the same proportion that the third actual amount of the fluent product 1551-*c* is less than the first actual amount of the fluent product 1551-*a*.

FIGS. 16A-16D illustrate flexible containers with fluent product, wherein the containers are in various conditions of being opened or closed, sealed or vented.

Figure 16B:
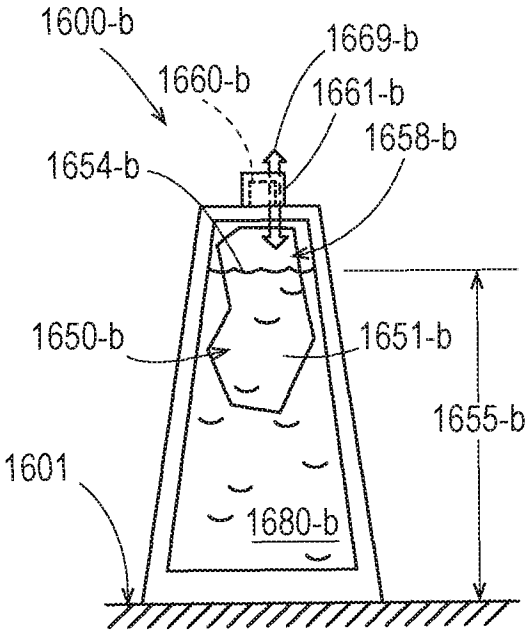
FIG. 16B illustrates a front view of a flexible container, which is closed by a cap but vented through the cap.
Figure 16A:
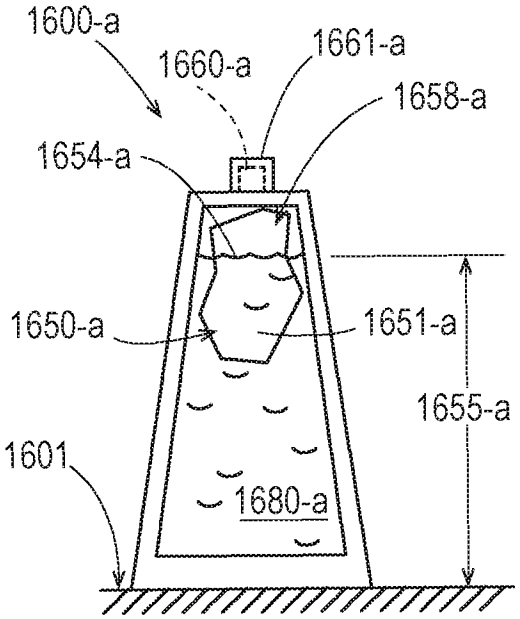
FIG. 16A illustrates a front view of a flexible container, which is closed and sealed by a cap.

FIG. 16A illustrates a front view of a flexible container 1600-*a*, which is closed and sealed by a cap 1661-*a*. The flexible container 1600-*a* is the same as the flexible container 200 of FIGS. 2A-2D, with like-numbered elements configured in the same way, except as described below. The container 1600-*a* is standing upright with its bottom resting on a horizontal support surface 1601. The flexible container 1600-*a* includes a product space 1650-*a* that is visible in FIG. 16A through a transparent panel 1680-*a* that is illustrated as partially broken away. A fluent product 1651-*a* is disposed in the product space 1650-*a*. The top of the flexible container 1600-*a* includes a dispenser 1660-*a* that is closed and sealed by the cap 1661-*a*. Inside the product space 1650-*a*, the fluent product 1651-*a* forms a fill line 1654-*a* at a closed and sealed fill height 1655-*a*; the fluent product 1651-*a* sits below the fill line 1654-*a* and a headspace 1658-*a* exists above the fill line 1654-*a*. Since the flexible container 1600-*a* is closed and sealed, the product space 1650-*a* (including the headspace 1658-*a*) is hermetically sealed, with respect to the environment outside of the container 1600-*a*. As a result of being sealed, the pressure in the headspace 1658-*a* is not free to equalize with the pressure of the environment outside of the container 1600-*a*. So, the fill line 1654-*a* does not move up or down from any pressure equalization, and the closed and sealed fill height 1655-*a* is determined by hydrostatics. Any embodiment of flexible container disclosed herein, can also be configured to be closed and sealed as described in connection with the flexible container 1600-*a* of FIG. 16A, or with any additional or alternate structures described herein, or known in the art.

FIG. 16B illustrates a front view of a flexible container 1600-*b*, which is closed by a cap 1661-*b* but vented through the cap 1661-*b*. The flexible container 1600-*b* is the same as the flexible container 1600-*a* of FIG. 16A, with like-numbered elements configured in the same way, except as described below. The container 1600-*a* is standing upright with its bottom resting on a horizontal support surface 1601. The top of the flexible container 1600-*b* includes a dispenser 1660-*b* that is closed but not sealed by the cap 1661-*b*. Inside the product space 1650-*b*, the fluent product 1651-*b* forms a fill line 1654-*b* at a closed fill height 1655-*b*. Since the flexible container 1600-*b* is closed but not sealed by the cap 1661-*b*, the product space 1650-*b* (including the headspace 1658-*b*) is in fluid communication 1669-*b*, through the vented cap 1661-*b*, with the environment outside of the container 1600-*b*. As a result of not being sealed, the pressure in the headspace 1658-*b* can equalize with the pressure of the environment outside of the container 1600-*b*. So, the fill line 1654-*b* can move up or down as these pressures equalize, allowing the closed fill height 1655-*b* to vary somewhat. Any embodiment of flexible container disclosed herein can also be configured to be closed but not sealed as described in connection with the flexible container 1600-*b* of FIG. 16B, or with any additional or alternate structures described herein, or known in the art. When a flexible container that is sealed becomes vented (e.g. by opening a vent in a cap), the pressure in the headspace can equalize with the pressure of the environment, allowing the fill line to move from a closed and sealed fill height to a closed fill height.

Figure 16D:
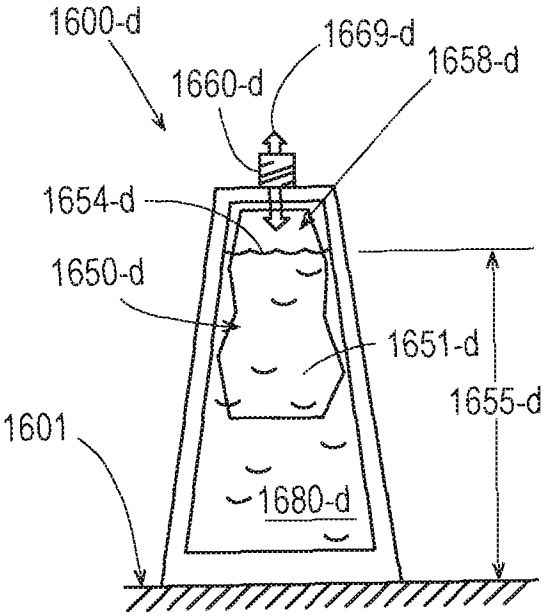
FIG. 16D illustrates a front view of the flexible container, which is vented through an open dispenser.
Figure 16C:
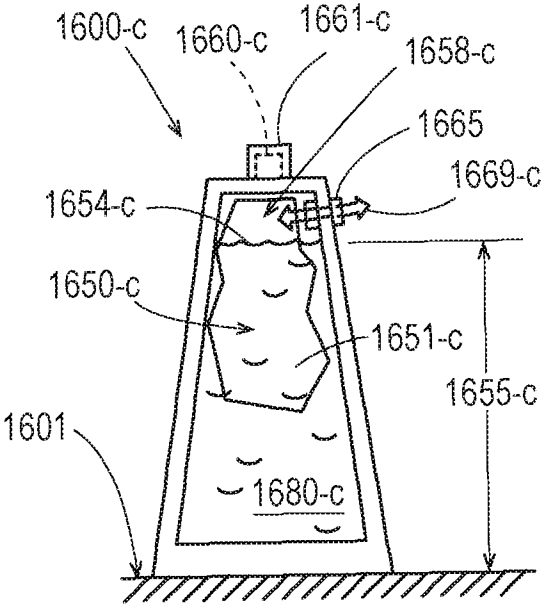
FIG. 16C illustrates a front view of the flexible container, which is closed by a cap, but vented through a vent.

FIG. 16C illustrates a front view of the flexible container 1600-*c*, which is closed by a cap 1661-*c*, but vented through a vent 1665. The flexible container 1600-*c* is the same as the flexible container 1600-*a* of FIG. 16A, with like-numbered elements configured in the same way, except as described below. The container 1600-*a* is standing upright with its bottom resting on a horizontal support surface 1601. The flexible container 1600-*c* includes the vent 1665. Inside the product space 1650-*c*, the fluent product 1651-*c* forms a fill line 1654-*c* at a closed fill height 1655-*c*. Since the flexible container 1600-*b* is closed by the cap 1661-*b* but vented through the vent 1665, the product space 1650-*c* (including the headspace 1658-*c*) is in fluid communication 1669-*c*, through the vent 1665, with the environment outside of the container 1600-*c*. As a result of not being sealed, the pressure in the headspace 1658-*c* can equalize with the pressure of the environment outside of the container 1600-*c*. So, the fill line 1654-*c* can move up or down as these pressures equalize, allowing the closed fill height 1655-*c* to vary somewhat. Any embodiment of flexible container disclosed herein can also be configured to be closed but vented as described in connection with the flexible container 1600-*c* of FIG. 16C, or with any additional or alternate structures described herein, or known in the art. When a flexible container that is sealed becomes vented (e.g. by opening a vent in the container), the pressure in the headspace can equalize with the pressure of the environment, allowing the fill line to move from a closed and sealed fill height to a closed fill height.

FIG. 16D illustrates a front view of the flexible container 1600-*d*, which is vented through an open dispenser 1660-*d*. The flexible container 1600-*d* is the same as the flexible container 1600-*a* of FIG. 16A, with like-numbered elements configured in the same way, except as described below. The container 1600-*a* is standing upright with its bottom resting on a horizontal support surface 1601. The top of the flexible container 1600-*d* includes a dispenser 1660-*d* that is open. Inside the product space 1650-*d*, the fluent product 1651-*d* forms a fill line 1654-*d* at an open fill height 1655-*d*. Since the flexible container 1600-*d* is open and vented through the dispenser 1660-*d*, the product space 1650-*d* (including the headspace 1658-*d*) is in fluid communication 1669-*d*, through the dispenser 1660-*d*, with the environment outside of the container 1600-*d*. As a result of not being sealed, the pressure in the headspace 1658-*d* can equalize with the pressure of the environment outside of the container 1600-*d*. So, the fill line 1654-*d* can move up or down as these pressures equalize, allowing the open fill height 1655-*d* to vary somewhat. Any embodiment of flexible container disclosed herein can also be configured to be open and vented as described in connection with the flexible container 1600-*d* of FIG. 16D, or with any additional or alternate structures described herein, or known in the art. When a flexible container that is sealed becomes unsealed (e.g. by opening a dispenser), the pressure in the headspace can also equalize with the pressure of the environment, allowing the fill line to move from a closed and sealed fill height to an open fill height.

Figure 17C:
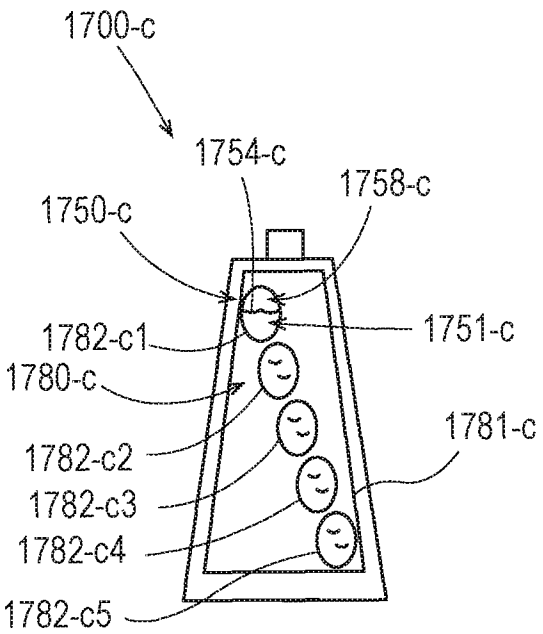
FIG. 17C illustrates a front view of a flexible container with a product space is partially visible through several shaped product viewing portions.
Figure 17B:
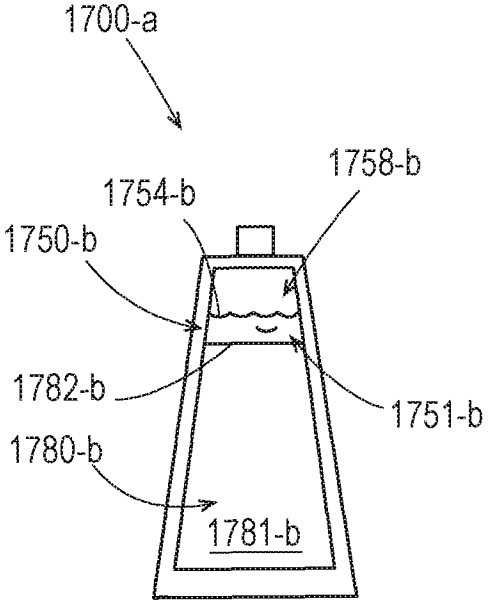
FIG. 17B illustrates a front view of a flexible container with a product space that is partially visible through a product viewing portion that occupies a top portion of a panel on the container.
Figure 17A:
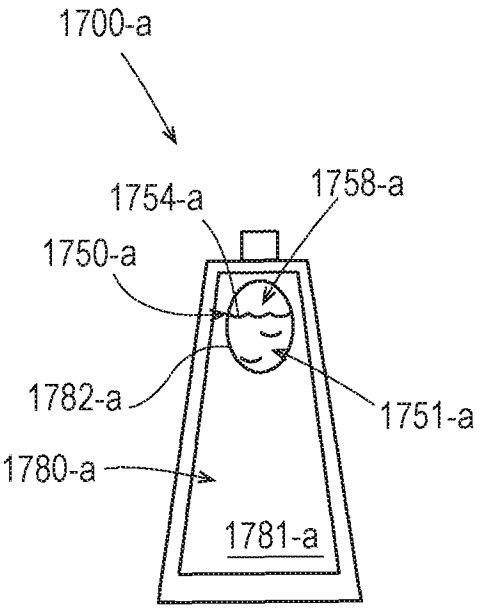
FIG. 17A illustrates a front view of a flexible container with a product space that is partially visible through one shaped product viewing portion.

FIG. 17A illustrates a front view of a flexible container 1700-*a*. The flexible container 1700-*a* is the same as the flexible container 200 of FIGS. 2A-2D, with like-numbered elements configured in the same way, except as described below. The container 1700-*a* is standing upright with its bottom resting on a horizontal support surface (not shown). The flexible container 1700-*a* includes a product space 1750-*a* that is partially visible in FIG. 17A through a product viewing portion 1782-*a*. The product viewing portion 1782-*a* is made from a flexible material that is transparent, but a product viewing portion can also be made from one or more flexible material that are semi-transparent and/or translucent. While the flexible container 1700-*a* has one product viewing portion 1782-*a*, a flexible container can have any number of product viewing portions. The product viewing portion 1782-*a* is an oval shaped portion however a product viewing portion can have any convenient size and shape. The product viewing portion 1782-*a* is laterally centered on a top portion of a panel 1780-*a*, however a product viewing portion can be disposed on any part of a flexible container. The product viewing portion 1782-*a* is surrounded on all sides by an opaque portion 1781-*a* of the panel 1780-*a*, however this particular relationship with surrounding elements is not required. The product space 1750-*a* is filled with a fluent product 1751-*a*. Inside the product space 1750-*a*, the fluent product 1751-*a* forms a fill line 1754-*a*; the fluent product 1751-*a* sits below the fill line 1754-*a* and a headspace 1758-*a* exists above the fill line 1754-*a*. In the embodiment of FIG. 17A, at least a portion of the fill line 1754-*a* is visible through the product viewing portion 1782-*a*, from outside of the flexible container 1700-*a*. So, a fill height for the fluent product 1751-*a* can be seen when the product space 1750-*a* of the flexible container 1700-*a* is filled. Any embodiment of a flexible container disclosed herein can include the product viewing portion 1782-*a* as described and illustrated in connection with flexible container 1700-*a* of FIG. 17A, including any alternative embodiments.

FIG. 17B illustrates a front view of a flexible container 1700-*b*. The flexible container 1700-*b* is the same as the flexible container 1700-*a* of FIG. 17A, with like-numbered elements configured in the same way, except as described below. The flexible container 1700-*b* includes a product space 1750-*b* that is partially visible in FIG. 17B through a product viewing portion 1782-*b*. The product viewing portion 1782-*b* is made from a flexible material that is transparent. The product viewing portion 1782-*b* is a trapezoidal shaped portion that occupies a top portion of a panel 1780-*b*. The product viewing portion 1782-*b* is bounded on its top and sides by an outer extent of the panel 1780-*b* and bounded on its bottom by an opaque portion 1781-*b* of the panel 1780-*b*, however this particular relationship with surrounding elements is not required. In the embodiment of FIG. 17B, all of the fill line 1754-*b* is visible through the product viewing portion 1782-*b*, from outside of the flexible container 1700-*b*. So, a fill height for the fluent product 1751-*a* can be seen when the product space 1750-*a* of the flexible container 1700-*a* is filled. Any embodiment of a flexible container disclosed herein can include the product viewing portion 1782-*b* as described and illustrated in connection with flexible container 1700-*b* of FIG. 17B, including any alternative embodiments.

FIG. 17C illustrates a front view of a flexible container 1700-*c*. The flexible container 1700-*c* is the same as the flexible container 1700-*a* of FIG. 17A, with like-numbered elements configured in the same way, except as described below. The flexible container 1700-*b* includes a product space 1750-*c* that is partially visible in FIG. 17C through five separate product viewing portions 1782-*c*1, 1782-*c*2, 1782-*c*3, 1782-*c*4, and 1782-*c*5. Each of the product viewing portions 1782-*c*1 through 1782-*c*5 is made from a flexible material that is transparent. Each of the product viewing portions 1782-*c*1 through 1782-*c*5 is an oval shaped portion. Each of the product viewing portions 1782-*c*1 through 1782-*c*5 is surrounded on all sides by an opaque portion 1781-*c* of the panel 1780-*c*. The product viewing portions 1782-*c*1 through 1782-*c*5 are distributed longitudinally and staggered laterally (with respect to each other), from a top portion of a panel 1780-*c* to a bottom portion of the panel

1780-*c*; however, in various embodiments product viewing portions may not be staggered laterally, or may be distributed over part, parts, or all of a product space or a panel overlaying a product space in any convenient arrangement. In the embodiment of FIG. 17C, at least a portion of the fill line 1754-*c* is visible through the product viewing portion 1782-*c*1, from outside of the flexible container 1700-*c*. So, a fill height for the fluent product 1751-*c* can be seen in the product viewing portion 1782-*c*1 when the product space 1750-*c* of the flexible container 1700-*c* is filled. And, since the product viewing portions 1782-*c*1 through 1782-*c*5 are distributed from top to bottom, the product viewing portions 1782-*c*1 through 1782-*c*5 allow the fluent product 1751-*c* in the product space 1750-*c* to be seen at a number of locations; a fill height for the fluent product 1751-*a* can also be seen at various ranges of fill heights (corresponding with the heights of the product viewing portions 1782-*c*1 through 1782-*c*5) as the flexible container 1750-*c* is emptied. As a result, the product viewing portions 1782-*c*1 through 1782-*c*5 are considered to form a visual fill gauge for the product space 1750-*c*. Any embodiment of a flexible container disclosed herein can include any or all of the plurality of product viewing portions 1782-*c*1 through 1782-*c*5 as described and illustrated in connection with flexible container 1700-*b* of FIG. 17B, including any alternative embodiments.

Figure 17E:
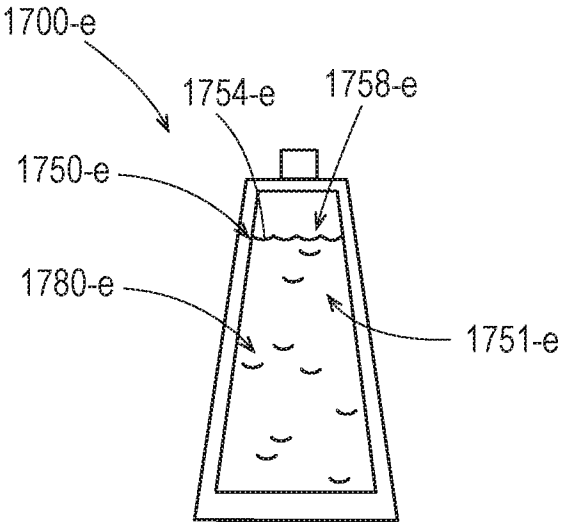
FIG. 17E illustrates a front view of a flexible container with a product space that is fully visible through a product viewing portion that occupies all of a panel on the container.
Figure 17D:
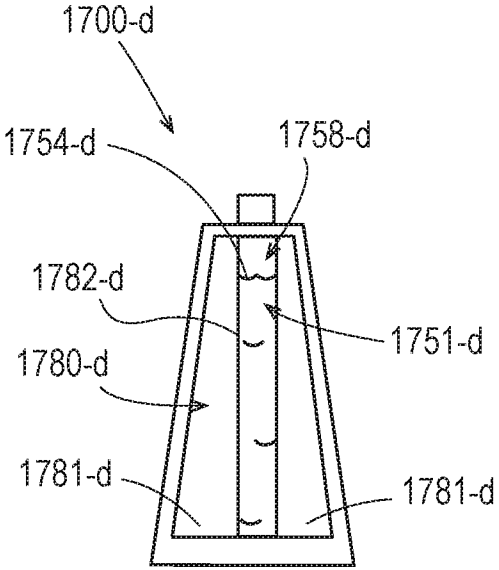
FIG. 17D illustrates a front view of a flexible container with a product space that is partially visible through an elongated product viewing portion that is a visual fill gauge.

FIG. 17D illustrates a front view of a flexible container 1700-*d*. The flexible container 1700-*d* is the same as the flexible container 1700-*a* of FIG. 17A, with like-numbered elements configured in the same way, except as described below. The flexible container 1700-*d* includes a product space 1750-*d* that is partially visible in FIG. 17D through a product viewing portion 1782-*d*. The product viewing portion 1782-*d* is made from a flexible material that is transparent. The product viewing portion 1782-*d* is an elongated, rectangular shaped portion. The product viewing portion 1782-*d* is bounded on its top and bottom by an outer extent of a panel 1780-*d* and bounded on its sides by opaque portions 1781-*d* of the panel 1780-*d*. The product viewing portion 1782-*d* extends continuously longitudinally, from a top portion of the panel 1780-*d* to a bottom portion of the panel 1780-*d*; however, in various embodiments an product viewing portion may be discontinuous or may also extend laterally or may extend over part, parts, or all of a product space or a panel overlaying a product space in any convenient arrangement. In the embodiment of FIG. 17D, at least a portion of the fill line 1754-*d* is visible through a top portion of the product viewing portion 1782-*d*, from outside of the flexible container 1700-*d*. So, a fill height for the fluent product 1751-*d* can be seen in the product viewing portion 1782-*d* when the product space 1750-*d* of the flexible container 1700-*d* is filled. And, since the product viewing portion 1782-*d* extends continuously from top to bottom, the product viewing portion 1782-*d* allows the fluent product 1751-*d* in the product space 1750-*d* to be seen at a number of locations; a fill height for the fluent product 1751-*d* can also be seen at any fill height as the flexible container 1750-*d* is emptied. As a result, the product viewing portion 1782-*d* is considered to form a visual fill gauge for the product space 1750-*d*. Any embodiment of a flexible container disclosed herein can include a product viewing portion 1782-*d* as described and illustrated in connection with flexible container 1700-*d* of FIG. 17D, including any alternative embodiments.

FIG. 17E illustrates a front view of a flexible container 1700-*d*. The flexible container 1700-*d* is the same as the flexible container 1700-*a* of FIG. 17A, with like-numbered elements configured in the same way, except as described below. The flexible container 1700-*d* includes a product space 1750-*d* that is fully visible in FIG. 17E through a product viewing portion 1782-*e*. The product viewing portion 1782-*e* is made from a flexible material that is transparent. The product viewing portion 1782-*e* is bounded on its top, bottom, and sides by an outer extent of a panel 1780-*e*. The product viewing portion 1782-*e* extends continuously longitudinally, from a top portion of the panel 1780-*e* to a bottom portion of the panel 1780-*e* and from a left portion of the panel 1780-*e* to a right portion of the panel 1780-*e*; however, in various embodiments an product viewing portion may be discontinuous (e.g. may include one or more opaque portions) or may only extend over part, parts, or all of a product space or a panel overlaying a product space in any convenient arrangement. In the embodiment of FIG. 17E, the fill line 1754-*e* is visible through a top portion of the product viewing portion 1782-*e*, from outside of the flexible container 1700-*e*. So, a fill height for the fluent product 1751-*e* can be seen in the product viewing portion 1782-*e* when the product space 1750-*e* of the flexible container 1700-*e* is filled. And, since the product viewing portion 1782-*e* extends continuously from top to bottom, the product viewing portion 1782-*e* allows the fluent product 1751-*e* in the product space 1750-*e* to be seen at a number of locations; a fill height for the fluent product 1751-*e* can also be seen at any fill height as the flexible container 1750-*e* is emptied. Any embodiment of a flexible container disclosed herein can include a product viewing portion 1782-*e* as described and illustrated in connection with flexible container 1700-*e* of FIG. 17E, including any alternative embodiments.

Figure 18:
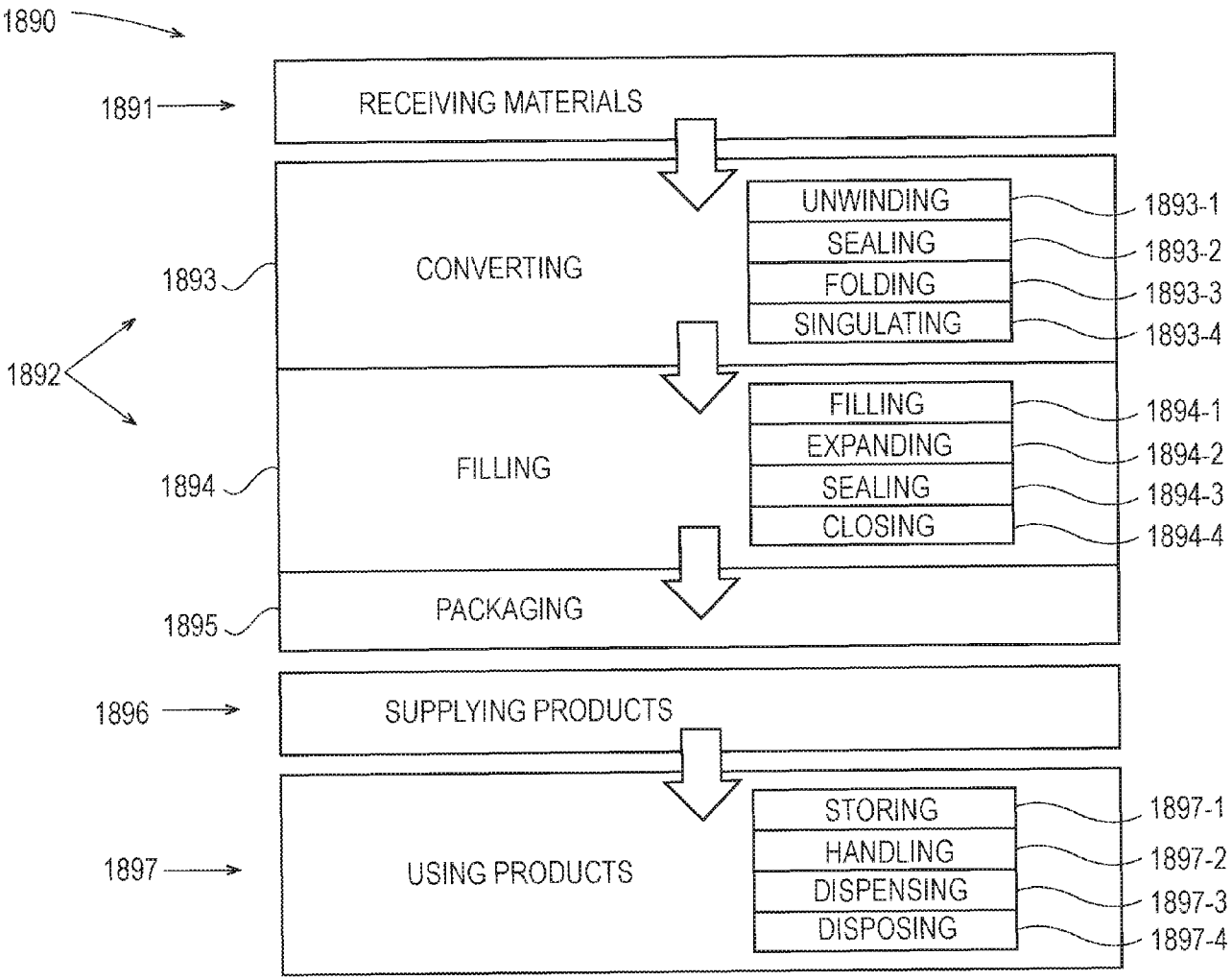
FIG. 18 is a flowchart illustrating a process of how a flexible container is made, supplied, and used.

FIG. 18 is a flowchart illustrating a process 1890 of how a product with a flexible container is made, supplied, and used. The process 1890 begins with receiving 1891 materials, then continues with the making 1892 of the product, followed by supplying 1896 the product, and finally ends with using 1897 the product.

The receiving 1891 of materials can include receiving any materials and/or ingredients for making the product (e.g. ingredients for making a fluent product) and/or the container for the product (e.g. flexible materials to be converted into a flexible container). The flexible materials can be any kind of suitable flexible material, as disclosed herein and/or as known in the art of flexible containers and/or in U.S. non-provisional application Ser. No. 13/889,061 filed May 7, 2013, entitled "Flexible Materials for Flexible Containers" published as US20130337244 and/or in U.S. non-provisional application Ser. No. 13/889,090 filed May 7, 2013, entitled "Flexible Materials for Flexible Containers" published as US20130294711, each of which is hereby incorporated by reference.

The making 1892 includes the processes of converting 1893, filling 1894, and packaging 1895. The converting 1893 process is the process for transforming one or more flexible materials and/or components, from the receiving 1891, into a flexible container, as described herein. The converting 1893 process includes the further processes of unwinding 1893-1, sealing 1893-2, and folding 1893-3 the flexible materials then (optionally) singulating 1893-4 the flexible materials into individual flexible containers. The filling process 1894 includes the further processes of filling 1894-1 one or more product spaces of the individual flexible containers, from the converting 1893, with one or more fluent products, expanding 1894-2 one or more structural support volumes with one or more expansion materials, then sealing 1894-3 the one or structural support frames and sealing 1894-3 and/or closing 1894-4 the one or more product spaces. The packaging 1895 process includes placing the filled product with a flexible container, from the filling 1894, into one or more packages (e.g. cartons, cases, shippers, etc.) as known in the art of packaging. In various embodiments of the process 1890, the packaging 1895 process may be omitted. In various embodiments, the processes of making 1892 can be performed in various orders, and additional/alternate processes for making flexible containers can be performed.

Any of the making 1892 processes can be accomplished according to any of the embodiments described here and/or as known in the art of making flexible containers and/or in U.S. non-provisional application Ser. No. 13/957,158 filed Aug. 1, 2013, entitled "Methods of Making Flexible Containers" published as US20140033654 and/or in U.S. non-provisional application Ser. No. 13/957,187 filed Aug. 1, 2013, entitled "Methods of Making Flexible Containers" published as US20140033655 and/or in U.S. provisional application 61/861,118 filed Aug. 1, 2013, entitled "Methods of Forming a Flexible Container" and/or in U.S. provisional application 61/900,450 filed Nov. 6, 2013, entitled "Flexible Containers and Methods of Forming the Same" and/or in U.S. provisional application 61/900,794 filed Nov. 6, 2013, entitled "Flexible Containers and Methods of Forming the Same" and/or in U.S. provisional application 61/900,805 filed Nov. 6, 2013, entitled "Flexible Containers and Methods of Making the Same" and/or in U.S. provisional application 61/900,810 filed Nov. 6, 2013, entitled "Flexible Containers and Methods of Making the Same," each of which is hereby incorporated by reference.

In a line-up of flexible containers, according to any of the embodiments disclosed herein, both or all of the flexible containers in the line-up can be made with a common folding pattern and/or a common sealing pattern, such that both or all of the flexible containers in the line-up can be made on the same machine for making 1892 (e.g. converting 1893, and/or filling 1894, and/or packaging 1895) and/or packaging 1895, as described in connection with embodiments of FIG. 18. As an example, a first flexible container in a line-up can be made using a particular model of a machine, while at the same time a second flexible container in the line-up can be made using the same particular model of the machine, but a different machine unit, according to embodiments disclosed herein. As another example, a first flexible container in a line-up can be made on a particular machine unit at a first time, and a second flexible container in the line-up can be made using the same particular machine unit at a second time that differs from the first time, according to embodiments disclosed herein.

A machine for making 1892 a flexible container, as described in connection with embodiments of FIG. 18, can include a particular set of unit operations for sealing (e.g. sealing 1893-2) flexible materials with a particular sealing pattern, resulting in a flexible container with a particular sealed configuration, as described herein. In any of the embodiments for a line-up of flexible containers, as described herein, the making of a first flexible container in the line-up and the making of the second flexible container in the line-up can use some or all of the same particular set of unit operations for sealing. By doing so, the same particular model of the machine, or even the same machine unit, can be used to make both a sealing pattern for the first flexible container and a sealing pattern for the second flexible container. As a result, the machine can switch from sealing the flexible container to sealing the second flexible container (or vice versa) without adding or removing any of the unit operations for sealing. In some embodiments, the machine can make such switches without changing parts in any of the unit operations for sealing. In other embodiments, the machine can make such switches without mechanically adjusting any of the unit operations for sealing.

A machine for making 1892 a flexible container, as described in connection with embodiments of FIG. 18, can include a particular set of unit operations for folding (e.g. folding 1893-3) flexible materials with a particular folding pattern, resulting in a flexible container with a particular folded configuration, as described herein. In any of the embodiments for a line-up of flexible containers, as described herein, the making of a first flexible container in the line-up and the making of the second flexible container in the line-up can use some or all of the same particular set of unit operations for folding. By doing so, the same particular model of the machine, or even the same machine unit, can be used to make both a folding pattern for the first flexible container and a folding pattern for the second flexible container. As a result, the machine can switch from folding the flexible container to folding the second flexible container (or vice versa) without adding or removing any of the unit operations for folding. In some embodiments, the machine can make such switches without changing parts in any of the unit operations for folding. In other embodiments, the machine can make such switches without mechanically adjusting any of the unit operations for folding.

In a line-up of flexible containers, according to any of the embodiments disclosed herein, the making (e.g. making 1892 of FIG. 18), of both or all of the flexible containers in the line-up can include an expanding (e.g. expanding 1894-2 of FIG. 18) of one or more structural support volumes with predetermined volumes and/pressures of one or more expansion materials, in various ways, as described below.

In a line-up of flexible containers, according to any of the embodiments described herein, a first flexible container can have a first predetermined volume of a first expansion material sealed inside, while a second disposable flexible container can have a second predetermined volume of a second expansion material (which can be similar to, the same as, or different from the first expansion material) sealed inside, wherein the second predetermined volume is greater than the first predetermined volume. For example, the first flexible container can have the first predetermined volume of the first expansion material sealed inside one or more first structural support volumes, such as structural support volumes that form the first structural support frame for the first container, while the second disposable flexible container can have the second predetermined volume of the second expansion material sealed inside one or more second structural support volumes, such as structural support volumes that form a second structural support frame for the second container. In various embodiments, the second predetermined volume can be 10-1000% more than the first predetermined volume, or any integer value for percentage from 10-1000%, or within any range formed by any of these values, such as 20-500%, 30-100%, etc.

In a line-up of flexible containers, according to any of the embodiments described herein, a first flexible container can have a first expansion material sealed inside at a first internal expansion pressure, while a second disposable flexible container can have a second expansion material sealed inside at a second internal expansion pressure, wherein the second internal expansion pressure is within 85% of the first internal pressure, or any integer value for percentage from 0-85%, or within any range formed by any of these values, such as 0-50%, 0-20%, etc.

A relatively different volume and/or pressure of expansion material(s) can be added to a structural support volume of a structural support frame of a flexible container in various ways, such as changing a flow rate when adding expansion material(s), and/or changing a time for adding expansion material(s), and/or changing a pressure at which expansion material(s) are added, and/or using an additional/alternate nozzle/dispenser for adding expansion material(s), and/or adding different expansion material(s) that expand at different rates or to different volumes, and/or changing an ability of expansion material(s) to escape before sealing the structural support frame, and/or sealing the structural support frame at a different sealing time after adding expansion materials, and/or sealing the structural support frame at a different sealing rate after adding expansion materials, and/or changing a size and/or shape of one or more structural support volumes in the structural support frame, etc. To make a flexible container that contains a particular predetermined volume and/or pressure of expansion material(s), one skilled in the art can empirically determine a target volume and/or pressure for the expansion material(s), in expanded form, within a flexible container, and then vary one or more of the conditions mentioned above, in the process of making the flexible container, to obtain the target volume and/or pressure.

The supplying 1896 of the product includes transferring the product, from the making 1892, to product purchasers and/or ultimately to product users, as known in the art of supplying. The using 1897 of the product includes the processes of storing 1897-1, handling 1897-2, dispensing 1897-3, and disposing 1897-4 of the product, as described herein and is known in the art of using products with flexible containers. Part, parts, or all of the process 1890 can be used to make products with flexible containers of the present disclosure, including products with line-ups of flexible containers.

Figure 19:
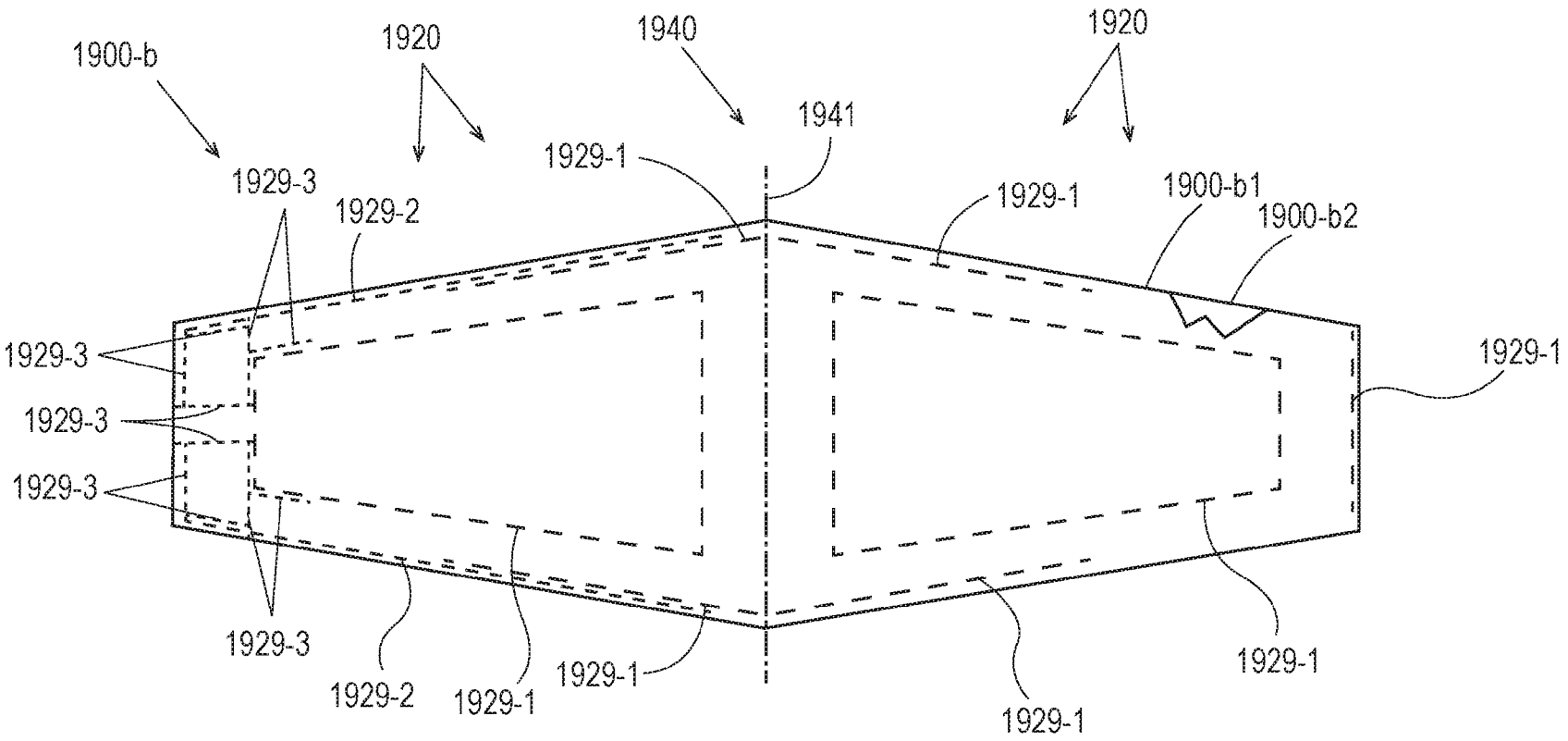
FIG. 19 is a plan view of an exemplary blank of flexible materials used to make a flexible container, wherein a sealing pattern and a folding pattern are illustrated in relation to the blank.

FIG. 19 is a plan view of an exemplary blank 1900-*b* of flexible materials used to make a flexible container with a structural support frame, according to embodiments disclosed herein. A sealing pattern 1920 and a folding pattern 1940 are illustrated in relation to the blank 1900-*b*. The blank 1900-*b* is formed by a first shaped cutout 1929-*b*1 and a second shaped cutout 1929-*b*2, although in various embodiments, a blank may be formed by only one, or more than two shaped cutouts. The first shaped cutout 1929-*b*1 is made from a first sealable flexible material and the second shaped cutout 1929-*b*2 is made from a second sealable flexible material, which may be the same as or different from the first sealable flexible material. The first shaped cutout 1929-*b*1 and the second shaped cutout 1929-*b*2 have the same overall cutout shape, although in various embodiments shaped cutouts may have different shapes. The first shaped cutout 1929-*b*1 fully overlays and aligns with the second shaped cutout 1929-*b*2, although in various embodiments a blank may have shaped cutouts that only partially overlay each other or only partially align. The first shaped cutout 1929-*b*1 is not initially attached to the second shaped cutout 1929-*b*2, although in various embodiments, part or parts of one shaped cutout in a blank may be attached to one or more other shaped cutouts in the blank. The blank 1900-*b* is sealed according to the folding pattern 1920 and folded according to the folding pattern 1940, to make a flexible container with a structural support frame, according to embodiments of the present disclosure.

The folding pattern 1920 includes a first set of seals 1929-1, a second set of seals 1929-2, and a third set of seals 1929-3, which are illustrated in FIG. 19 as dashed lines of varying dash length. While the first shaped cutout 1929-*b*1 fully overlays and aligns with the second shaped cutout 1929-*b*2, the blank 1900-*b* is sealed with continuous seals along the dashed lines of the first set of seals 1929-2. The first set of seals 1929-1 is represented by the dashed lines having a longest dash length in FIG. 19.

The first set of seals 1929-1 includes: the pair of mirrored trapezoidal shapes that are offset from the edges of the blank 1900-*b*, on the left and right sides; two pairs of linear segments that extend along central parts of the top and bottom edges of the blank 1900-*b*, on its left and right sides; and one linear segment that extends along the right side edge of the blank 1900-*b*. The first set of seals 1929-1 seals through both the first shaped cutout 1929-*b*1 and the second shaped cutout 1929-*b*2.

The sealing of the mirrored trapezoidal shapes from the first set of seals 1929-1 forms nonstructural panels for a product space of the flexible container being made from the blank 1900-*b*. As a result, for the flexible container being made from the blank 1900-*b*, the product space construction is based, at least in part on the sealing pattern 1920. In particular, for the flexible container being made from the blank 1900-*b*, substantially all of the product space construction is based on the first set of seals 1929-1 in the sealing pattern 1920. In various embodiments, all of a product space construction can be based on a particular sealing pattern.

The sealing of the mirrored trapezoidal shapes from the first set of seals 1929-1 also forms inner portions of the structural support frame in the flexible container being made from the blank 1900-*b*. The sealing of the linear segments from the first set of seals 1929-1 forms outer portions of the structural support frame for the flexible container being made from the blank 1900-*b*.

After the blank 1900-*b* is sealed along the dashed lines of the first set of seals 1929-1, the blank 1900-*b* is folded according to the folding pattern 1940. The folding pattern 1940 includes a full fold at the fold line 1941, although in various embodiments, a folding line can include partial and/or full folds along any number of folding lines. The fold line 1941 extends continuously from the top edge of the blank 1900-*b* to the bottom edge of the blank 1900-*b*, although in various embodiments a fold line may be discontinuous or may extend over only part of a blank 1900-*b*.

The blank 1900-*b* is folded at the fold line 1941 so that the portions of the first shaped cutout 1929-*b*1 and the second shaped cutout 1929-*b*2 on the right side fully overlay and align with the portions of the first shaped cutout 1929-*b*1 and the second shaped cutout 1929-*b*2 on the left side. The folding of the blank 1900-*b* along the fold line 1941 further forms a top, a bottom, and sides of the flexible container being made from the blank 1900-*b*, wherein the narrow, open edge opposite the fold line 1941 is the partially formed top, the wide, folded edge adjacent the fold line 1941 is the partially formed bottom, and the angled, open, top and bottom edges are the partially formed sides. As a result, for the flexible container being made from the blank 1900-*b*, the container construction is based, at least in part on the folding pattern 1940. In particular, for the flexible container being made from the blank 1900-*b*, the container construction is based on the fold line 1941 of the folding pattern 1940. In various embodiments, substantially all or all of a container construction can be based on a particular folding pattern.

The folding of the blank 1900-*b* along the fold line 1941 also further forms the product space of the flexible container by bringing the nonstructural panels into positions that will be on a front and a back of the flexible container being made from the blank 1900-*b*. As a result, for the flexible container being made from the blank 1900-*b*, the product space construction is based, at least in part on the folding pattern 1940. In particular, for the flexible container being made from the blank 1900-*b*, the product space construction is based on the fold line 1941 of the folding pattern 1940. In various embodiments, substantially all or all of a product space construction can be based on a particular folding pattern.

After the blank 1900-*b* is folded according to the folding pattern 1940 and while the blank 1900-*b* is maintained in this folded state, the blank 1900-*b* is sealed with continuous seals along the dashed lines of the second set of seals 1929-2. The second set of seals 1929-2 is represented by the dashed lines having an intermediate dash length in FIG. 19.

The second set of seals 1929-2 includes: one pair of linear segments that extend along significant portions of the top and bottom edges of the blank 1900-*b*, on its left side, including portions that extend next to and along portions of the first set of seals 1929-1. Since the second set of seals 1929-2 is made while the blank 1900-*b* is folded, the second set of seals 1929-2 seals through the left side of the second shaped cutout 1929-*b*2, the left side and the (original) right side of the first shaped cutout 1929-*b*1, and the (original) right side of the second shaped cutout 1929-*b*2. The sealing of the linear segments from the second set of seals 1929-2 forms outer portions of the structural support frame for the flexible container being made from the blank 1900-*b*. The sealing of the linear segments from the second set of seals 1929-2 also forms an outer extent of the product space of the flexible container being made from the blank 1900-*b*.

Before the structural support frame is fully sealed, one or more expansion materials can be added to the partially formed structural support frame, as described herein. And, before the product space is fully closed and/or sealed, one or more fluent products can be added to the partially formed product space, as described herein.

After the blank 1900-*b* is sealed along the dashed lines of the second set of seals 1929-2 and while the blank 1900-*b* remains in the folded and partially sealed state, the blank 1900-*b* is sealed with continuous seals along the dashed lines of the third set of seals 1929-3. The third set of seals 1929-3 is represented by the dashed lines having a shortest dash length in FIG. 19.

The third set of seals 1929-2 includes: one pair of linear segments that extend in parallel from the left side edge of the blank 1900-*b*, inward to the trapezoidal shape; a first three sided shape, having a first side extending from the upper parallel segment, along an upper portion of the left side edge of the blank 1900-*b*, a second side extending along an outer portion of the top edge of the blank 1900-*b*, and a third side extending from the top edge of the blank 1900-*b* back to the upper parallel segment; a second three sided shape, having a first side extending from the lower parallel segment, along a lower portion of the left side edge of the blank 1900-*b*, a second side extending along an outer portion of the bottom edge of the blank 1900-*b*, and a third side extending from the bottom edge of the blank 1900-*b* back to the lower parallel segment; and, a pair of linear segments that extend next to and along outer portions of the trapezoidal shape from the first set of seals 192-1.

Since the third set of seals 1929-3 is made while the blank 1900-*b* is folded, the third set of seals 1929-3 seals through the left side of the second shaped cutout 1929-*b*2, the left side and the (original) right side of the first shaped cutout 1929-*b*1, and the (original) right side of the second shaped cutout 1929-*b*2. The sealing of the parallel linear segments from the third set of seals 1929-3 forms a product dispensing path in the flexible container being made from the blank 1900-*b*; the product dispensing path can be closed and/or sealed with any kind of suitable closure, seal, or dispenser disclosed herein or known in the art. The sealing of the other linear segments from the third set of seals 1929-3 forms portions of the top of the flexible container being made from the blank 1900-*b*, and also fully seals the structural support frame of the flexible container being made from the blank 1900-*b*.

In a line-up of flexible containers, according to any of the embodiments disclosed herein, both or all of the flexible containers in the line-up can include one or more product spaces, each product space having a product space construction, and any of the product space constructions can be partly, substantially, or fully based on part, parts, or all of one or more common folding patterns and/or can be partly, substantially, or fully based on part, parts, or all of one or more common sealing patterns.

While the embodiment of FIG. 19 is exemplary, other flexible containers of the present disclosure can be formed using various alternate sealing patterns and folding patterns, based on the descriptions provided in connection with the embodiment of FIG. 19 and by using the methods for sealing, folding, filling, expanding, and otherwise making such flexible containers, as described, illustrated, and referenced herein, as will be understood by one skilled in the art. Any such folding and sealing patterns can be applied to any line-ups of flexible containers disclosed herein. In a line-up of flexible containers, according to any of the embodiments disclosed herein, both or all of the flexible containers in the line-up can include one or more product spaces, each product space having a product space construction, and any of the product space constructions can be partly, substantially, or fully based on part, parts, or all of one or more common folding patterns and/or can be partly, substantially, or fully based on part, parts, or all of one or more common sealing patterns.

Also, in a line-up of flexible containers, according to any of the embodiments disclosed herein, for both or all of the flexible containers in the line-up, wherein each container has a container construction, any of the container constructions can be partly, substantially, or fully based on part, parts, or all of one or more common folding patterns and/or can be partly, substantially, or fully based on part, parts, or all of one or more common sealing patterns.

Figure 20A:
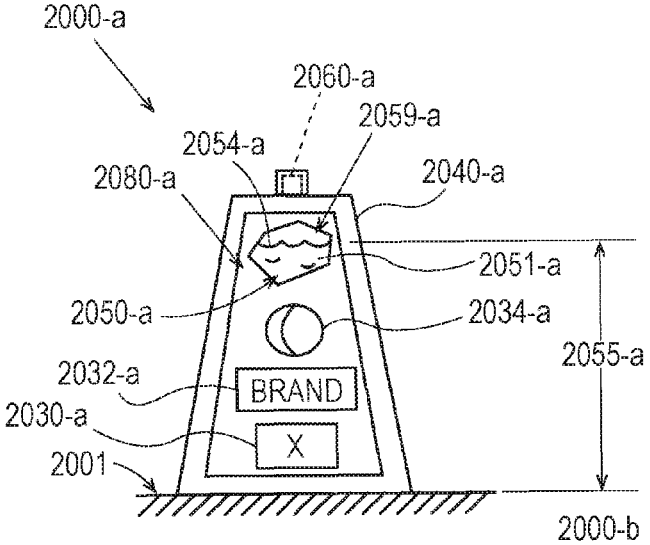
FIG. 20A illustrates a front view of a flexible container, having a first amount of a fluent product.
Figure 20B:
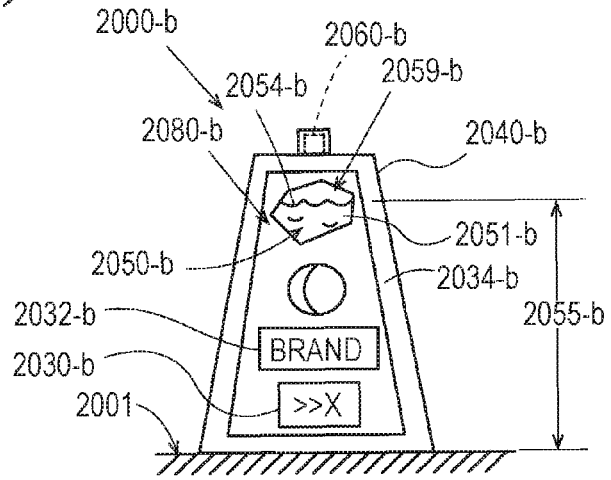
FIG. 20B illustrates a front view of the flexible container of FIG. 20A, having a second amount of a fluent product, which is greater than the first amount.
Figure 20C:
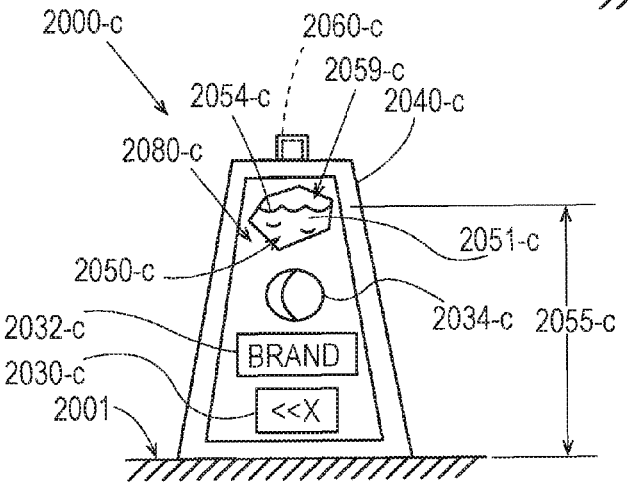
FIG. 20C illustrates a front view of the flexible container of FIG. 20A, having a third amount of a fluent product, which is less than the first amount.

Together, FIGS. 20A-20C illustrate an embodiment of a line-up of self-supporting flexible containers having easily variable sizing, according to any of the embodiments disclosed herein. The flexible containers of FIGS. 20A-20C are based on the flexible containers of FIGS. 2A-2D. However, in various embodiments, a line-up of self-supporting flexible containers having easily variable sizing can be similarly based on any of the embodiments of flexible containers disclosed herein, including the embodiments of FIGS. 2E-2G, the embodiments of FIGS. 1A-1G, the embodiments of FIGS. 3A-11E, the embodiments of FIGS. 16A-16D, and/or the embodiments of FIGS. 17A-17E. Any of the elements, structures, and/or features (e.g. structural support frames, structural support members, panels, dispensers, venting configurations, viewing portions, etc.) of the flexible containers of FIGS. 20A-20C, can be configured according to any of the embodiments disclosed herein. For clarity, not all structural details of these flexible containers are illustrated in FIGS. 20A-20C, however any of the embodiments of FIGS. 20A-20C can be configured to include any structure or feature for flexible containers, disclosed herein.

While FIGS. 20A-20C illustrate a line-up of three self-supporting flexible containers, in various embodiments, a line-up can have two flexible containers, or four flexible containers, or more than four flexible containers, as described herein.

FIG. 20A illustrates a front view of a flexible container 2000-*a*, having a first actual amount of a fluent product 2051-*a*. The flexible container 2000-*a* is the same as the flexible container 200 of FIGS. 2A-2D, with like-numbered elements configured in the same way, except as described below. The flexible container 2000-*a* is standing upright with its bottom resting on a horizontal support surface 2001. The flexible container 2000-*a* includes a structural support frame 2040-*a* and a product space 2050-*a* that is visible in FIG. 20A through a portion of a panel 2080-*a* that is illustrated as broken away. The product space 2050-*a* has a particular size and shape. A fluent product 2051-*a* is disposed in the product space 2050-*a*. The top of the flexible container 2000-*a* includes a dispenser 2060-*a* that is closed by a cap. A branding logo 2034-*a*, a branding trademark 2032-*a*, and an external amount indicium 2030-*a* are disposed on the outside of the panel 2080-*a*. The external amount indicium 2030-*a* indicates a particular listed amount (designated "X") of the fluent product 2051-*a* that is being offered for sale with the container 2000-*a*. In the embodiment of FIG. 20A, the flexible container 2000-*a* contains a first actual amount of the fluent product 2051-*a*, wherein the first actual amount is equal to the particular listed amount in the external amount indicium 2030-*a*. Inside the product space 2050-*a*, the fluent product 2051-*a* forms a fill line 2054-*a* at a closed fill height 2055-*a*; the fluent product 2051-*a* sits below the fill line 2054-*a* and a headspace 2058-*a* exists above the fill line 2054-*a*. In various embodiments, the flexible container 2000-*a* of FIG. 20A can be configured according to one or more structures and/or features of one or more of any of the embodiments of the flexible containers of FIGS. 23A, 24A, 25A, 26A, 27A, 28A, 29A, 30A, 31A, 32A, 33A, 34A, 35A, 36A, and 37A (individually or in combination), including any alternative embodiments, as described herein, so that, when the first actual amount of the fluent product 2051-*a* is added to the product space 2050-*a*, the fluent product 2051-*a* forms the fill line 2054-*a* at a particular fill height, which is the closed fill height 2055-*a*.

FIG. 20B illustrates a front view of a flexible container 2000-*b*, having a second amount of a fluent product 2051-*b*. The flexible container 2000-*b* is the same as the flexible container 2000-*a* of FIG. 20A, with like-numbered elements configured in the same way, except as described below. The external amount indicium 2030-*b* indicates a particular listed amount (designated ">>X") of the fluent product 2051-*b* that is being offered for sale with the container 2000-*b*. In the embodiment of FIG. 20B, the flexible container 2000-*b* contains a second actual amount of the fluent product 2051-*b*, wherein the second actual amount is equal to the particular listed amount in the external amount indicium 2030-*b*. In FIG. 20B, the second actual amount of the fluent product 2051-*b* in the container 2000-*b* is greater than the first actual amount of the fluent product 2051-*a* in the container 2000-*a* of FIG. 20A. In various embodiments, the flexible container 2000-*b* of FIG. 20B can be configured according to one or more structures and/or features of one or more of any of the embodiments of the flexible containers of FIGS. 23B, 24B, 25B, 26B, 27B, 28B, 29B, 30B, 31B, 32B, 33B, 34B, 35B, 36B, and 37A (individually or in any combination), including any alternative embodiments, as described herein, so that, when the second actual amount of the fluent product 2051-*b* is added to the product space 2050-*b*, the fluent product 2051-*b* forms a fill line 2054-*b* at a closed fill height 2055-*b*. Although the flexible container 2000-*b* has at least some external dimensions that are similar to (or the same as) external dimensions of the flexible container 2000-*a*, the closed fill height 2055-*b* is not higher than the closed fill height 2055-*a* of FIG. 20A. In FIG. 20B, the closed fill height 2055-*b* is equal to the closed fill height 2055-*a* of FIG. 20A, even though the second actual amount of the fluent product 2051-*b* is greater than the first actual amount of the fluent product 2051-*a*.

In any embodiment of the line-up of FIGS. 20A-20C, the closed fill height 2055-*b* can be greater than but about equal to the closed fill height 2055-*a*, the closed fill height 2055-*b* can be greater than but approximately equal to the closed fill height 2055-*a*, the closed fill height 2055-*b* can be greater than but substantially equal to the closed fill height 2055-*a*, the closed fill height 2055-*b* can be greater than but nearly equal to the closed fill height 2055-*a*, the closed fill height 2055-*b* can be less than and about equal to the closed fill height 2055-*a*, the closed fill height 2055-*b* can be less than and approximately equal to the closed fill height 2055-*a*, the closed fill height 2055-*b* can be less than and substantially equal to the closed fill height 2055-*a*, the closed fill height 2055-*b* can be less than and nearly equal to the closed fill height 2055-*a*, the closed fill height 2055-*b* can be greater than or less than and about equal to the closed fill height 2055-*a*, the closed fill height 2055-*b* can be greater than or less than and approximately equal to the closed fill height 2055-*a*, the closed fill height 2055-*b* can be greater than or less than and substantially equal to the closed fill height 2055-*a*, or the closed fill height 2055-*b* can be greater than or less than and nearly equal to the closed fill height 2055-*a*.

FIG. 20C illustrates a front view of a flexible container 2000-*c*, having a third amount of a fluent product 2051-*c*. The flexible container 2000-*c* is the same as the flexible container 2000-*a* of FIG. 20A, with like-numbered elements configured in the same way, except as described below. The external amount indicium 2030-*c* indicates a particular listed amount (designated "<<X") of the fluent product 2051-*c* that is being offered for sale with the container 2000-*c*. In the embodiment of FIG. 20C, the flexible container 2000-*c* contains a third actual amount of the fluent product 2051-*c*, wherein the third actual amount is equal to the particular listed amount in the external amount indicium 2030-*c*. In FIG. 20C, the third actual amount of the fluent product 2051-*c* in the container 2000-*c* is less than the first actual amount of the fluent product 2051-*a* in the container 2000-*a* of FIG. 20A. In various embodiments, the flexible container 2000-*c* of FIG. 20C can be configured according to one or more structures and/or features of one or more of any of the embodiments of the flexible containers of FIGS. 23C, 24C, 25C, 26C, 27C, 28C, 29C, 30C, 31C, 32C, 33C, 34C, 35C, 36C, and 37C (individually or in any combination), including any alternative embodiments, as described herein, so that, when the third actual amount of the fluent product 2051-*c* is added to the product space 2050-*c*, the fluent product 2051-*c* forms a fill line 2054-*c* at a closed fill height 2055-*c*. Although the flexible container 2000-*c* has at least some external dimensions that are similar to (or the same as) external dimensions of the flexible container 2000-*a*, the closed fill height 2055-*c* is not lower than the closed fill height 2055-*a* of FIG. 20A. In FIG. 20C, the closed fill height 2055-*c* is equal to the closed fill height 2055-*a* of FIG. 20A, even though the third actual amount of the fluent product 2051-*c* is less than the first actual amount of the fluent product 2051-*a*.

In any embodiment of the line-up of FIGS. 20A-20C, the closed fill height 2055-*c* can be less than but about equal to the closed fill height 2055-*a*, the closed fill height 2055-*c* can be less than but approximately equal to the closed fill height 2055-*a*, the closed fill height 2055-*c* can be less than but substantially equal to the closed fill height 2055-*a*, the closed fill height 2055-*c* can be less than but nearly equal to the closed fill height 2055-*a*, the closed fill height 2055-*c* can be greater than and about equal to the closed fill height 2055-*a*, the closed fill height 2055-*c* can be greater than and approximately equal to the closed fill height 2055-*a*, the closed fill height 2055-*c* can be greater than and substantially equal to the closed fill height 2055-*a*, the closed fill height 2055-*c* can be greater than and nearly equal to the closed fill height 2055-*a*, the closed fill height 2055-*c* can be greater than or less than and about equal to the closed fill height 2055-*a*, the closed fill height 2055-*c* can be greater than or less than and approximately equal to the closed fill height 2055-*a*, the closed fill height 2055-*c* can be greater than or less than and substantially equal to the closed fill height 2055-*a*, or the closed fill height 2055-*c* can be greater than or less than and nearly equal to the closed fill height 2055-*a*.

The flexible containers of FIGS. 20A-20C can be used in various combinations to form line-ups of the present disclosure, as described below.

In a first set of embodiments of the present disclosure, a line-up of flexible containers having similar constructions can hold different amounts of fluent product at similar fill heights. This line-up of flexible containers can comprise a first disposable self-supporting flexible container and a second disposable self-supporting flexible container. Any or all of the containers in the line-up may or may not be configured for retail sale. The first container can have: a first product space construction that is based, at least in part, on a first folding pattern; a first external amount indicium that indicates a first listed amount of a first fluent product that is being offered for sale with the first container; a first actual amount of the first fluent product, disposed in the first product space, wherein the first actual amount is nearly equal to the first listed amount; and a first closed fill height for the first fluent product in the first product space. The second container can have: a second product space having a second product space construction that is based, at least in part, on a second folding pattern that is substantially the same as the first folding pattern; a second external amount indicium that indicates a second listed amount of a second fluent product that is being offered for sale with the second container (the second fluent product may be similar to, or the same as, or different from the first fluent product), wherein the second listed amount is a particular percentage less than the first listed amount, and the particular percentage is greater than or equal to 0.1% and less than or equal to 70%; a second actual amount of the second fluent product, disposed in the second product space, wherein the second actual amount is nearly equal to the second listed amount; and a second closed fill height for the second fluent product in the second product space, wherein the second closed fill height is greater than or equal to the first closed fill height.

In one example of a line-up from this first set of embodiments, any embodiment of the flexible container 2000-*a* described herein can be used as the first container in the line-up (as described above) while any embodiment of the flexible container 2000-*c* described herein can be used as the second container in the line-up (as described above); these containers can also be used with any variation of this line-up described herein. In another example of a line-up from this first set of embodiments, any embodiment of the flexible container 2000-*b* described herein can be used as the first container in the line-up (as described above) while any embodiment of the flexible container 2000-*a* described herein can be used as the second container in the line-up (as described above); these containers can also be used with any variation of this line-up described herein.

In a second set of embodiments of the present disclosure, in a line-up of flexible containers having similar constructions, one of the containers can hold relatively less fluent product at an unexpectedly high fill height. This line-up of flexible containers can comprise a first disposable self-supporting flexible container and a second disposable self-supporting flexible container. Any or all of the containers in the line-up may or may not be configured for retail sale. The first container can have: a first product space construction that is based, at least in part, on a first folding pattern; a first external amount indicium that indicates a first listed amount of a first fluent product that is being offered for sale with the first container; a first actual amount of the first fluent product, disposed in the first product space, wherein the first actual amount is nearly equal to the first listed amount; and a first closed fill height for the first fluent product in the first product space. The second container can have: a second product space having a second product space construction that is based, at least in part, on a second folding pattern that is substantially the same as the first folding pattern; a second external amount indicium that indicates a second listed amount of a second fluent product that is being offered for sale with the second container (the second fluent product may be similar to, or the same as, or different from the first fluent product), wherein the second listed amount is a particular percentage less than the first listed amount, and the particular percentage is greater than or equal to 0.1% and less than or equal to 70%; a second actual amount of the second fluent product, disposed in the second product space, wherein the second actual amount is nearly equal to the second listed amount; and a second closed fill height for the second fluent product in the second product space, wherein the second closed fill height is within a particular range of calculated values (explained herein) that represent an unexpectedly high fill height.

In one example of a line-up from this second set of embodiments, any embodiment of the flexible container 2000-*a* described herein can be used as the first container in the line-up (as described above) while any embodiment of the flexible container 2000-*c* described herein can be used as the second container in the line-up (as described above); these containers can also be used with any variation of this line-up described herein. In another example of a line-up from this second set of embodiments, any embodiment of the flexible container 2000-*b* described herein can be used as the first container in the line-up (as described above) while any embodiment of the flexible container 2000-*a* described herein can be used as the second container in the line-up (as described above); these containers can also be used with any variation of this line-up described herein.

In a line-up of flexible containers, according to any of the embodiments in the first or second set of embodiments, described above, the particular percentage can be greater than or equal to 1% and less than or equal to 70%, or any integer value for percentage between 1% and 70%, or any range formed by any of these integer values, such as: greater than or equal to 1% and less than or equal to 60%, greater than or equal to 2% and less than or equal to 50%, greater than or equal to 3% and less than or equal to 40%, etc. Also, in a line-up of flexible containers, according to any of the embodiments described herein, the second product space of the second container can have a second total capacity that is 1% to 70% less than a first total capacity of the first product space of the first container, or the second total capacity can be less than the first total capacity by any integer value for percentage between 1% and 70%, or by any range formed by any of these integer values, such as 5-70%, 10-60%, 15-50%, 20-40%, etc.

In a line-up of flexible containers, according to any of the embodiments in the first or second set of embodiments, described above, the first container and the second container can have various headspace pressures as described below.

In various embodiments, the first container can have a first product space that is sealed closed and has a first headspace at a first sealed closed headspace pressure, while the second container can have a second product space that is sealed closed and has a second headspace at a second sealed closed headspace pressure that is 0-20% of the first sealed closed headspace pressure, or any integer value for percentage from 0% to 20%, or within any range formed by any of these values, such as 0-10%. When the second sealed closed headspace pressure in the product space of the second container is about the same as the first sealed closed headspace pressure in the product space of the first container—despite the fact that the containers have similar constructions, and the second container has a lesser amount of fluent product—this can indicate that the product spaces of the containers are configured to not apply significant (positive or negative) forces on the fluent product that they contain, when sealed closed. These kinds of configurations can be accomplished by permanently increasing a total capacity of the first product space of the first flexible container and/or by permanently decreasing a total capacity of the second product space of the second flexible container, as described herein.

And, in various embodiments, a flexible container can have a product space that is sealed closed at a sealed closed headspace pressure that is 0-20% of atmospheric pressure, or any integer value for percentage from 0% to 20%, or within any range formed by any of these values, such as 0-10%. When a sealed closed headspace pressure in the product space of a container is about the same as atmospheric pressure, this can indicate that the product space of the container is configured to not apply significant (positive or negative) forces on the fluent product that it contains, when sealed closed. This kind of configuration can be accomplished by permanently setting a total capacity of a product space in the flexible container, as described herein.

Further, in various embodiments, a flexible container can have a product space that is sealed closed with fluent product at a sealed closed fill height, wherein the container is configured such that, when the product space is opened, the fluent product in the product space assumes an open fill height that is within 30% of the sealed closed fill height, or any integer value for percentage from 0% to 30%, or within any range formed by any of these values, such as 0-20% or 0-10%. Also, the open fill height can be within 0-6 centimeters of the sealed closed fill height, or any integer value for centimeters from 0 to 6, or within any range formed by any of these values, such as 0-4 centimeters or 0-2 centimeters. When an open fill height in the product space of a flexible container is similar to the sealed closed fill height in the product space of the container—despite the fact that the container is open, such that the product space is vented and can equalize with the pressure of the environment—this can indicate that the product space of the container is configured to not apply significant (positive or negative) forces on the fluent product that it contains, when sealed closed. This kind of configuration can be accomplished by permanently setting a total capacity of a product space in the flexible container, as described herein.

In a third set of embodiments of the present disclosure, in a line-up of flexible containers having similar external shapes, one of the containers can hold relatively less fluent product. This line-up of flexible containers can comprise a first disposable self-supporting flexible container and a second disposable self-supporting flexible container. Any or all of the containers in the line-up may or may not be configured for retail sale. The first container can have a first overall front profile and a first product space with a first total capacity. The second container can have a second disposable self-supporting flexible container, having a second overall front profile that has substantially the same size and shape as the first overall front profile, and a second product space with a second total capacity that is a particular percentage less than the first total capacity; wherein the particular percentage is greater than or equal to 5% and less than or equal to 70%.

In one example of a line-up from this third set of embodiments, any embodiment of the flexible container 2000-*a* described herein can be used as the first container in the line-up (as described above) while any embodiment of the flexible container 2000-*c* described herein can be used as the second container in the line-up (as described above); these containers can also be used with any variation of this line-up described herein. In another example of a line-up from this third set of embodiments, any embodiment of the flexible container 2000-*b* described herein can be used as the first container in the line-up (as described above) while any embodiment of the flexible container 2000-*a* described herein can be used as the second container in the line-up (as described above); these containers can also be used with any variation of this line-up described herein.

In a fourth set of embodiments of the present disclosure, in a line-up of flexible containers having similar external sizes, one of the containers can hold relatively less fluent product. This line-up of flexible containers can comprise a first disposable self-supporting flexible container and a second disposable self-supporting flexible container. Any or all of the containers in the line-up may or may not be configured for retail sale. The first container can have a first overall external displacement and a first product space with a first total capacity. The second container can have a second disposable self-supporting flexible container, having a second overall external displacement, and a second product space with a second total capacity that is a particular percentage less than the first total capacity; wherein the particular percentage is greater than or equal to 5% and less than or equal to 70%; and wherein the second overall external displacement is greater than or equal to the first overall external displacement.

When the second overall external displacement of the second container is greater than or equal to the first overall external displacement of the first container—despite the fact that the second container has a lesser amount of fluent product—this can indicate that the containers are configured to have internal capacities that are different, but external dimensions that are similar (or the same). These kinds of configurations can be accomplished by changing product spaces within flexible containers, as described herein.

In a line-up of flexible containers, according to any of the embodiments in the fourth set of embodiments, described above, the particular percentage can be greater than or equal to 5% and less than or equal to 70%, or any integer value for percentage between 5% and 70%, or any range formed by any of these integer values, such as: greater than or equal to 10% and less than or equal to 60%, greater than or equal to 15% and less than or equal to 50%, greater than or equal to 20% and less than or equal to 40%, etc.

In a line-up of flexible containers, according to any of the embodiments in the fourth set of embodiments, described above, second overall external displacement can be: greater than and about equal to the first overall external displacement, greater than and approximately equal to the first overall external displacement, greater than and substantially equal to the first overall external displacement, and/or greater than and nearly equal to the first overall external displacement.

In one example of a line-up from this fourth set of embodiments, any embodiment of the flexible container 2000-*a* described herein can be used as the first container in the line-up (as described above) while any embodiment of the flexible container 2000-*c* described herein can be used as the second container in the line-up (as described above); these containers can also be used with any variation of this line-up described herein. In another example of a line-up from this fourth set of embodiments, any embodiment of the flexible container 2000-*b* described herein can be used as the first container in the line-up (as described above) while any embodiment of the flexible container 2000-*a* described herein can be used as the second container in the line-up (as described above); these containers can also be used with any variation of this line-up described herein.

Figure 21:
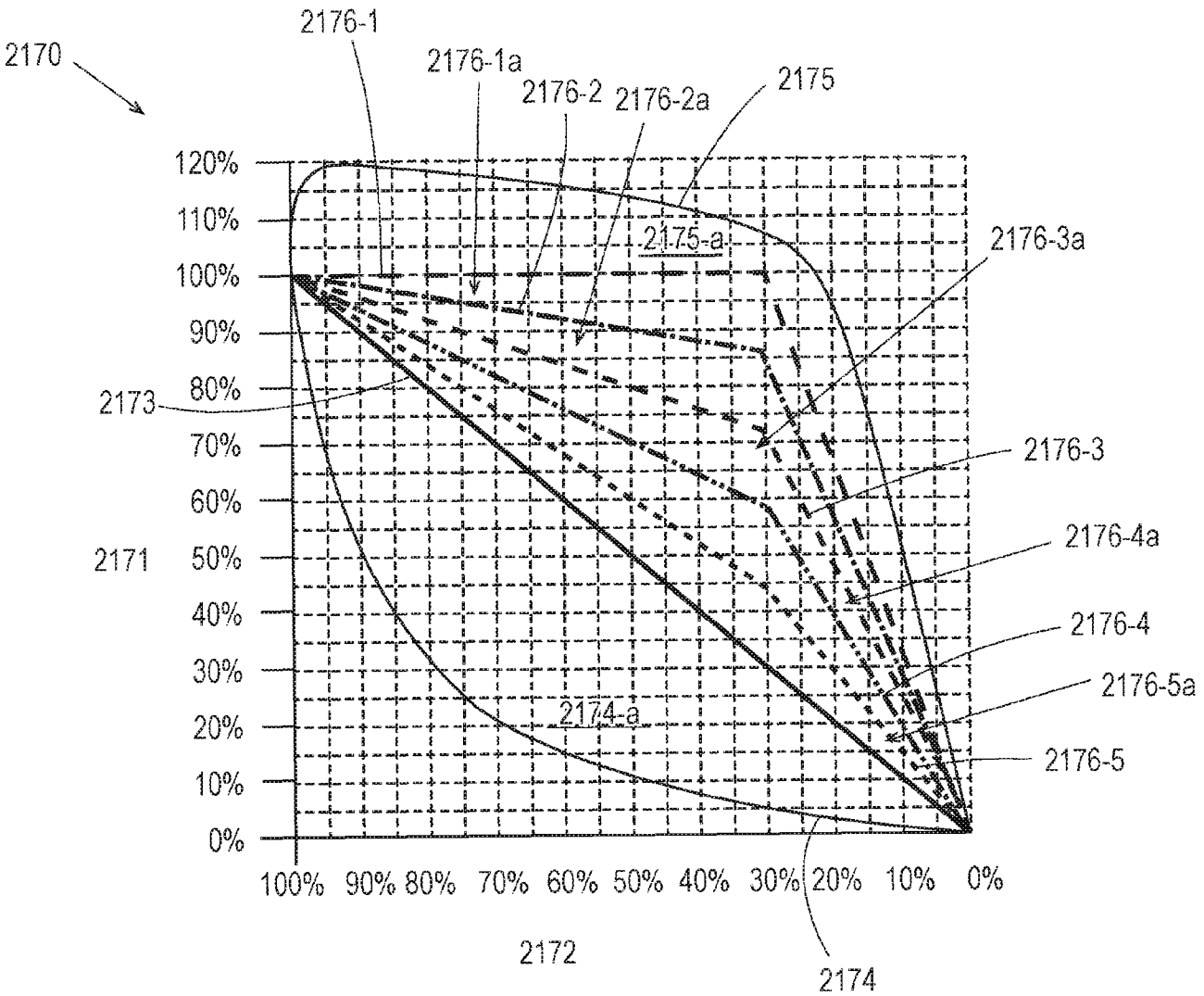
FIG. 21 is a chart that illustrates various relationships between fill height and fill volume in product spaces for various types and configurations of containers.

FIG. 21 is a chart 2170 that illustrates various relationships between fill height 2171 and fill volume 2172 in product spaces for various types and configurations of containers. The chart 2170, along with its lines, curves, and areas, is considered drawn to scale, unless otherwise indicated. In various embodiments, the fill height 2171 in the chart 2170 can represent a closed fill height, a sealed closed fill height, and/or an open fill height, as defined and described herein. The fill volume 2172 represents how full a product space is, which is based on an amount of fluent product in the product space.

The fill height 2171 is represented on the vertical axis of the chart 2170 as percentages from 120% to 0% where 100% represents a fill height of a fluent product in a product space that is 100% filled with the fluent product and 0% represents a fill height of a fluent product in a product space that is 0% filled with the fluent product. The fill volume 2172 is represented on the horizontal axis of the chart 2170 as percentages from 100% to 0% where 100% represents a reference amount of fluent product in a product space of a container that is 100% filled with a fluent product, 0% represents a product space in a container that is 0% filled with a fluent product, and percentages between 0% and 100% represent an amount of fluent product that is scaled to the reference amount.

The lines, curves, and areas on the chart 2170 represent how fill height 2171 can vary with fill volume 2172 for various types and configurations of product spaces in containers. For each particular product space, the fill height depends on the amount of fluent product in the product space—and the geometry and/or configuration of the product space. Part, parts, or all of a proportional line 2173 represent a container with a particular product space, wherein fill height 2171 varies in direct proportion to the fill volume 2172, as described and illustrated in connection with the conventional rigid containers of FIGS. 15A-15C.

Below the proportional line 2173 is a lower boundary curve 2174. Part, parts, or all of the lower boundary curve 2174 represent a container with a product space, wherein fill height 2171 at first drops very quickly as the fill volume 2172 initially decreases from 100% filled, then curves and drops quite slowly as the fill volume 2172 approaches 0% filled. The lower boundary curve 2174 represents a product space with a particular geometry and/or configuration, wherein the higher portions of the product space account for only a small portion of the filled volume, while the lower portions of the product space account for nearly all of the filled volume. As illustrated in the chart 2170, on the lower boundary curve 2174, with only a 10% reduction (from 100% to 90%) in fill volume 2172 the fill height 2171 drops quickly from 100% to about 50%, and then with a further 10% reduction (from 90% to 80%) in fill volume 2172 the fill height 2171 drops quickly again from about 50% to about 30%. Also as illustrated in FIG. 21, on the lower boundary curve 2174, for the last 50% reduction (from 50% to 0%) in fill volume 2172 the fill height 2171 drops slowly from about 10% to 0%. So, in the product space that is represented by the lower boundary curve, most of the volume of the fluent product in the product space is found in the lowest portions of the product space.

The lower boundary curve 2174 and the proportional line 2173, together enclose a lower area 2174-*a* on the chart 2170. The lower area 2174-*a* represents a range of product spaces, wherein as the fill volume 2172 initially decreases from 100% filled the fill height 2171 at first drops more quickly (than the proportional line 2173), then as the fill volume 2172 approaches 0% filled the fill height 2171 drops more slowly (than the proportional line 2173). The lower area 2174-*a* can include any number of curves and/or lines (not shown) that represent various relationships between fill height and fill volume within the range of product spaces, as will be understood by one skilled in the art. For filled product spaces that fall within the lower area 2174-*a*, more of the fluent product in the product space is found in the lower portions of the product space than in the upper portions of the product space, which is common in conventional containers for fluent products, and is especially common in conventional flexible containers for fluent products.

Above the proportional line 2173 is an upper boundary curve 2175. Part, parts, or all of the upper boundary curve 2175 represent a container with a product space, wherein as the fill volume 2172 initially decreases from 100% filled the fill height 2171 at first unexpectedly rises, then as the fill volume 2172 further decreases the fill height 2171 curves and drops quite slowly, then as the fill volume 2172 approaches 0% filled the fill height 2171 drops very quickly. The upper boundary curve 2175 represents a container with a particular geometry and configuration, wherein the product space is configured such that upper portions of the product space account for a large portion of the filled volume, while the lower portions of the product space account for a small portion of the filled volume. As illustrated in FIG. 21, on the upper boundary curve 2175, with a 10% reduction (from 100% to 90%) in fill volume 2172 the fill height 2171 rises from 100% to about 120%, and then with a further 70% reduction (from 90% to 20%) in fill volume 2172 the fill height 2171 drops to about 100%, then for the last 20% reduction (from 20% to 0%) in fill volume 2172 the fill height 2171 drops slowly from about 100% to 0%. So, in the product space that is represented by the upper boundary curve 2175, most of the volume of the fluent product in the product space is found in the upper portions of the product space and the product space is unconventionally configured with higher fill heights for initially lesser amount of fluent product, according to various embodiments disclosed herein.

In various embodiments, locations along the upper boundary curve 2175 can also represent product spaces for two or more flexible containers that form a line-up of flexible containers, as described herein. For example, in an exemplary line-up of containers, a first flexible container in the line-up can have a first product space wherein a first amount of fluent product corresponding with a first fill volume rises to a first fill height at a first point along the upper boundary curve 2175, while a second flexible container in the line-up can have a second product space wherein a second amount of fluent product (that differs from the first amount) corresponding with a second fill volume rises to a second fill height at a second point along the upper boundary curve 2175.

The upper boundary curve 2175 and the proportional line 2173, together enclose an upper area 2175-*a* on the chart 2170. The upper area 2175-*a* represents a range of containers, wherein fill height 2171 at first unexpectedly rises, or unexpectedly remains constant, or unexpectedly drops more slowly than the proportional line 2173 as the fill volume 2172 initially decreases from 100% filled, then drops and/or drops more quickly as the fill volume 2172 approaches 0% filled. The upper area 2175-*a* can include any number of curves and/or lines (not shown) that represent various relationships between fill height and fill volume within the range of product spaces, as will be understood by one skilled in the art. For filled product spaces that fall within the upper area 2175-*a*, more of the fluent product in the product space can be found in the upper portions of the product space than in the lower portions of the product space and the product space can be configured with fill heights that behave in unexpected ways for initially lesser amounts of fluent product in the product space, according to various embodiments disclosed herein. A product space configuration that falls anywhere within the upper area 2175-*a* can be used for any embodiment of flexible container described herein.

In various embodiments, locations within the upper boundary area 2175-*a* can also represent product spaces for two or more flexible containers that form a line-up of flexible containers, as described herein. For example, in an exemplary line-up of containers, a first flexible container in the line-up can have a first product space wherein a first amount of fluent product corresponding with a first fill volume rises to a first fill height at a first point within the upper boundary area 2175-*a*, while a second flexible container in the line-up can have a second product space wherein a second amount of fluent product (that differs from the first amount) corresponding with a second fill volume rises to a second fill height at a second point within the upper boundary area 2175-*a*.

The upper boundary area 2175-*a* also includes five modeled boundaries, including a first modeled boundary 2176-1, a second modeled boundary 2176-2, a third modeled boundary 2176-3, a fourth modeled boundary 2176-4, and a fifth modeled boundary 2176-5. Part, parts, or all of each of these modeled boundaries can represent a container with a particular geometry and/or configuration, wherein the modeled boundary represents various relationships between fill height and fill volume within a product space. Locations along each of these modeled boundaries can also represent product spaces for two or more flexible containers that form a line-up of flexible containers, as described herein.

In combination with the proportional line 2173, the five modeled boundaries 2176-1 through 2176-5 enclose five modeled areas, including a first modeled area 2176-1*a*, a second modeled area 2176-2*a*, a third modeled area 2176-3*a*, a fourth modeled area 2176-4*a*, and a fifth modeled area 2176-5*a*. Each of these modeled areas 2176-1*a* through 2176-5*a* represents a particular subset of the upper boundary area 2175-*a*. And, each of these modeled areas 2176-1*a* through 2176-5*a* can include any number of curves and/or lines (not shown) that represent various relationships between fill height and fill volume within the ranges of the corresponding product spaces, as will be understood by one skilled in the art.

Since flexible containers for fluent products have product space configurations that most commonly fall within the lower area 2174-*a*, the proportional line 2173 can be considered a reasonable upper limit for the relationship between fill height and fill volume in a product space of a conventional flexible container (e.g. a pouch) for a fluent product. In a product space of a conventional flexible container for a fluent product, as fill volume initially decreases, a person skilled in the art would not expect fill height to drop more slowly than in direct proportion to the fill volume (i.e. more slowly than along the proportional line 2173). So, a person skilled in the art would not expect such a product space to have a relationship between fill height and fill volume that exists above the proportional line 2173. And, a person skilled in the art would also not expect two conventional flexible containers that have product spaces with product space constructions that are similar or the same to have a relationship between fill height and fill volume that exists above the proportional line 2173. This understanding can be used as a basis for a first mathematical expression, which is:

$$FH2 > FH1X\left(\frac{FV2}{FV1}\right)$$

wherein:

FH2=second fill height, which is a fill height for a second particular amount of fluent product in a second product space of a second container, FH1=first fill height, which is a fill height for a first particular amount of fluent product in a first product space of a first container, wherein the first product space has one or more defined similarities with respect to the second product space, FV2=second fill volume, which is a second particular amount of fluent product in the second product space, wherein the second fill volume is less than a first fill volume, FV1=first fill volume, which is a first particular amount of fluent product in the first product space.

The first mathematical expression states that the second fill height (FH2) is greater than: the first fill height (FH1) times the ratio of the second fill volume to the first fill volume (FV2/FV1). The ratio of the second fill volume to the first fill volume (FV2/FV1) represents a directly proportional relationship between the fill volumes. As a result, the first particular mathematical expression indicates that, in line-ups of flexible containers disclosed herein, the second fill height (FH2) is higher than the proportional line 2173 (i.e. higher than a directly proportional relationship to fill volume), when the second product space is filled with less fluent product. So, the first mathematical expression represents the lower limit for each of the five modeled areas 2176-1*a* through 2176-5*a*.

A first form of a second mathematical expression and a first form of a third mathematical expression together represent the five modeled boundaries 2176-1 through 2176-5, which form the upper limits for each of the five modeled areas 2176-1*a* through 2176-5*a*, respectively. The first form of the second mathematical expression represents the portions of the upper limits that extend from 100% filled to 30% filled. The first form of the third mathematical expression represents the portions of the upper limits that extend from 30% filled to 0% filled.

A first form of the second mathematical expression (for 100% to 30% filled) is:

$$FH2 = FH1X\left(1-\left(\left(1-\frac{FV2}{FV1}\right)XSF\right)\right)$$

and a first form of the third mathematical expression (for 30% to 0% filled) is:

$$FH2 = FH1X\left(\frac{FV2}{FV1}\right)X\left(1+\left(\frac{7}{3}X(1-SF)\right)\right)$$

wherein, for both the second and third mathematical expressions:

FH2=second fill height, which is a fill height for a second particular amount of fluent product in a second product space of a second container, FH1=first fill height, which is a fill height for a first particular amount of fluent product in a first product space of a first container, wherein the first product space has one or more defined similarities with respect to the second product space, FV2=second fill volume, which is a second particular amount of fluent product in the second product space, wherein the second fill volume is less than a first fill volume, FV1=first fill volume, which is a first particular amount of fluent product in the first product space, SF=scaling factor (can range from 0.00 to 0.99, in any increment of 0.01).

The first form of the second mathematical expression states that (from 100% to 30% filled), along a modeled boundary, the second fill height (FH2) drops linearly, more slowly than the proportional line 2173. The first form of the third mathematical expression states that (from 30% to 0% filled), along a modeled boundary, the second fill height (FH2) drops linearly, more quickly than the proportional line 2173.

For the fifth modeled boundary 2176-5, the scaling factor (SF) equals 0.8. For the fourth modeled boundary 2176-4, the scaling factor (SF) equals 0.6. For the third modeled boundary 2176-3, the scaling factor (SF) equals 0.4. For the second modeled boundary 2176-2, the scaling factor (SF) equals 0.2. For the first modeled boundary 2176-1, the scaling factor (SF) equals 0.0. Table 1, below, shows exemplary values for the second fill height (FH2) for each of the five modeled boundaries 2176-1 through 2176-5, based on the scaling factors listed above.

TABLE 1

| | | Scaling Factor | | | | |
|---|---|---|---|---|---|---|
| | FV2 (%) | 0.00 | 0.20 | 0.40 | 0.60 | 0.80 |
| Second Mathematical Expression | 100% | 100% | 100% | 100% | 100% | 100% |
| | 90% | 100% | 98% | 96% | 94% | 92% |
| | 80% | 100% | 96% | 92% | 88% | 84% |
| | 70% | 100% | 94% | 88% | 82% | 76% |
| | 60% | 100% | 92% | 84% | 76% | 68% |
| | 50% | 100% | 90% | 80% | 70% | 60% |
| | 40% | 100% | 88% | 76% | 64% | 52% |
| | 30% | 100% | 86% | 72% | 58% | 44% |
| First Mathematical Expression | 30% | 100% | 86% | 72% | 58% | 44% |
| | 20% | 67% | 57% | 48% | 39% | 29% |
| | 10% | 33% | 29% | 24% | 19% | 15% |
| | 0% | 0% | 0% | 0% | 0% | 0% |

The results in Table 1 are consistent with the modeled boundaries 2176-1 through 2176-5 illustrated on the chart 2170.

While the first forms of the second and third mathematical expressions define the modeled boundaries 2176-1 through 2176-5, second forms of these expressions are used to define the modeled areas 2176-1*a* through 2176-5*a*. The difference between the first forms and the second forms is that the equal signs (for use with the boundaries) are replaced by less than or equal to signs (for use with the areas), to indicate that within the modeled areas, the second fill height (FH2) is less than or equal to the modeled boundaries. So, the second form of the second mathematical expression (for 100% to 30% filled) is:

$$FH2 \le FH1X\left(1-\left(\left(1-\frac{FV2}{FV1}\right)X\,SF\right)\right)$$

and the second form of the third mathematical expression (for 30% to 0% filled) is:

$$FH2 \le FH1X\left(\frac{FV2}{FV1}\right)X\left(1+\left(\frac{7}{3}X(1-SF)\right)\right)$$

So, each of the five modeled areas 2176-1*a* through 2176-5*a* has a lower limit defined by the first mathematical expression and an upper limit defined by the second form of the second mathematical expression (for 100% to 30%) and by the second form of the third mathematical expression (30% to 0%), with a scaling factor (SF) of 0.0 for the first modeled area 2176-1*a*, 0.2 for the second modeled area 2176-2*a*, 0.4 for the third modeled area 2176-3*a*, 0.6 for the fourth modeled area 2176-4*a*, and 0.8 for the fifth modeled area 2176-5*a*.

FIG. 22A illustrates a front view of a flexible container 2200-*a* with a structural support frame, according to embodiments of the present disclosure, wherein FIG. 22 shows an exemplary squeeze panel 2280-*a* and an exemplary squeeze panel profile 2280-*p*. The parts of the flexible container 2200-*a* are illustrated in phantom lines, except that the squeeze panel profile 2280-*p* is illustrated in solid lines. In a line-up of flexible containers, according to any of the embodiments disclosed herein, both or all of the flexible containers in the line-up can include one or more squeeze panels (e.g. front squeeze panel, back squeeze panel, squeeze panels on multiple sides, etc.), each squeeze panel having a squeeze panel profile, and any of the squeeze panels can have a size and/or shape that is about, or approximately, or substantially, or nearly similar to or the same as a size and/or shape of a squeeze panel profile of another squeeze panel of another flexible container in the line-up.

FIG. 22B illustrates a view of a front 2202-1*b* of a flexible container 2200-*a* with a structural support frame, according to embodiments of the present disclosure, wherein FIG. 22 shows an exemplary overall front profile 2202-1*p*. The parts of the flexible container 2200-*a* are illustrated in phantom lines, except that the overall front profile 2202-1*p* is illustrated in solid lines. In a line-up of flexible containers, according to any of the embodiments disclosed herein, both or all of the flexible containers in the line-up can include an overall front profile having a size and/or shape that is about, or approximately, or substantially, or nearly similar to or the same as a size and/or shape of an overall front profile of another flexible container in the line-up. In the same way that a flexible container can have an overall front profile, a flexible container can have an overall back profile, which can also be similar or the same among containers in a line-up of flexible containers.

FIG. 22C illustrates a view of a side 2209-*c* of a flexible container 2200-*c* with a structural support frame, according to embodiments of the present disclosure, wherein FIG. 22 shows a longitudinal centerline 2214, a front 2202-1*c*, and a back 2202-2*c* of the flexible container 2200-*c*, along with an exemplary overall side profile 2209-*p*. The parts of the flexible container 2200-*c* are illustrated in phantom lines, except that the overall side profile 2209-*p* is illustrated in solid lines. In a line-up of flexible containers, according to any of the embodiments disclosed herein, both or all of the flexible containers in the line-up can include an overall side profile having a size and/or shape that is about, or approximately, or substantially, or nearly similar to or the same as a size and/or shape of an overall side profile of another flexible container in the line-up; the similarity or sameness may apply to front halves of the overall side profiles, or back halves of the overall side profiles, or both front and back halves of the overall side profiles. In various embodiments described herein, a line-up of flexible containers can include a first container having a first overall side profile and a second container having a second overall side profile, wherein a front half of the second overall side profile has about, or approximately, or substantially, or nearly the same size and shape as a front half of the first overall side profile, and a back half of the second overall side profile has a smaller size than a back half of the first overall side profile.

FIG. 22 shows two exemplary side profile central depth measurements of the flexible container 2200-*c*. The flexible container 2200-*c* has a front side profile central depth measurement 2209-1*cd* that is measured linearly from the longitudinal centerline 2214 of the container 2200-*c*, parallel to a third centerline of the container, to a farthest point 2202-1*fp* on the squeeze panel 2209-*p* profile of the container 2200-*c*, in a front of the container 2200-*c*. The flexible container 2200-*c* has a back side profile central depth measurement 2209-2*cd* that is measured linearly from the longitudinal centerline 2214 of the container 2200-*c*, parallel to a third centerline of the container, to a farthest point 2202-2*fp* on the squeeze panel profile 2209-*p* of the container 2200-*c*, in a front of the container 2200-*c*.

FIGS. 23A-37C illustrate various line-ups of flexible containers wherein, for each particular Figure Number, the container of Figure Number A, the container of Figure Number B, and the container of Figure Number C, represent various containers for inclusion in a line-up, as disclosed herein. The flexible containers of these line-ups are made to have some dimensions that are similar and/or the same and some dimensions that differ, and various amounts of fluent product, according to embodiments described herein. Each of the flexible containers in FIGS. 23A-37C is the same as the flexible container 200 of FIGS. 2A-2D, with like-numbered elements configured in the same way, except as described below. For clarity, not all structural details of these flexible containers are illustrated in FIGS. 23A-37C, however any of the embodiments of FIGS. 23C-37C can be configured to include any structure or feature for flexible containers, disclosed herein. For example, any of the embodiments of FIGS. 23A-37C can be configured to include any kind of structural support frame disclosed herein. In various embodiments, the flexible containers of FIGS. 23C-37C may be sealed or may not be sealed.

Figures 23A, 23B, 23C:
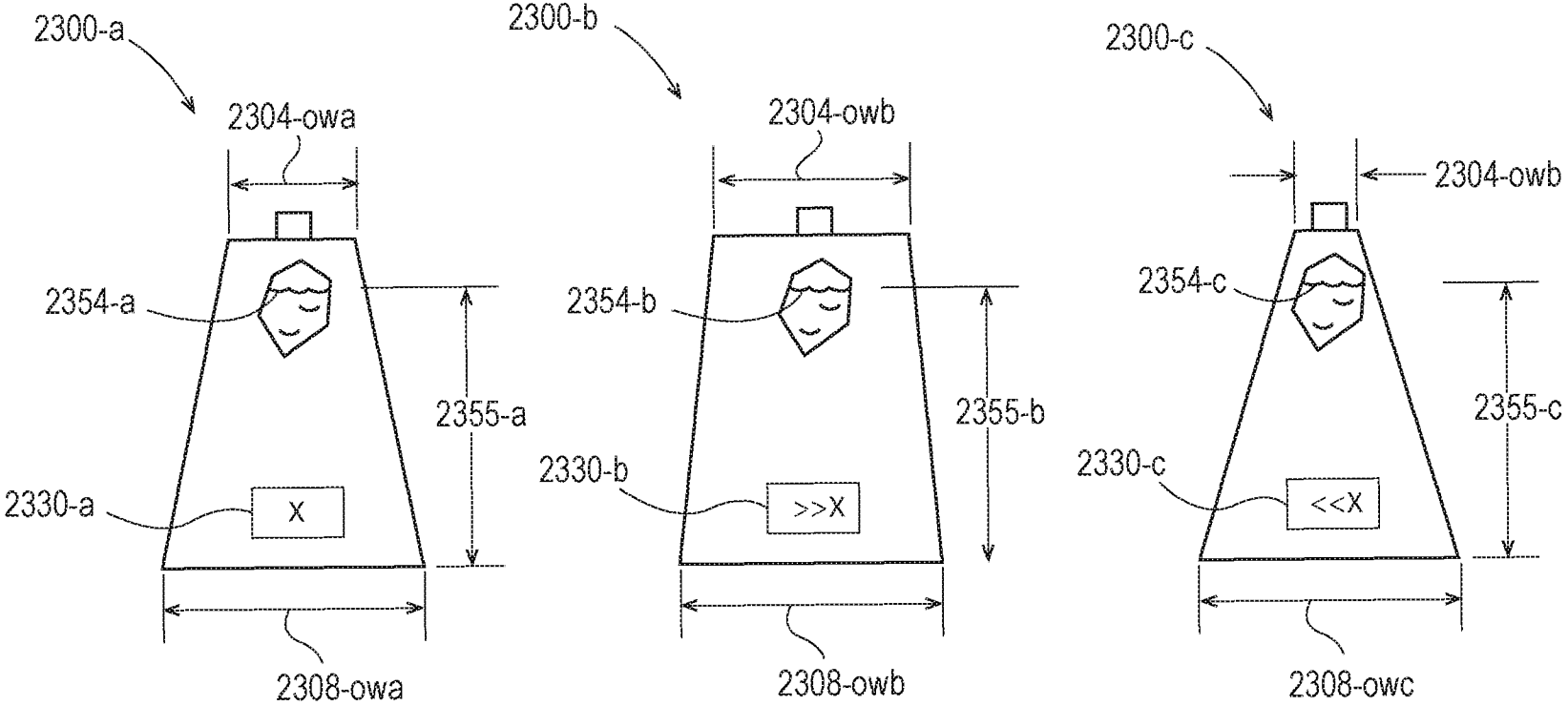
FIG. 23A illustrates a front view of a flexible container, having a medium-sized overall top width.
FIG. 23B illustrates a front view of a flexible container, having a relatively larger overall top width.
FIG. 23C illustrates a front view of a flexible container, having a relatively small overall top width.

FIGS. 23A-23C illustrate a line-up of flexible containers having differing overall top widths, and differing amounts of fluent product, but the same closed fill height.

FIG. 23A illustrates a front view of a flexible container 2300-*a*, having a product space that is visible through a portion of a panel that is illustrated as broken away. An external amount indicium 2330-*a* indicates a particular listed amount (designated "X") of the fluent product that is being offered for sale with the container 2300-*a*. A product space of the flexible container 2300-*a* contains an actual amount of the fluent product equal to the particular listed amount in the external amount indicium 2330-*a*. Inside the product space, the fluent product forms a fill line 2354-*a* at a closed fill height 2355-*a*. An uppermost part of a top of the container 2300-*a* (excluding the dispenser and cap) has an overall top width 2304-*owa*, and a lowermost part of a bottom of the container 2300-*a* has an overall bottom width 2308-*owa*.

FIG. 23B illustrates a front view of a flexible container 2300-*b*, having a product space that is visible through a portion of a panel that is illustrated as broken away. An external amount indicium 2330-*b* indicates a particular listed amount (designated ">>X") of the fluent product that is being offered for sale with the container 2300-*b*. A product space of the flexible container 2300-*b* contains an actual amount of the fluent product equal to the particular listed amount in the external amount indicium 2330-*b*. Inside the product space, the fluent product forms a fill line 2354-*b* at a closed fill height 2355-*b*. An uppermost part of a top of the container 2300-*b* (excluding the dispenser and cap) has an overall top width 2304-*owb*, and a lowermost part of a bottom of the container 2300-*b* has an overall bottom width 2308-*owb*. When compared with the flexible container 2300-*a* of FIG. 23A, the flexible container 2300-*b* contains more fluent product and has a larger overall top width 2304-*owb*, but has the same overall bottom width 2308-*owb* and the same closed fill height 2355-*b*. The larger overall top width 2304-*owb* enables the flexible container 2300-*b* to have a product space that holds more fluent product at the same closed fill height 2355-*b*, with the same overall bottom width 2308-*owb*. In various embodiments, the flexible container 2300-*b* may have an overall thickness and/or overall height that is the same as, similar to, or different from the flexible container 2300-*a* of FIG. 23A.

FIG. 23C illustrates a front view of a flexible container 2300-*c*, having a product space that is visible through a portion of a panel that is illustrated as broken away. An external amount indicium 2330-*c* indicates a particular listed amount (designated "<<X") of the fluent product that is being offered for sale with the container 2300-*c*. A product space of the flexible container 2300-*c* contains an actual amount of the fluent product equal to the particular listed amount in the external amount indicium 2330-*c*. Inside the product space, the fluent product forms a fill line 2354-*c* at a closed fill height 2355-*c*. An uppermost part of a top of the container 2300-*c* (excluding the dispenser and cap) has an overall top width 2304-*owc*, and a lowermost part of a bottom of the container 2300-*b* has an overall bottom width 2308-*owc*. When compared with the flexible container 2300-*a* of FIG. 23A, the flexible container 2300-*c* contains less fluent product and has a smaller overall top width 2304-*owc*, but has the same overall bottom width 2308-*owc*, and the same closed fill height 2355-*c*. The smaller overall top width 2304-*otc* enables the flexible container 2300-*c* to have a product space that holds less fluent product at the same closed fill height 2355-*b*, with the same overall bottom width 2308-*otc*. In various embodiments, the flexible container 2300-*c* may have an overall thickness and/or overall height that is the same as, similar to, or different from the flexible container 2300-*a* of FIG. 23A.

Figure 24C:
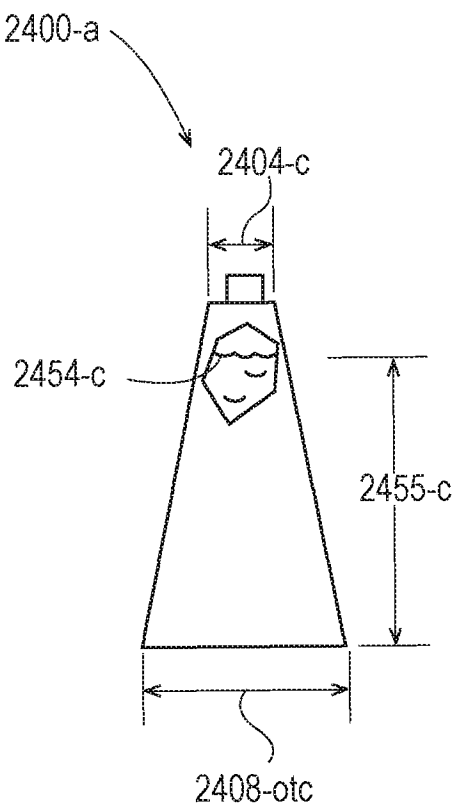
FIG. 24C illustrates a side view of a flexible container, having a relatively smaller overall top thickness.
Figure 24B:
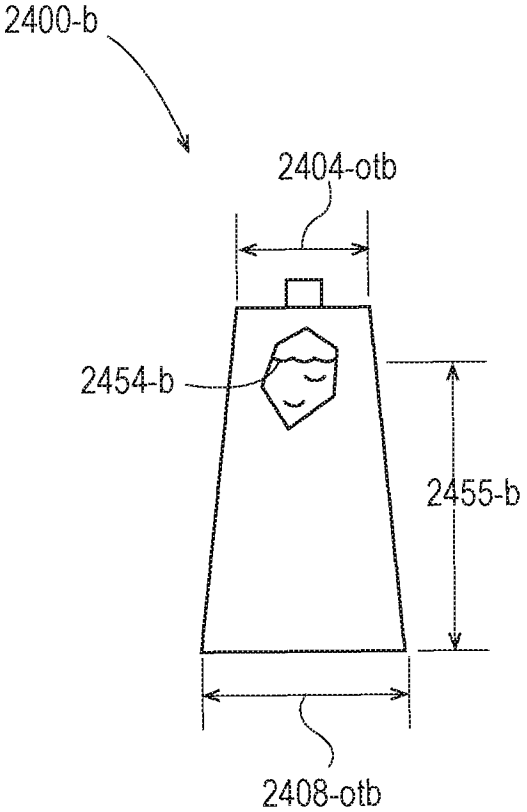
FIG. 24B illustrates a side view of a flexible container, having a relatively larger overall top thickness.
Figure 24A:
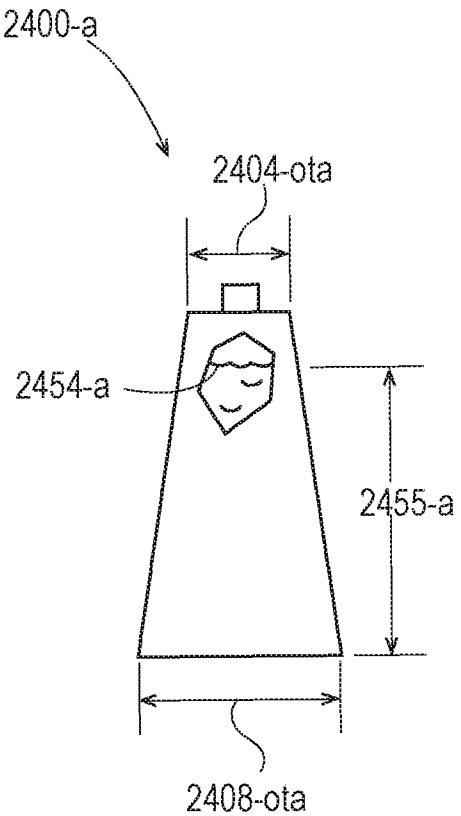
FIG. 24A illustrates a side view of a flexible container, having a medium-sized overall top thickness.

FIGS. 24A-24C illustrate a line-up of flexible containers having differing overall top thicknesses, and differing amounts of fluent product, but the same closed fill height.

FIG. 24A illustrates a front view of a flexible container 2400-*a*, having a product space that is visible through a portion of a panel that is illustrated as broken away. A product space of the flexible container 2400-*a* contains a particular actual amount of a fluent product, which forms a fill line 2454-*a* at a closed fill height 2455-*a*. An uppermost part of a top of the container 2400-*a* (excluding the dispenser and cap) has an overall top thickness 2404-*ota*, and a lowermost part of a bottom of the container 2400-*a* has an overall thickness width 2408-*ota*.

FIG. 24B illustrates a front view of a flexible container 2400-*b*, having a product space that is visible through a portion of a panel that is illustrated as broken away. A product space of the flexible container 2400-*b* contains a particular actual amount of a fluent product, which forms a fill line 2454-*b* at a closed fill height 2455-*b*. An uppermost part of a top of the container 2400-*b* (excluding the dispenser and cap) has an overall top thickness 2404-*otb*, and a lowermost part of a bottom of the container 2400-*b* has an overall bottom thickness 2408-*otb*. When compared with the flexible container 2400-*a* of FIG. 24A, the flexible container 2400-*b* contains more fluent product and has a larger overall top thickness 2404-*otb*, but has the same overall bottom thickness 2408-*otb* and the same closed fill height 2455-*b*. The larger overall top thickness 2404-*otb* enables the flexible container 2400-*b* to have a product space that holds more fluent product at the same closed fill height 2455-*b*, with the same overall bottom thickness 2408-*otb*. In various embodiments, the flexible container 2400-*b* may have an overall width and/or overall height that is the same as, similar to, or different from the flexible container 2400-*a* of FIG. 24A.

FIG. 24C illustrates a front view of a flexible container 2400-*c*, having a product space that is visible through a portion of a panel that is illustrated as broken away. A product space of the flexible container 2400-*c* contains a particular actual amount of a fluent product, which forms a fill line 2454-*c* at a closed fill height 2455-*c*. An uppermost part of a top of the container 2400-*c* (excluding the dispenser and cap) has an overall top thickness 2404-*otc*, and a lowermost part of a bottom of the container 2400-*b* has an overall bottom thickness 2408-*otc*. When compared with the flexible container 2400-*a* of FIG. 24A, the flexible container 2400-*c* contains less fluent product and has a smaller overall top thickness 2404-*otc*, but has the same overall bottom thickness 2408-*otc*, and the same closed fill height 2455-*c*. The smaller overall top thickness 2404-*otc* enables the flexible container 2400-*c* to have a product space that holds less fluent product at the same closed fill height 2455-*b*, with the same overall bottom thickness 2408-*otc*. In various embodiments, the flexible container 2400-*c* may have an overall width and/or overall height that is the same as, similar to, or different from the flexible container 2400-*a* of FIG. 24A.

Figures 25A, 25B, 25C:
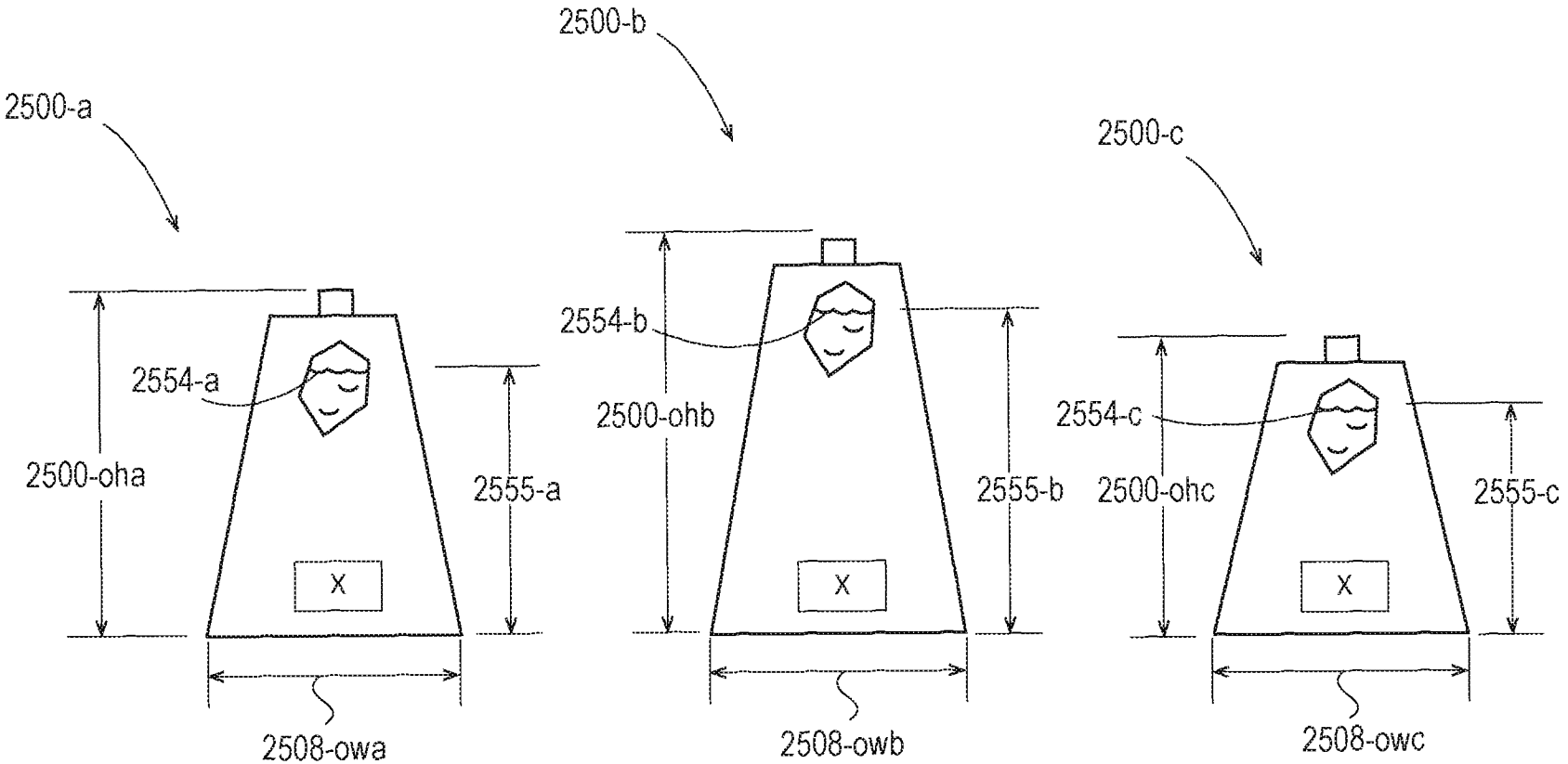
FIG. 25A illustrates a front view of a flexible container, having a medium-sized overall height.
FIG. 25B illustrates a front view of a flexible container, having a relatively taller overall height.
FIG. 25C illustrates a front view of a flexible container, having a relatively shorter overall height.

FIGS. 25A-25C illustrate a line-up of flexible containers having differing overall heights, and differing closed fill heights, but the same amount of fluent product.

FIG. 25A illustrates a front view of a flexible container 2500-*a*, having a product space that is visible through a portion of a panel that is illustrated as broken away. An external amount indicium 2530-*a* indicates a particular listed amount (designated "X") of the fluent product that is being offered for sale with the container 2500-*a*. A product space of the flexible container 2500-*a* contains an actual amount of the fluent product equal to the particular listed amount in the external amount indicium 2530-*a*. Inside the product space, the fluent product forms a fill line 2554-*a* at a closed fill height 2555-*a*. The container 2500-*a* has an overall height 2504-*oha*, and a lowermost part of a bottom of the container 2500-*a* has an overall bottom width 2508-*owa*.

FIG. 25B illustrates a front view of a flexible container 2500-*b*, having a product space that is visible through a portion of a panel that is illustrated as broken away. An external amount indicium 2530-*b* indicates a particular listed amount (designated "X") of the fluent product that is being offered for sale with the container 2500-*b*. A product space of the flexible container 2500-*b* contains an actual amount of the fluent product equal to the particular listed amount in the external amount indicium 2530-*b*. Inside the product space, the fluent product forms a fill line 2554-*b* at a closed fill height 2555-*b*. The container 2500-*b* has an overall height 2504-*ohb*, and a lowermost part of a bottom of the container 2500-*b* has an overall bottom width 2508-*owb*. When compared with the flexible container 2500-*a* of FIG. 25A, the flexible container 2500-*b* contains the same amount of fluent product and has the same overall bottom width 2508-*owb*, but has a taller overall height 2504-*ohb* (with the same dispenser and cap), and a higher closed fill height 2555-*b*. The flexible configuration of the product space enables the flexible container 2500-*b* to hold the same amount of fluent product at a higher closed fill height 2555-*b*, with the same overall bottom width 2508-*owb*, according to embodiments disclosed herein. In various embodiments, the flexible container 2500-*b* may have an overall thickness and/or overall top width that is the same as, similar to, or different from the flexible container 2500-*a* of FIG. 25A.

FIG. 25C illustrates a front view of a flexible container 2500-*c*, having a product space that is visible through a portion of a panel that is illustrated as broken away. An external amount indicium 2530-*c* indicates a particular listed amount (designated "X") of the fluent product that is being offered for sale with the container 2500-*c*. A product space of the flexible container 2500-*c* contains an actual amount of the fluent product equal to the particular listed amount in the external amount indicium 2530-*c*. Inside the product space, the fluent product forms a fill line 2554-*c* at a closed fill height 2555-*c*. The container 2500-*c* has an overall height 2504-*ohc*, and a lowermost part of a bottom of the container 2500-*b* has an overall bottom width 2508-*otc*. When compared with the flexible container 2500-*a* of FIG. 25A, the flexible container 2500-*c* contains the same amount of fluent product and has the same overall bottom width 2508-*owc*, but has a shorter overall height 2504-*ohc* (with the same dispenser and cap), and a lower closed fill height 2555-*c*. The flexible configuration of the product space enables the flexible container 2500-*c* to hold the same amount of fluent product at a lower closed fill height 2555-*c*, with the same overall bottom width 2508-*owc*, according to embodiments disclosed herein. In various embodiments, the flexible container 2500-*c* may have an overall thickness and/or overall top width that is the same as, similar to, or different from the flexible container 2500-*a* of FIG. 25A.

Figure 26C:
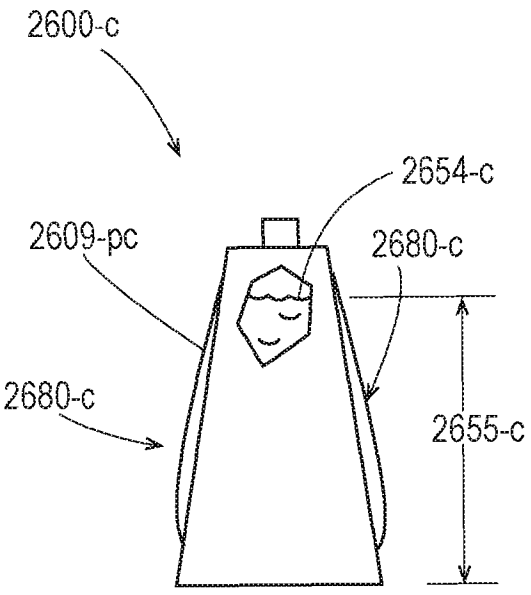
FIG. 26C illustrates a front view of a flexible container, having a relatively smaller overall side profile.
Figure 26B:
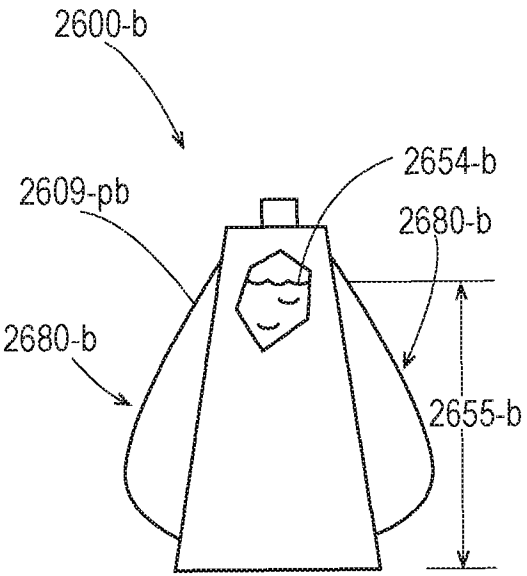
FIG. 26B illustrates a front view of a flexible container, having a relatively larger overall side profile.
Figure 26A:
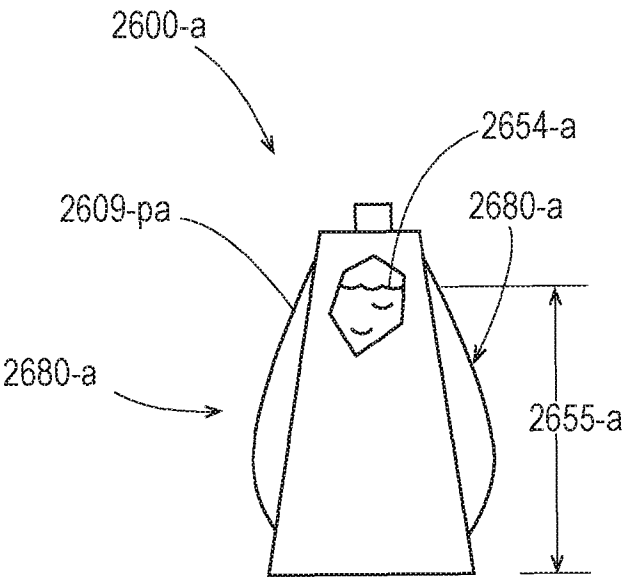
FIG. 26A illustrates a front view of a flexible container, having a medium-sized overall side profile.

FIGS. 26A-26C illustrate a line-up of flexible containers having differing overall side profiles, and differing amounts of fluent product, but the same closed fill height.

FIG. 26A illustrates a side view of a flexible container 2600-*a*, having a product space that is visible through a portion of the container 2600-*a* that is illustrated as broken away. A product space of the flexible container 2600-*a* contains a particular actual amount of a fluent product. Inside the product space of the flexible container 2600-*a*, the fluent product forms a fill line 2654-*a* at a closed fill height 2655-*a*. The flexible container 2600-*a* has a particular overall side profile 2609-*pa*, which includes a moderate degree of bulging by front and back squeeze panels 2680-*a* of the flexible container 2600-*a*. The size and shape of the overall side profile 2609-*a* result from the construction of the flexible container 2600-*a*, and the construction of the product space for the flexible container 2600-*a*, including the squeeze panels 2680-*a* as well as the processing steps used to make the flexible container 2600-*a*. In various embodiments, the flexible container 2600-*a* of FIG. 26A can include one or more materials configured according to one or more structures, features, and/or constructions of one or more of any of the embodiments of the flexible containers of FIGS. 27A, 28A, 29A, 30A, 31A, 32A, 33A and 34A (individually or in combination), and/or according to one or more processing steps for the flexible containers of FIGS. 35A, 36A, and 37A (individually or in combination), including any alternative embodiments, as described herein, so that, when the particular amount of the fluent product is added to the product space of the flexible container 2600-*a*, the fluent product forms the fill line 2654-*a* at the closed fill height 2655-*a*.

FIG. 26B illustrates a side view of a flexible container 2600-*b*, having a product space that is visible through a portion of the container 2600-*b* that is illustrated as broken away. A product space of the flexible container 2600-*b* contains a particular actual amount of a fluent product, which is greater than the particular actual amount of the fluent product in the product space of the flexible container 2600-*a* of FIG. 26A. Inside the product space of the flexible container 2600-*b*, the fluent product forms a fill line 2654-*b* at a closed fill height 2655-*b*, which is the same as the closed fill height 2655-*a* of the flexible container 2600-*a* of FIG. 26A. The flexible container 2600-*b* has a particular overall side profile 2609-*pb*, which includes a relatively large degree of bulging by front and back squeeze panels 2680-*b* of the flexible container 2600-*b*. The front and back squeeze panels 2680-*b* of the flexible container 2600-*b* bulge out to a greater extent than the front and back squeeze panels 2680-*a* of the flexible container 2600-*a* of FIG. 26A. And, the squeeze panels 2680-*b* of the flexible container 2600-*b* have side profile central depth measurements that are greater than the side profile central depth measurements of the squeeze panels 2680-*a* of the flexible container 2600-*a* of FIG. 26A.

The size and shape of the overall side profile 2609-*b* result from the construction of the flexible container 2600-*b*, and the construction of the product space for the flexible container 2600-*b*, including the squeeze panels 2680-*b* as well as the processing steps used to make the flexible container 2600-*b*. In various embodiments, the flexible container 2600-*b* of FIG. 26B can include one or more materials configured according to one or more structures, features, and/or constructions of one or more of any of the embodiments of the flexible containers of FIGS. 27B, 28B, 29B, 30B, 31B, 32B, 33B, and 34B (individually or in combination), and/or according to one or more processing steps for the flexible containers of FIGS. 35B, 36B, and 37B (individually or in combination), including any alternative embodiments, as described herein, so that, when the particular amount of the fluent product is added to the product space of the flexible container 2600-*b*, the fluent product forms the fill line 2654-*b* at the closed fill height 2655-*b*. The squeeze panel 2680-*b* can be made from one or more flexible materials, which may or may not be the same flexible materials that make the squeeze panel 2680-*a* of the flexible container 2600-*a* of FIG. 26A. In various embodiments, the squeeze panel 2680-*b* can be made from one or more flexible materials having an overall modulus of elasticity that is less than an overall modulus of elasticity of the one or more materials that make the squeeze panel 2680-*a* of the flexible container 2600-*a* of FIG. 26A.

In various embodiments, the flexible container 2600-*b* of FIG. 26B may have an overall width and/or overall height and/or overall thickness that is the same as, similar to, or different from corresponding dimension(s) in the flexible container 2600-*a* of FIG. 26A. Also, in various embodiments, the flexible container 2600-*b* of FIG. 26B may have a squeeze panel profile and/or an overall front profile and/or overall back profile with a size and/or shape that is the same as, similar to, or different from corresponding profile(s) of the flexible container 2600-*a* of FIG. 26A.

FIG. 26C illustrates a side view of a flexible container 2600-*c*, having a product space that is visible through a portion of the container 2600-*c* that is illustrated as broken away. A product space of the flexible container 2600-*c* contains a particular actual amount of a fluent product, which is less than the particular actual amount of the fluent product in the product space of the flexible container 2600-*a* of FIG. 26A. Inside the product space of the flexible container 2600-*c*, the fluent product forms a fill line 2654-*c* at a closed fill height 2655-*c*, which is the same as the closed fill height 2655-*a* of the flexible container 2600-*a* of FIG. 26A. The flexible container 2600-*c* has a particular overall side profile 2609-*pc*, which includes a relatively small degree of bulging by front and back squeeze panels 2680-*c* of the flexible container 2600-*c*. The front and back squeeze panels 2680-*c* of the flexible container 2600-*c* bulge out to a lesser extent than the front and back squeeze panels 2680-*a* of the flexible container 2600-*a* of FIG. 26A. And, the squeeze panels 2680-*c* of the flexible container 2600-*c* have side profile central depth measurements that are less than the side profile central depth measurements of the squeeze panels 2680-*a* of the flexible container 2600-*a* of FIG. 26A.

The size and shape of the overall side profile 2609-*c* result from the construction of the flexible container 2600-*c*, and the construction of the product space for the flexible container 2600-*c*, including the squeeze panels 2680-*a* as well as the processing steps used to make the flexible container 2600-*c*. In various embodiments, the flexible container 2600-*c* of FIG. 26C can include one or more materials configured according to one or more structures, features, and/or constructions of one or more of any of the embodiments of the flexible containers of FIGS. 27C, 28C, 29C, 30C, 31C, 32C, 33C, and 34C (individually or in combination), and/or according to one or more processing steps for the flexible containers of FIGS. 35C, 36C, and 37C (individually or in combination), including any alternative embodiments, as described herein, so that, when the particular amount of the fluent product is added to the product space of the flexible container 2600-*c*, the fluent product forms the fill line 2654-*c* at the closed fill height 2655-*c*. The squeeze panel 2680-*c* can be made from one or more flexible materials, which may or may not be the same flexible materials that make the squeeze panel 2680-*a* of the flexible container 2600-*a* of FIG. 26A. In various embodiments, the squeeze panel 2680-*c* can be made from one or more flexible materials having an overall modulus of elasticity that is greater than an overall modulus of elasticity of the one or more materials that make the squeeze panel 2680-*a* of the flexible container 2600-*a* of FIG. 26A.

In various embodiments, the flexible container 2600-*c* of FIG. 26C may have an overall width and/or overall height and/or overall thickness that is the same as, similar to, or different from corresponding dimension(s) in the flexible container 2600-*a* of FIG. 26A. Also, in various embodiments, the flexible container 2600-*c* of FIG. 26C may have a squeeze panel profile and/or an overall front profile and/or overall back profile with a size and/or shape that is the same as, similar to, or different from corresponding profile(s) of the flexible container 2600-*a* of FIG. 26A.

Figures 27A, 27B, 27C:
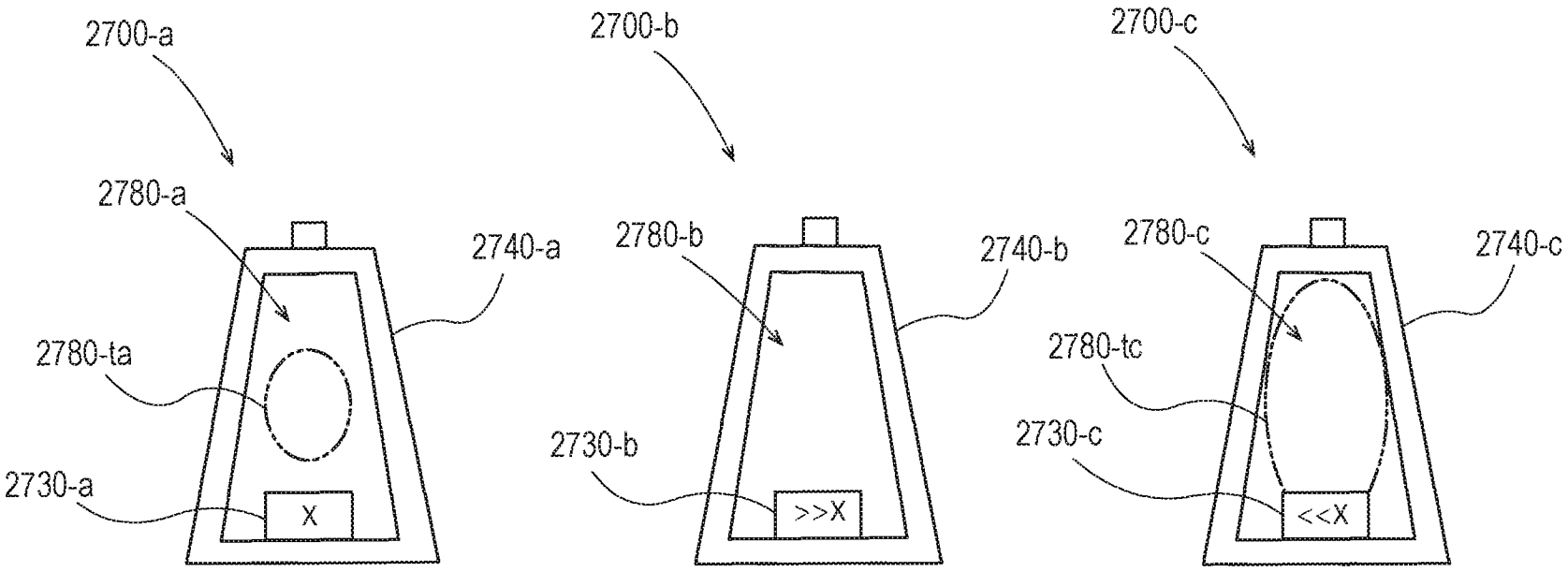
FIG. 27A illustrates a front view of a flexible container, having a relatively smaller treated area for increasing the rigidity of a squeeze panel.
FIG. 27B illustrates a front view of a flexible container, having no treated area for increasing the rigidity of a squeeze panel.
FIG. 27C illustrates a front view of a flexible container, having a relatively larger treated area for increasing the rigidity of a squeeze panel.

FIGS. 27A-27C illustrate a line-up of flexible containers having squeeze panels with differing treatments for increasing the rigidity of the squeeze panel.

FIG. 27A illustrates a front view of a flexible container 2700-*a*, having a particular actual amount of a fluent product, which is equal to a particular listed amount (designated "X"), indicated on an external amount indicium 2730-*a*. The flexible container 2700-*a* includes a structural support frame 2740-*a* and a squeeze panel 2780-*a* made from one or more flexible materials.

The squeeze panel 2780-*a* includes a treated area 2780-*ta*, which is treated with one or more treatments that increase the rigidity of flexible materials, as described below. While the squeeze panel 2780-*a* has one treated area 2780-*ta*, a squeeze panel can have any number of treated areas. The treated area 2780-*ta* is an oval shaped portion of the squeeze panel 2780-*a*, however a treated area can have any convenient size and shape. The treated area 2780-*ta* is laterally centered on a middle portion of the squeeze panel 2780-*a*, however a treated area can be disposed on any part of a squeeze panel. A treated area may extend over part, parts, or all of a top, middle, or bottom portion of a squeeze panel, in any convenient arrangement. A treated area may or may not be centered on the squeeze panel, may or may not be laterally centered on the flexible container, and may or may not be adjacent to one or more portions of an outer periphery of the squeeze panel. The treated area 2780-*ta* is surrounded on all sides by an untreated portion of the squeeze panel 2780-*a*, however this particular relationship with surrounding elements is not required. The treated area 2780-*ta* is a continuous area, however, in various embodiments a treated area may be discontinuous (e.g. may include and/or be separated by one or more untreated portions) in any regular or irregular pattern. A treated area can cover 1-100% of an area of a squeeze panel, or any integer value for percentage from 1-100%, or within any range formed by any of these values, such as 1-90%, 1-80%, 1-70%, 1-60% x, 1-50%, 1-40%, 1-30%, 1-20%, 1-10%, 10-100%, 20-100%, 30-100%, 40-100%, 50-100%, 60-100%, 70-100%, 80-100%, 90-100%, 10-90%, 20-80%, 30-70%, 40-60%, 45-55%, etc. Any embodiment of a flexible container disclosed herein can include a squeeze panel with the treated area 2780-*ta* as described and illustrated in connection with flexible container 2700-*a* of FIG. 27A, including any alternative embodiments. In various embodiments, a treated area that increases the rigidity of flexible materials can be similarly included on flexible materials of any portion of a flexible container, including a panel that may not be considered a squeeze panel.

Within the treated area 2780-*ta*, some or all of flexible material(s) of the squeeze panel 2780-*a*, can be treated with one or more of the treatments described below. The flexible materials can be chemically treated to increase their rigidity and/or to decrease their extensibility. The flexible materials can be coated to increase their rigidity and/or to decrease their extensibility. The flexible materials can also be treated with radiation to promote cross-linking between polymers within the materials (or coated thereon) for increasing rigidity and/or decreasing extensibility. The flexible materials can also be treated in any other way known in the art of flexible materials, for increasing rigidity and/or decreasing extensibility.

A treated area can be treated at various points in the process for making a flexible container. As examples, one or more treatments can be applied to flexible materials before they are received, after they are received but before they are converted, or even after they are converted. However, one or more treatments may be conveniently applied to flexible materials after their unwinding but before they are singulated, to more easily align treated area(s) with specific locations on flexible containers.

FIG. 27B illustrates a front view of a flexible container 2700-*b*, having a particular actual amount of a fluent product, which is equal to a particular listed amount (designated ">>X"), indicated on an external amount indicium 2730-*b*. The particular actual amount of fluent product in the flexible container 2700-*b* is greater than the particular actual amount of the fluent product in the flexible container 2700-*a* of FIG. 27A. The flexible container 2700-*b* includes a structural support frame 2740-*b* and a squeeze panel 2780-*b* made from one or more flexible materials, which may or may not be the same flexible materials that make the squeeze panel 2780-*a* of the flexible container 2700-*a* of FIG. 27A.

In the embodiment of FIG. 27B, the squeeze panel 2780-*b* does not include an area treated for increasing rigidity, so the untreated flexible materials of the squeeze panel 2780-*b* are relatively less rigid and/or relatively more extensible than the treated portion(s) of the flexible materials of the squeeze panel 2780-*a* of the flexible container 2700-*a* of FIG. 27A. This difference in rigidity and/or extensibility enables the squeeze panel 2780-*b* of the flexible container 2700-*b* to bulge out to a relatively greater extent than the squeeze panel 2780-*a* of the flexible container 2700-*a* of FIG. 27A.

In various alternative embodiments, the squeeze panel 2780-*b* may include a treated area, so long as there is a difference in rigidity and/or extensibility that enables the squeeze panel 2780-*b* of the flexible container 2700-*b* to bulge out to a relatively greater extent than the squeeze panel 2780-*a* of the flexible container 2700-*a* of FIG. 27A. As an example, the squeeze panel 2780-*b* may include a treated area that is smaller than the treated area 2780-*ta* of the squeeze panel 2780-*a* of the flexible container 2700-*a*. As another example, the squeeze panel 2780-*b* may include a treated area that is similar in size to the treated area 2780-*ta* of the squeeze panel 2780-*a* of the flexible container 2700-*a*, but the treated area of the squeeze panel 2780-*b* may be treated to a lesser degree (i.e. treated to provide rigidity, but relatively less rigidity). As a further example, the squeeze panel 2780-*b* may include a treated area that is similar in size and treated to a similar degree, when compared to the treated area 2780-*ta* of the squeeze panel 2780-*a* of the flexible container 2700-*a*, but the treated area of the squeeze panel

2780-*b* may be configured in a shape and/or pattern that effectively provides a relatively lesser degree of rigidity to the squeeze panel 2780-*b*.

FIG. 27C illustrates a front view of a flexible container 2700-*c*, having a particular actual amount of a fluent product, which is equal to a particular listed amount (designated "<<X"), indicated on an external amount indicium 2730-*c*. The particular actual amount of fluent product in the flexible container 2700-*c* is less than the particular actual amount of the fluent product in the flexible container 2700-*a* of FIG. 27A. The flexible container 2700-*c* includes a structural support frame 2740-*c* and a squeeze panel 2780-*c* made from one or more flexible materials, which may or may not be the same flexible materials that make the squeeze panel 2780-*a* of the flexible container 2700-*a* of FIG. 27A.

In the embodiment of FIG. 27C, the squeeze panel 2780-*c* includes a treated area 2780-*tc*. The treated area 2780-*tc* increases the rigidity of flexible materials, and is configured in the same way as the treated area 2780-*ta* of FIG. 27A, except that the treated area 2780-*tc* is relatively larger than the treated area 2780-*ta* of FIG. 27A, so the squeeze panel 2780-*c* is relatively more rigid and/or relatively less extensible than the squeeze panel 2780-*a* of the flexible container 2700-*a* of FIG. 27A. This difference in rigidity and/or extensibility enables the squeeze panel 2780-*c* of the flexible container 2700-*c* to bulge out to a relatively lesser extent than the squeeze panel 2780-*a* of the flexible container 2700-*a* of FIG. 27A.

In various alternative embodiments, the squeeze panel 2780-*b* may include a treated area with other configurations, so long as there is a difference in rigidity and/or extensibility that enables the squeeze panel 2780-*c* of the flexible container 2700-*c* to bulge out to a relatively lesser extent than the squeeze panel 2780-*a* of the flexible container 2700-*a* of FIG. 27A. As an example, the squeeze panel 2780-*c* may include a treated area that is similar in size to the treated area 2780-*ta* of the squeeze panel 2780-*a* of the flexible container 2700-*a*, but the treated area of the squeeze panel 2780-*c* may be treated to a greater degree (i.e. treated to provide relatively more rigidity). As another example, the squeeze panel 2780-*c* may include a treated area that is similar in size and treated to a similar degree, when compared to the treated area 2780-*ta* of the squeeze panel 2780-*a* of the flexible container 2700-*a*, but the treated area of the squeeze panel 2780-*c* may be configured in a shape and/or pattern that effectively provides a relatively greater degree of rigidity to the squeeze panel 2780-*c*. Alternatively, a thicker and/or stiffer film may be added to part or parts of the squeeze panel, to provide a greater degree of rigidity.

Figures 28A, 28B, 28C:
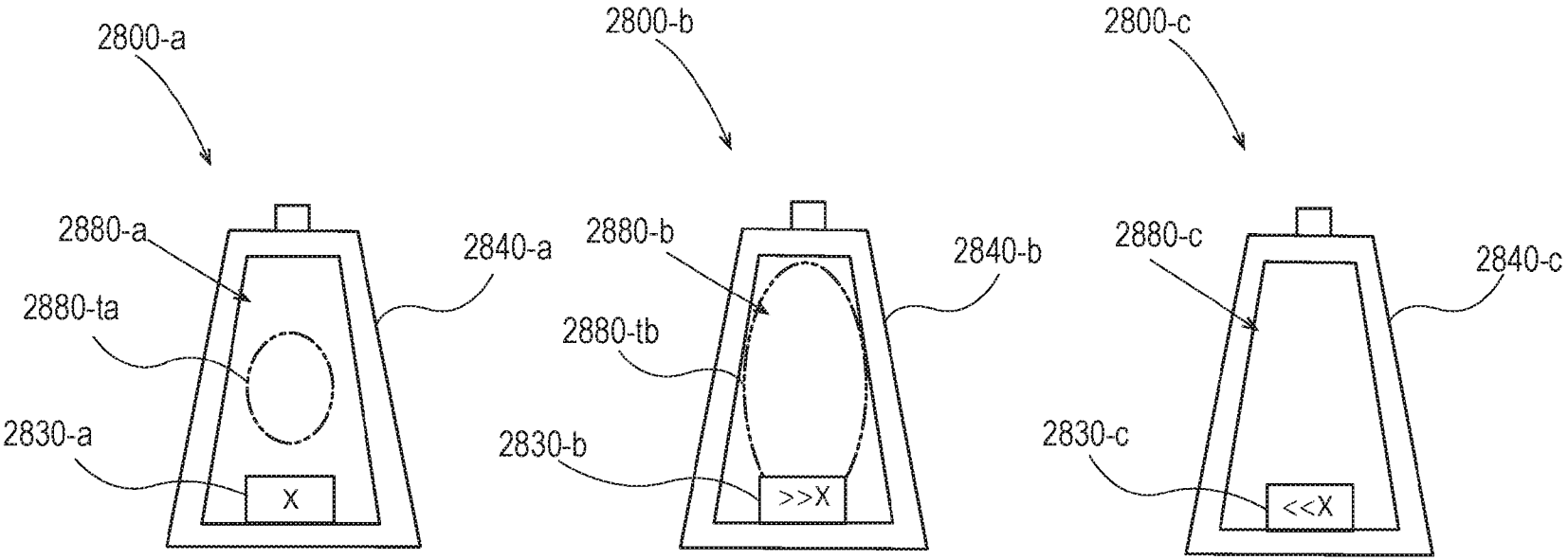

FIGS. 28A-28C illustrate a line-up of flexible containers having squeeze panels with differing treatments for increasing the extensibility of the squeeze panel.

FIG. 28A illustrates a front view of a flexible container 2800-*a*, having a particular actual amount of a fluent product, which is equal to a particular listed amount (designated "X"), indicated on an external amount indicium 2830-*a*. The flexible container 2800-*a* includes a structural support frame 2840-*a* and a squeeze panel 2880-*a* made from one or more flexible materials.

The squeeze panel 2880-*a* includes a treated area 2880-*ta*, which is treated with one or more treatments that increase the extensibility of flexible materials, as described below. The squeeze panel 2880-*a* has one treated area 2880-*ta*, which is an oval shaped continuous area that is laterally centered on a middle portion of the squeeze panel 2880-*a*, and surrounded on all sides by an untreated portion of the squeeze panel 2880-*a*, however this particular configuration is not required, and the treated area 2880-*a* can be configured in any manner disclosed herein for treated areas. Any embodiment of a flexible container disclosed herein can include a squeeze panel with the treated area 2880-*ta* as described and illustrated in connection with flexible container 2800-*a* of FIG. 28A, including any alternative embodiments. In various embodiments, a treated area that increases the extensibility of flexible materials can be similarly included on flexible materials of any portion of a flexible container, including on a panel that may not be considered a squeeze panel.

Within the treated area 2880-*ta*, some or all of flexible material(s) of the squeeze panel 2880-*a*, can be treated with one or more of the treatments described below. The flexible materials can be mechanically treated to increase their extensibility; for example, the flexible materials can be embossed and/or incrementally stretched. Examples of incremental stretching include those found in U.S. Pat. No. 4,834,741 entitled "Diaper with Waist Band Elastic" by Sabee in the name of Tuff Spun Products, Inc.; in U.S. Pat. No. 5,143,679 entitled "Method for sequentially stretching zero strain stretch laminate web to impart elasticity thereto without rupturing the web" by Weber, et al. in the name of The Procter & Gamble Company; in U.S. Pat. No. 5,156,793 entitled "Method for incrementally stretching zero strain stretch laminate web in a non-uniform manner to impart a varying degree of elasticity thereto" by Buell, et al. in the name of The Procter & Gamble Company; U.S. Pat. No. 5,167,897 entitled "Method for incrementally stretching a zero strain stretch laminate web to impart elasticity thereto" by Weber, et al. in the name of The Procter & Gamble Company; each of which, is hereby incorporated by reference. The flexible materials can be thermally treated to increase their extensibility; for example, the flexible materials can be heated by conduction, convection, and/or radiation. The flexible materials can also be treated in any other way known in the art of flexible materials, for increasing extensibility and/or decreasing rigidity.

FIG. 28B illustrates a front view of a flexible container 2800-*b*, having a particular actual amount of a fluent product, which is equal to a particular listed amount (designated ">>X"), indicated on an external amount indicium 2830-*b*. The particular actual amount of fluent product in the flexible container 2800-*b* is greater than the particular actual amount of the fluent product in the flexible container 2800-*a* of FIG. 28A. The flexible container 2800-*b* includes a structural support frame 2840-*b* and a squeeze panel 2880-*b* made from one or more flexible materials, which may or may not be the same flexible materials that make the squeeze panel 2880-*a* of the flexible container 2800-*a* of FIG. 28A.

In the embodiment of FIG. 28B, the squeeze panel 2880-*b* includes a treated area 2880-*tb*. The treated area 2880-*tb* increases the extensibility of flexible materials, and is configured in the same way as the treated area 2880-*ta* of FIG. 28A, except that the treated area 2880-*tb* is relatively larger than the treated area 2880-*ta* of FIG. 28A, so the squeeze panel 2880-*b* is relatively more extensible and/or relatively less rigid than the squeeze panel 2880-*a* of the flexible container 2800-*a* of FIG. 28A. This difference in rigidity and/or extensibility enables the squeeze panel 2880-*b* of the flexible container 2800-*b* to bulge out to a relatively greater extent than the squeeze panel 2880-*a* of the flexible container 2800-*a* of FIG. 28A.

In various alternative embodiments, the squeeze panel 2880-*b* may include a treated area with other configurations, so long as there is a difference in extensibility and/or rigidity that enables the squeeze panel 2880-*b* of the flexible container 2800-*b* to bulge out to a relatively greater extent than the squeeze panel 2880-*a* of the flexible container 2800-*a* of FIG. 28A. As an example, the squeeze panel 2880-*b* may include a treated area that is similar in size to the treated area 2880-*ta* of the squeeze panel 2880-*a* of the flexible container 2800-*a*, but the treated area of the squeeze panel 2880-*b* may be treated to a greater degree (i.e. treated to provide relatively more extensibility). As another example, the squeeze panel 2880-*b* may include a treated area that is similar in size and treated to a similar degree, when compared to the treated area 2880-*ta* of the squeeze panel 2880-*a* of the flexible container 2800-*a*, but the treated area of the squeeze panel 2880-*b* may be configured in a shape and/or pattern that effectively provides a relatively greater degree of extensibility to the squeeze panel 2880-*b*. Alternatively, a thinner and/or more pliable film may be added to part or parts of the squeeze panel, to provide a greater degree of extensibility.

FIG. 28C illustrates a front view of a flexible container 2800-*c*, having a particular actual amount of a fluent product, which is equal to a particular listed amount (designated "<<X"), indicated on an external amount indicium 2830-*c*. The particular actual amount of fluent product in the flexible container 2800-*c* is less than the particular actual amount of the fluent product in the flexible container 2800-*a* of FIG. 28A. The flexible container 2800-*c* includes a structural support frame 2840-*c* and a squeeze panel 2880-*c* made from one or more flexible materials, which may or may not be the same flexible materials that make the squeeze panel 2880-*a* of the flexible container 2800-*a* of FIG. 28A.

In the embodiment of FIG. 28C, the squeeze panel 2880-*c* does not include an area treated for increasing extensibility, so the untreated flexible materials of the squeeze panel 2880-*c* are relatively less extensible and/or relatively more rigid than the treated portion(s) of the flexible materials of the squeeze panel 2880-*a* of the flexible container 2800-*a* of FIG. 28A. This difference in extensibility and/or rigidity enables the squeeze panel 2880-*c* of the flexible container 2600-*c* to bulge out to a relatively lesser extent than the squeeze panel 2880-*a* of the flexible container 2800-*a* of FIG. 28A.

In various alternative embodiments, the squeeze panel 2880-*c* may include a treated area, so long as there is a difference in rigidity and/or extensibility that enables the squeeze panel 2880-*c* of the flexible container 2800-*c* to bulge out to a relatively lesser extent than the squeeze panel 2880-*a* of the flexible container 2800-*a* of FIG. 28A. As an example, the squeeze panel 2880-*c* may include a treated area that is smaller than the treated area 2880-*ta* of the squeeze panel 2880-*a* of the flexible container 2800-*a*. As another example, the squeeze panel 2880-*c* may include a treated area that is similar in size to the treated area 2880-*ta* of the squeeze panel 2880-*a* of the flexible container 2800-*a*, but the treated area of the squeeze panel 2880-*c* may be treated to a lesser degree (i.e. treated to provide extensibility, but relatively less extensibility). As a further example, the squeeze panel 2880-*c* may include a treated area that is similar in size and treated to a similar degree, when compared to the treated area 2880-*ta* of the squeeze panel 2880-*a* of the flexible container 2800-*a*, but the treated area of the squeeze panel 2880-*c* may be configured in a shape and/or pattern that effectively provides a lesser degree of extensibility to the squeeze panel 2880-*c*.

Figure 29C:
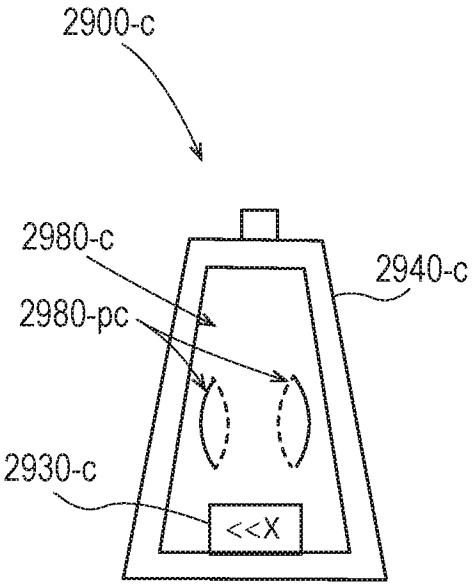
Figure 29B:
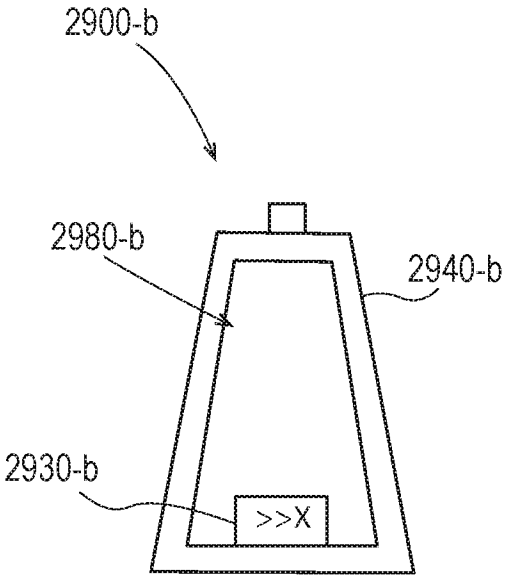
Figure 29A:
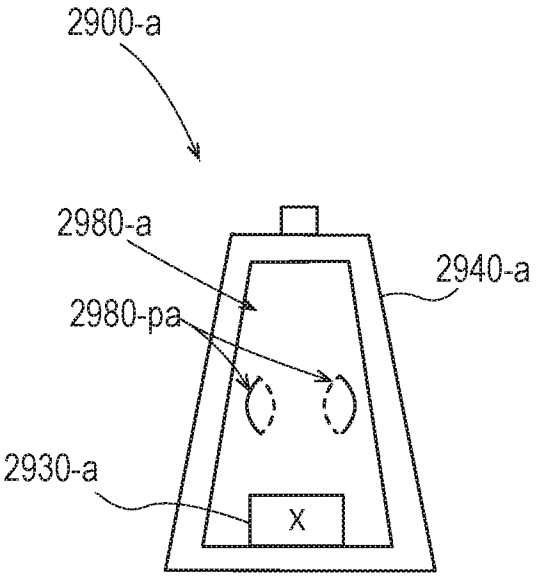

FIGS. 29A-29C illustrate a line-up of flexible containers having squeeze panels with differing folds for decreasing the size of the overall side profiles of the containers.

FIG. 29A illustrates a front view of a flexible container 2900-*a*, having a particular actual amount of a fluent product, which is equal to a particular listed amount (designated "X"), indicated on an external amount indicium 2930-*a*. The flexible container 2900-*a* includes a structural support frame 2940-*a* and a squeeze panel 2980-*a* made from one or more flexible materials. The squeeze panel 2980-*a* includes two overlapping folds 2980-*pa*, which are medium-sized, opposing folds, each having a pointed oblong shape, both disposed in a middle portion of the squeeze panel 2980-*a*; however this particular configuration is not required, and various numbers, sizes, shapes, and locations of overlapping folds can be used. Together, the overlapping folds 2980-*pa* take-up a particular amount of one or more of the flexible materials that make the squeeze panel 2980-*a*. This take-up enables the squeeze panel 2980-*a* of the flexible container 2900-*b* to bulge out to a relatively lesser extent than if the squeeze panel 2980-*a* did not have the overlapping folds 2980-*pa*. In addition to or in alternative to overlapping folds, one or more of the flexible materials that make a squeeze panel can be taken up with various other material connections such as one or more pleats, creases, crimps, tucks, darts, puckers, gathers, etc. in any combination. Overlapping folds and/or other take-ups can be configured in any convenient manner known in the art. The overlapping folds 2980-*a* and/or other take-ups can also provide greater tension in the squeeze panel 2980-*a*, than if the squeeze panel 2980-*a* did not have the folds and/or take-ups.

FIG. 29B illustrates a front view of a flexible container 2900-*b*, having a particular actual amount of a fluent product, which is equal to a particular listed amount (designated ">>X"), indicated on an external amount indicium 2930-*b*. The particular actual amount of fluent product in the flexible container 2900-*b* is greater than the particular actual amount of the fluent product in the flexible container 2900-*a* of FIG. 29A. The flexible container 2900-*b* includes a structural support frame 2940-*b* and a squeeze panel 2980-*b* made from one or more flexible materials, which may or may not be the same flexible materials that make the squeeze panel 2980-*a* of the flexible container 2900-*a* of FIG. 29A. In the embodiment of FIG. 29B, the squeeze panel 2980-*b* does not include overlapping folds or other take-ups, so more of the flexible materials of the squeeze panel 2980-*b* are freely available, which enables the squeeze panel 2980-*b* of the flexible container 2900-*b* to bulge out to a relatively greater extent than the squeeze panel 2980-*a* of the flexible container 2900-*a* of FIG. 29A.

FIG. 29C illustrates a front view of a flexible container 2900-*c*, having a particular actual amount of a fluent product, which is equal to a particular listed amount (designated "<<X"), indicated on an external amount indicium 2930-*c*. The particular actual amount of fluent product in the flexible container 2900-*c* is less than the particular actual amount of the fluent product in the flexible container 2900-*a* of FIG. 29A. The flexible container 2900-*c* includes a structural support frame 2940-*c* and a squeeze panel 2980-*c* made from one or more flexible materials, which may or may not be the same flexible materials that make the squeeze panel 2980-*a* of the flexible container 2900-*a* of FIG. 29A. The squeeze panel 2980-*c* includes two overlapping folds 2980-*pc*, which are large-sized, opposing folds, each having a pointed oblong shape, both disposed in a middle portion of the squeeze panel 2980-*c*. Together, the overlapping folds 2980-*pc* take-up a particular amount of one or more of the flexible materials that make the squeeze panel 2980-*c*; the particular amount taken-up is greater than the amount that is taken-up by the overlapping folds 2980-*pc* of the squeeze panel 2980-*a* of the flexible container 2900-*a* of FIG. 29A. This greater take-up enables the squeeze panel 2980-*c* of the flexible container 2900-*c* to bulge out to a relatively lesser extent than the squeeze panel 2980-*a* of the flexible container 2900-*a* of FIG. 29A. The overlapping folds 2980-*pc* (and/or other take-ups) can also provide a tension in the squeeze panel 2980-*c* that is greater than the tension in the squeeze panel 2980-*a* of the flexible container 2900-*a* of FIG. 29A.

Overlapping folds and other take-ups can be applied at various points in the process for making a flexible container. As an example, one or more folds or take-ups may be conveniently applied to flexible materials along with other folding—to more easily form the folds in a web or sheet—and along with other sealing—to set the folds while sealing the flexible materials into a fixed arrangement.

Figure 30C:
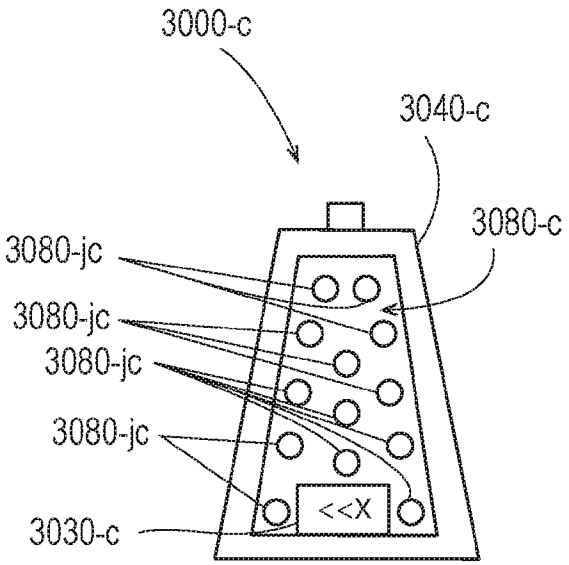
Figure 30B:
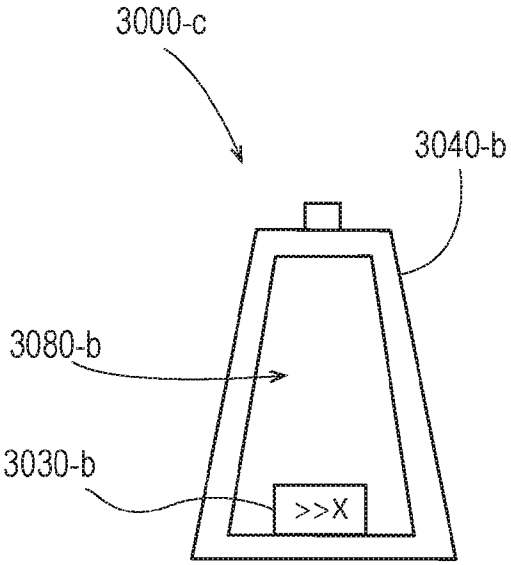
Figure 30A:
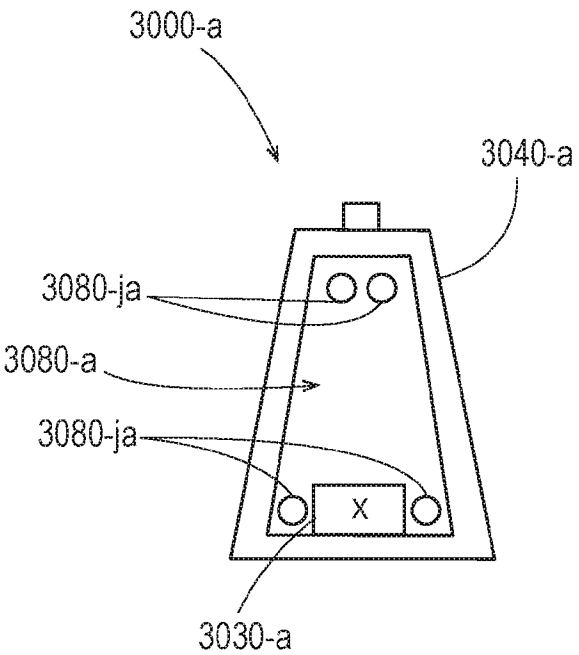

FIGS. 30A-30C illustrate a line-up of flexible containers having squeeze panels with differing joining locations for decreasing the size of the overall side profiles of the containers.

FIG. 30A illustrates a front view of a flexible container 3000-*a*, having a particular actual amount of a fluent product, which is equal to a particular listed amount (designated "X"), indicated on an external amount indicium 3030-*a*. The flexible container 3000-*a* includes a structural support frame 3040-*a* and a squeeze panel 3080-*a* made from one or more flexible materials. The area of the squeeze panel 3080-*a* includes joining locations 3080-*ja*. A joining location is a connection between one or more flexible materials of a squeeze panel and either an internal structure of its flexible container or an opposing side of its flexible container (e.g. one or more flexible materials of another squeeze panel). In the embodiment of FIG. 30A, the joining locations 3080-*ja*, are four small, round, connections, two disposed in a top portion of the squeeze panel 3080-*a* and two disposed in a bottom portion of the squeeze panel 3080-*a*; however this particular configuration is not required, and various numbers, sizes, shapes, locations, and distributions of joining locations can be used, to cover various portions of a squeeze panel. A joining location can be a direct or indirect connection. A joining location can be created in various ways, such as by thermally fusing together, two or more flexible materials. Together, the joining locations 3080-*ja* take in portions of the squeeze panel 3080-*a* that form the overall side profile for the flexible container 3000-*a*. This take-in enables the squeeze panel 3080-*a* of the flexible container 3000-*a* to bulge out to a relatively lesser extent than if the squeeze panel 3080-*a* did not have the joining locations 3080-*ja*. The joining locations 3080-*ja* can also provide greater tension in the squeeze panel 3080-*a*, than if the squeeze panel 3080-*a* did not have joining locations.

FIG. 30B illustrates a front view of a flexible container 3000-*b*, having a particular actual amount of a fluent product, which is equal to a particular listed amount (designated ">>X"), indicated on an external amount indicium 3030-*b*. The particular actual amount of fluent product in the flexible container 3000-*b* is greater than the particular actual amount of the fluent product in the flexible container 3000-*a* of FIG. 30A. The flexible container 3000-*b* includes a structural support frame 3040-*b* and a squeeze panel 3080-*b* made from one or more flexible materials, which may or may not be the same flexible materials that make the squeeze panel 3080-*a* of the flexible container 3000-*a* of FIG. 30A. In the embodiment of FIG. 30B, the squeeze panel 3080-*b* does not include joining locations or other take-ins, so more of the flexible materials of the squeeze panel 3080-*b* are freely available, which enables the squeeze panel 3080-*b* of the flexible container 3000-*b* to bulge out to a relatively greater extent than the squeeze panel 3080-*a* of the flexible container 3000-*a* of FIG. 30A.

FIG. 30C illustrates a front view of a flexible container 3000-*c*, having a particular actual amount of a fluent product, which is equal to a particular listed amount (designated "<<X"), indicated on an external amount indicium 3030-*c*. The particular actual amount of fluent product in the flexible container 3000-*c* is less than the particular actual amount of the fluent product in the flexible container 3000-*a* of FIG. 30A. The flexible container 3000-*c* includes a structural support frame 3040-*c* and a squeeze panel 3080-*c* made from one or more flexible materials, which may or may not be the same flexible materials that make the squeeze panel 3080-*a* of the flexible container 3000-*a* of FIG. 30A. The area of the squeeze panel 3080-*c* includes joining locations 3080-*jc*. In the embodiment of FIG. 30C, the joining locations 3080-*jc*, are thirteen small, round, connections, distributed over top. middle, and bottom portions of the squeeze panel 3080-*a*. When compared to the joining locations 3080-*ja* of the flexible container 3000-*a* of FIG. 30A, the joining locations 3080-*jc* of the flexible container 3000-*c* are more numerous, have a larger combined size, and are distributed over a greater portion of the squeeze panel 3080-*c*. Together, the joining locations 3080-*jc* take in portions of the squeeze panel 3080-*c* that form the overall side profile for the flexible container 3000-*c*. This take-in enables the squeeze panel 3080-*c* of the flexible container 3000-*c* to bulge out to a relatively lesser extent than the squeeze panel 3080-*a* of the flexible container 3000-*a* of FIG. 30A. The joining locations 3080-*jc* (and/or other take-ins) can also provide a tension in the squeeze panel 3080-*c* that is greater than the tension in the squeeze panel 3080-*a* of the flexible container 3000-*a* of FIG. 30A.

Joining locations can be applied at various points in the process for making a flexible container. As an example, one or more joining locations or take-ins may be conveniently applied to flexible materials after other sealing—to set the joining locations when the flexible materials are sealed into a fixed arrangement.

Figures 31A, 31B, 31C:
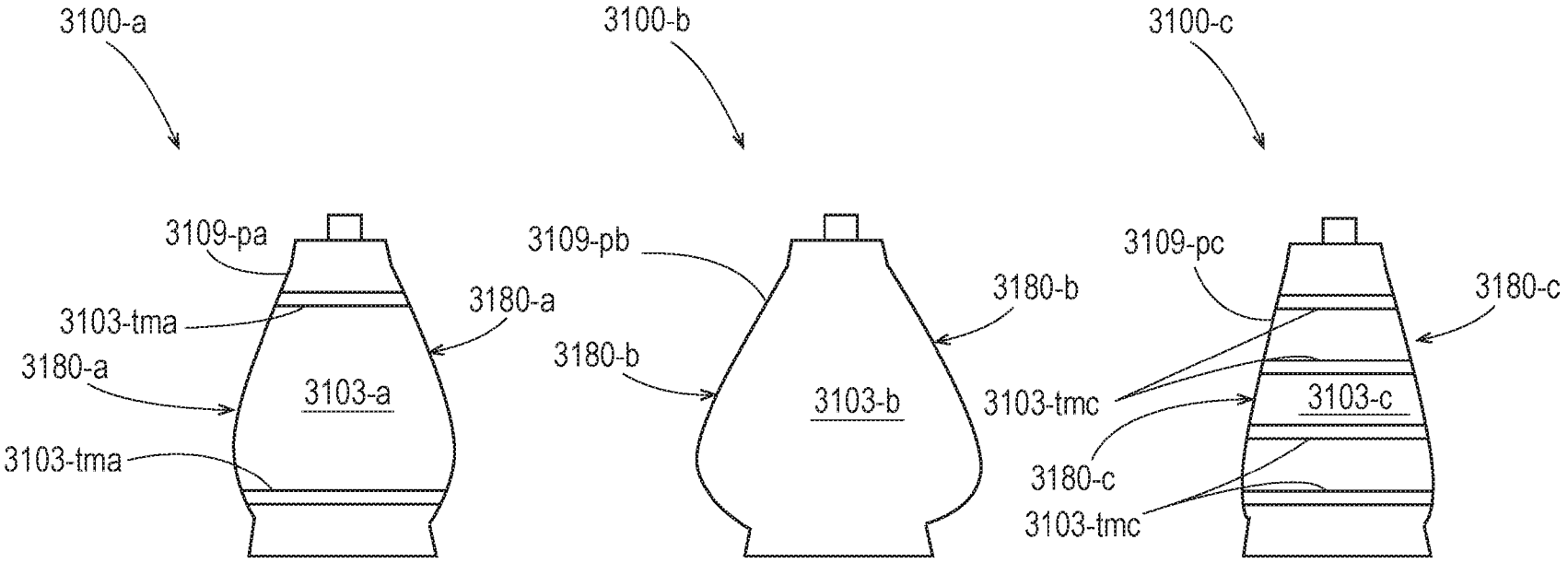

FIGS. 31A-31C illustrate a line-up of flexible containers having squeeze panels with differing internal tie members for decreasing the size of the overall side profiles of the containers. FIG. 31A illustrates a partial internal cross-sectional side view of portions of a flexible container 3100-*a*, having a particular actual amount of a fluent product (not shown) disposed in a product space. The flexible container 3100-*a* includes squeeze panels 3180-*a* made from one or more flexible materials, and also includes a particular overall side profile 3109-*pa*. In addition to other parts of their construction, the squeeze panels 3180-*a* are connected by internal tie members 3103-*tma*, on an inside 3103-*a* of the flexible container 3100-*a*. An internal tie member is a tension carrying structural element that is disposed inside of flexible container and connects one or more flexible materials of a squeeze panel to either an internal structure of its flexible container or to an opposing side of its flexible container (e.g. one or more flexible materials of another squeeze panel). An internal tie member can be made from any flexible material that can connect as described above and is useful for carrying tension. An internal tie member can have any convenient width, such as 5-50 millimeters, any convenient thickness disclosed herein, and any convenient length between its connected ends. In the embodiment of FIG. 31A, the internal tie members, are two structural elements, one disposed between top portions of the squeeze panels 3180-*a* and one disposed between bottom portions of the squeeze panels 3180-*a*; however this particular configuration is not required, and various numbers, sizes, shapes, locations, and distributions of internal tie members can be used, at various locations of a squeeze panel. Either or both ends of an internal tie member can be connected directly or indirectly, in any manner disclosed herein. Together, the internal tie members 3103-*tma* take in portions of the squeeze panel 3180-*a* that form the overall side profile for the flexible container 3100-*a*. This take-in enables the squeeze panel 3180-*a* of the flexible container 3100-*a* to bulge out to a relatively lesser extent than if the squeeze panel 3180-*a* did not have the internal tie members 3103-*tma*.

FIG. 31B illustrates a partial internal cross-sectional side view of portions of a flexible container 3100-*b*, having a particular actual amount of a fluent product (not shown), which is greater than the particular actual amount of the fluent product in the flexible container 3100-*a* of FIG. 31A. The flexible container 3100-*b* includes squeeze panels 3180-*b* made from one or more flexible materials, which may or may not be the same flexible materials that make the squeeze panel 3180-*a* of the flexible container 3100-*a* of FIG. 31A. The flexible container 3100-*b* also includes a particular overall side profile 3109-*pb*. In the embodiment of FIG. 31B, the squeeze panels 3180-*b* are not connected by internal tie members or other take-ins on an inside 3103-*b* of the flexible container 3100-*b*, so more of the flexible materials of the squeeze panel 3180-*b* are freely available, which enables the squeeze panel 3180-*b* of the flexible container 3100-*b* to bulge out to a relatively greater extent than the squeeze panel 3180-*a* of the flexible container 3100-*a* of FIG. 31A.

FIG. 31C illustrates a partial internal cross-sectional side view of portions of a flexible container 3100-*c*, having a particular actual amount of a fluent product (not shown), which is less than the particular actual amount of the fluent product in the flexible container 3100-*a* of FIG. 31A, disposed in a product space. The flexible container 3100-*c* includes squeeze panels 3180-*c* made from one or more flexible materials, and also includes a particular overall side profile 3109-*pc*. In addition to other parts of their construction, the squeeze panels 3180-*c* are connected by internal tie members 3103-*tmc*, on an inside 3103-*c* of the flexible container 3100-*c*. In the embodiment of FIG. 31C, the internal tie members, are four structural elements, one disposed between top portions of the squeeze panels 3180-*c*, two disposed between middle portions of the squeeze panels 3180-*c*, and one disposed between bottom portions of the squeeze panels 3180-*a*. When compared to the internal tie members 3109-*tma* of the flexible container 3100-*a* of FIG. 31A, the internal tie members 3109-*tmc* of the flexible container 3100-*c* are more numerous, have relatively shorter lengths, and are distributed over a greater portion of the squeeze panel 3180-*c*. Together, the internal tie members 3103-*tmc* take in portions of the squeeze panel 3180-*c* that form the overall side profile for the flexible container 3100-*c*. This take-in enables the squeeze panel 3180-*c* of the flexible container 3100-*c* to bulge out to a relatively lesser extent than the squeeze panel 3180-*a* of the flexible container 3100-*a* of FIG. 31A.

FIGS. 32A-33C illustrate a line-up of flexible containers having squeeze panels with differing surface stiffening members for decreasing the size of the overall side profiles of the containers.

FIG. 32A illustrates a front view of a flexible container 3200-*a*, having a particular actual amount of a fluent product, which is equal to a particular listed amount (designated "X"), indicated on an external amount indicium 3230-*a*. The flexible container 3200-*a* includes a structural support frame 3240-*a* and a front panel 3280-*a* made from one or more flexible materials. The area of the front panel 3280-*a* includes surface stiffening members 3285-1*a* through 3285-5*a*. A surface stiffening member is a fillable space on a panel of flexible container, wherein the fillable space is made from one or more flexible materials, and wherein the space is configured to optionally be at least partially filled with one or more expansion materials, which create tension in the one or more flexible materials, and form an expanded surface stiffening member. In the embodiment of FIG. 32A, the surface stiffening members 3285-1*a* through 3285-5*a*, are five horizontally elongated panel sections, disposed over the entire front panel 3280-*a*, from top to bottom; however this particular configuration is not required, and various numbers, sizes, shapes, locations, and distributions of surface stiffening members can be used, to cover various portions of a panel of a flexible container.

A surface stiffening member can be created in various ways, such as by selectively sealing portions of overlaid flexible materials, such as the flexible materials that can make a front panel or a back panel of a flexible container. A surface stiffening member can be expanded in any of the ways that a structural support member can be expanded, as described herein. In a flexible container, one or more surface stiffening members can be in fluid communication with each other and/or with one or more structural support volumes. The fluid communication can be always open or selectively open (e.g. controlled by a minimum required expansion pressure, or by a frangible seal, which breaks when subjected to a particular pressure, or through a flexible valve, which opens when subjected to a particular pressure).

The first surface stiffening member 3285-1*a* is in selective fluid communication with the structural support frame 3240-*a* through a first valve 3284-1*a*; since the structural support volumes of the structural support frame 3240-*a* are expanded and the first valve 3284-1*a* is open, the first surface stiffening member 3285-1*a* is also expanded. Similarly, the fifth surface stiffening member 3285-5*a* is in selective fluid communication with the structural support frame 3240-*a* through a sixth valve 3284-6*a*; since the structural support volumes of the structural support frame 3240-*a* are expanded and the sixth valve 3284-6*a* is open, the fifth surface stiffening member 3285-5*a* is also expanded. The second surface stiffening member 3285-2*a* is in selective fluid communication with the first surface stiffening member 3285-1*a* through a second valve 3284-2*a*; although the first surface stiffening member 3285-1*a* is expanded, since the second valve 3284-2*a* is closed, the second surface stiffening member 3285-2*a* is not expanded. Similarly, the fourth surface stiffening member 3285-4*a* is in selective fluid communication with the fifth surface stiffening member 3285-5*a* through a fifth valve 3284-5*a*; although the fifth surface stiffening member 3285-5*a* is expanded, since the fifth valve 3284-5*a* is closed, the fourth surface stiffening member 3285-4*a* is not expanded. The third surface stiffening member 3285-3*a* is in selective fluid communication with the second surface stiffening member 3285-2*a* through a third valve 3284-3*a* and is in selective fluid communication with the fourth surface stiffening member 3285-4*a* through a fourth valve 3284-4*a*; since the second surface stiffening member 3285-2*a* and the fourth surface stiffening member 3285-4*a* are not expanded, and since the third valve 3284-3*a* and the fourth valve 3284-4*a* are closed, the third surface stiffening member 3285-3*a* is not expanded.

Together, the expanded surface stiffening members 3285-*al* and 3285-5*a* create tensions across top and bottom portions of the front panel 3280-*a* that form the overall side profile for the flexible container 3200-*a*. These tensions enable the front panel 3280-*a* of the flexible container 3200-*a* to bulge out to a relatively lesser extent than if the surface stiffening members 3285-*al* and 3285-5*a* on the front panel 3280-*a* were not expanded.

FIG. 32B illustrates a front view of a flexible container 3200-*b*, having a particular actual amount of a fluent product, which is equal to a particular listed amount (designated ">>X"), indicated on an external amount indicium 3230-*b*. The particular actual amount of fluent product in the flexible container 3200-*b* is greater than the particular actual amount of the fluent product in the flexible container 3200-*a* of FIG. 32A. The flexible container 3200-*b* includes a structural support frame 3240-*b* and a front panel 3280-*b* made from one or more flexible materials. The area of the front panel 3280-*b* includes surface stiffening members 3285-1*b* through 3285-5*b* and valves 3284-1*b* through 3284-6*b*, which are the same as the surface stiffening members 3285-1*a* through 3285-5*a* and the valves 3284-1*a* through 3284-6*a* of the flexible container 3200-*a* of FIG. 32A, except as described below. In the embodiment of FIG. 32B, none of the valves 3284-1*b* through 3284-6*b* are open and none of the surface stiffening members 3285-1*b* through 3285-5*b* are expanded, so more of the flexible materials of the front panel 3280-*b* are freely available, which enables the front panel 3280-*b* of the flexible container 3200-*b* to bulge out to a relatively greater extent than the front panel 3280-*a* of the flexible container 3200-*a* of FIG. 32A.

FIG. 32C illustrates a front view of a flexible container 3200-*c*, having a particular actual amount of a fluent product, which is equal to a particular listed amount (designated "<<X"), indicated on an external amount indicium 3230-*c*. The particular actual amount of fluent product in the flexible container 3200-*c* is less than the particular actual amount of the fluent product in the flexible container 3200-*a* of FIG. 32A. The flexible container 3200-*b* includes a structural support frame 3240-*c* and a front panel 3280-*c* made from one or more flexible materials. The area of the front panel 3280-*c* includes surface stiffening members 3285-1*c* through 3285-5*c* and valves 3284-1*c* through 3284-6*c*, which are the same as the surface stiffening members 3285-1*a* through 3285-5*a* and the valves 3284-1*a* through 3284-6*a* of the flexible container 3200-*a* of FIG. 32A, except as described below. In the embodiment of FIG. 32C, all of the valves 3284-1*b* through 3284-6*b* are open and all of the surface stiffening members 3285-1*b* through 3285-5*b* are expanded. When compared to the expanded surface stiffening members 3285-1*a* and 3285-5*a* of the flexible container 3200-*a* of FIG. 32A, the expanded surface stiffening members 3285-1*c* through 3285-5*c* of the flexible container 3200-*c* are more numerous, have a larger combined size, and are distributed over a greater portion of the front panel 3280-*c*. Together, the expanded surface stiffening members 3285-1*c* through 3285-5*c* provide an overall tension in the front panel 3280-*c* that is greater than the overall tension in the squeeze panel 3280-*a* of the flexible container 3200-*a* of FIG. 32A. This greater tension enables the front panel 3280-*c* of the flexible container 3200-*c* to bulge out to a relatively lesser extent than the front panel 3280-*a* of the flexible container 3200-*a* of FIG. 32A.

FIG. 33A illustrates a partial internal cross-sectional side view of the flexible container 3200-*a* of FIG. 32A, which illustrates the front panel 3280-*a* and a front portion of an overall side profile 3309-*pa* for the flexible container 3200-*a*.

FIG. 33B illustrates a partial internal cross-sectional side view of the flexible container 3200-*b* of FIG. 32B, which illustrates the front panel 3280-*b* and a front portion of an overall side profile 3309-*pb* for the flexible container 3200-*b*.

FIG. 33C illustrates a partial internal cross-sectional side view of the flexible container 3200-*c* of FIG. 32C, which illustrates the front panel 3280-*c* and a front portion of an overall side profile 3309-*pc* for the flexible container 3200-*c*.

FIGS. 34A-34C illustrate a line-up of flexible containers having the same overall side profiles, but differing amounts and/or pressures of expansion material in their structural support volumes.

FIGS. 35A-35C illustrate a line-up of flexible containers having their products spaces increased to different sizes to form differing total capacities for the containers. In FIG. 35A, a relatively small positive pressure 3598-*a* is applied to an inside of the flexible container 3500-*a*, permanently increasing the size of the product space 3550-*a* for the flexible container 3500-*a*, resulting in a particular total capacity for the flexible container 3500-*a*. In FIG. 35B, a relatively large positive pressure 3598-*b* is applied to an inside of the flexible container 3500-*b*, permanently increasing the size of the product space 3550-*b* for the flexible container 3500-*b*, resulting in a particular total capacity for the flexible container 3500-*b* that is greater than the particular total capacity for the flexible container 3500-*a* of FIG. 35A. In FIG. 35C, no positive pressure is applied to an inside of the flexible container 3500-*c*, so the size of the product space 3550-*c* for the flexible container 3500-*c* is not increased, resulting in a particular total capacity for the flexible container 3500-*c* that is less than the particular total capacity for the flexible container 3500-*a* of FIG. 35A. Alternatively, pushing forces can be internally applied to permanently increase the size of a product space. Also, alternatively, a positive pressure or pushing forces may temporarily increase the size of a product space. Further, alternatively, a negative pressure or pulling forces can be internally applied, which can temporarily or permanently decrease the size of a product space.

FIGS. 36A-36C illustrate the flexible containers of FIGS. 35A-35C, when their products spaces are filled with fluent product.

FIGS. 37A-37C illustrate a line-up of flexible containers having their products spaces decreased to different sizes to form differing total capacities for the containers. In FIG. 37A, opposing pushers 3799-*ea* apply relatively small pushing forces 3799-*a* to an outside of the flexible container 3700-*a*, temporarily decreasing the size of the product space 3750-*a* for the flexible container 3700-*a*, resulting in a particular total capacity for the flexible container 3700-*a*. In FIG. 37B, opposing pushers 3799-*eb* do not apply pushing forces to an outside of the flexible container 3700-*b*, so the size of the product space 3750-*b* for the flexible container 3700-*b* is not decreased, resulting in a particular total capacity for the flexible container 3700-*b* that is greater than the particular total capacity for the flexible container 3700-*a* of FIG. 37A. In FIG. 37C, opposing pushers 3799-*ec* apply relatively large pushing forces 3799-*c* to an outside of the flexible container 3700-*c*, temporarily decreasing the size of the product space 3750-*c* for the flexible container 3700-*c*, resulting in a particular total capacity for the flexible container 3700-*c* that is less than the particular total capacity for the flexible container 3700-*a* of FIG. 37A. Alternatively, positive pressure can be externally applied to permanently increase the size of a product space. Also, alternatively, a positive pressure or pushing forces may permanently increase the size of a product space. Further, alternatively, a negative pressure or pulling forces can be externally applied, which can temporarily or permanently increase the size of a product space.

Part, parts, or all of any of the embodiments disclosed herein can be combined with part, parts, or all of other embodiments known in the art of flexible containers, including those described below.

Embodiments of the present disclosure can use any and all embodiments of materials, structures, and/or features for flexible containers, as well as any and all methods of making and/or using such flexible containers, as disclosed in the following patent applications: (1) U.S. non-provisional application Ser. No. 13/888,679 filed May 7, 2013, entitled "Flexible Containers" and published as US20130292353 (applicant's case 12464M); (2) U.S. non-provisional application Ser. No. 13/888,721 filed May 7, 2013, entitled "Flexible Containers" and published as US20130292395 (applicant's case 12464M2); (3) U.S. non-provisional application Ser. No. 13/888,963 filed May 7, 2013, entitled "Flexible Containers" published as US20130292415 (applicant's case 12465M); (4) U.S. non-provisional application Ser. No. 13/888,756 May 7, 2013, entitled "Flexible Containers Having a Decoration Panel" published as US20130292287 (applicant's case 12558M); (5) U.S. non-provisional application Ser. No. 13/957,158 filed Aug. 1, 2013, entitled "Methods of Making Flexible Containers" published as US20140033654 (applicant's case 12558M); and (6) U.S. non-provisional application Ser. No. 13/957,187 filed Aug. 1, 2013, entitled "Methods of Making Flexible Containers" published as US20140033655 (applicant's case 12579M2); (7) U.S. non-provisional application Ser. No. 13/889,000 filed May 7, 2013, entitled "Flexible Containers with Multiple Product Volumes" published as US20130292413 (applicant's case 12785M); (8) U.S. non-provisional application Ser. No. 13/889,061 filed May 7, 2013, entitled "Flexible Materials for Flexible Containers" published as US20130337244 (applicant's case 12786M); (9) U.S. non-provisional application Ser. No. 13/889,090 filed May 7, 2013, entitled "Flexible Materials for Flexible Containers" published as US20130294711 (applicant's case 12786M2); (10) U.S. non-provisional application Ser. No. 14/448,396 filed Jul. 31, 2014, entitled "Disposable Flexible Containers having Surface Elements" published as US20150034670 (applicant's case 13016); (11) U.S. non-provisional application Ser. No. 14/448,440 filed Jul. 31, 2014, entitled "Flexible Containers having Improved Seam and Methods of Making the Same" published as US20150036950 (applicant's case 13017); (12) U.S. non-provisional application Ser. No. 14/448,491 filed Jul. 31, 2014, entitled "Methods of Forming a Flexible Container" published as US 20150033671 (applicant's case 13018); (13) U.S. non-provisional application Ser. No. 14/448,599 filed Jul. 31, 2014, entitled "Enhancements to Tactile Interaction with Film Walled Packaging Having Air Filled Structural Support Volumes" published as US 20150034662 (applicant's case 13019); (14) PCT patent application CN2013/085045 filed Oct. 11, 2013, entitled "Flexible Containers Having a Squeeze Panel" published as WO2015/051531 (applicant's case 13036); (15) PCT patent application CN2013/085065 filed Oct. 11, 2013, entitled "Stable Flexible Containers" published as WO2015/051539 (applicant's case 13037); (16) U.S. non-provisional application Ser. No. 14/534,197 filed Nov. 6, 2014, entitled "Flexible Containers and Methods of Forming the Same" published as US20150126349 (applicant's case 13126); (17) U.S. non-provisional application Ser. No. 14/534,201 filed Nov. 6, 2014, entitled "Easy to Empty Flexible Containers" published as US20150122841 (applicant's case 13127); (18) U.S. non-provisional application Ser. No. 14/534,201 filed Nov. 6, 2014, entitled "Containers Having a Product Volume and a Stand-Off Structure Coupled Thereto" published as US20150122842 (applicant's case 13128); (19) U.S. non-provisional application Ser. No. 14/534,203 filed Nov. 6, 2014, entitled "Flexible Containers Having Flexible Valves" published as US20150122840 (applicant's case 13129); (20) U.S. non-provisional application Ser. No. 14/534,206 filed Nov. 6, 2014, entitled "Flexible Containers with Vent Systems" published as US20150122846 (applicant's case 13130); (21) U.S. non-provisional application Ser. No. 14/534,209 filed Nov. 6, 2014, entitled "Flexible Containers for use with Short Shelf-Life Products and Methods for Accelerating Distribution of Flexible Containers" published as US2015012557 (applicant's case 13131); (22) U.S. non-provisional application Ser. No. 14/534,210 filed Nov. 6, 2014, entitled "Flexible Containers and Methods of Forming the Same" published as US20150125099 (applicant's case 13132); (23) U.S. non-provisional application Ser. No. 14/534,213 filed Nov. 6, 2014, entitled "Flexible Containers and Methods of Making the Same" published as US20150122373 (applicant's case 13133); (24) U.S. non-provisional application Ser. No. 14/534,214 filed Nov. 6, 2014, entitled "Flexible Containers and Methods of Making the Same" published as US20150121810 (applicant's case 13134); (25) U.S. provisional application 62/145,670 filed Apr. 10, 2015, entitled "Flexible Containers with Intermediate Bottom Member" (applicant's case 13781P); (26) U.S. provisional application 62/145,676 filed Apr. 10, 2015, entitled "Flexible Containers with Reinforcing Seals" (applicant's case 13782P); (27) U.S. provisional application 62/145,681 filed Apr. 10, 2015, entitled "Flexible Containers with Product Dispensing Visibility" (applicant's case 13783P); (28) U.S. provisional application 62/145,684 filed Apr. 10, 2015, entitled "Flexible Containers with Puckered Corners" (applicant's case 13784P); (29) U.S. provisional application 62/145,932 filed Apr. 10, 2015, entitled "Flexible Containers with Biased Dispensing" (applicant's case 13785P); (30) U.S. provisional application 62/157,766 filed May 6, 2015, entitled "Methods of Forming Flexible Containers with Gussets" (applicant's case 13840P); (31) U.S. design patent application Ser. No. 29/526,409 filed May 8, 2015, entitled "Flexible Container for Fluent Product" (applicant's case D2277); (32) U.S. provisional application 62/186,704 filed Jun. 30, 2015, entitled "Flexible Container with Removable Portions" (applicant's case 13927P); each of which is hereby incorporated by reference.

Embodiments of the present disclosure can use any and all embodiments of materials, structures, and/or features for flexible containers, as well as any and all methods of making and/or using such flexible containers, as disclosed in the following patent documents: U.S. Pat. No. 5,137,154, filed Oct. 29, 1991, entitled "Food bag structure having pressurized compartments" in the name of Cohen, granted Aug. 11, 1992; PCT international patent application WO 96/01775 filed Jul. 5, 1995, published Jan. 26, 1995, entitled "Packaging Pouch with Stiffening Air Channels" in the name of Prats (applicant Danapak Holding A/S); PCT international patent application WO 98/01354 filed Jul. 8, 1997, published Jan. 15, 1998, entitled "A Packaging Container and a Method of its Manufacture" in the name of Naslund; U.S.

Pat. No. 5,960,975 filed Mar. 19, 1997, entitled "Packaging material web for a self-supporting packaging container wall, and packaging containers made from the web" in the name of Lennartsson (applicant Tetra Laval), granted Oct. 5, 1999; U.S. Pat. No. 6,244,466 filed Jul. 8, 1997, entitled "Packaging Container and a Method of its Manufacture" in the name of Naslund, granted Jun. 12, 2001; PCT international patent application WO 02/085729 filed Apr. 19, 2002, published Oct. 31, 2002, entitled "Container" in the name of Rosen (applicant Eco Lean Research and Development A/S); Japanese patent JP4736364 filed Jul. 20, 2004, published Jul. 27, 2011, entitled "Independent Sack" in the name of Masaki (applicant Toppan Printing); PCT international patent application WO2005/063589 filed Nov. 3, 2004, published 14 Jul. 2005, entitled "Container of Flexible Material" in the name of Figols Gamiz (applicant Volpak, S. A.); German patent application DE202005016704 U1 filed Jan. 17, 2005, entitled "Closed bag for receiving liquids, bulk material or objects comprises a bag wall with taut filled cushions or bulges which reinforce the wall to stabilize it" in the name of Heukamp (applicant Menshen), laid open as publication DE102005002301; Japanese patent application 2008JP-0024845 filed Feb. 5, 2008, entitled "Self-standing Bag" in the name of Shinya (applicant Toppan Printing), laid open as publication JP2009184690; U.S. patent application Ser. No. 10/312,176 filed Apr. 19, 2002, entitled "Container" in the name of Rosen, published as US20040035865; U.S. Pat. No. 7,585,528 filed Dec. 16, 2002, entitled "Package having an inflated frame" in the name of Ferri, et al., granted on Sep. 8, 2009; U.S. patent application Ser. No. 12/794,286 filed Jun. 4, 2010, entitled "Flexible to Rigid Packaging Article and Method of Use and Manufacture" in the name of Helou (applicant, published as US20100308062; U.S. Pat. No. 8,540,094 filed Jun. 21, 2010, entitled "Collapsible Bottle, Method Of Manufacturing a Blank For Such Bottle and Beverage-Filled Bottle Dispensing System" in the name of Reidl, granted on Sep. 24, 2013; and PCT international patent application WO 2013/124201 filed Feb. 14, 2013, published Aug. 29, 2013, entitled "Pouch and Method of Manufacturing the Same" in the name of Rizzi (applicant Cryovac, Inc.); each of which is hereby incorporated by reference.

Part, parts, or all of any of the embodiments disclosed herein also can be combined with part, parts, or all of other embodiments known in the art of containers for fluent products, so long as those embodiments can be applied to flexible containers, as disclosed herein. For example, in various embodiments, a flexible container can include a vertically oriented transparent strip, disposed on a portion of the container that overlays the product space, and configured to show the level of the fluent product in the product space.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or patent publication, is hereby incorporated herein by reference in its entirety unless expressly excluded or otherwise limited. The citation of any document is not an admission that it is prior art with respect to any document disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A line-up of flexible containers for retail sale of one or more fluent products, the line-up comprising:

a first disposable self-supporting flexible container, configured for retail sale, wherein the first container includes:

a first product space having a first product space construction that is based, at least in part, on a first folding pattern;

a first external amount indicium that indicates a first listed amount of a first fluent product that is being offered for sale with the first container; and a first actual amount of the first fluent product, disposed in the first product space, wherein the first actual amount is nearly equal to the first listed amount;

a first closed fill height for the first fluent product in the first product space;

a second disposable self-supporting flexible container, configured for retail sale, wherein the second container includes:

a second product space having a second product space construction that is based, at least in part, on a second folding pattern that is substantially the same as the first folding pattern;

a second external amount indicium that indicates a second listed amount of a second fluent product that is being offered for sale with the second container, wherein the second listed amount is a particular percentage less than the first listed amount, and the particular percentage is greater than or equal to 0.1% and less than or equal to 70%;

a second actual amount of the second fluent product, disposed in the second product space, wherein the second actual amount is nearly equal to the second listed amount; and a second closed fill height for the second fluent product in the second product space, wherein the second closed fill height is greater than or equal to the first closed fill height.

2. The line-up of claim 1, wherein the particular percentage is greater than or equal to 1% and less than or equal to 60%.

3. The line-up of claim 1, wherein the second closed fill height is greater than and about equal to the first closed fill height.

4. The line-up of claim 1, wherein:

the second container includes one or more product viewing portions; and at least a portion of the second fill line is visible through the one or more product viewing portions, from outside of the second container.

5. The line-up of claim 1, wherein:

the first container is made from one or more particular flexible materials; and the second container is also made from the one or more particular flexible materials.

6. The line-up of claim 1, wherein:

the first container has a first overall front profile; and the second container has a second overall front profile that has substantially the same size and shape as the first overall front profile.

7. The line-up of claim 1, wherein:

the first container has a first overall side profile;

the second container has a second overall side profile;

a front half of the second overall side profile has substantially the same size and shape as a front half of the first overall side profile; and a back half of the second overall side profile has a smaller size than a back half of the first overall side profile.

8. The line-up of claim 1, wherein:

the first container has a first effective base contact area;

the second container has a second effective base contact area that has substantially the same size and shape as the first effective base contact area.

9. The line-up of claim 1, wherein the second folding pattern is the same as the first folding pattern.

10. The line-up of claim 1, wherein:

the first container has a first container construction, wherein substantially all of the first container construction is based on the first folding pattern; and the second container has a second container construction, wherein substantially all of the second container construction is based on the second folding pattern.

11. The line-up of claim 1, wherein:

substantially all of the first product space construction is based on the first sealing pattern; and substantially all of the second product space construction is based on the second sealing pattern.

12. The line-up of claim 1, wherein:

the first container has a first container construction, wherein substantially all of the first container construction is based on the first sealing pattern; and the second container has a second container construction, wherein substantially all of the second container construction is based on the second sealing pattern.

13. The line-up of claim 1, wherein:

the first container includes a first overall set of printed external indicia; and the second container includes a second overall set of printed external indicia that is substantially the same as first overall set of printed external indicia.

14. The line-up of claim 1, wherein the second product space is vented.

15. The line-up of claim 1, wherein:

the first product space is sealed closed and has a first headspace at a first sealed closed headspace pressure;

the second product space is sealed closed and has a second headspace at a second sealed closed headspace pressure that is within 20% of the first sealed closed headspace pressure.

16. The line-up of claim 15, wherein the first sealed closed headspace pressure is within 20% of atmospheric pressure.

17. The line-up of claim 1, wherein:

the second product space is sealed closed, and the second closed fill height is a second sealed closed fill height;

the second container is configured such that, when the second product space is opened, the second fluent product in the second product space assumes a second open fill height; and the second open fill height is within 30% of the second sealed closed fill height.

18. The line-up of claim 1, wherein:

the second product space is sealed closed, and the second closed fill height is a second sealed closed fill height;

the second container is configured such that, when the second product space is opened, the second fluent product in the second product space assumes a second open fill height; and the second open fill height is within 6 centimeters of the second sealed closed fill height.

19. The line-up of claim 1, wherein:

the first flexible container is a stand-up container; and the second flexible container is a stand-up container.

20. The line-up of claim 1, wherein the first fluent product and the second fluent product are at least essentially the same.

* * * * *